US005458324A

United States Patent [19]

Nakamura et al.

[11] Patent Number: 5,458,324

[45] Date of Patent: Oct. 17, 1995

[54] PRESSURE-SENSITIVE AND ELECTRICALLY-CONDUCTIVE ROLLER

[75] Inventors: Hajime Nakamura; Jun Sakakibara, both of Tokyo, Japan

[73] Assignee: Kabushiki Kaisha Toshiba, Kawasaki, Japan

[21] Appl. No.: 216,023

[22] Filed: Mar. 21, 1994

[30] Foreign Application Priority Data

Mar. 25, 1993 [JP] Japan ..... 5-089441

[51] Int. Cl.[6] ..... B65H 5/00; B65H 7/12

[52] U.S. Cl. ..... 271/10.02; 271/263; 271/272; 271/265.04; 324/699; 324/701; 492/10; 492/11

[58] Field of Search ..... 271/109, 153, 271/261–263, 265, 272, 273, 10; 324/699, 701, 716; 73/865.8; 492/9–11, 59

[56] References Cited

U.S. PATENT DOCUMENTS

| | | | |
|---|---|---|---|
| 2,849,916 | 9/1958 | Nolan | 271/265 X |
| 3,182,301 | 5/1965 | Kolb | 271/265 |
| 3,600,591 | 8/1971 | Thier | 271/263 X |
| 3,744,047 | 7/1973 | Allen | 271/263 |
| 4,462,587 | 7/1984 | Graef et al. | 71/263 |
| 5,029,837 | 7/1991 | Uchiyama | 271/263 X |
| 5,031,896 | 7/1991 | Winkler | 271/265 X |
| 5,174,562 | 12/1992 | Mizunaga et al. | 271/263 |
| 5,222,157 | 6/1993 | Yoneda et al. | 382/41 |
| 5,238,123 | 8/1993 | Tovini et al. | 71/262 X |

FOREIGN PATENT DOCUMENTS

| | | | |
|---|---|---|---|
| 203141 | 8/1989 | Japan | 271/263 |
| 140253 | 5/1992 | Japan | 271/263 |

*Primary Examiner*—H. Grant Skaggs
*Attorney, Agent, or Firm*—Foley & Lardner

[57] ABSTRACT

It is an object of this invention to allow detection of multiple paper-conveying of an original sheet in image reading or forming operation and facilitate a recovery operation. An automatic original feeding apparatus of this invention uses pressure sensitive conductive rubber in a feeding roller, and changes in length and thickness of a sheet are changed into electrical signals, so that the conveyed state such as multiple paper-conveying of the sheet can be detected.

31 Claims, 68 Drawing Sheets

DOBLE-CONVEYING PROCESSING ROUTINE "A" (ST292) FOR 1ST SHEET

DOBLE-CONVEYING PROCESSING ROUTINE "B" (ST294) FOR 2ND & SUBSEQUENT SHEETS

PRESSURE-SENSITIVE AND ELECTRICALLY-CONDUCTIVE ROLLER

BACKGROUND OF THE INVENTION

1. Field of the Invention

The present invention relates to a paper feeding apparatus, for example, an automatic paper feeding apparatus, used in an image forming apparatus such as a copying machine.

2. Description of the Related Art

A conventional automatic paper feeding apparatus having a function for detecting the thickness of a fed paper (sheet) is described in Jpn. Pat. Appln. KOKAI Application No. 2-127327. In this conventional apparatus, a noncontact micro-displacement sensor is used but it is very expensive, resulting in impractical applicability.

The purpose of detecting the thickness of the paper/sheet is to properly convey the paper/sheet such that the pressure acting on a pressure roller in a paper feeding unit for reversing an original is adjusted in accordance with the thickness of the paper/sheet.

Jpn. Pat. Appln. KOKAI Application No. 4-52780 describes an embodiment in which multiple paper-conveying is detected. In this embodiment, a discharge destination for papers/sheets having been subjected to multiple paper-conveying and a discharge destination for other non-multiple-conveyed papers/sheets are separately arranged, thereby removing only the papers/sheets having been subjected to multiple paper-conveying.

Jpn. Pat. Appln. KOKAI Application No. 3-107174 describes an embodiment in which copied originals are counted on the basis of a detection signal from a paper discharge sensor in an automatic original conveying apparatus for conveying originals to a copying machine, thereby displaying the count value.

In the first prior-art example, the pressure is adjusted to only improve assurance in paper feeding. A means for measuring/detecting the displacement of the feeding roller is expensive to result in impractical applicability.

In the second prior-art example, the method of causing the displacement sensor to detect a displacement amount of the conveying roller poses the following problem.

In the embodiment of this prior art, the resolution of the displacement sensor is specified to be about 1 to 10 μm. In such a displacement sensor, precision of the outer diameter of the sheet conveying roller is 5 to 10 μm. Therefore, the displacement data has large fluctuations to make it difficult to detect multiple paper-conveying in practice.

In the means for causing the electrostatic capacitive sensor to detect the thickness of an original, even if the electrostatic capacitance of the sheet to be conveyed is small or its humidity is high, different detection results in thickness are caused even if the same original is detected.

If an original is straight, the thickness can be accurately expressed as a change in electrostatic capacitance. However, if the original is curled or the curled state of the original changes between the electrodes in this detecting device, it is difficult to accurately detect the thickness.

Assume that an original is preliminarily read to detect multiple paper-conveying on the basis of thickness and length data. However, if the frequency of times of multiple paper-conveying in the preliminary mode is different from that in an actual operation, multiple paper-conveying is erroneously determined.

In the third prior-art example, the number of originals whose copying is completed is counted by the paper discharge sensor in the automatic paper feeding apparatus, and the count value is displayed. In this case, a user (operator) must count the number of originals to be set in the automatic paper feeding apparatus and must compare this count with the displayed count value, thereby detecting multiple paper-conveying by himself or herself.

In an apparatus for conveying paper, and particularly feeding originals, it is very important to detect multiple paper-conveying. The automatic paper feeding apparatus is used not only for a copying machine but also for a facsimile machine, an optical disk file apparatus, or the like. In a copying machine, if multiple paper-conveying is detected, the operator can immediately make a countermeasure upon checking the copied sheets. In this case, the user must be present until the end of copying operation to always check the operation of the copying machine. In high-speed, large-capacity operations of a recent copying machine, even if multiple paper-conveying is detected, a large number of wasted papers (sheets) would result until the operation of the copying machine is stopped.

On the other hand, in a facsimile apparatus or optical disk file apparatus for converting image information of an original into electrical signals, multiple paper-conveying of originals becomes a decisive problem. It is impossible to determine on the basis of copied sheets whether multiple paper-conveying has occurred. Omissions of information which are caused by multiple paper-conveying can often be known upon an inquiry to a destination.

In the optical disk file apparatus, when image information is converted into an electrical signal and stored in a recording medium such as an optical disk, the stored information is read out from the optical disk again to check it on a display means such as a CRT, thereby determining whether a multiple paper-conveying error has occurred. This check operation greatly degrades office automation (OA) using an optical disk file apparatus capable of storing a large volume of information.

As described above, the importance of multiple paper-conveying detection has been recognized, but any practical means for realizing it is not yet proposed. Therefore, this problem is left unsolved.

SUMMARY OF THE INVENTION

It is accordingly an object of the present invention to provide a paper feeding apparatus capable of properly detecting multiple paper-conveying of originals and easily restoring a normal operation immediately after the multiple paper-conveying is detected.

A paper feeding apparatus according to the present invention comprises conveying means for conveying sheets; converting means, formed on the conveying means and having pressure sensitive conductive rubber whose resistance value changes with a pressure applied thereto, for feeding the sheet conveyed by the conveying means and causing the pressure sensitive conductive rubber to convert a pressure generated during feeding into an electrical signal; and detecting means for detecting a conveyed state of the sheet in accordance with the electrical signal output from the converting means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Preferred embodiments of the present invention will be described below with reference to the accompanying drawings.

Figure 2:
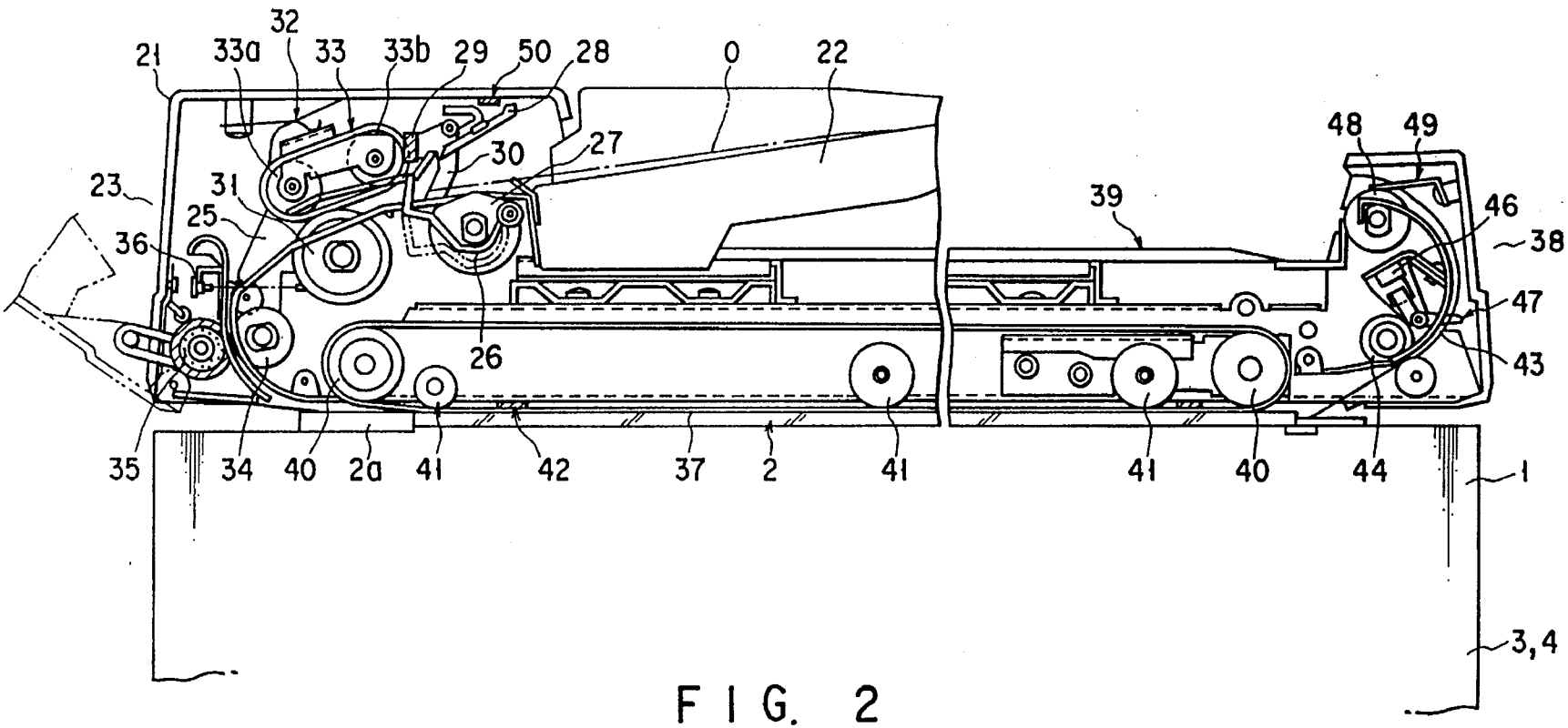
FIG. 2 is a schematic sectional view showing the structure of a copying machine serving as an image forming apparatus according to the embodiment of the present invention.

FIG. 2 shows a copying machine serving as an image forming apparatus according to the present invention.

More specifically, automatic paper feeding apparatus (or auto-document feeder; ADF) 20 is mounted on the upper portion of copying machine main body 1.

Original table (transparent glass) 2 is mounted on the upper surface of copying machine main body 1. Original (paper or sheet) O fed from ADF 20 is placed on original table 2.

Original scanner unit 2 for scanning and reading original O set on original table 2 is arranged in copying machine main body 1. The lower portion of original scanner unit 3 serves as image forming unit 4. Original table 2 is fixed to main body 1.

Image forming unit 4 comprises an image forming unit as a combination of, e.g., a laser optical system and an electrophotographic system capable of forming an image on transfer paper.

The structure of ADF 20 will be described with reference to FIG. 2.

Automatic paper (document) feeding apparatus, abbreviated as ADF 20, is constituted as a unit, and the edge of the rear end of cover main body 21 as a housing is pivotally mounted on the edge of the rear end of the upper surface of copying machine main body 1 through a hinge device (not shown). ADF 20 can be pivoted and displaced as a whole, if required, to open the upper surface of original table 2.

As shown in FIG. 2, original feeding table 22 serving as an original holding means for temporarily holding a plurality of originals O is disposed on the upper surface of cover main body 21 at a position slightly to the left from the center thereof.

Pickup/feeding means 23 is arranged such that originals O with image formation surfaces facing upward are held on original feeding table 22 and fed one by one to one end (left end in FIG. 2) of original table 2.

This pickup/feeding means 23 has the following structure.

That is, laterally U-shaped feeding path 25 is formed to cause the inclined lower end portion of original feeding table 22 to communicate with the upper surface portion of original stopper 2*a* disposed along the left edge of original table 2. Path 25 reverses and guides original O with its original formation surface facing downward.

A shutter 26 for aligning the end faces of originals O set on original feeding table 22 is disposed in the upstream side of feeding path 25. Pickup roller 27 for picking up original O, weight board 28 for pressing original O against pickup roller 27, empty sensor 29 serving as an original detection sensor for detecting the set state of original O on original feeding table 22, and actuator 30 for empty sensor 29 are arranged near shutter 26.

Paper feed roller 31 and separation belt 33 which is in slight contact with paper feed roller 31 by a biasing force of compression spring 32 are disposed in a direction to cause pickup roller 27 to pickup the original. For this reason, originals O can be properly fed one by one. Separation belt 33 is looped between a pair of belt rollers 33*a* and 33*b*.

Aligning roller 34 and feeding roller 35 which constitute a resist roller pair for correcting inclination (skew) of original O and adjusting the feed timing are disposed in the downstream of feeding path 25. At the same time, resist sensor 36 is disposed in front of aligning roller 34 to detect original O to adjust the operation timings of aligning roller 34 and feeding roller 35. Feeding roller 35 is formed of pressure sensitive conductive rubber 35*b* (to be described in detail later) for detecting the leading and trailing edges, multiple paper-conveying, size, and conveyed state (e.g., skew) of original O.

Original conveyor belt 37 serving as an original conveying means for covering the upper surface of original table 2 is kept taut. Original O fed by pickup/feeding means 23 is conveyed from one end (left end) to the other end (right end) of original table 2 and is discharged on paper discharge tray 39 formed on the upper surface of cover main body 21 by paper discharging means 38 formed on the right side of cover main body 21.

Original conveyor belt 37 comprises a white wide endless belt whose upper surface is looped between a pair of belt rollers 40. Original conveyor belt 37 is reciprocally driven by a belt drive mechanism (not shown) to be described later. A plurality of belt press rollers 41 for pressing the belt surface against original table 2 and a set switch 42 serving as a jamming release switch or a switch for detecting opening/closing of ADF 20 are arranged on the inner surface of original conveyor belt 37.

Paper discharging means 38 described above is arranged as follows.

More specifically, laterally U-shaped sheet discharge path 43 is formed to cause paper discharge tray 39 to communicate with the right edge of original table 2 to reverse and discharge the original sheet with the original formation surface facing upward.

Conveyor roller 44, pinch roller 45 for pressing original O against this conveyor roller 44, paper discharge sensor 46 serving as an original detecting means for detecting the trailing edge of original O fed in the discharge direction, and actuator 47 for paper discharge sensor 46 are arranged midway along sheet discharge path 43.

Discharge roller 48 and leaf spring 49 for pressuring original O against discharge roller 48 are disposed on the downstream side of original sheet discharge path 43.

Reference numeral 50 in FIG. 2 denotes a cover switch.

The control circuit will be described with reference to the block diagram in FIG. 1.

Main control unit 51 for controlling the overall operation of copying machine 1 is arranged. This main control unit 51 is connected to operation panel 52 for designating various operations, original operation unit 3, image forming unit 4, and interface 53 for exchanging data with ADF 20.

Operation panel 52 has display unit 52*a* for displaying and prompting for operation contents, keys 52*b* for designating various settings, copy key 52*c* for designating the start of copying, input mode select key 52*d*, clear key 52*e*, and the like.

ADF 20 has controller 61 for controlling the overall operation of ADF 20. Controller 61 is connected to driver 63 for driving feeding motor 61 serving as a drive source for pickup roller 27 and paper feed roller 31, driver 64 for driving carrier motor 64 serving as a drive source for aligning roller 34, feeding roller 35, original conveyor belt 37, conveying roller 44, and paper discharge roller 48, empty sensor 29, resist sensor 36, set switch 42, paper discharge sensor 40, cover switch 50, driver 67 for driving electromagnetic clutch 66 for interrupting transmission of a rotational force of carrier motor 64 to aligning roller 34 and feeding roller 35, driver 69 for driving shutter solenoid 68 for pivoting shutter 26, driver 71 for driving weight board solenoid 70 for pivoting weight board 28, memory 72 for storing various data, ADC 74 for converting a voltage value (E73) from detector 73 to a digital value (E73), and interface 60 for interfacing data with copying machine 1.

ADC 74 has an inverting output function and outputs, to controller 61, digital value E74 corresponding to a change in voltage value E73 from detector 73 for detecting a change in resistance value of feeding roller 35. ADC 74 outputs digital value E74 which increases in the positive direction with a decrease in voltage value E73 from detector 73.

Controller 61 determines a conveyed state such as multiple paper-conveying (such as double-paper conveying) of originals O in accordance with digital value E74 supplied from ADC 74. For example, when digital value E74 corresponding to voltage value E73=V0 of detector 73 is output from ADC 74, controller 61 determines that original O is not currently conveyed. when digital value E74 corresponding to voltage value E73=V1 of detector 73 is output from ADC 74, controller 61 determines that original O is normally conveyed. When digital value E74 corresponding to voltage value E73=V2 of detector 73 is output from ADC 74, controller 61 determines that multiple paper-conveying of originals O has occurred.

Figure 3:
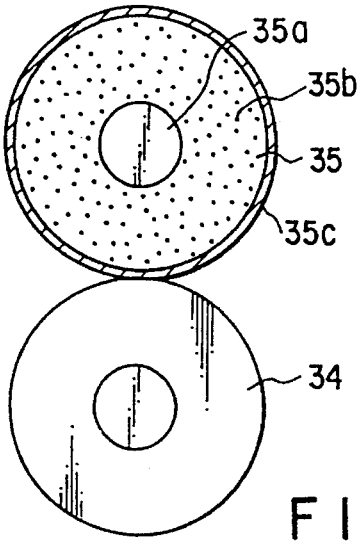
FIG. 3 is a schematic sectional view showing the structure of a feeding roller.

Feeding roller 35 has a structure, as shown in FIG. 3. Pressure sensitive conductive rubber 35*b* is concentrically formed on conductive support shaft 35*a*, and conductive layer 35*c* is formed on pressure sensitive conductive rubber 35*b*.

Figure 4:
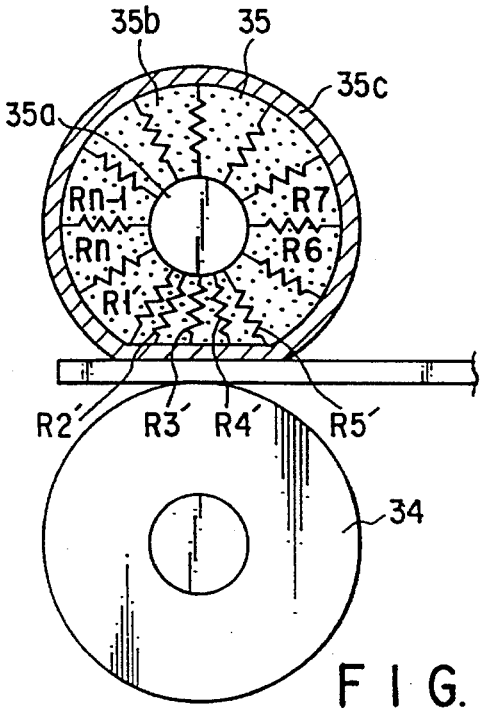
FIG. 4 is a sectional view showing clamping of an original between the feeding roller and an aligning roller.
Figure 5:
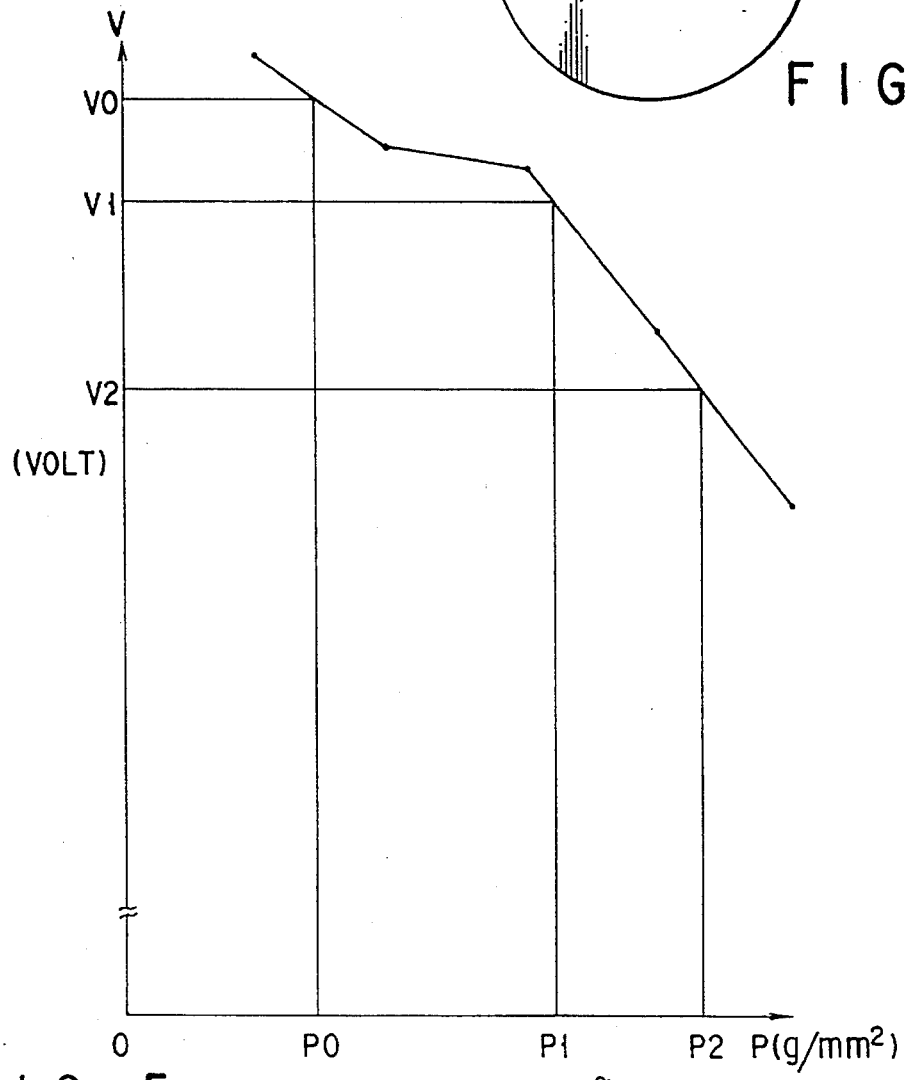
FIG. 5 is a graph for explaining a relationship between the pressure of the feeding roller and the output voltage from a detector.

Feeding roller 35 is connected to detector 73 for outputting different voltage values corresponding to changes in resistance values of pressure sensitive conductive rubber 35*b*. For example, as shown in FIG. 3, when original O is not clamped between feeding roller 35 and aligning roller 34, the pressure applied to feeding roller 35 is P0, and an output voltage from detector 73 is V0. As shown in FIG. 4, when one original O is clamped between feeding roller 35 and aligning roller 34, the pressure applied to feeding roller 35 is P1, and an output voltage from detector 73 is V1. When two originals O are clamped between feeding roller 35 and aligning roller 34, the pressure applied to feeding roller 35 is P2, and an output voltage from detector 73 is V2 (P2>P1>P0 and V0>V1>V2).

Figure 7:
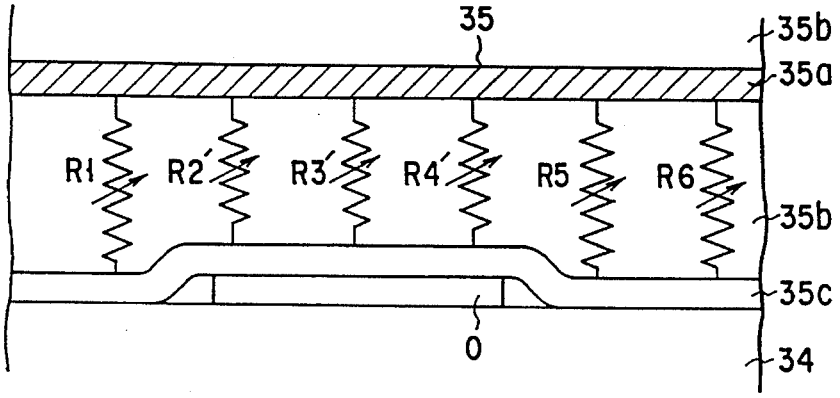
FIG. 7 is another equivalent circuit diagram of the feeding roller.

A relationship between the pressure of feeding roller 35 and the output voltage from detector 73 is shown in FIG. 7.

Pressure sensitive conductive rubber 35*b* is formed of a conductive elastomer (e.g., an elastic polymer such as silicone rubber) prepared by dispersing a conductive filler in a polymer material. Pressure sensitive conductive rubber 35*b* is an elastomer whose change in resistance can be detected in response to a pressure stimulus in the conductive elastomer. The pressure sensitive conductive rubber may be a conventional one and is called PCR.

Conductive layer 35*c* may be formed by thick film printing to a thickness of 10 to 20 μm, using a conductive ink mixed with conductive particles, or may be formed of a conductive rubber material. In the latter case, the wear resistance can be increased, and original O will not be damaged.

Figure 6:
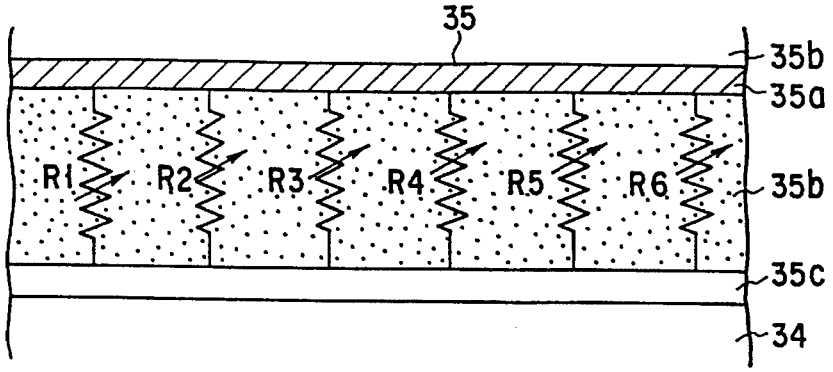
FIG. 6 is an equivalent circuit diagram of the feeding roller.

The equivalent circuits of feeding roller 35 are shown in FIGS. 6 and 7. In pressure sensitive conductive rubber 35*b*, its resistance value changes in a direction parallel to a direction to apply a pressure. For this reason, when pressure sensitive conductive rubber 35*b* is clamped between the shaft and conductive layer 35c, a signal can be effectively detected.

When original O is not clamped between feeding roller 35 and aligning roller 34, the following equation is derived:

$$1/R=(1/R1)+(1/R2)+(1/R3)+\ldots\ldots\ldots+(1/Rn)$$

(R1=R2=R3, . . . Rn)

where R is the total resistance value of feeding roller 35.

When original O is, however, clamped between feeding roller 35 and aligning roller 34, the following equation can be derived:

$$1/R'=((1/R2')+(1/R3')+(1/R4'))+((1/R1)+(1/R5)+(1/R6)+\ldots(1/Rn))$$

(R2'=R3'=R4', R1=R5=R6=Rn)

where R' is the total resistance value of feeding roller 35.

Figure 1:
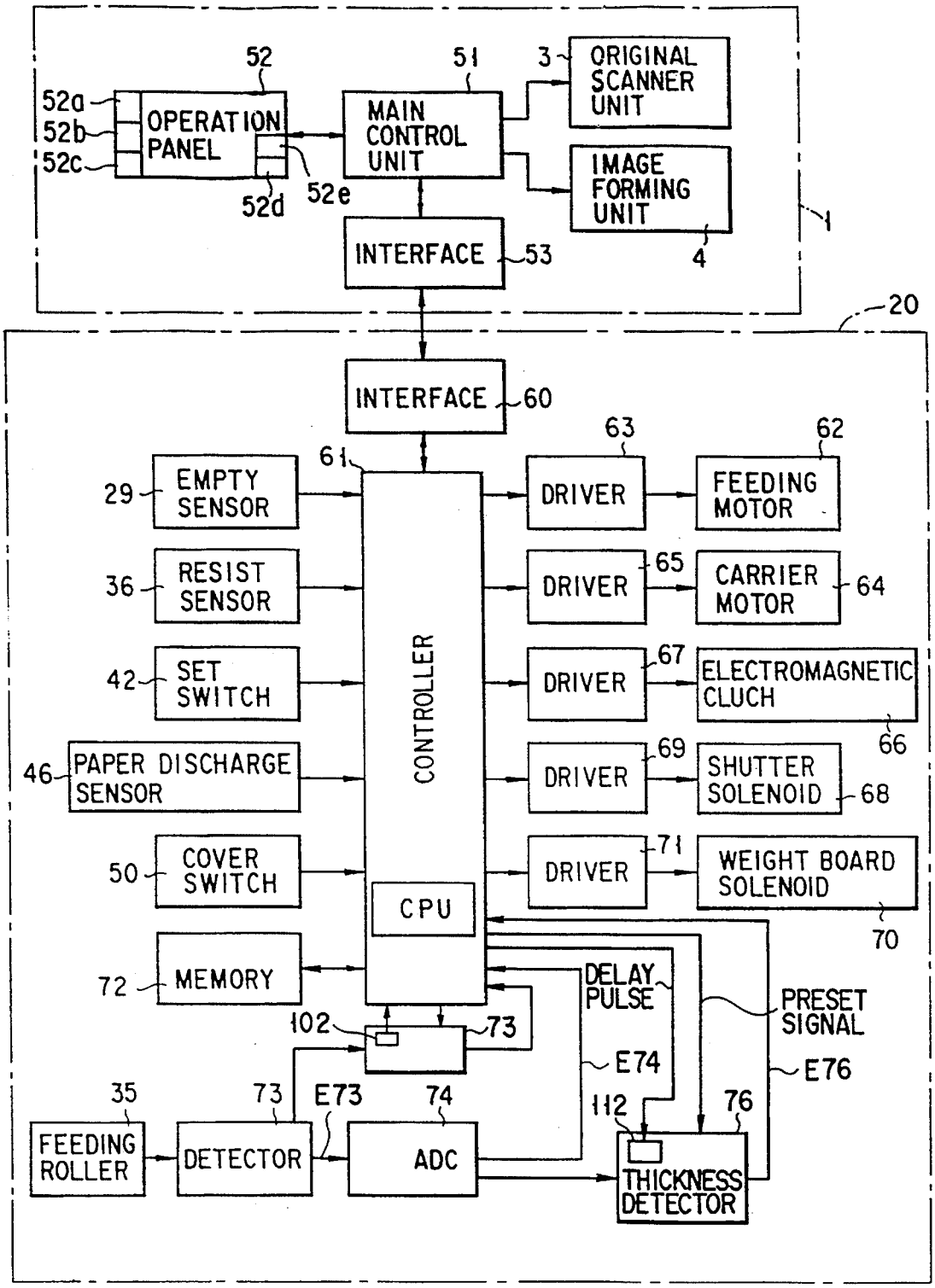
FIG. 1 is a schematic block diagram showing the arrangement of a control circuit according to an embodiment of the present invention.
Figure 8:
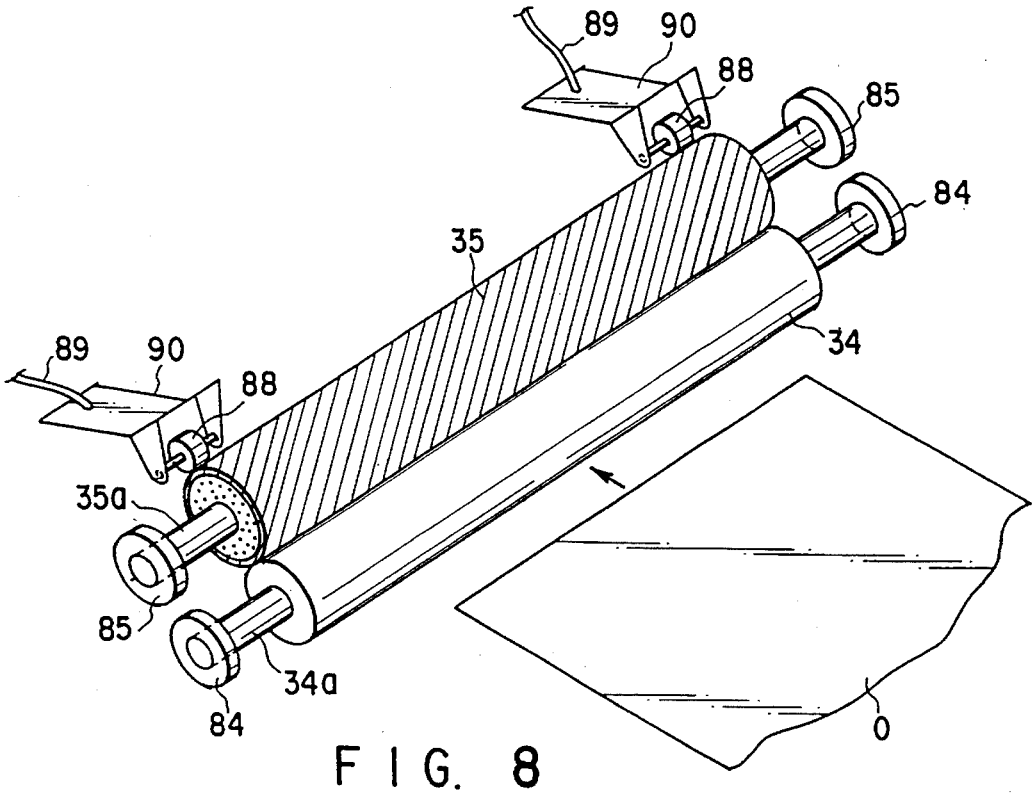
FIG. 8 is a perspective view showing the arrangement of a resist roller pair constituted by the feeding roller and the aligning roller.
Figure 9:
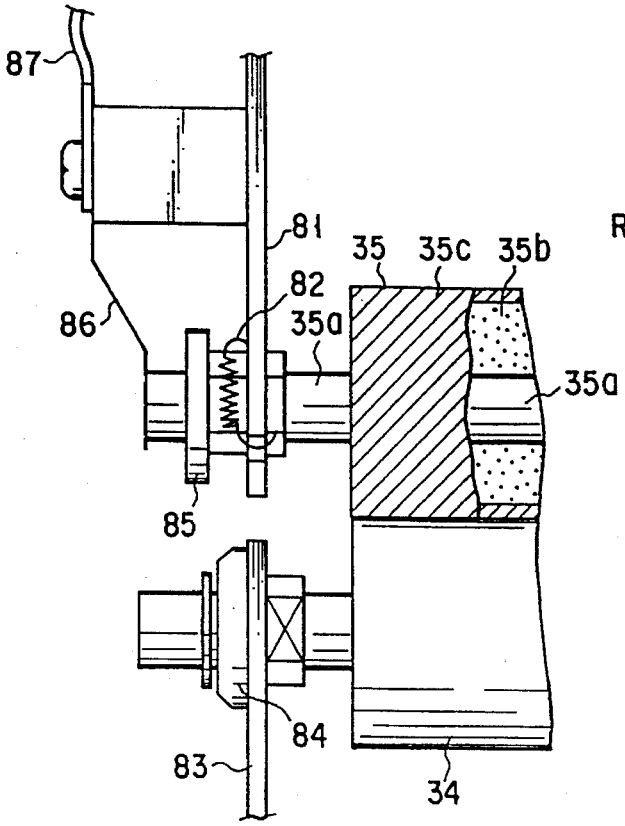
FIG. 9 is a view showing part of the structure of the resist roller pair constituted by the feeding roller and the aligning roller.

As shown in FIGS. 1, 8 and 9, aligning roller 34 rotates in contact with feeding roller 35. Feeding roller 35 is pressed against aligning roller 34 by compression springs 82 each having one end connected to frame 81 of the ADF main body.

Support shaft 34a of aligning roller 34 is rotatably supported to be electrically insulated by nonconductive bearings 84 disposed in frame 83 of the ADF main body. Support shaft 35a of feeding roller 35 is also rotatably supported to be electrically insulated by nonconductive bearings 85 disposed in frame 81 of the ADF main body. Therefore, aligning roller 34 is electrically insulated from feeding roller 35.

As shown in FIG. 9, a metal terminal (electrode) 86 having spring properties is connected to support shaft 35a of feeding roller 35 to keep in contact with support shaft 35a. Harness 87 is connected to this terminal 86. Support shaft 35a of feeding roller 35 is connected to one input terminal 73a of detector 73 through terminal 86 and harness 87. Terminal 86 is formed of, e.g., an SUS material or phosphor bronze.

As shown in FIG. 8, signal detection rollers 88 are kept in contact with conductive layer 35c of feeding roller 35 in a state wherein rollers 88 are rotated together with feeding roller 35. Harnesses 89 are connected to signal detection rollers 88, respectively. Conductive layer 35c of feeding roller 35 and the other input terminal 73b of detector 73 are connected to each other through signal detection rollers 88 and harnesses 89. Signal detection rollers 88 is formed of a conductive material (e.g., an SUS material or phosphor bronze) having spring properties. Signal detection rollers 88 are rotatably supported by support members 90, respectively.

As described above, conductive layer 35c of feeding roller 35 and the other input terminal 73b of detector 73 are connected using signal detection rollers 88 to minimize wear of conductive layer 35c. The thickness of conductive layer 35 can be made small by thick film printing using a conductive ink. In this case, the thickness of original O as a target object has a thickness of 50 to 150 μm, thereby increasing the detection sensitivity. In addition, since signal detection rollers 88 are located away from the conveying path of original O and do not adversely affect paper feeding performance.

Figure 10:
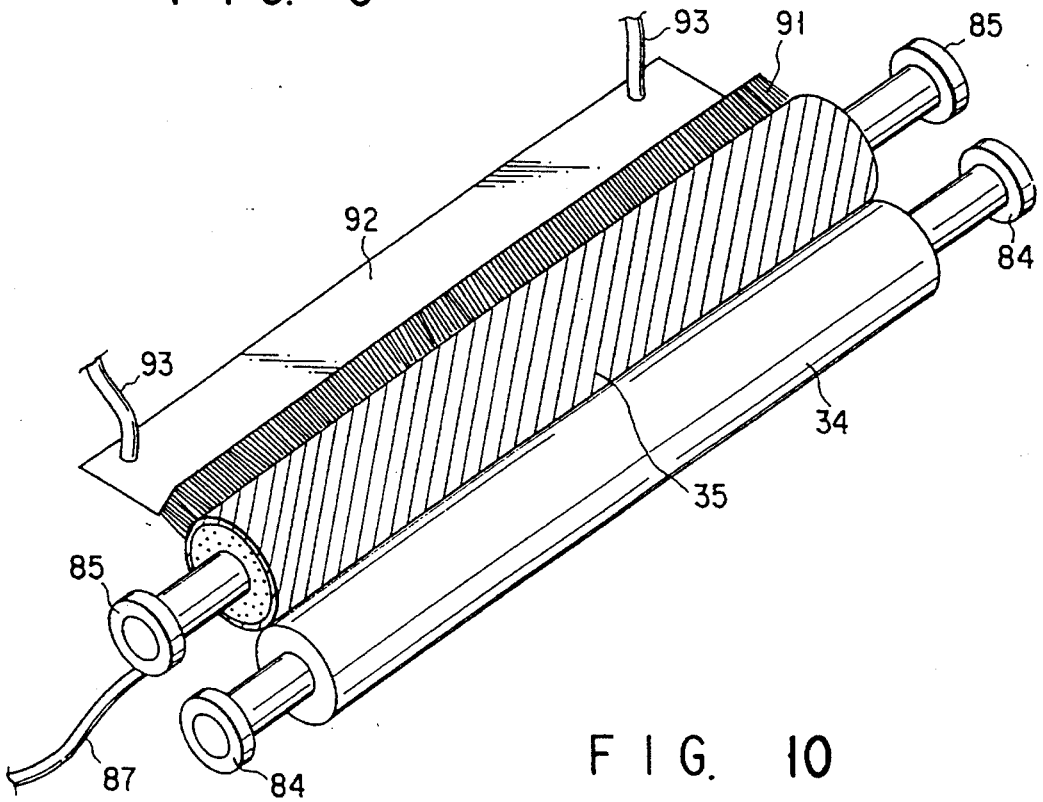
FIG. 10 is a perspective view showing the structure of the resist roller pair when a conductive brush is used in place of a signal detection roller.

To connect conductive layer 35c of feeding roller 35 to the other input terminal 73b of detector 73, conductive brush 91 may be used in place of signal detection roller 88, as shown in FIG. 10. In this case, conductive brush 91 is supported by conductive support member 92, and harnesses 93 are connected to this support member 92. Conductive layer 35c of feeding roller 35 and the other input terminal 73b of detector 73 are connected to each other through conductive brush 91, support member 92, and harnesses 93. Use of conductive brush 91 can provide not only a signal extracting function but also a function of cleaning a material attaching to feeding roller 35. As described above, since conductive brush 91 is in contact with conductive layer 35c, wear of conductive layer 35c of feeding roller 35 can be minimized.

Figure 11:
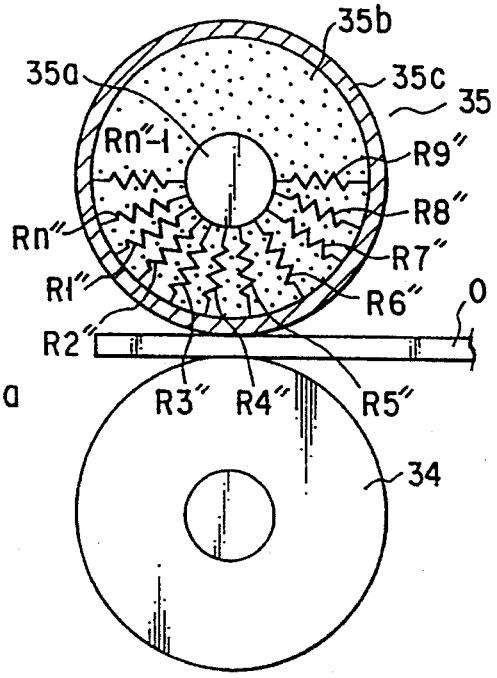
FIG. 11 is a sectional view showing the structure of a conductive layer of the feeding roller.

Conductive layer 35c of feeding roller 35 which is made by thick film printing with a conductive ink or formed of conductive rubber has been described above. However, the present invention is not limited to this. As shown in FIG. 11, conductive layer 35c may be made of a conductive material (e.g., a metal) having a Japanese Industrial Standard (JIS) hardness value of 80° or more.

When conductive layer 35c is made of a conductive material having the JIS hardness value of 80° or more, the corresponding equivalent circuit is given as follows:

$$1/R'' = ((1/R1'') + (1/R2'') + (1/R3'') + (1/R4'') + (1/R5'') + (1/R6'') + (1/R7'') + (1/R8'') + (1/R9'') \ldots + (1/Rn'') + (1/Rn_{-1})) + (1/R10) + (1/R11) \ldots + (1/Rn_{-2})$$

As described above, when conductive layer 35c is made of a material (e.g., a metal) which rarely deforms, a signal gain can increase even if the thickness of original O is kept unchanged.

Figure 12:
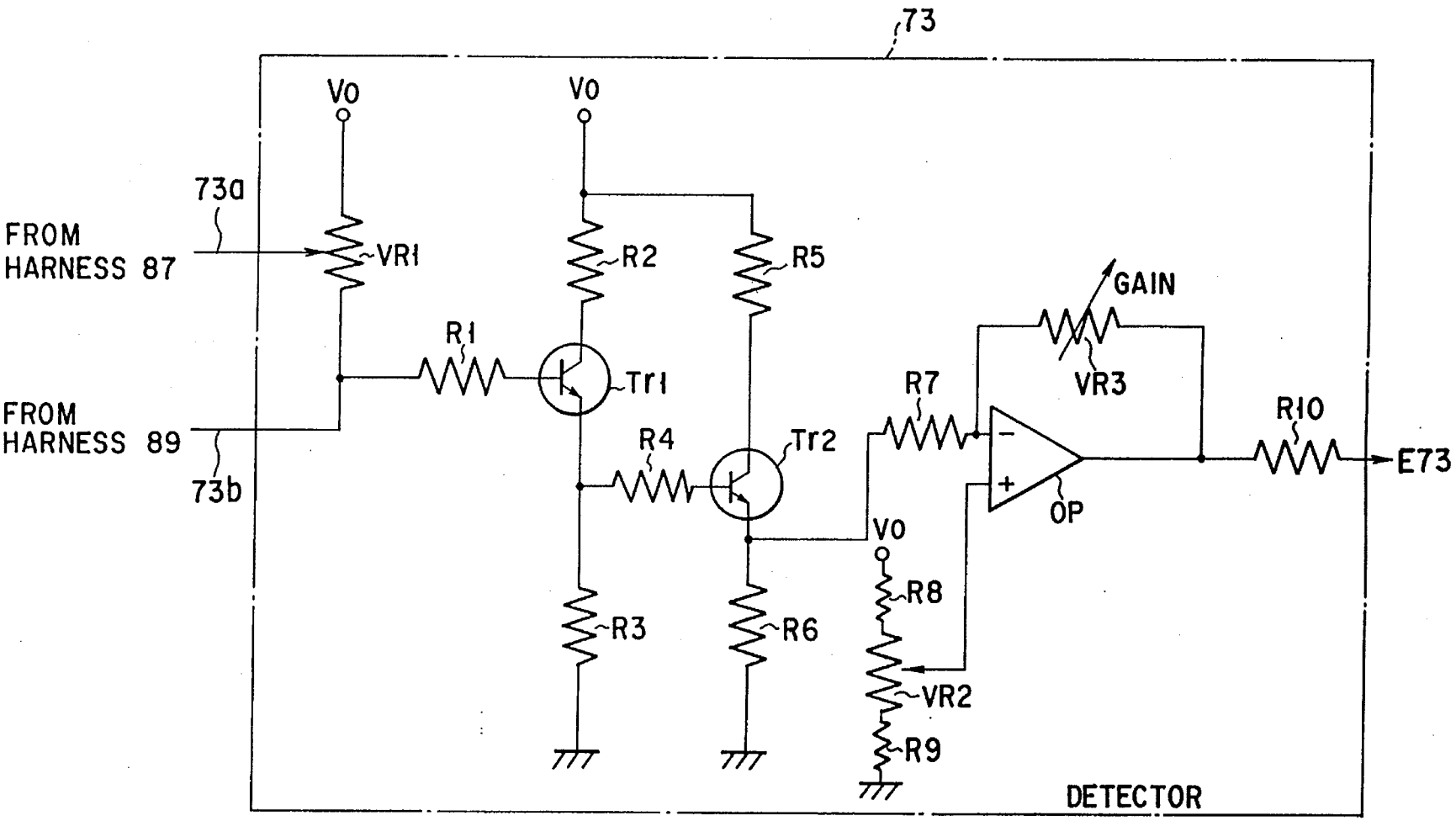
FIG. 12 is a schematic circuit diagram showing a detector.

As shown in FIG. 12, detector 73 comprises resistors R1 to R10, variable resistors VR1, VR2, and VR3, current detection transistors Tr1 and Tr2, and operational amplifier OP. In detector 73, a change in resistance value is supplied from feeding roller 35 to input terminals 73a and 73b. A current corresponding to this change in resistance value is adjusted by variable resistor VR1 and resistor R1, and the adjusted current serves as a base current to transistor Tr1. Since the amplitude of the change in resistance value supplied to input terminals 73a and 73b is unknown, a fixed resistor is not used, but variable resistor (volume resistor) VR1 is arranged. The base current of transistor Tr1 is detected at a current detection ratio of transistor Tr1, and an emitter current of transistor Tr1 is divided by resistors R4 and R5. A current flowing through resistor R4 is detected by transistor Tr2 at a current detection ratio of transistor Tr2, and an emitter current of transistor Tr2 is divided by resistors R6 and R7. A current flowing through resistor R7 is detected by operational amplifier OP to VR2/R7 times determined by variable resistor VR2 and resistor R7 on the basis of a reference voltage. The reference voltage input to the non-inverting input terminal of this operational amplifier OP is used for adjusting an input offset and is adjusted by variable resistor VR3. A signal (voltage value E73) detected by operational amplifier OP is output to ADC 74 through resistor R10.

In the above operation, the current detection ratio is set high using two transistors Tr1 and Tr2. However, only one transistor Tr1 may be used. In this case, in detector 73, a signal is output from transistor Tr1 through resistor R4.

Another resistor may be inserted between input terminal 73b and resistor R1, depending on a signal supplied to input terminal 73b.

The operation of the above arrangement will be described with reference to FIGS. 13A to 13D.

Figure 13A:
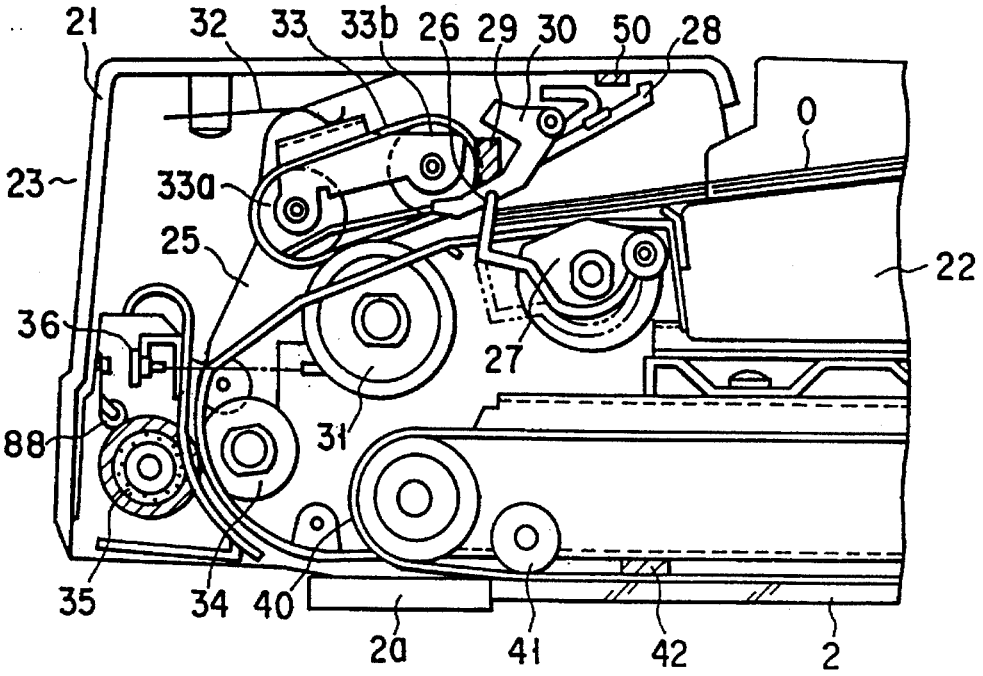
FIGS. 13A to 13D are views for explaining a conveying operation of an original.
Figure 13B:
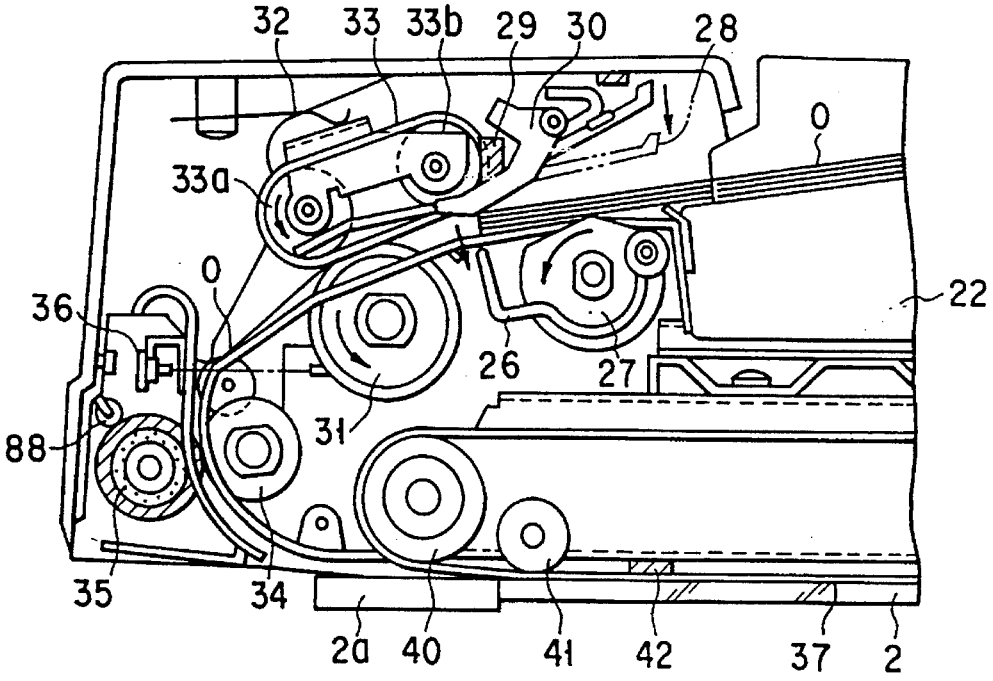
Figure 13C:
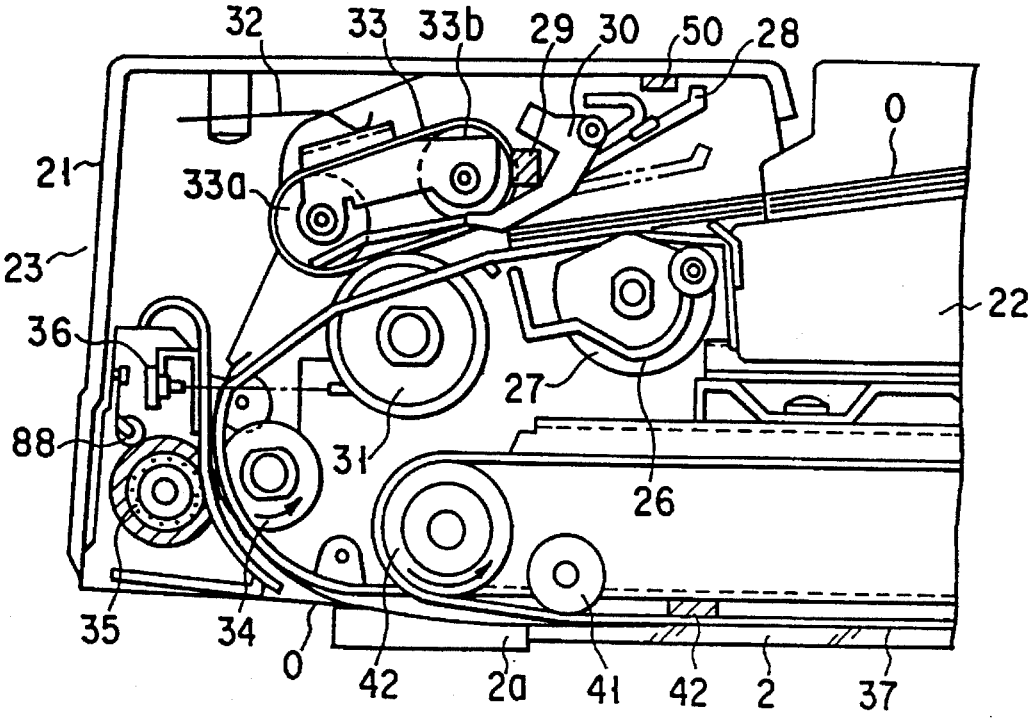
Figure 13D:
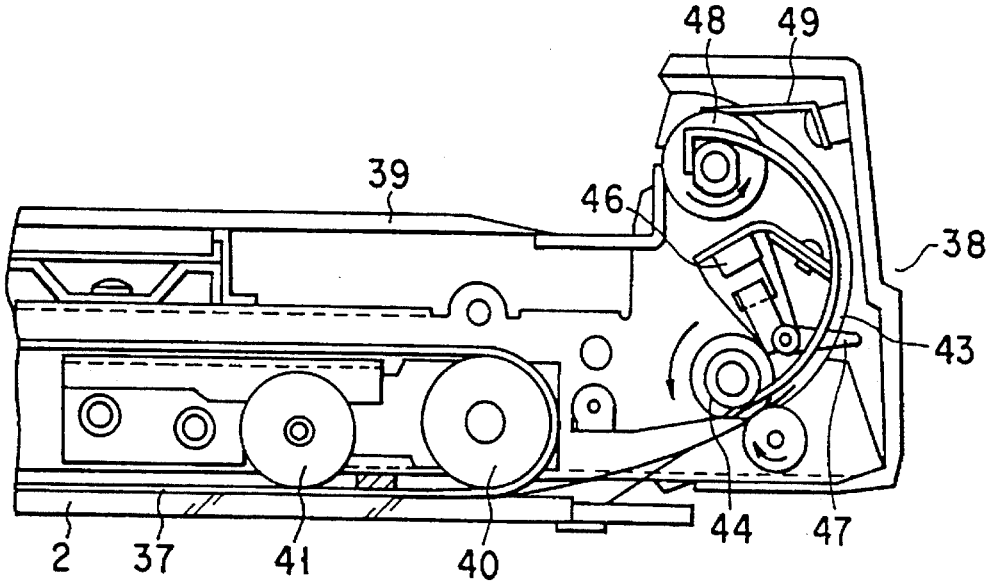

As shown in FIG. 13A, a plurality of originals O are set (placed) to abut against shutter 26 on original feeding table 22. Upon placing originals O, actuator 30 is pivoted to turn on empty sensor 29. On the other hand, necessary information is input from operation panel 52. The operator depresses copy key 52*c*. Shutter solenoid 68 and weight board solenoid 70 are turned on to cause weight board 28 to prevent original O from floating, and shutter 26 is retracted from conveying path 25 (FIG. 13B).

When the rotational force of feeding motor 62 is transmitted to pickup roller 27, paper feed roller 31, and separation belt 33, controller 61 rotates them. Lowermost original O on original feeding table 22 is picked up and fed. This original O is fed to the lower-surface side of original conveyor belt 37 during feeding through the resist roller pair constituted by aligning roller 34 and feeding roller 35 (cf. FIG. 13C).

When a predetermined period of time has elapsed upon rotation of aligning roller 34 and feeding roller 35, controller 61 determines jamming, i.e., that original O is not conveyed when the digital value from ADC 74 is a value corresponding to voltage value E73=V0 from detector 73. When the digital value from ADC 74 is a value corresponding to voltage value E73=V2 from detector 73, controller 61 determines that multiple paper-conveying of originals O has occurred.

When jamming is determined, controller 61 stops feeding motor 62 and carrier motor 64 and sends a jamming detection signal to main control unit 51 in copying machine main body 1 through interfaces 60 and 53. Main control unit 51 indicates occurrence of jamming on operation panel 52.

When multiple paper-conveying is determined, controller 61 stops feeding motor 62 and carrier motor 64 and sends a multiple paper-conveying detection signal to main control unit 51 in copying machine main body 1 through interfaces 60 and 53. Main control unit 51 indicates occurrence of multiple paper-conveying on operation panel 52.

When original O is normally fed onto original table 2, the following operations are performed to abut original O against original stopper 2*a*. The trailing edge of original O is detected by resist sensor 36 or feeding roller 35, and then original conveyor belt 37 is driven by a predetermined number of pulses. Thereafter, original conveyor belt 37 is driven by the predetermined number of pulses in the reverse direction to cause original O to return, thereby completely setting original O.

When original O is completely set, it is scanned by original scanner unit 3 in copying machine main body 1. Copying to a sheet serving as transfer paper is started by image forming unit 4.

When original scanning by original scanner unit 3 is completed, original O is fed out from original table 2 during driving original conveyor belt 37. Original O is then discharged on paper discharge tray 39 through paper discharging means 38 (cf. FIG. 13D).

More specifically, actuator 43 is pivoted by the leading edge of original O to turn on paper discharge sensor 38. In this case, controller 61 stops original conveyor belt 37. When a predetermined period of time (several 10 msec) has elapsed after paper discharge sensor 38 is turned off (sheet passing) by the trailing edge of original O, controller 61 stops conveying roller 44 and paper discharge roller 48.

When original O is fed out from original table 2, next original O is fed onto original table 2. This operation is repeated until the number of originals O set on original feeding table 22 becomes zero.

An embodiment will be described below in which a length detector for detecting the length of original O on the basis of an output signal from detector 73 is arranged, and the conveyed state of original O is determined in accordance with the detection result of this length detector. Similar to ADC 74, length detector 75 is coupled to detector 73 and controller 61.

Length detector 75 detects the length of fed original O in accordance with a change in voltage value E73 from detector 73 with a change in resistance value of feeding roller 35. Length detector 75 outputs, to controller 61, a detection signal (E75) representing whether the length of second or subsequent original O is larger than that of the first original O or a detection signal (E75) representing whether the length of first original O is larger than that of second or subsequent original O.

Controller 61 determines a conveying abnormality in accordance with the detection signal from length detector 75. For example, when length detector 75 outputs detection signal E75 representing that the length of second or subsequent original O is larger than the reference length, controller 61 determines multiple paper-conveying of second and subsequent originals O. When length detector 75 outputs detection signal E75 representing that the length of first original O is larger than that of the second or subsequent original O, controller 61 determines multiple paper-conveying of first original O.

Figure 14:
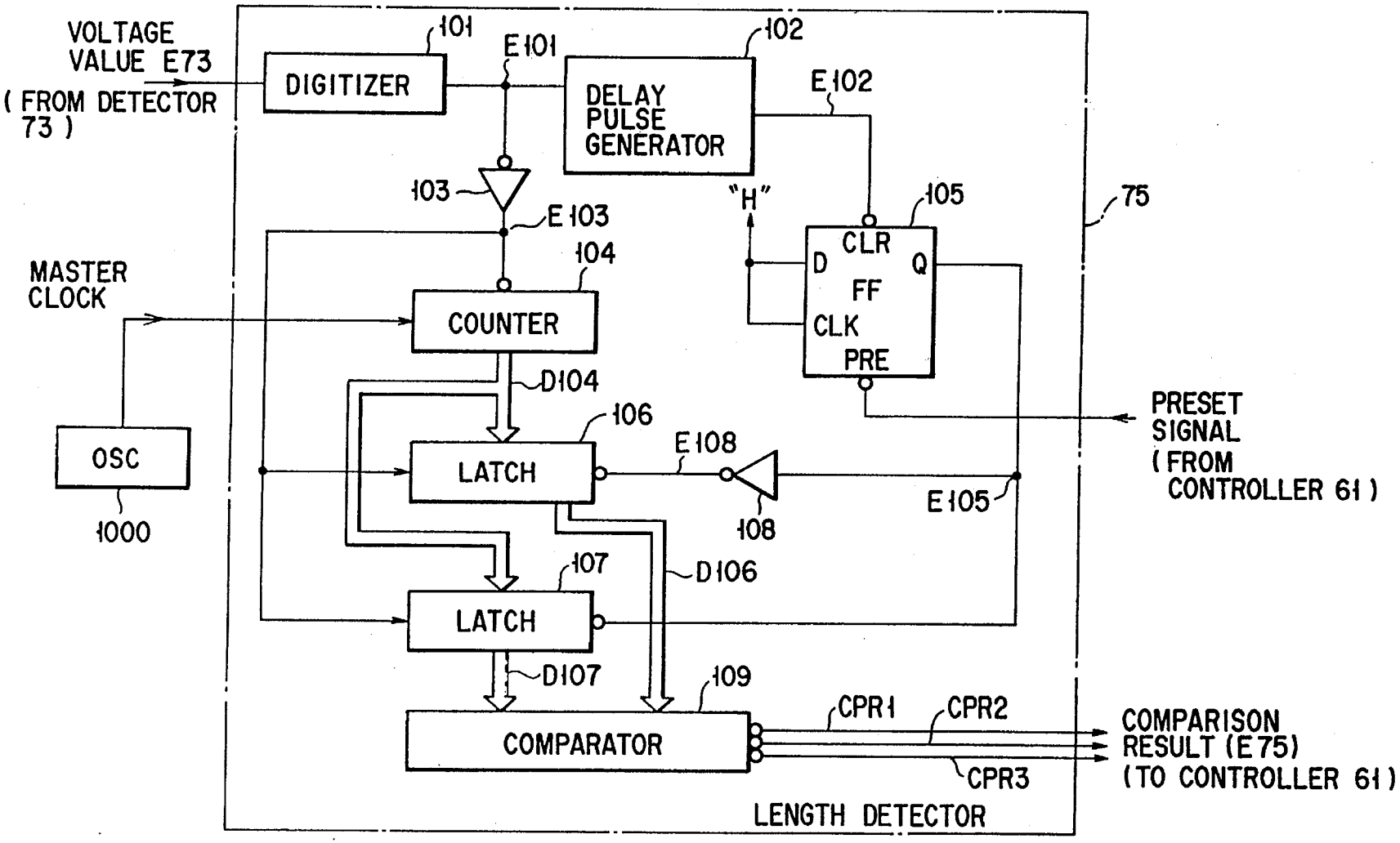
FIG. 14 is a schematic block diagram showing the length detector.

As shown in FIG. 14, length detector 75 comprises digitizer 101, delay pulse generator 102, inverters 103 and 104, counter 104, FF 105, latches 106 and 107, and comparator 109.

Figures 15A, 15B, 15C, 15D, 18A, 18B, 18C, 18D:
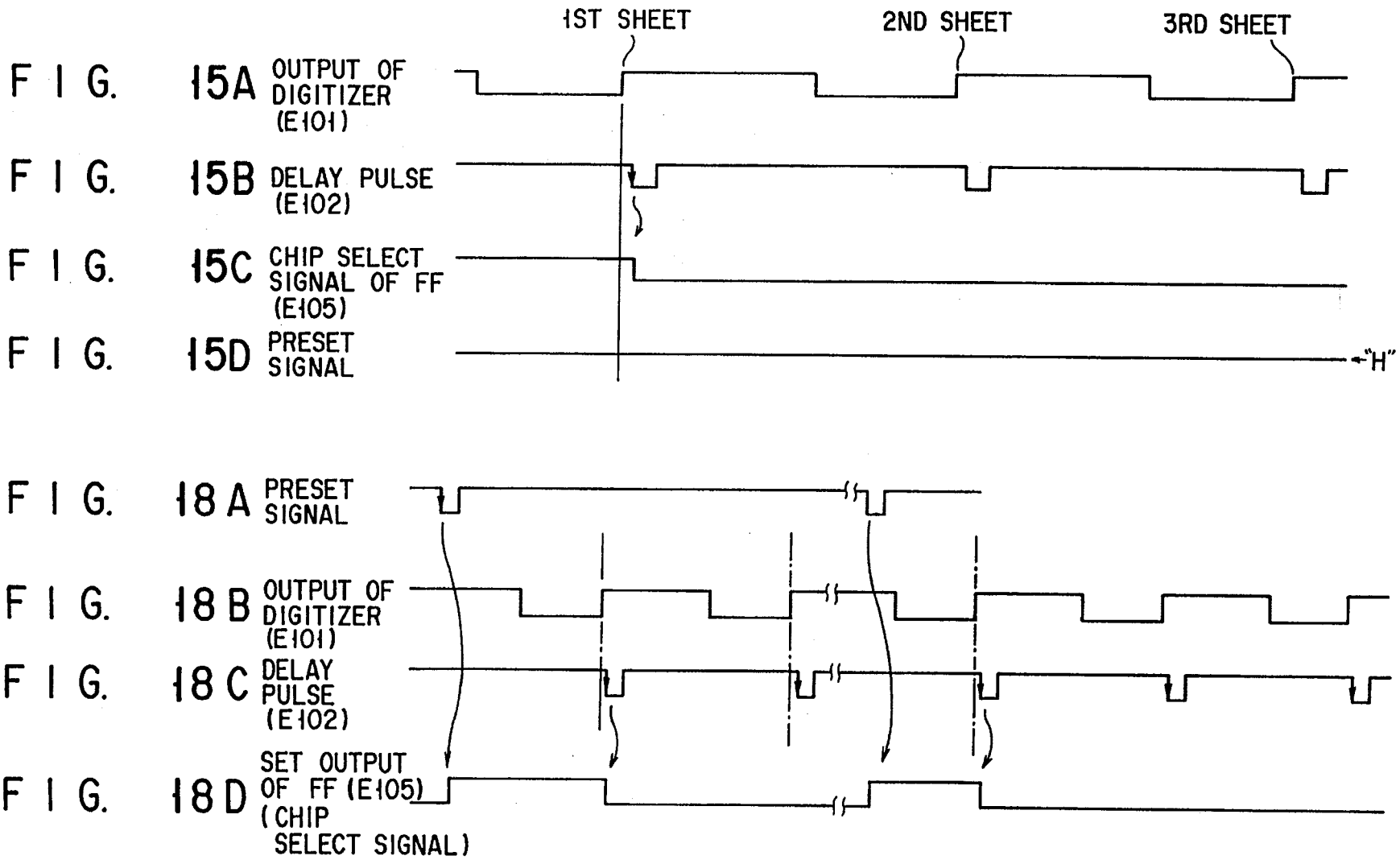
FIGS. 15A to 15D are timing charts showing output waveforms of a main part in the length detector.
FIGS. 18A to 18D are timing charts showing a chip select signal, an output from a digitizer, and a delay pulse in response to a preset signal.

Digitizer 101 digitizes voltage value E73 from detector 73 to output detection signal E101 representing passing of original O to feeding roller 35, as shown in FIG. 15A. When original O is present between feeding roller 35 and aligning roller 34, digitizer 101 outputs signal E101 of "L" level. Otherwise, digitizer 101 outputs signal E101 of "H" level. Digitized output E101 from digitizer 101 is supplied to delay pulse generator 102 and to counter 104 and latches 106 and 107 through inverter 103.

When digitized signal (passing detection signal) E101 from digitizer 101 is switched (i.e., when signal E101 goes from "L" to "H"), delay pulse generator 102 outputs delay pulse E102 shown in FIG. 15B. This delay pulse E102 is output to FF 105.

Counter 104 counts the master clock pulses supplied from oscillator (OSC) 1000 while digitized output (passing detection signal of "L") E101 is being output from digitizer 101. Count value D104 is output to latches 106 and 107.

More specifically, count value D104 of counter 104 is kept at "0" when original O is absent between feeding roller 35 and aligning roller 34. However, when original O is present between feeding roller 35 and aligning roller 34, counter 104 starts to count the clock pulses from "0".

Figure 24:
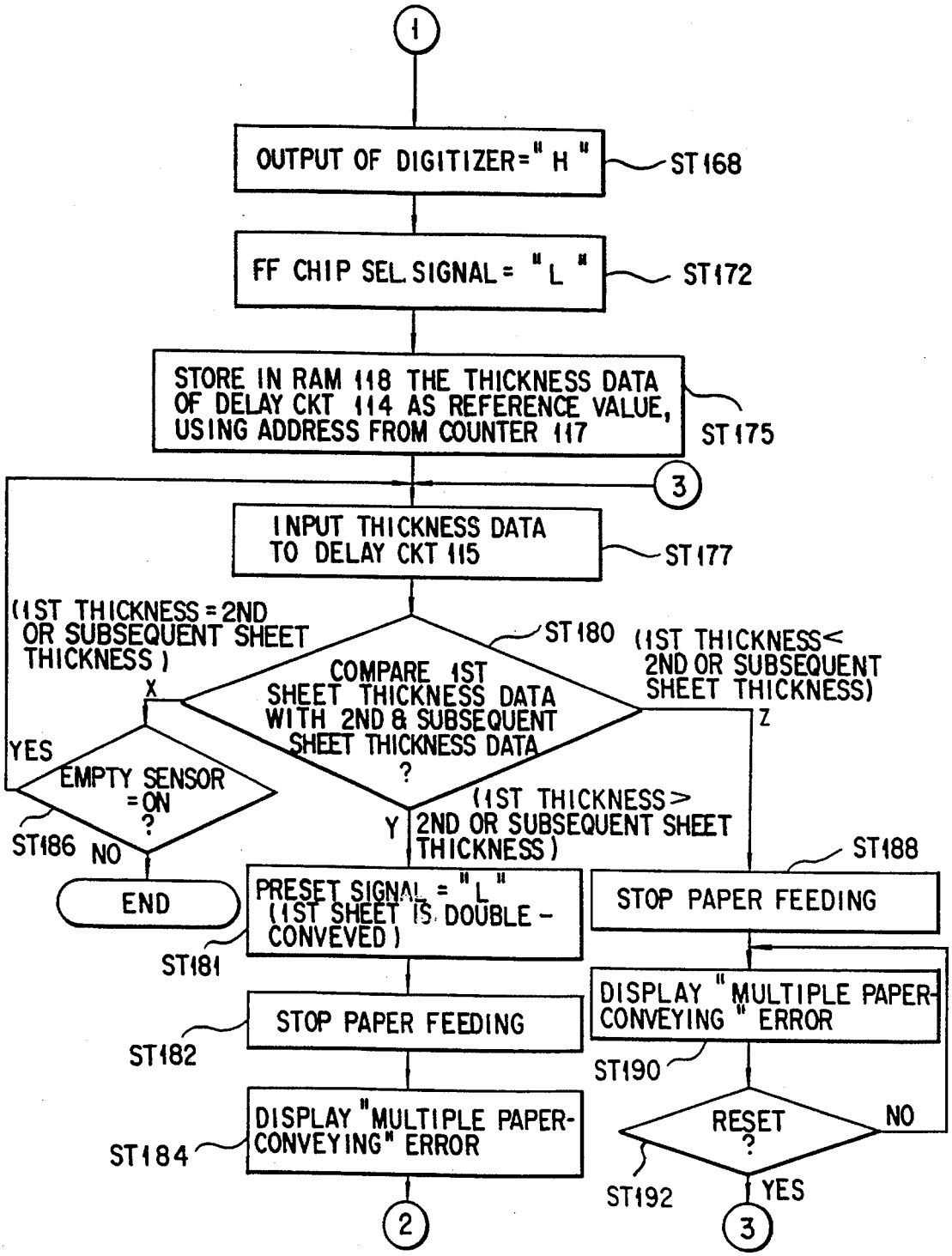
FIG. 24 is a flow chart for explaining the multiple paper-conveying detection during feeding for the original.

FF 105 is a D flip-flop whose data input terminal D and clock input terminal CLK are set at "H" level. Delay pulse E102 from delay pulse generator 102 is supplied to clear input terminal CLR, and a preset signal ("L") is supplied from controller 61 to preset input terminal PRE. Preset input terminal PRE is normally set at "H" level, as shown in FIG. 24D.

In FF 105, chip select signal (Q output) E105 is kept at "H" level until the first delay pulse (E102) is supplied from delay pulse generator 102, as shown in FIG. 15C. Upon reception of the first delay pulse (E102), chip select signal (Q output) E105 goes from "H" level to "L" level when first original O has passed through roller 35 and is then held at "L" level.

When a preset signal of "L" level is input from controller 61 to FF 105, chip select signal E105 goes to "H" level again.

Chip select signal (CS signal) E105 from FF 105 is supplied to latch 107. CS signal E105 is also inverted via inverter 108, and the inverted signal is supplied to latch 106.

When inverted signal E108 of chip select signal ("H" level) E105 is supplied from FF 105 to latch 106 through inverter 108, latch 106 latches count value D104 of counter 104. Thus, latch 106 stores the count value corresponding to the length of first original O. Count value D106 of this latch 106 is output to comparator 109.

When latch 107 receives chip select signal ("L") E105 from FF 105, latch 107 stores count value D104 of counter 104. That is, latch 107 stores count value D104 corresponding to the length of second or subsequent original O. The latched count value (D107) of latch 107 is output to comparator 109.

Comparator 109 compares count value D106 corresponding to the length of first original O from latch 106 with count value D107 corresponding to the length of second or subsequent original O from latch 107. Comparator 109 then outputs, to controller 61, a signal (CPR3) representing that the length of second or subsequent original O is equal to that of first original O, a signal (CPR2) representing that the length of second or subsequent original O is larger than that of first original O, or a signal (CPR1) representing that the length of first original O is larger than that of second or subsequent original O.

For example, comparator 109 outputs 3-bit comparison results CPR1, CPR2, and CPR3. When the length of first original O is larger than that of second or subsequent original O, comparison result CPR1 is set at "L" level. When the length of second or subsequent original O is larger than that of first original O, comparison result CPR2 is set at "L" level. When the length of second or subsequent original O is equal to that of first original O, comparison result CPR3 is set at "L" level.

The period of the master clock has a predetermined value, and the conveying speed of original O by feeding roller 35 is also predetermined. For these reasons, the length of original O can be detected by the count values (D106, D107) stored in latches 106 and 107.

Figure 16:
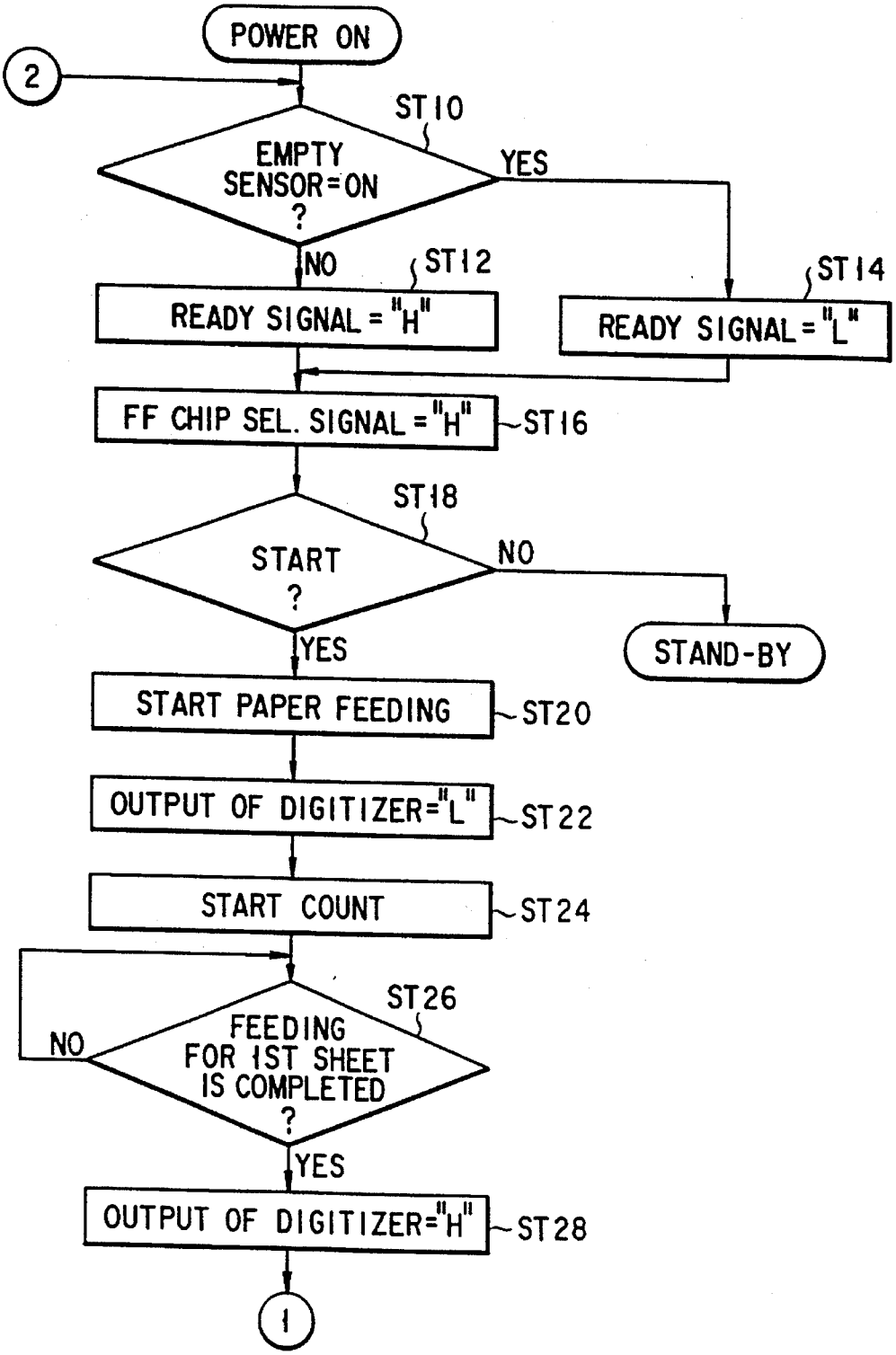
FIG. 16 is a flow chart for explaining multiple paper-conveying detection during feeding for an original.
Figure 17:
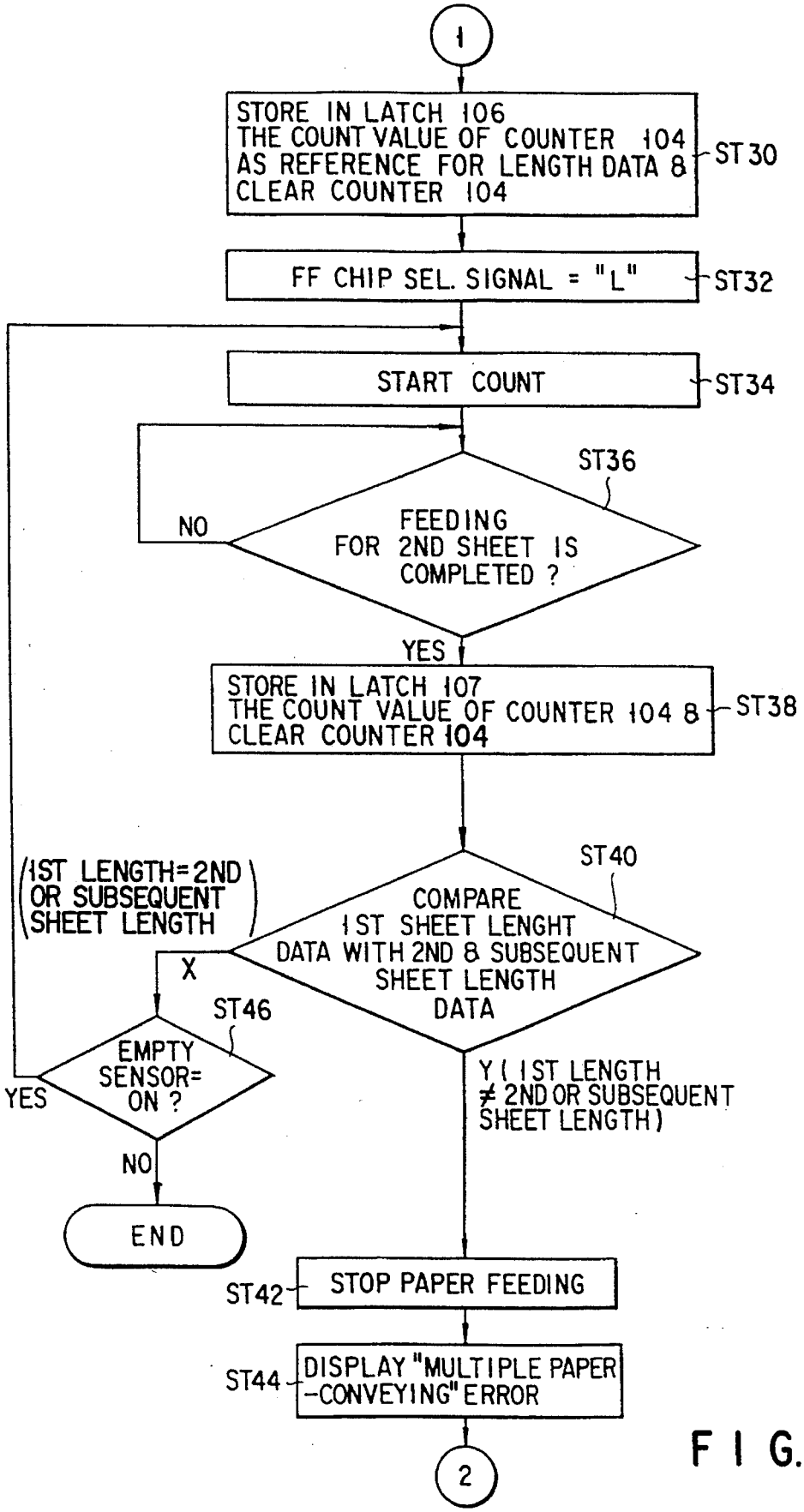
FIG. 17 is a flow chart for explaining the multiple paper-conveying detection during feeding for the original.
Figure 23:
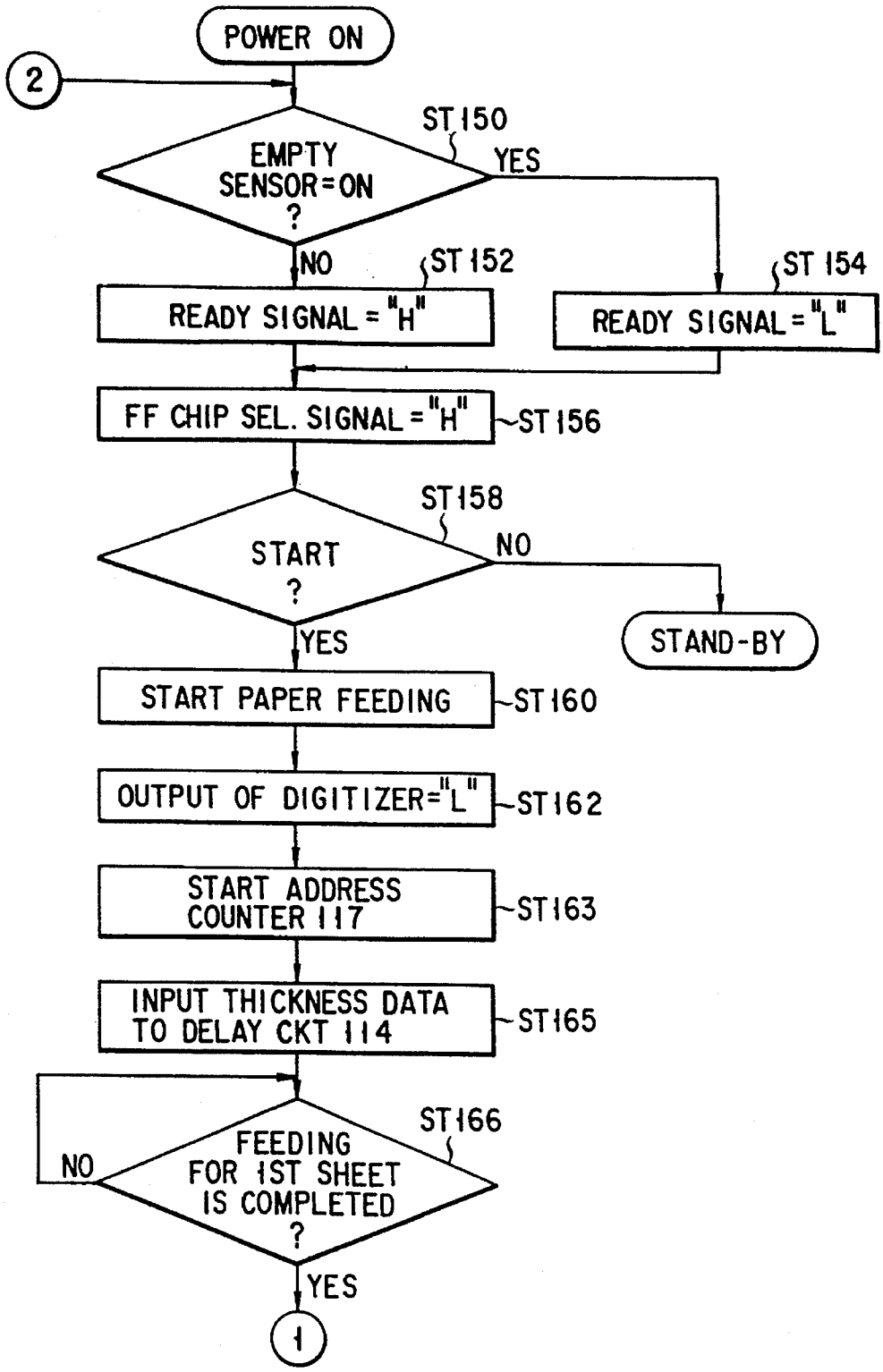
FIG. 23 is a flow chart for explaining multiple paper-conveying detection during feeding for an original.

The operation of the arrangement shown in FIG. 23 will be described with reference to flow charts in FIGS. 16 and 17.

For example, assume that a plurality of originals O are set (placed) on original feeding table 22 (FIG. 13A) so as to abut against shutter 26. By this setting of the sheets, actuator 30 is pivoted to turn on empty sensor 29 (YES in ST10) and output a ready signal of "L" level (ST14). If the sheets run out, sensor 29 is turned off (NO in ST10) to output a ready signal of "H" level (ST12). Chip select signal E105 from FF 105 is then preset to "H" level (ST16).

Necessary information is then input from operation panel 52, and copy key 52*c* is depressed (YES in ST18), thereby starting paper feeding (ST20). Controller 61 turns on shutter solenoid 68 and weight board solenoid 70. As a result, weight board 28 prevents original O from floating, and shutter 26 is retracted from feeding path 25.

Controller 61 designates to transmit a rotational force of feeding motor 62 to pickup roller 27, paper feed roller 31, separation belt 33 to rotate them. Lowermost original O on original feeding table 22 is picked up and fed. At the same time, original O is fed to the lower-surface side of original conveyor belt 37, driven in the feeding direction, through a resist roller pair consisting of aligning roller 34 and feeding roller 35.

When first original O passes between aligning roller 34 and feeding roller 35, data corresponding to the length of first original O is stored as a reference value in latch 106 in length detector 75.

More specifically, when the leading edge of first original O reaches the portion between feeding roller 35 and aligning roller 34, digitizer 101 outputs signal E101 of "L" level in accordance with the voltage value detected by detector 73 (ST22). In response to this "L" signal E101, counter 104 starts to count the clock pulses from oscillator 1000 (ST24).

When the trailing edge of first original O has passed through feeding roller 35 and aligning roller 34 (YES in ST26), digitizer 101 outputs signal E101 of "H" level in accordance with the voltage value detected by detector 73 (ST28). In this case, chip select signal E105 from FF 105 has been set at "H" level (ST16). This "H" signal is inverted to a signal of "L" level by inverter 108, thereby storing count result D104 of counter 104 in latch 106 (ST30). In response to this "H" signal E101, counter 104 is cleared (ST30). As a result, a clock count corresponding to first original O is stored as a reference value in latch 106. When signal E101 of "H" level is output from digitizer 101 (ST28), a delay pulse is generated by delay pulse generator 102. FF 105 is then cleared in response to the delay pulse to set chip select signal E105 to "L" level (ST32).

When first original O is normally fed onto original table 2, the trailing edge of original O is detected by resist sensor 36 or feeding roller 35 so as to abut first original O against original stopper 2*a*, and then original conveyor belt 37 is driven by a predetermined number of pulses. Thereafter, original conveyor belt 37 is driven by the predetermined number of pulses in the reverse direction to cause original O to return, thereby completely setting original O.

When first original O is completely set, original scanning is performed by original scanner unit 3 in copying machine main body 1. By this scanning, copying is performed on a sheet serving as transfer paper by image forming unit 4.

When original scanning by original scanner unit 3 is completed, first original O is fed out from original table 2 upon driving original conveyor belt 37. Original O is then discharged on paper discharge tray 39 through paper discharge means 38.

When first original O is fed out from original table 2, second original O is fed from original feeding table 22 to original table 2.

When second original O has passed through aligning roller 34 and feeding roller 35, comparator 109 compares data (D107) corresponding to the length of second original O with the reference value (D106) corresponding to the length of first original O. The result of the comparison is output to controller 61.

More specifically, when the leading edge of second original O reaches the portion between feeding roller 35 and aligning roller 34, digitizer 101 outputs signal E101 of "L" level in accordance with the voltage value detected by detector 73. Counter 104 starts to count the clock pulses from OSC 1000 in response to signal E101 of "L" level (ST34). In this case, chip select signal E105 of FF 105 is set at "L" level (ST32), and count value D104 of counter 104 is stored in latch 107.

When the trailing end of second original O has passed through feeding roller 35 and aligning roller 34 (YES in ST36), digitizer 101 outputs signal E101 of "H" level in accordance with the voltage value detected by detector 73. Counter 104 is cleared in response to this "H" signal E101. As a result, a clock pulse count corresponding to the length of second original O is stored in latch 107 (ST38).

Comparator 109 compares count value D106 corresponding to the length of first original O from latch 106 with count value D107 corresponding to the length of second or subsequent original O from latch 107 (ST40). If the length of first original O is larger than that of second or subsequent sheet (Y at ST40), comparison result CPR1 is set at "L" level. When the length of second or subsequent sheet is larger than that of first original O (Y at ST40), comparison result CPR2 is set at "L" level. If the length of second or subsequent original O is equal to that of first original O (X at ST40), comparison result CPR3 is set at "L" level.

When controller 61 receives, from length detector 75, a signal (CPR2="L") representing that the length of second original O is larger than that of first original O (Y at ST40), controller 61 determines multiple paper-conveying of second original O. However, when controller 61 receives, from length detector 75, a signal (CPR1="L") representing that the length of first original O is larger than that of second original O, controller 61 determines multiple paper-conveying of first original O.

When controller 61 determines multiple paper-conveying in accordance with the detection signal from length detector 75 (Y at ST40), controller 61 stops the feeding operation (ST42) and sends a multiple paper-conveying detection signal to main control unit 51 (ST44). Therefore, main control unit 51 causes display unit 52*a* in operation panel 52 to display a multiple paper-conveying error.

If a detection signal (CPR3="L") representing that the length of second original O is equal to that of first original O is supplied from length detector 75 to controller 61 (X at ST40), controller 61 performs original scanning and paper discharge processing for second original O. At the same time, third original O is fed from original feeding table 22 to original table 2 in the same manner as described above.

The same multiple paper-conveying detection as described above is also performed for the third and subsequent sheets (YES in ST46).

When multiple paper-conveying detection is performed using length detector 75, as described above, patched original O on which a photograph or the like is adhered will not be erroneously detected because the length of patched original O is equal to that of reference original O.

In the above case, upon detection of multiple paper-conveying, the feeding operation is stopped, and occurrence of multiple-paper feeding is displayed on display unit 52*a*. However, an original sheet count prior to occurrence of multiple paper-conveying may be displayed on display unit 52*a*.

In this case, as shown in FIG. 1, delay pulse E102 from delay pulse generator 102 in length detector 75 is supplied to controller 61. Counter 72*a* is arranged in memory 72. The count value of counter 72*a* in memory 72 is counted up by controller 61 every time the delay pulse (E102) from delay pulse generator 102 is supplied to counter 72*a*.

When an operation is restarted, and if multiple paper-conveying of the first sheet is determined, counter 72*a* is cleared to "0". However, when multiple paper-conveying of the second or subsequent sheet is determined, counter 72*a* holds the count value obtained prior to occurrence of multiple paper-conveying. Therefore, at the time of restart, the user can only set a document on original feeding table 22 from the original O having been subjected to multiple paper-conveying.

With the above arrangement, when multiple paper-conveying has occurred, feeding need not be performed from the first sheet, thereby allowing the operator to save time.

When a preset signal ("L") is supplied from controller 61 to FF 105 upon occurrence of multiple paper-conveying during feeding for a plurality of originals O, the reference data in latch 106 is initialized. Length data corresponding to first original O upon release of multiple paper-conveying is stored in latch 106 as a reference value.

In this case, the timing charts of the chip select signal for the preset signal, the output from digitizer 101, and the delay pulse are shown in FIGS. 18A to 18D.

Figure 19:
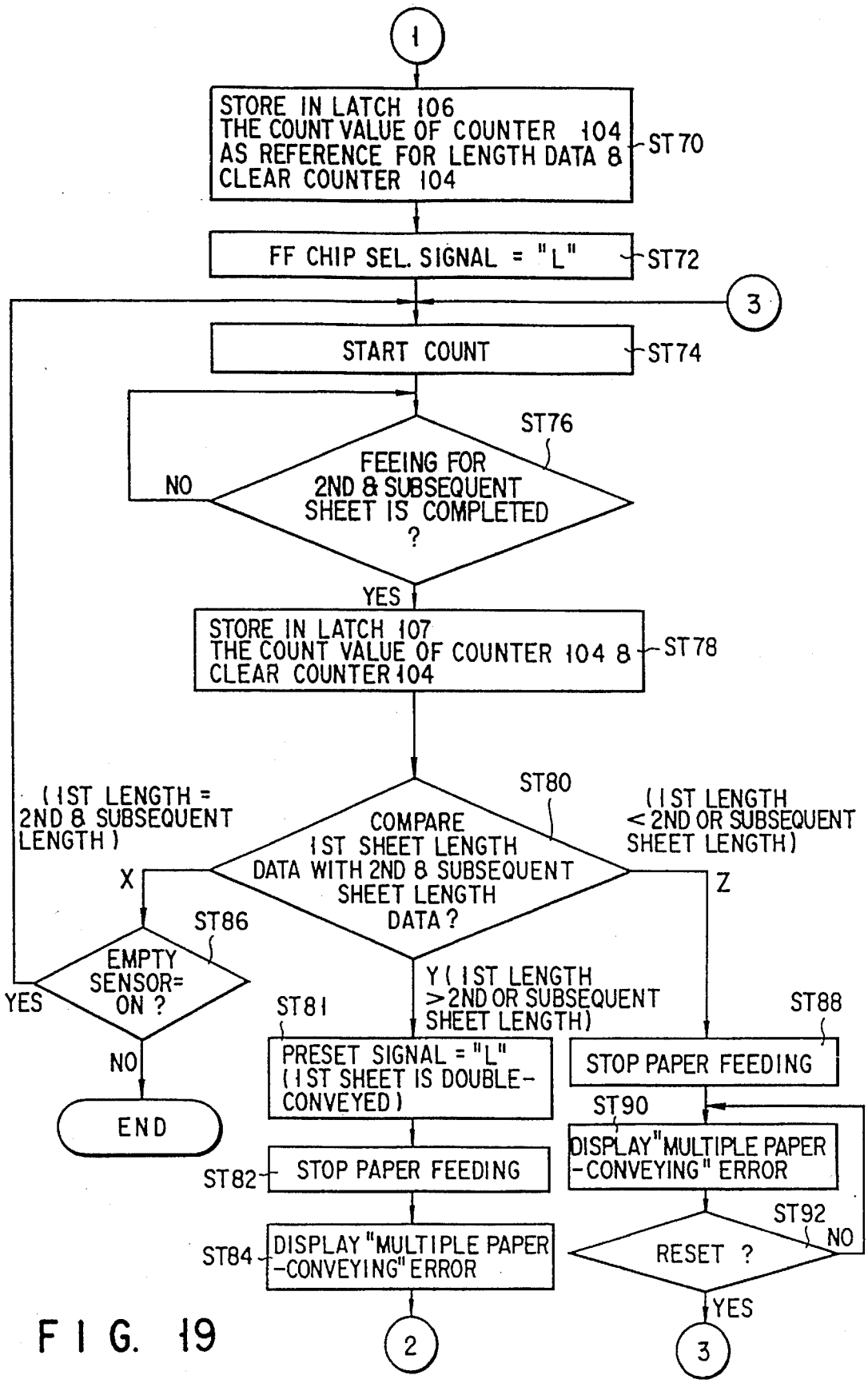
FIG. 19 is a flow chart for explaining the multiple paper-conveying detection during feeding for the original.

When the preset signal is not supplied from controller 61 to FF 105 upon occurrence of multiple paper-conveying during feeding for a plurality of originals O, the reference data in latch 106 is replaced with length data, as a reference value, for the first original O prior to multiple paper-conveying. A control sequence of this case will be described with reference to the flow charts of FIGS. 16 and 19.

More specifically, after the power ON of the apparatus, and when feeding for first original O is completed (YES in ST26 of FIG. 16), digitized output E101 returns to "H" level (ST28). This "H" signal E101 is inverted to signal E103 of "L" level by inverter 103. Signal E103 is input to counter 104 and latch 106. At this time, count value D104 of counter 104 is stored in latch 106, and counter 104 is then immediately cleared (ST70 of FIG. 19).

When delay pulse generator 102 is triggered with "H" signal E101, delay pulse generator 102 generates pulse E102 for clearing FF 105 with a predetermined delay time. FF 105 is cleared to output chip select signal E105 of "L" level (ST72). In response to this "L" signal E105, latch 107 is set in a latch enabled state, and latch 106 is set in a latch disabled state.

When the leading edge of second original O then reaches the portion between feeding roller 35 and aligning roller 34, digitized output signal E101 goes to "L" level, and counter 104 starts to count the master clock pulses (ST74).

When feeding for second original O is completed (YES in ST76), digitized output E101 returns to "H" level. At this time, count value D104 of counter 104 is stored in latch 107, and counter 104 is immediately cleared (ST78).

As described above, when the count value (first length data 1) of first original O and the count value (second length data 2) of second original O are stored in latches 106 and 107, respectively, comparator 109 compares data 1 and 2 (ST80).

If data 1>data 2 (Y in ST80), multiple paper-conveying of first original O is detected, and controller 61 outputs a preset signal of "L" level (ST81). Paper feeding is immediately stopped (ST82), and a multiple paper-conveying error is displayed on a display unit (not shown) of the apparatus (ST84).

If data 1<data 2 (Z in ST80), multiple paper-conveying of second original O is detected. In this case, paper feeding is immediately stopped (ST88), and a multiple paper-conveying error is displayed on the display unit (not shown) of the apparatus (ST90). When original O having been subjected to multiple paper-conveying is correctly reset (YES in ST92), operations from step ST74 are restarted.

If data 1=data 2 (X in ST80), any multiple paper-conveying error is not detected. If sheets to be fed are still left, and empty sensor 29 is kept on (YES in ST86), operations in steps ST74 to ST80 are repeated.

Multiple paper-conveying of first original O upon release of multiple paper-conveying can be immediately detected.

An embodiment will be described below wherein a thickness detector detects the thickness of original O on the basis of an output signal (voltage value) from ADC 74 in FIG. 1 so as to determine the conveyed state of original O in accordance with the detection result of this thickness detector. In this case, as shown in FIG. 1, thickness detector 76 is connected between ADC 74 and controller 61.

Thickness detector 76 detects the thickness of fed original O in accordance with digital value E74 from ADC 74 which corresponds to a change in voltage value E73 from detector 73, which change is obtained with a change in resistance value of feeding roller 35. Thickness detector 76 outputs, to controller 61, detection signal E76 representing whether the thickness of second or subsequent original O is larger than a reference thickness on the basis of the thickness of first original O as the reference thickness. Thickness detector 76 also outputs, to controller 61, detection signal E76 representing whether the thickness of first original O is larger than that of second original O.

Controller 61 determines a conveying abnormality of original O in accordance with detection signal E76 from thickness detector 76. For example, when controller 61 receives, from thickness detector 76, detection E76 signal representing that the thickness of second or subsequent original O is larger than the reference thickness, controller 61 determines multiple paper-conveying of second or subsequent original O. However, when controller 61 receives, from thickness detector 76, a detection signal representing that the thickness of first original O is larger than that of second original O, controller 61 determines multiple paper-conveying of first original O.

Figure 32:
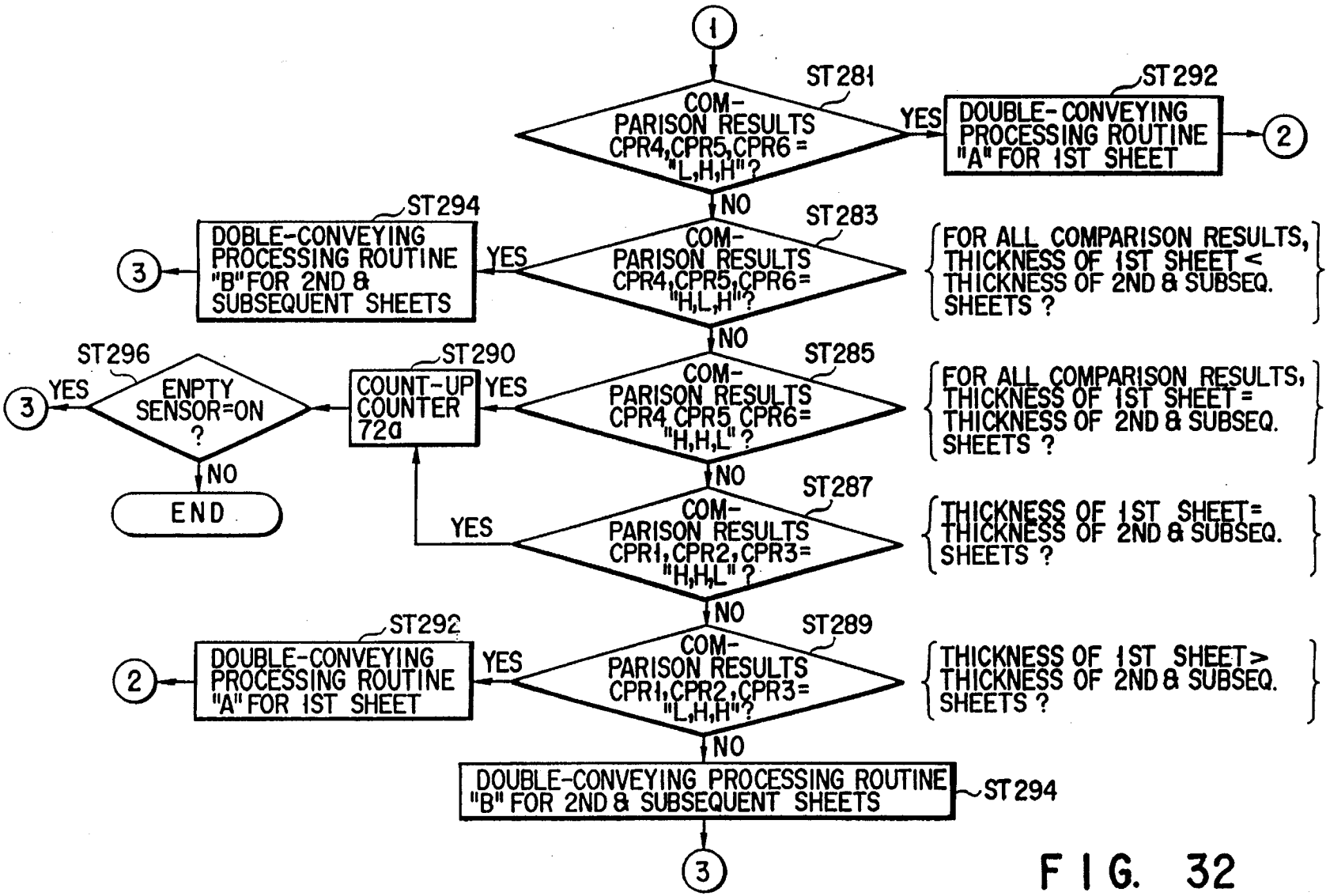
FIG. 32 is a flow chart for explaining the multiple paper-conveying detection during feeding for the original.

As shown in FIG. 32, thickness detector 76 comprises digitizer 111, delay pulse generator 112, FF 113, delay circuits 114 and 115, inverters 116 and 120, address counter 117, RAM 118, and comparator 119. Detector 76 has a function of ADC 74.

Digitizer 111 digitizes voltage value E73 from detector 73 to output detection signal E111 representing that original O is passing through feeding roller 35, as shown in FIG. 15A. When original O is present between feeding roller 35 and aligning roller 34, digitizer 111 outputs signal E111 of "L" level. Otherwise, digitizer 111 outputs signal E111 of "H" level. Digitized output E111 from digitizer 111 is supplied to delay pulse generator 112.

When digitized output (passing detection signal) E111 from digitizer 111 is switched (from "L" to "H"), delay pulse generator 112 outputs delay pulse E112 shown in FIG. 15B. This delay pulse E112 is output to FF 113.

FF 113 is a D flip-flop whose data input terminal D and clock input terminal CLK are set at "H" level. Delay pulse E112 from delay pulse generator 112 is supplied to clear input terminal CLR of FF 113, and a preset signal ("L") is supplied from controller 61 to preset input terminal PRE of FF 113. Preset input terminal PRE is normally set at "H" level, as shown in FIG. 15D.

FF 113 outputs chip select signal (Q output) E113 of "H" level until the first delay pulse (E112) is input from delay pulse generator 112, as shown in FIG. 15C. Upon reception of first delay pulse E112, chip select signal E113 is set at "L" level. That is, when first original O has passed through roller 35, chip select signal E113 goes from "H" level to "L" level and is then held at "L" level.

When the preset signal of "L" level is input from controller 61, chip select signal E113 goes to "H" level again.

Chip select signal E113 from FF 113 is supplied to delay circuit 115. At the same time, chip select signal E113 is inverted by inverter 116, and the inverted signal is supplied to delay circuit 114.

Delay circuits 114 and 115 have a latch function of temporarily storing digital values from ADC 74. The digital value stored in each delay circuit is delayed by a predetermined period of time, and each delay circuit outputs a delayed signal. Output D114 from delay circuit 114 is supplied to RAM 118, and output D115 from delay circuit 115 is supplied to comparator 119. Use of delay circuit 115 allows thickness detection even if conveying timings of second and subsequent originals O are shifted.

When address counter 117 receives a start signal which is simultaneously output with rotation start designation from controller 61 to feeding roller 35 for original O, i.e., when a signal obtained by inverting output E111 from digitizer 111 by inverter 120 goes to "H" level, address counter 117 counts the master clock pulses from oscillator 1000. When the count value of address counter 117 reaches a predetermined count value, address counter 117 outputs an address to RAM 118. The address generated by address counter 117 serves as a write address for first original O and a read address for second or subsequent original O.

The inverted level of output E111 from digitizer 111 is supplied to the clear terminal of counter 117 through inverter 120. If original O is absent, an output from inverter 120 is set at "0" level, and the count value is cleared to "0".

When a write signal is supplied from controller 61 to RAM 118, and address data D117 is supplied from address counter 117 to RAM 118, RAM 118 stores digital value D114 from delay circuit 114 at the address of D117. Therefore, thickness data at a predetermined position of first original O is stored. When a read signal is supplied from controller 61 to RAM 118, data at the address (D117) designated by address counter 117 is read out to comparator 119.

Comparator 119 incorporates a subtracter and compares data, having a predetermined range which is determined by thickness data D118 of first original O supplied from RAM 118, with thickness data of second or subsequent original O. Comparator 119 outputs, to controller 61, a signal (CPR6) representing that the thickness of second or subsequent original O is equal to that of first original O, a signal (CPR5) representing that the thickness of second or subsequent original O is larger than that of first original O, or a signal (CPR4) representing that the thickness of first original O is larger than that of second or subsequent original O.

For example, comparator 119 outputs 3-bit comparison results CPR4, CPR5, and CPR6. When the thickness of first original O is larger than that of second or subsequent original O, comparator 119 sets comparison result CPR4 to "L" level. If the thickness of second or subsequent original O is larger than that of first original O, comparator 119 sets comparison result CPR5 to "L" level. When the thickness of second or subsequent original O is equal to that of first original O, comparator 119 sets comparison result CPR6 to "L" level.

Comparator 119 may be connected to controller 61 through three signal lines or a tristate signal line.

Figure 21:
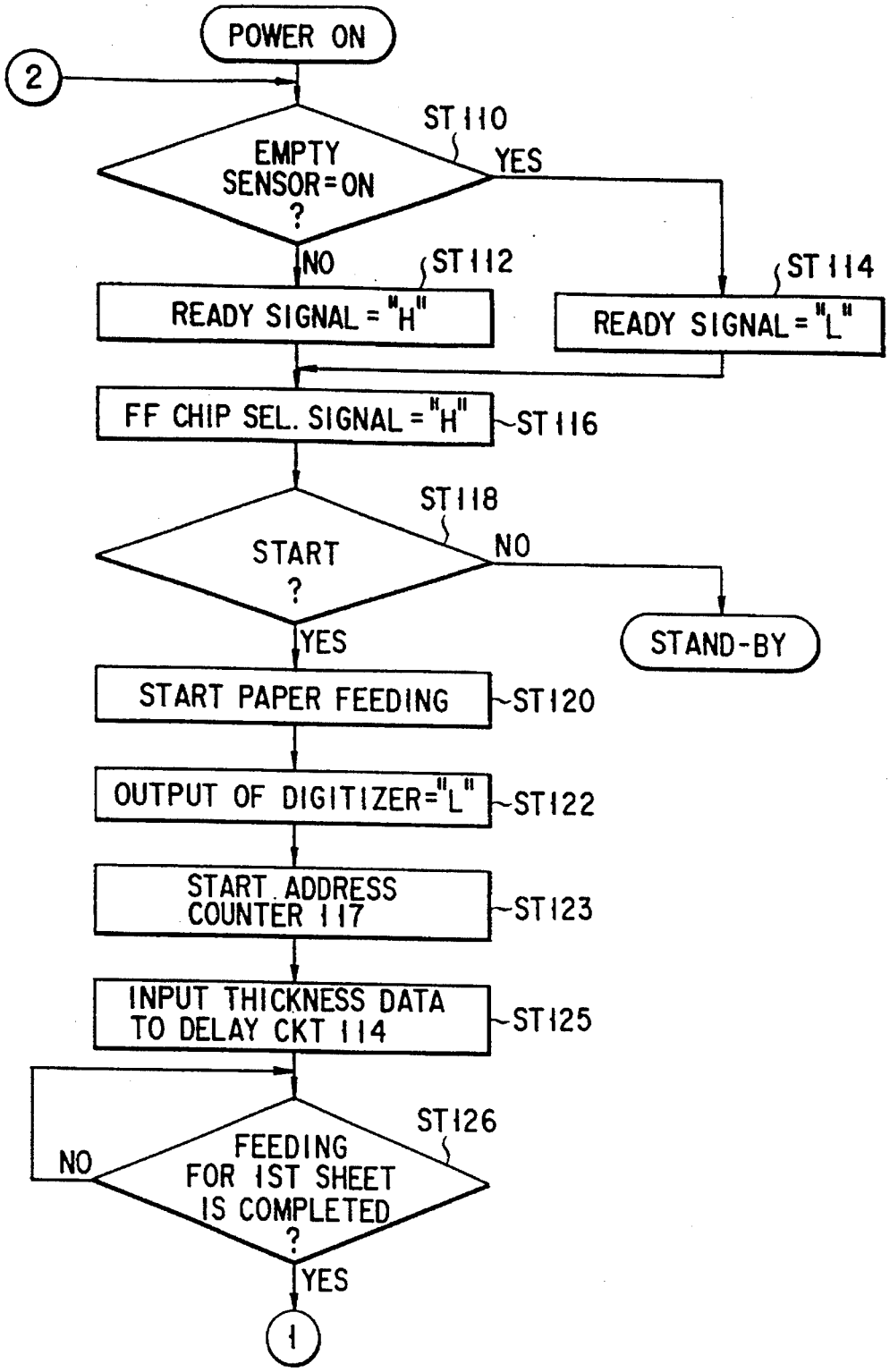
FIG. 21 is a flow chart for explaining multiple paper-conveying detection during feeding for an original.
Figure 22:
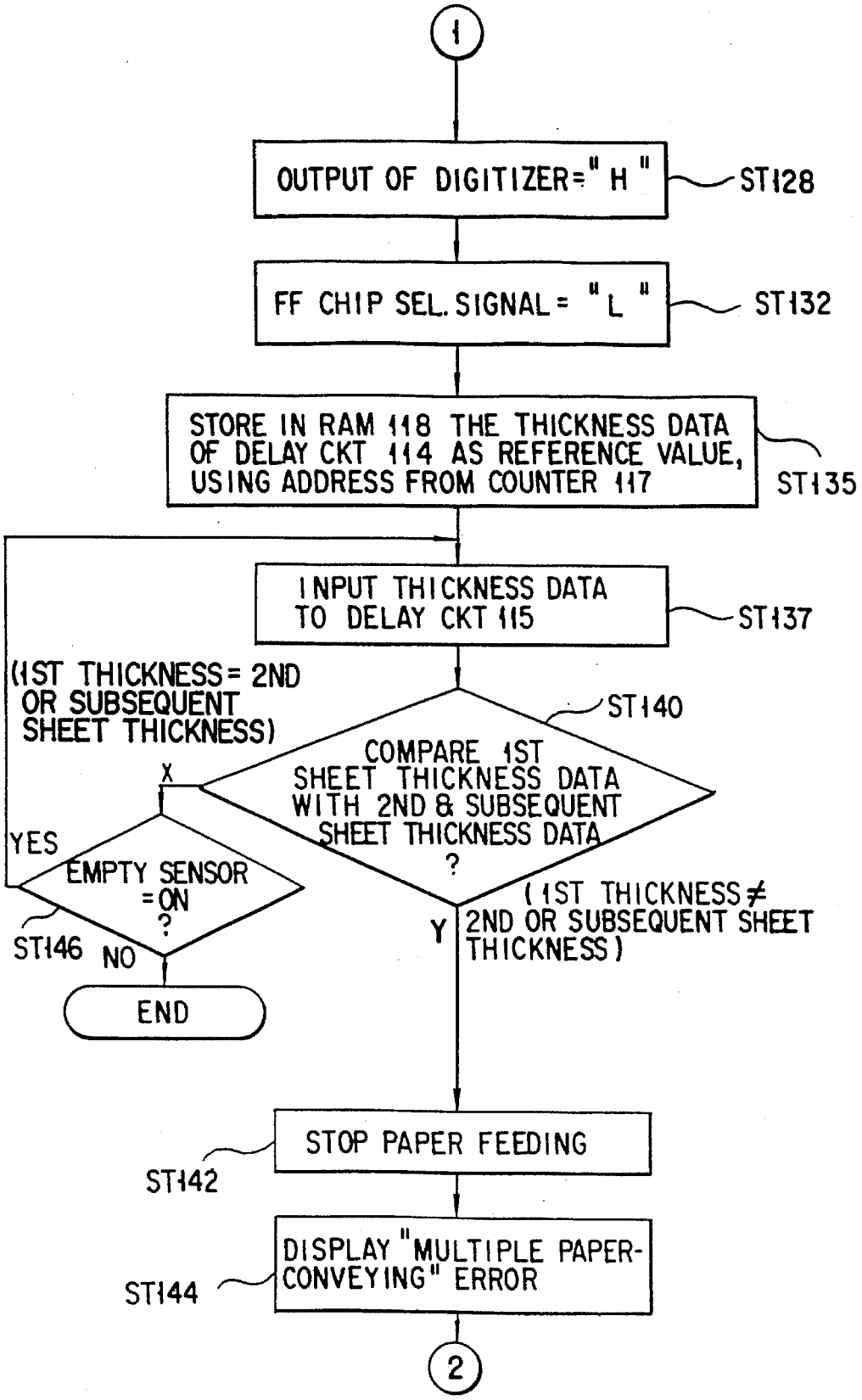
FIG. 22 is a flow chart for explaining the multiple paper-conveying detection during feeding for the original.

The operation of the arrangement shown in FIG. 20 will be described with reference to flow charts in FIGS. 21 and 22.

Assume that a plurality of originals O are set (placed) on original feeding table 22 (FIG. 13A) so as to abut against shutter 26. By this setting of the sheets, actuator 30 is pivoted to turn on empty sensor 29 (YES in ST110) and output a ready signal of "L" level (ST114). If the sheets run out, sensor 29 is turned off (NO in ST110) to output a ready signal of "H" level (ST112). Chip select signal E113 from FF 113 is then preset to "H" level (ST116).

Necessary information is then input from operation panel 52, and copy key 52*c* is depressed (YES in ST118), thereby starting paper feeding (ST120). Controller 61 turns on shutter solenoid 68 and weight board solenoid 70. As a result, weight board 28 prevents original O from floating, and shutter 26 is retracted from feeding path 25.

Controller 61 designates to transmit a rotational force of feeding motor 62 to pickup roller 27, paper feed roller 31, and separation belt 33 so as to rotate them. Lowermost original O on original feeding table 22 is picked up and fed. At the same time, original O is fed to the lower-surface side of original conveyor belt 37, driven in the feeding direction, through a resist roller pair being formed of aligning roller 34 and feeding roller 35.

When first original O passes between aligning roller 34 and feeding roller 35, data corresponding to the thickness of first original O is stored as a reference value in RAM 118 in thickness detector 76.

When the leading edge of first original O reaches a portion between feeding roller 35 and aligning roller 34, digitizer 111 outputs signal E111 of "L" level in accordance with a voltage value detected by detector 73 (ST122). Counter 117 starts to count the clock pulses from oscillator 1000 (ST123). In this case, chip select signal E113 from FF 113 is set at "H" level, and a digital value corresponding to the voltage value of detector 73 is supplied from ADC 74 to delay circuit 114. This digital value is stored in delay circuit 114 in response to the inverted level of the "H" level of signal E113 (ST125).

When the trailing end of first original O has passed through feeding roller 35 and aligning roller 34 (YES in ST126), digitizer 111 outputs signal E111 of "H" level in accordance with the voltage value detected by detector 73 (ST128). Counter 117 is cleared in response to signal E120 obtained by inverting "H" level signal E111 by inverter 120. When signal E111 of "H" level is output from digitizer 111, delay pulse E112 is generated by delay pulse generator 112. Then, FF 113 is cleared, and chip select signal E113 is set to "L" level (ST132).

When first original O is normally fed onto original table 2, the trailing edge of original O is detected by resist sensor 36 or feeding roller 35, and original conveyor belt 37 is driven by a predetermined number of pulses. Thereafter, in order to abut first original O against original stopper 2*a*, original conveyor belt 37 is driven by the predetermined number of pulses in the reverse direction so as to cause original O to return, thereby completely setting original O.

When address data D117 is supplied from counter 117 to RAM 118 and a write signal is supplied from controller 61 to RAM 118, RAM 118 stores digital value D114 from delay circuit 114 at the address of D117. As a result, the thickness data of first original O is stored in RAM 118 as the reference value (ST135).

When first original O is completely set, original scanning is performed by original scanner unit 3 in copying machine main body 1. By this scanning, copying is performed on a original serving as transfer paper by image forming unit 4.

When original scanning by original scanner unit 3 is completed, first original O is fed out from original table 2 upon driving original conveyor belt 37. Original O is then discharged on paper discharge tray 39 through paper discharge means 38.

When first original O having been copied is fed out from original table 2, second original O is fed from original feeding table 22 to original table 2.

When second original O has passed through aligning roller 34 and feeding roller 35, data corresponding to the thickness of second original O is compared with the reference value corresponding to the thickness of first original O. This comparison result is output to controller 61.

More specifically, when the leading edge of second original O reaches the portion between feeding roller 35 and aligning roller 34, digitizer 111 outputs signal E111 of "L" level in accordance with the voltage value detected by detector 73. Counter 117 starts to count the clock pulses from oscillator 1000 in response to signal E111 of "L" level. In this case, chip select signal E113 of FF 113 is set at "L" level, and the digital value corresponding to the voltage value of detector 73 is supplied from ADC 74 to delay circuit 115. This digital value is stored in delay circuit 115 (ST137).

Thickness data D115 of the second original latched by delay circuit 115 is supplied to comparator 119. When address data D117 is supplied from counter 117 to RAM 118 and a read signal is supplied from controller 61 to RAM 118, data (reference thickness data) D118 stored in the address of D117 is read out from RAM 118 and output to comparator 119.

Comparator 119 compares data in a predetermined range, which is determined based on thickness data D118 of first original O from RAM 118, with thickness data D115 of second original O from delay circuit 115. If the thickness of the first original O is larger than that of second original O (Y at ST140), comparator 119 sets comparison result CPR4 to "L" level. When the thickness of second original O is larger than that of first original O (Y at ST140), comparator 119 sets comparison result CPR5 to "L" level. When the thickness of second original O is equal to that of first original O, comparator 119 sets comparison result CPR6 to "L" level (X at ST140).

When controller 61 receives, from thickness detector 76, a detection signal (CPR5="L") representing that the thickness of second original O is larger than that of first original O, controller 61 determines multiple paper-conveying of second original O. However, when controller 61 receives, from thickness detector 76, a detection signal (CPR4="L") representing that the thickness of first original O is larger than that of second original O, controller 61 determines multiple paper-conveying of first original O.

When controller 61 determines multiple paper-conveying in accordance with the detection signal from thickness detector 76, controller 61 stops the feeding operation (ST142) and outputs a multiple paper-conveying detection signal to main control unit 51 (ST144). Therefore, the main control unit 51 displays multiple paper-conveying on display unit 52*a* of operation panel 52.

When thickness detector 76 outputs a detection signal (CPR6="L") representing that the thickness of second original O is equal to that of first original O, controller 61 performs original scanning and paper discharge processing for second original O. At the same time, third original O is fed from original feeding table 22 to original table 2.

Multiple paper-conveying of third and subsequent sheets is determined in the same manner as described above (YES in ST146).

When a preset signal from controller 61 is not supplied to FF 113 upon occurrence of multiple paper-conveying during feeding for a plurality of originals O, the reference thickness data in RAM 118 is updated as the thickness data for first original O prior to multiple paper-conveying, and the updated reference thickness data is stored and held in RAM 118. This operation is shown in flow charts in FIGS. 23 and 24.

More specifically, during the OFF period of empty sensor 29 upon power-ON operation of the apparatus (NO in ST150), the ready signal is set at "H" level (ST152). When the turn-ON operation of empty sensor 29 is detected (YES in ST150), the ready signal goes to "L" level (ST154). FF 113 in FIG. 32 is then preset in response to the preset signal from controller 61, and FF 113 outputs chip select signal E113 of "H" level (ST156). This "H" signal E113 is inverted to signal E116 of "L" level through inverter 116. Delay circuit 114 is enabled in response to signal E116. In this case, delay circuit 115 is disabled.

In this state, for example, when the copy start key of the copying machine is depressed (YES in ST158), automatic paper feeding is started (ST160). When the leading edge of first original O reaches the portion between feeding roller 34 and aligning roller 34, output signal E111 from digitizer 111 goes to "L" level (ST162). This "L" signal E111 is inverted to signal E120 of "H" level by inverter 120. Signal E120 is then input to address counter 117. Address counter 117 starts to count the predetermined master clock pulses (ST163). At this time, delay circuit 114 set in an enabled state receives the digital value (thickness data of first original O) from ADC 74 (ST165).

When feeding for first original O is completed (YES in ST166), digitized output E111 returns to "H" level (ST168). When this "H" signal E111 is supplied to delay pulse generator 112, delay pulse generator 112 outputs signal E112 to FF 113 to clear FF 113. FF 113 then outputs chip select signal E113 of "L" level (ST172).

"H" signal E111 is inverted to "L" signal E120 by inverter 120, and signal E120 is output to counter 117. The current count value (address data D117) of counter 117 is output to RAM 118. At this time, RAM 118 receives thickness data D114 of first original O from delay circuit 114. When a write signal is input from controller 61 to RAM 118, thickness data D114 of first original O is written at the address specified by address data D117 (ST175).

At this time, delay circuit 115 is disabled because FF 113 outputs chip select signal E113 of "L" level. Therefore, the digital value (thickness data of second or subsequent original O) output from ADC 74 is input to delay circuit 115 set in the enabled state (ST177).

When count value (=first thickness data 1) D118 of first original O and count value (=second length data 2) D115 of second or subsequent original O are read out from RAM 118 in accordance with read signals from controller 61, data 1 and 2 are compared by comparator 119 (ST180).

If data 1>data 2 (Y in ST180), multiple paper-conveying of first original O is detected, and controller 61 outputs a preset signal of "L" level to FF 113 (ST181). Paper feeding is immediately stopped (ST182), and a multiple paper-conveying error is displayed on a display unit (not shown) of the apparatus (ST184). Then, chip select signal E113 goes to "H" level, and delay circuit 114 is disabled. The flow returns to the initial state in step ST150.

If data 1<data 2 (Z in ST180), multiple paper-conveying of second or subsequent original O is detected. In this case, paper feeding is immediately stopped (ST188), and a multiple paper-conveying error is displayed on the display unit (not shown) of the apparatus (ST190). When original O having been subjected to multiple paper-conveying is correctly reset (YES in ST192), operations from step ST177 are restarted.

If data 1=data 2 (X in ST180), any multiple paper-conveying error is not detected. If sheets to be fed are still left, empty sensor 29 is kept on (YES in ST186), so that operations in steps ST177 to ST180 are repeated.

As mentioned above, multiple paper-conveying of first original O upon release of multiple paper-conveying can be immediately detected.

In the above embodiment, the reference thickness data for first original O in thickness detector 76 is stored using delay circuit 114, counter 117, and RAM 118. However, storage of the reference thickness data may be performed using a latch circuit selected in response to chip select signal E113.

When multiple paper-conveying is detected based only on the thickness data, original O on which a photograph or the like is adhered may be erroneously detected as a sheet having been subjected to multiple paper-conveying.

To solve this problem, multiple paper-conveying detection using both length and thickness data will be described below.

Figures 25A, 25B, 25C:
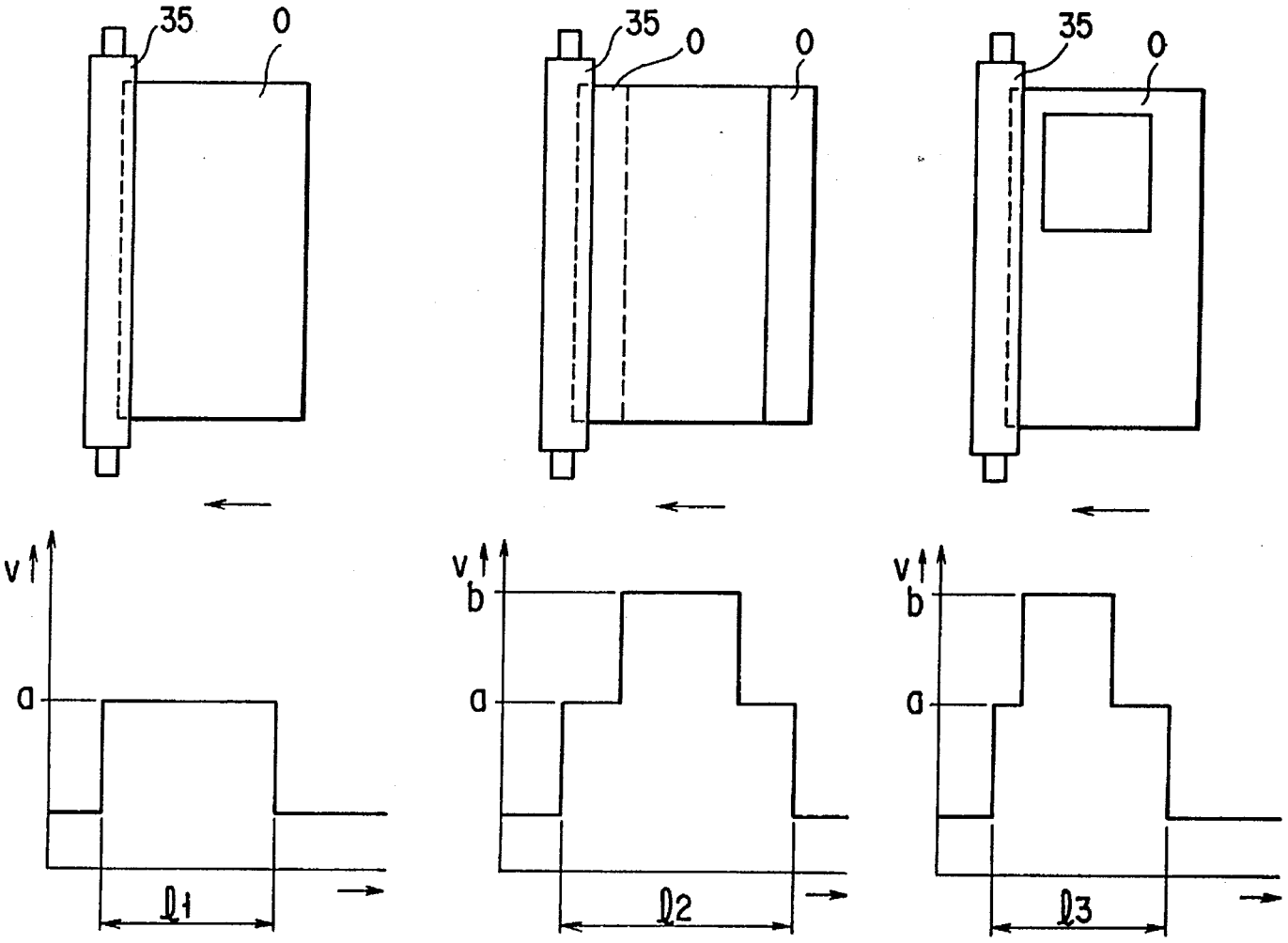
FIGS. 25A to 25C are views for explaining relationships between the conveyed states of originals and output signals corresponding to the thicknesses of the originals.

FIGS. 25A to 25C show detection outputs from length detector 75 when normal original O, original O having been subjected to multiple paper-conveying, and patched original O pass through aligning roller 34 and feeding roller 35.

In FIGS. 25A to 25C, the thickness of a patched photograph and the like is regarded as the same thickness as that of reference original O. However, the same effect can be obtained even if the thickness of the patched photograph is regarded to be different from that of reference original O.

Assume that the lengths of normal original O, original O having been subjected to multiple paper-conveying, and patched original O are defined as l1, l2, and l3. In this case, the length of patched original O is equal to that of reference original O. However, at the time when multiple paper-conveying occurs, two sheets rarely perfectly overlap each other. For this reason, the length of detected original O is almost always larger than that of reference original O.

That is, l1=l3 and l2>l1.

Multiple paper-conveying can also be detected by detection of only the length.

More specifically,

If l1=l3, then a sheet is detected as a patched sheet.

If l2>l1, then a sheet is detected to be multiple paper-conveying.

When the conveyed state of original O is determined using these two different detection results, even if originals O having different lengths are fed, multiple paper-conveying, patching, and normal feeding can be accurately determined.

In the following, an embodiment will be described wherein a conveyed state is detected during feeding for patched original O or originals O having different lengths, using the two detection results, i.e., the detection result of the length of original O by length detector 75 and the detection result of the thickness of original O by thickness detector 76.

More specifically, if the conditions (reference thickness data)>(thickness data of target object) and (reference length data)>(length data of target object) are detected, then multiple paper-conveying of the target object (0) is determined. If the conditions (reference thickness data)>(thickness data of target object) and (reference length data)=(length data of target object) are detected, then the target object (original O), is determined as a patched sheet. If (reference thickness data)=(thickness data of target object) and (reference length data)=(length data of target object) are detected, then the target object (O) is determined as the reference sheet.

The relationship between the comparison results (CPR1 to CPR3) from comparator 109 in length detector 75 and the comparison results (CPR4 to CPR6) from comparator 119 in thickness detector 76 is shown in Table 1 below.

TABLE 1

| | (First sheet) > (Second or subsequent sheet) | (First sheet) < (Second or subsequent sheet) | (First sheet) = (Second or subsequent sheet) |
|---|---|---|---|
| | Length | | |
| CPR1 | L | H | H |

TABLE 1-continued

| | (First sheet) > (Second or subsequent sheet) | (First sheet) < (Second or subsequent sheet) | (First sheet) = (Second or subsequent sheet) |
|---|---|---|---|
| | Length | | |
| CPR2 | H | L | H |
| CPR3 | H | H | L |
| | Thickness | | |
| CPR4 | L | H | H |
| CPR5 | H | L | H |
| CPR6 | H | H | L |

If (length of first original O)>(length of second or subsequent original O) and (thickness of first original O)>(thickness of second or subsequent original O), then first original O is determined as a sheet having been subjected to multiple paper-conveying. If (thickness of second or subsequent original O)>(length of first original O) and (thickness of second or subsequent original)>(thickness of first original O), then second or subsequent original O is determined to have been subjected to multiple paper-conveying. If (length of first original O)>(length of second or subsequent original O) and (thickness of second or subsequent original O)>(thickness of first original O), then the thickness and size of second or subsequent original O are determined to be different from those of reference original O. If (length of sequent or subsequent original O)>(length of first original O) and (thickness of first original O)>(thickness of second or subsequent original O), then the thickness and size of first original O are determined to be different from those of the reference original O. If (length of first original O)=(length of second or subsequent original O) and (thickness of first original O)>(thickness of second or subsequent original O), then the first sheet is determined to be a patched sheet. If (length of first original O)=(length of second or subsequent original O) and (thickness of second or subsequent original O)>(thickness of first original O), then the second or subsequent sheet is determined to be a patched sheet. If (length of first original O)=(length of second or subsequent original O) and (thickness of second or subsequent original O)=(thickness of first original O), then the first and second sheets are determined as reference originals O.

Only two conditions are established to stop the feeding operation of automatic paper feeding apparatus 20 upon determination of an abnormality based on the above conditions.

Figure 26:
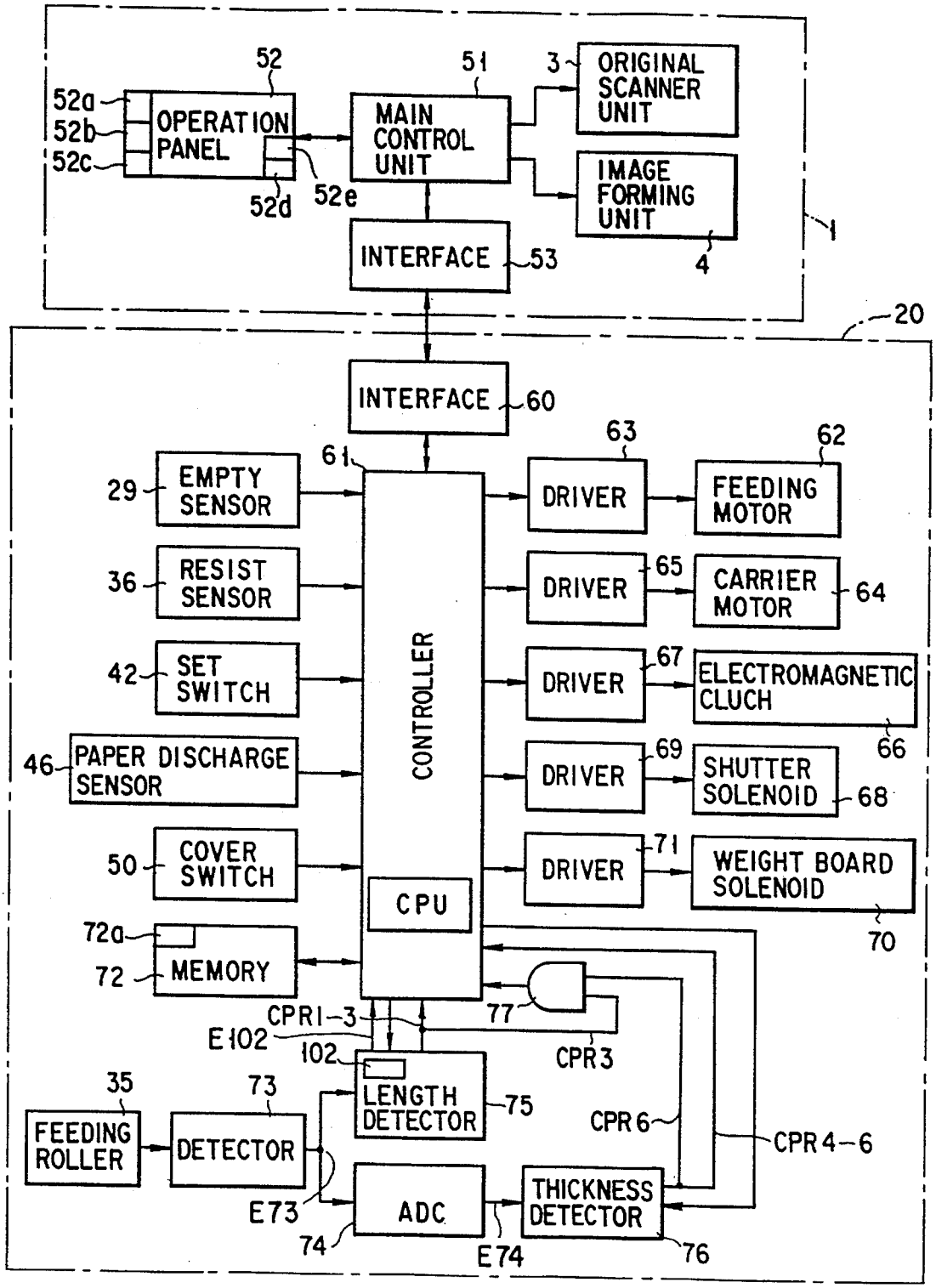
FIG. 26 is a block diagram showing a control circuit having a length detector.

If an AND (logical AND) signal of comparison result CPR3 from comparator 109 and comparison result CPR6 from comparator 119 is connected to an interrupt input of controller 61, multiple paper-conveying detection for sheets including patched original O can be performed. For example, as shown in FIG. 26, an AND output of comparison results CPR3 and CPR6 is supplied from AND gate 77 to controller 61.

The contents of the AND signals are summarized in Table 2 below.

TABLE 2

| CPR3 | CPR6 | AND Output |
|---|---|---|
| L | L | L |
| L | H | L |
| H | L | L |
| H | H | H |

That is, when an AND output is set at "H" level, controller 61 determines multiple paper-conveying (abnormality).

When the abnormality is released to restart the operation, controller 61 determines in accordance with comparison results CPR1, CPR2, CPR4, and CPR5 whether the data of the first sheet of a re-feed mode is updated as the reference data or the reference data of the first sheet in the previous feeding is held as the reference data.

More specifically, when controller 61 determines or detects multiple paper-conveying of the first sheet from comparison results CPR1, CPR2, CPR4, and CPR5, controller 61 determines updating using first original O of the re-feed mode with respect to the reference data stored in latch 106 in length detector 75 and the reference data stored in RAM 118 in thickness detector 76. Therefore, the reference data is updated using first original O of the re-feed mode, and the length and thickness of another original O are compared with those of the reference data.

When controller 61 determines from comparison results CPR1, CPR2, CPR4, and CPR5 that multiple paper-conveying does not occur in the first sheet, controller 61 confirms holding of the reference data stored in latch 106 in length detector 75 and the reference data stored in RAM 118 in thickness detector 76. Therefore, the length and thickness of original O in the re-feed mode are determined with reference to the above reference data.

The operation in the above case will be described with reference to flow charts in FIGS. 27 and 28.

Figure 20:
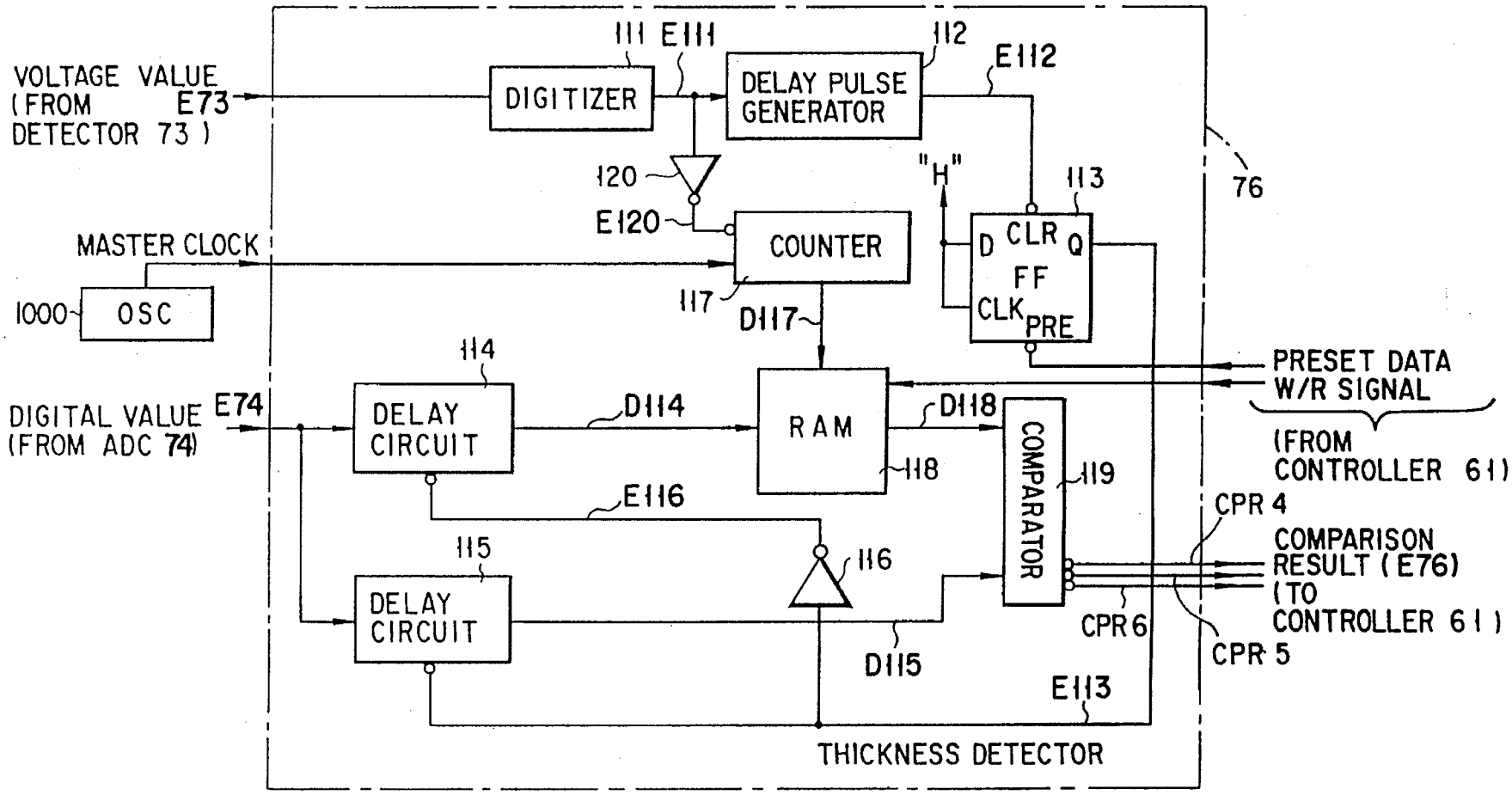
FIG. 20 is a schematic block diagram of the thickness detector.
Figure 27:
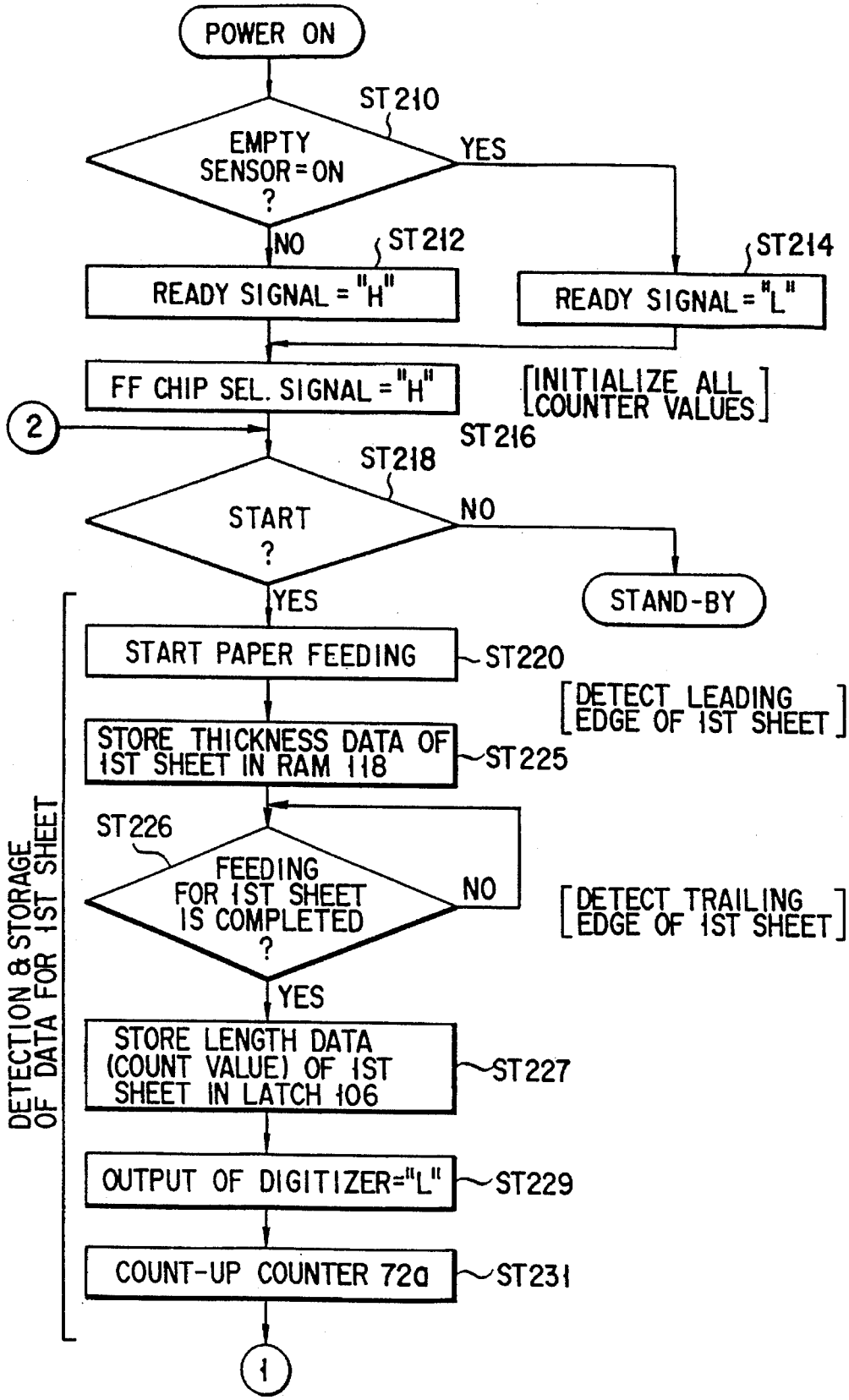
FIG. 27 is a flow chart for explaining multiple paper-conveying detection during feeding for an original.
Figure 28:
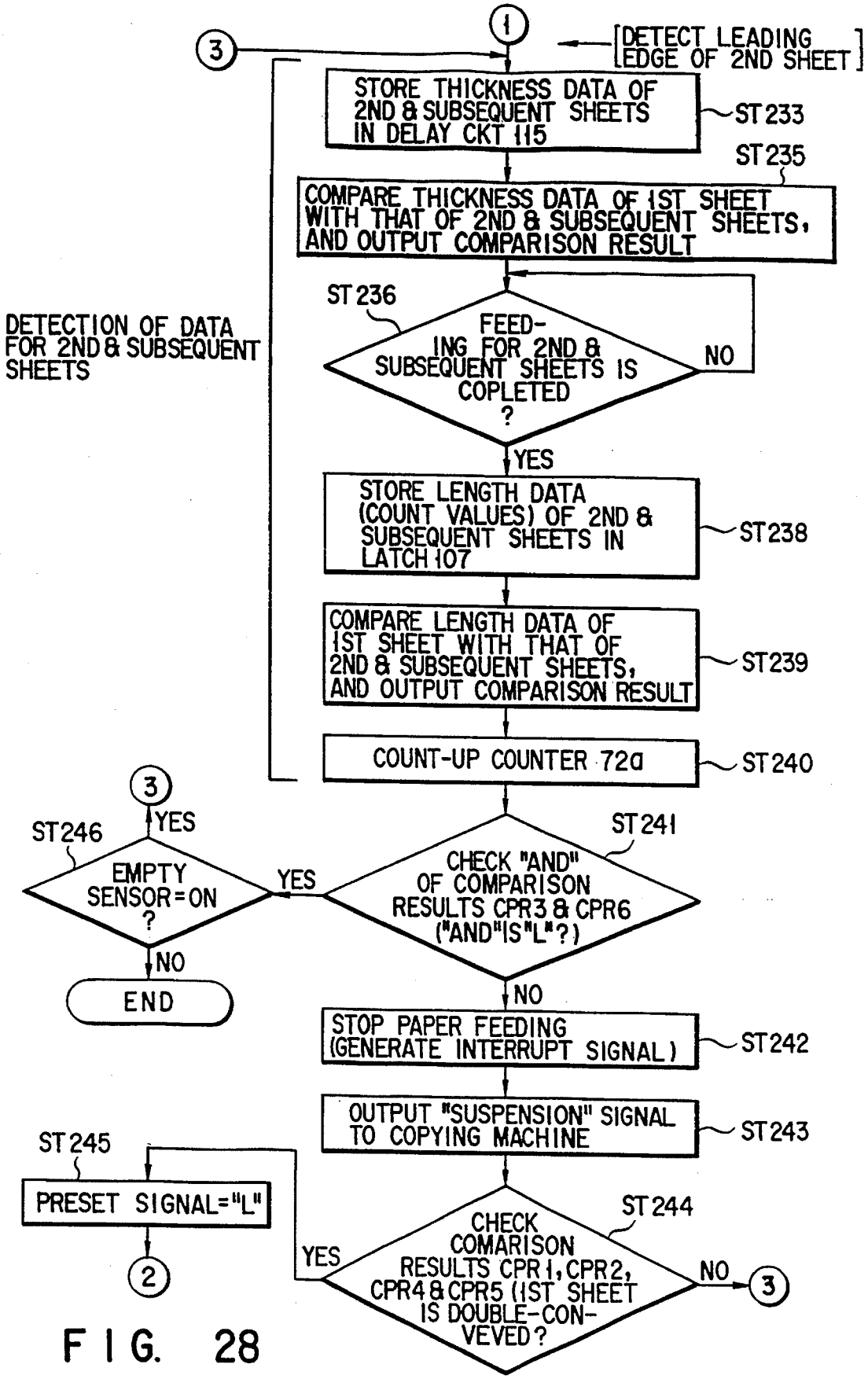
FIG. 28 is a flow chart for explaining the multiple paper-conveying detection during feeding for the original.

The processes in FIGS. 27 and 28 can be executed using both the arrangements shown in FIGS. 14 and 20.

During the OFF period of empty sensor 29 upon power-ON operation of the apparatus (NO in ST210), the ready signal is kept at "H" level (ST212). When the turn-ON operation of empty sensor 29 is detected (YES in ST210), the ready signal goes to "L" level (ST214).

FF 105 (FIG. 14) and FF 113 (FIG. 20) are preset in response to the preset signals from controller 61 and output chip select signals E105 and E113 of "H" level (ST216). In this case, the count values of counter 104 (FIG. 14) and counter 117 (FIG. 20) are cleared to an initial value (e.g., they are cleared to zero).

"H" signal E105 is inverted to "L" signal E108 through inverter 108 to enable latch 106. In this case, latch 107 is disabled.

"H" signal E113 is inverted to an "L" signal through inverter 116 to enable delay circuit 114. In this case, delay circuit 115 is disabled.

For example, when the copy start button of the copying machine is depressed (YES in ST218), automatic paper feeding is started (ST220). When the leading edge of first original O reaches the portion between feeding roller 35 and aligning roller 34, output signals E101 and E111 from digitizers 101 and 111 go to "L" level (detection of the leading edge of the first sheet).

"L" signal E111 in FIG. 20 is inverted to "H" signal E120 by inverter 120, and signal E120 is input to address counter 117. Address counter 117 starts to count the master clock pulses. At this time, the digital value (thickness data of first original O) is input from ADC 74 to delay circuit 114 which is set in the enabled state. Thickness data D114 of first original O input to delay circuit 114 is stored in RAM 118 at the address specified by current count value D117 of counter 117 (ST225).

When paper feeding for first original O is completed (YES in ST226), digitized outputs E101 and E111 return to "H" level. The trailing edge of first original O is detected in accordance with this change in level from "L" to "H" level of signal E101.

When "H" signal E101 in FIG. 14 is input to delay pulse generator 102, delay pulse generator 102 outputs signal E102 to FF 105 to clear FF 105. FF 105 outputs chip select signal E105 of "H" level. This "H" signal E105 is inverted to "L" signal E108 by inverter 108, and signal E108 enables latch 106.

"H" signal E101 is inverted to "L" signal E103 by inverter 103, and this "L" signal E103 is input to counter 104 and latch 106. Current count value (length data of original O) D104 of counter 104 is stored in latch 106 set in the enabled state (ST227).

When the leading edge of second original O is detected to set outputs E101 and E111 from digitizers 101 and 111 to "L" level (ST229), counter 72*a* (FIG. 26) for counting a change in level of output E101 or E111 is incremented by one (ST231).

Steps ST220 to ST231 constitute a data detection/data storage process for first original O. When the leading edge of second original O reaches the portion between feeding roller 35 and aligning roller 34, output signals E101 and E111 from digitizers 101 and 111 go to "L" level again (i.e., the leading edge of the second original is detected).

"L" signal E111 in FIG. 20 is inverted to "H" signal E120 by inverter 120, and signal E120 is input to address counter 117. Address counter 117 starts to count the master clock pulses. FF 113 keeps to output chip select signal E113 of "L" level to delay circuit 115 until FF 113 is delayed by the delay time of delay pulse generator 112. Therefore, the digital value (thickness data of second original O) from ADC 74 is stored in delay circuit 115 which is set in the enabled state (ST233).

Thickness data D118 of first sheet read out from RAM 118 on the basis of address data D117 from counter 117 is supplied to comparator 119. Thickness data of second original O which is stored in delay circuit 115 is also supplied to comparator 119. Comparator 119 compares the thickness data of first original O with the thickness data of second original O. Comparator 119 outputs comparison results CPR4 to CPR6 to controller 61 (ST235).

When paper feeding for second original O is completed (YES in ST236), digitized output signals E101 and E111 return to "H" level. The trailing edge of second original O is detected in accordance with this change in level from "L" to "H" level of signal E101.

"H" signal E101 in FIG. 14 is inverted to "L" signal E103 by inverter 103, and signal E103 is input to counter 104. Counter 117 starts to count the master clock pulses. FF 105 keeps to output chip select signal E105 of "L" level to latch 107 until FF 105 is cleared upon a lapse of the delay time of delay pulse generator 102. Therefore, the count value (length data of second original O) obtained before counter 104 starts to count the master clock pulses is stored in latch 107 being set in the enabled state (ST238).

As described above, when the length data of first original O and the length data of second original O are stored in latches 106 and 107, respectively, comparator 109 compares length data D106 of first original O with length data D107 of second original O. Comparator 109 outputs comparison results CPR1 to CPR3 to controller 61 (ST239). Then, counter 72*a* is incremented by one (ST240).

Steps ST223 to ST240 constitute a data detection/data storage process for second original O.

As a result of length check in the arrangement shown in FIG. 14, if a multiple paper-conveying error is not detected, comparison result CPR3 is set at "L" level. As a result of thickness check in the arrangement shown in FIG. 32, if a multiple paper-conveying error is not detected, comparison result CPR6 is set at "L" level. Therefore, if length check result CPR3 and thickness check result CPR6 are set at "L", the absence of multiple-paper conveying errors is determined (YES in ST241).

If no multiple paper-conveying error is detected (YES in ST241) and originals O to be fed are still left (YES in ST246), the same process (steps ST233 to ST240) as for the second sheet is performed for third and subsequent sheets.

If at least one of length check result CPR3 and thickness check result CPR6 is set at "H" level, a multiple paper-conveying error is detected in the length or thickness check (NO in ST241). In this case, the CPU in controller 61 generates an interrupt signal to stop paper feeding in the automatic paper feeding apparatus in FIG. 2 (ST242). At the same time, the CPU in controller 61 outputs a "suspension" signal corresponding to the stop of paper feeding to copying machine main body 1 (ST243).

The CPU in controller 61 determines in accordance with combinations of logic levels of comparison results CPR1, CPR2, CPR4, and CPR5 whether a multiple paper-conveying error is detected for first original O (the determination conditions have been shown in Table 1).

If a multiple paper-conveying error of the first sheet is detected (YES in ST244), the CPU in controller 61 sends a preset signal of "L" level to FF 105 (FIG. 14) and FF 113 (FIG. 32) so as to preset chip select signals E105 and E113 from FFs 105 and 113 to "H" level (ST245). Operations are then restarted from the process in step ST218 in FIG. 27.

If the multiple paper-conveying error detected in step ST241 is for the second or subsequent sheet (NO in ST244), the flow returns to step ST233. Paper feeding is kept stopped until original O having been subjected to multiple-paper conveying (double-conveyed) is reset (NO in ST241), and paper feeding is kept stopped (ST242).

When original O being double-conveyed is reset, and the multiple paper-conveying error is released (YES in ST241), the process in steps ST233 to ST246 is repeated, provided that originals O to be fed are still left (YES in ST246).

As described with reference to the flow charts in FIGS. 39 and 40, when the double check (logical AND of CPR3 and CPR6) using the lengths and thicknesses of the fed sheets is performed, multiple paper-conveying can be properly detected. For example, the first and second ones of a plurality of sheets are fed such that the leading edges thereof are accidentally and perfectly aligned with each other, and multiple paper-conveying cannot be detected in the length check. However, this multiple paper-conveying can be detected in the thickness check. For this reason, all multiple paper-conveying errors can be detected. Assume that multiple paper-conveying of the second and third ones of a plurality of sheets is not detected because the second and third sheets are thinner than the first sheet. In this case, if the second sheet is slightly shifted from the third sheet, a difference between the lengths of these sheets is caused to detect multiple paper-conveying in the length check. All multiple paper-conveying errors can be detected.

In the above embodiment, the digitizers, the delay pulse generators, the inverters, and the FFs can be shared by length detector 75 and thickness detector 76. In this case, only the above electrical components in either detector may be used.

If the thickness varies within one original O like patched original O, a plurality of thicknesses are sampled in one original O and compared with the reference thickness, thereby detecting the accurate conveyed state of original O without arranging a peak detector.

Referring to FIG. 20, address counter 117 starts counting from zero upon detection of the leading edge of first original O.

Address counter 117 generates an address in synchronism with the counter operation, and thickness data of first original O is sequentially stored in RAM 118.

As for second and subsequent originals O, thickness data to be detected is stored in delay circuit 115 and output to comparator 119. At the same sampling timing from the leading edge of first original O, the thickness data of first original O output from RAM 118 is compared with the thickness data of second or subsequent original O by comparator 119.

Figures 29A, 29B, 29C:
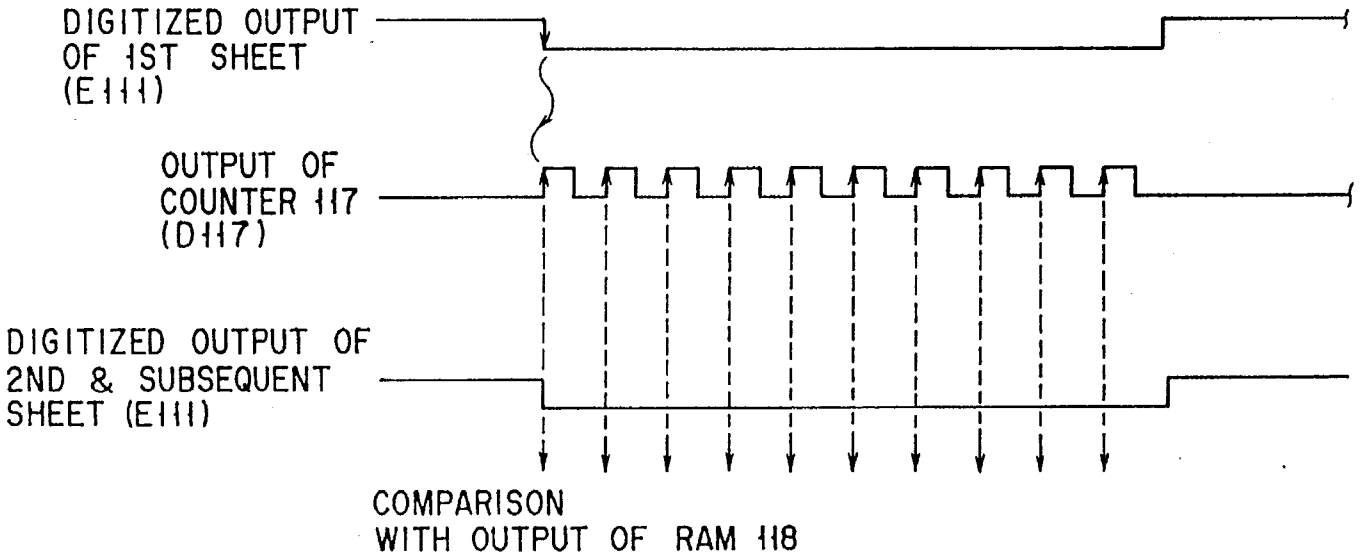
FIGS. 29A to 29C are timing charts for explaining sampling of the first original sheet and the second and subsequent original sheets.

FIGS. 29A to 29C show the timing of sampling (upperward arrows of the waveforms) first original O and second or subsequent original O.

The comparison results (CPR4 to CPR6) sampled a plurality of times are stored as outputs from thickness detector 76 in memory 72 by controller 61.

The relation between the comparison result (CPR4 to CPR6) of data detected at each timing and the state of overlapping papers/sheets O will be described with reference to FIG. 30.

Figure 30:
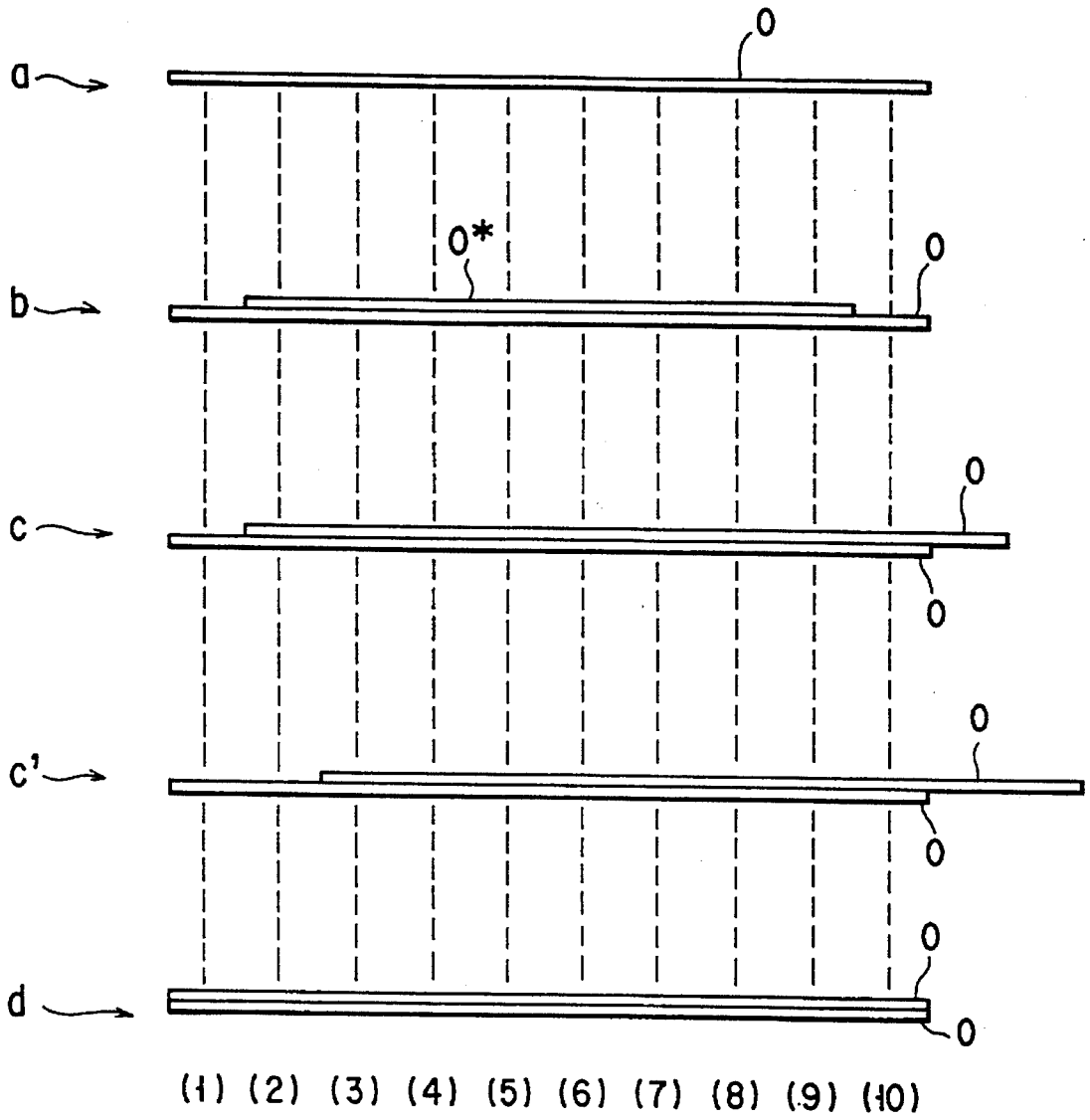
FIG. 30 is a view for explaining the conveyed states of a reference original, a patched original, and an original having been subjected to multiple paper-conveying, and sampling for these originals.

In FIG. 30, a represents reference original O free from patching, b represents reference original O with patching paper piece C*, c and c' represent multiple paper-conveying in which the leading edges of two originals O are shifted from each other, and d represents multiple paper-conveying in which the leading edges of two originals O are aligned with each other.

The results of comparison with respect to variations in thickness, obtained at the sampling timings where the lengthwise direction of paper/sheet O is divided by ten, are shown in (1) to (10) in Table 3.

TABLE 3

| Thickness | | | | | | | | | | |
|---|---|---|---|---|---|---|---|---|---|---|
| 1 | 2 | 3 | 4 | 5 | 6 | 7 | 8 | 9 | 10 | Length |
| a = b | a < b | a < b | ← | ← | ← | ← | ← | ← | a = b | a = b |
| a = c | a < c | a < c | ← | ← | ← | ← | ← | ← | a < c | a < c |
| a = c' | a = c' | a < c' | ← | ← | ← | ← | ← | ← | a < c' | a < c' |
| a < d | a < d | a < d | ← | ← | ← | ← | ← | ← | a < d | a = d |

For example, if the first sheet (original) is patched sheet b from FIG. 30 and Table 4, and the second sheet (original) has been subjected multiple paper-conveying c', condition b>c' is established at sample timing (1). In other sample timings, condition b=c' is established.

If sampling values corresponding to different thicknesses are present, as described above, longer original O is determined to have been subjected to multiple paper-conveying in accordance with the length data.

A shorter original sheet is always selected to update the reference data upon detection of multiple paper-conveying.

Multiple paper-conveying may sometimes represent that the leading edges of a plurality of original sheets are aligned with each other as is shown by "d" in FIG. 30.

In such a case, since these original sheets have a length equal to that of the reference original (O), the condition of the "d" in FIG. 30 could be erroneously determined that the sheet subjected to multiple paper-conveying is a patched sheet.

When all sample data (1) to (10) in Table 3 are taken into consideration, thickness data, obtained when the multiple paper-conveying occurs, exhibits a large value (a<d) if the leading edges are aligned with each other and "a=d" with respect to the length is given.

By utilizing this fact, multiple paper-conveying in which the leading edges of original O are aligned with each other can be detected.

A method for detecting the multiple paper-conveying based on the above fact will be described below.

(1) A plurality of comparison results (the sampling data of Table 3) are stored in memory 72.

(2) An AND signal of thickness comparison results (CPR4 to CPR6) is calculated.

Comparator outputs in one sampling cycle are shown in Table 4 below.

TABLE 4

| | (First sheet) > (Second or subsequent sheet) | (First sheet) < (Second or subsequent sheet) | (First sheet) = (Second or subsequent sheet) |
|---|---|---|---|
| | Length | | |
| CPR1 | L | H | H |
| CPR2 | H | L | H |
| CPR3 | H | H | L |
| | Thickness | | |
| CPR4 | L | H | H |
| CPR5 | H | L | H |
| CPR6 | H | H | L |

When the AND signal of the comparison results with respect to the positions (1)–(10) of FIG. 30 is obtained, outputs shown in Table 5 are obtained only if all comparison results are the same.

All the thickness comparison results are shown in Table 5 below.

TABLE 5

| | | CPR4 | CPR5 | CPR6 |
|---|---|---|---|---|
| 1 | If (first sheet) > (second or subsequent sheet) | L | H | H |
| 2 | If (first sheet) < (second or subsequent sheet) | H | L | H |
| 3 | If (first sheet) = (second or subsequent sheet) | H | H | L |

(3) If the comparison results (CPR4–CPR6) of Table 5 described above are obtained, the following judgement can be made:

1. the first original sheet has been subjected to multiple paper-conveying, so that the feeding operation should be stopped;

2. the second original sheet has been subjected to multiple paper-conveying, so that the feeding operation should be stopped; and 3. the first and second original sheets are reference or pasted sheets, so that the next feeding operation should be started.

(4) If at least one of the comparison results with respect to the respective thicknesses of positions (1)–(10) of FIG. 30 is different from the remaining results, the following determinations can be made based on the length data of Table 4:

4-1. if (length of first sheet)>(length of second or subsequent sheet), then the first original sheet is determined to have been subjected to multiple paper-conveying, so that the feeding operation is stopped;

4-2. if (length of first sheet)<(length of second or subsequent sheet), then the second original sheet is determined to have been subjected to multiple paper-conveying, so that the feeding operation is stopped;

4-3. if (length of first sheet)=(length of second or subsequent sheet), then first or second original sheet is determined as a patched sheet.

Even if the lengths of the original sheets are equal to each other as in 4-3, multiple paper-conveying in which the leading edges of the sheets are aligned with each other can be detected as in (3). Therefore, erroneous detection can be avoided.

Figure 31:
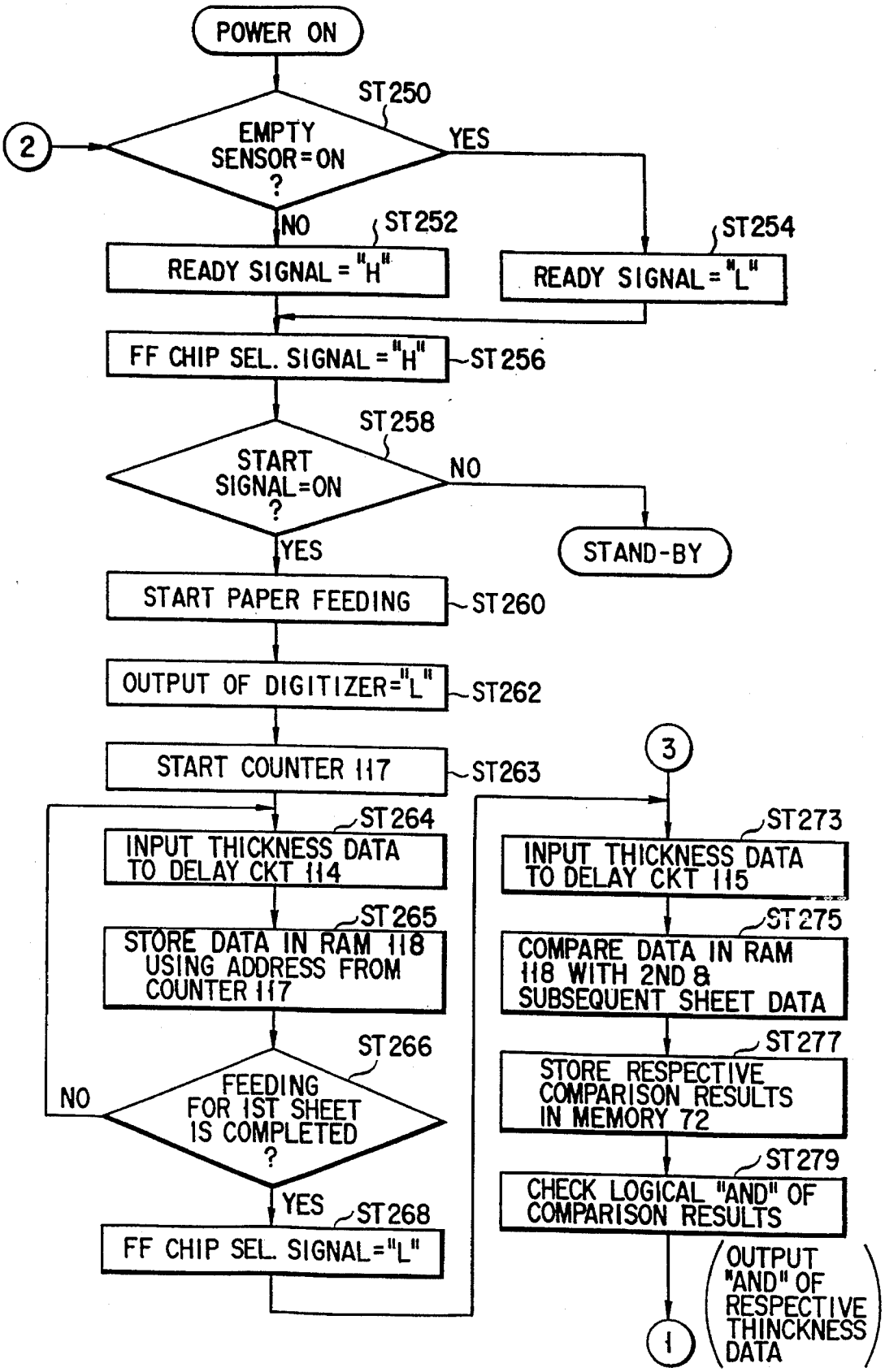
FIG. 31 is a flow chart for explaining multiple paper-conveying detection during feeding for an original.
Figure 33A:
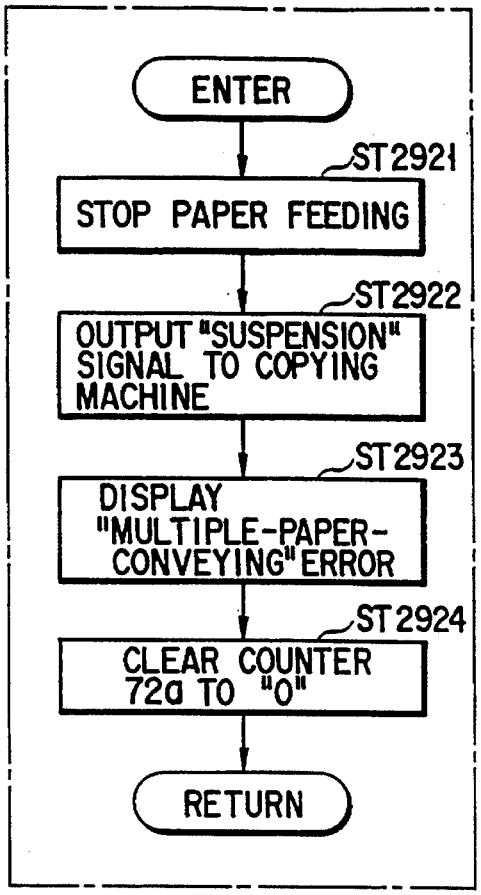
FIGS. 33A and 33B are flow charts each for explaining the multiple paper-conveying detection during feeding for the original.

The process of determination obtained upon comparisons in one original O are shown in FIGS. 31, 32, and 33A/33B.

During the OFF period of empty sensor 29 upon power-ON operation of the apparatus (NO in ST250), the ready signal is kept at "H" level (ST252). When a turn-ON operation of empty sensor 29 is detected (YES in ST250), the ready signal goes to "L" level (ST254). FF 113 in FIG. 20 is preset in accordance with the preset signal from controller 61 and outputs chip select signal E113 of "H" level (ST256). This "H" signal E113 is inverted to "L" signal E116 by inverter 116 to enable delay circuit 114 and disable delay circuit 115.

For example, when the copy start button of the copying machine is depressed (YES in ST258), automatic paper feeding is started (ST260). When the leading edge of first original O reaches the portion between feeding roller 35 and aligning roller 34, output signal E111 from digitizer 111 goes to "L" level (ST262). This "L" signal E111 is inverted to "H" signal E120 by inverter 120, and signal E120 is input to address counter 117. Address counter 117 starts counting master clock pulses (ST263).

A digital value (thickness data at any one of paper feeding positions (1) to (10) (FIG. 30) of first original O) from ADC 74 is input to delay circuit 114 set in the enabled state (ST264). When a write signal is input from the CPU in controller 61 to RAM 118, thickness data D114 input to delay circuit 114 is written at an address of RAM 118 which is specified by address data D117 from address counter 117 (ST265). This write access is performed at all points of paper feeding positions (1) to (10) in FIG. 30 until paper feeding for first original O is completed (NO in ST266). The operations in steps ST264 to ST266 are repeated until paper feeding for first original O is completed. As a result, 10 thickness data obtained along the paper feeding direction of originals O are stored in RAM 118.

When paper or sheet feeding for first original O is completed (YES in ST266), digitized output signal E111 returns to "H" level. When this "H" signal E111 is input to delay pulse generator 112, delay pulse generator 112 supplies signal E112 to FF 113 to clear FF 113. FF 113 then outputs chip select signal E113 of "L" level (ST268).

In response to this chip select signal E113 of "L" level, delay circuit 115 is enabled. Therefore, a subsequent digital value (thickness data of 10 points obtained by dividing second or subsequent original O in the paper feeding direction) output from ADC 74 is input to delay circuit 115 set in the enabled state (ST273).

Count value (thickness data of 10 points of the first original sheet in the paper feeding direction; data 1) is read out from RAM 118 in accordance with a read signal from the CPU in controller 61. Count value (thickness data of 10 points of the second or subsequent original sheet in the paper feeding direction; data 2) of second or subsequent original O is extracted from delay circuit 115.

Comparator 119 compares data 1 and 2 (ST275). The comparison results (10 results of each of CPR4, CPR5, and CPR6) of data 1 and 2 of the ten points in the paper feeding direction are stored in memory 72 in FIG. 26 (ST277).

The CPU in controller 61 calculates logical AND products (AND calculation result CPR4 of 10 comparison results CPR4; AND calculation result CPR5 of 10 comparison results CPR5; and AND calculation result CPR6 of 10 comparison results CPR6) of the comparison results (10 comparison results CPR4, 10 comparison results CPR5, and comparison results CPR6) stored in memory 72. The CPU in controller 61 outputs the calculation results (logical AND products CPR4, CPR5, and CPR6) (ST279).

When the logical levels of comparison results CPR4, CPR5, and CPR6 as the logical AND products are "L, H, H", respectively (YES in ST281), a double-conveying processing routine (ST292) for the first sheet in FIG. 33A is started.

When the routine in FIG. 33A is started, the CPU in controller 61 generates an interrupt signal to stop paper feeding in the automatic paper feeding apparatus in FIG. 2 (ST2921). At the same time, the CPU in controller 61 outputs a "suspension" signal corresponding to the stop of paper feeding to copying machine main body 1 (ST2922). A "multiple paper-conveying" error is displayed on a display unit (not shown) of main body 1 (ST2923), and counter 72*a* arranged in memory 72 in FIG. 26 is cleared to zero (ST2924). The flow then returns to step ST250 in FIG. 31. The operations in steps ST250 to ST281 in FIGS. 31 and 32 are repeated.

In step ST281, if the logic levels of comparison results CPR4, CPR5, and CPR6 as the logical AND products are determined not to be "L, H, H", respectively, (NO in ST281), the logic levels of comparison results CPR4, CPR5, and CPR6 as the logical AND products are checked again.

Figure 33B:
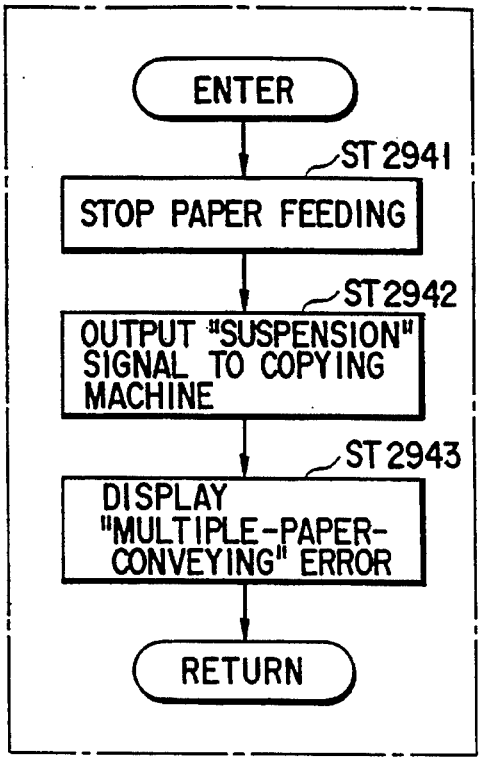

If these comparison results CPR4, CPR5, and CPR6 are set at "H, L, H", respectively, (YES in ST283), a double-conveying processing routine (ST294) for the second and subsequent sheets in FIG. 33B is started.

When the routine in FIG. 33B is started, the CPU in controller 61 generates an interrupt signal to stop paper feeding in the automatic paper feeding apparatus in FIG. 2 (ST2941). At the same time, the CPU in controller 61 outputs a "suspension" signal corresponding to this paper feeding to copying machine main body 1 (ST2942). A "multiple paper-conveying" error is displayed on a display unit (not shown) in main body 1 (ST2943). The flow then returns to step ST273 in FIG. 32 to repeat the operations in steps ST273 to ST283 in FIG. 32.

If it is determined in step ST283 that comparison results CPR4, CPR5, and CPR6 as the logical AND products are not "H, L, H", respectively, (NO in ST283), the logic levels of these CPR4, CPR5, and CPR6 are checked again.

If the logic levels of these CPR4, CPR5, and CPR6 are determined to be "H, H, L", respectively, (YES in ST285), the comparison results of thicknesses at all the 10 points in the paper feeding direction are equal to each other, and any multiple paper-conveying error is not detected. In this case, counter 72*a* in FIG. 26 is incremented by one (ST290). If original sheets to be fed are still left, and empty sensor 29 is kept on (YES in ST296), the operations in steps ST273 to ST285 and ST290 are repeated.

If the logic levels of CPR4, CPR5, and CPR6 are determined not to be "H, H, L", respectively, in step ST285 (NO in ST285), the contents of the comparison results (CPR1, CPR2, and CPR3) of two originals O are checked (ST287).

If the logic levels of comparison results CPR1, CPR2, and CPR3 are "H, H, L", respectively, (YES in ST287), counter 72*a* in FIG. 26 is incremented by one (ST290). If sheets to be fed are still left, and empty sensor 29 is kept on (YES in ST296), the operations in steps ST273 to ST287 and ST290 are repeated.

If the logic levels of CPR1, CPR2, and CPR3 are determined in step ST287 not to be "H, H, L", respectively, (NO in ST287), the logic levels of these CPR1, CPR2, and CPR3 are checked again (ST289).

If the logic levels of comparison results CPR1, CPR2, and CPR3 are determined to be "L, H, H" (YES in ST289), processing routine ST292 in FIG. 33A is executed, and then operations in steps ST250 to ST289 are repeated. If the logic levels of comparison results CPR1, CPR2, and CPR3 are determined not to be "L, H, H", respectively, (NO in ST289), processing routine ST294 in FIG. 33B is executed, and the operations in steps ST273 to ST289 are repeated.

If the first original sheet is determined to have been subjected to multiple paper-conveying, counter 72*a* is cleared to "0". When the second or subsequent original sheet is determined to have been subjected to multiple paper-conveying, the count value prior to occurrence of multiple paper-conveying is held in counter 72*a*. At the time of restart, the operator can set a document on original feeding table 22 from the specific original O having been subjected to multiple paper-conveying.

Only the minimum thickness data of one original O may be stored as reference data (the thickness of the first original sheet) in RAM 118 of thickness detector 76.

With this arrangement, even if the thicknesses of fed originals O are different from one another, it is not erroneously detected as the original sheet having been subjected to multiple paper-conveying, and the accurate conveyed state of original O can be detected.

With this arrangement, the minimum value of the thickness of first original O, serving as the reference original sheet, becomes the actual reference for the data of second and subsequent original sheets. If the thickness of the first original sheet is larger than that of the second or subsequent original sheet, only the first original sheet is a sheet having been subjected to multiple paper-conveying.

The feeding operation can be immediately stopped when the thickness of the first original sheet which is larger than that of the second or subsequent original sheet is detected without detecting the length of second or subsequent original O.

Even if the leading edges of the first pair of originals O, subjected to the multiple paper-conveying, overlap each other, accurate detection of the multiple paper-conveying can be performed without using a combination of thickness and length data.

The above determination method based on the minimum value detection is summarized in Table 6 below.

TABLE 6

| | Thickness | Length | Determination by Detector | Actual Conveyed State |
|---|---|---|---|---|
| 1 | (First sheet) > (Second or subsequent sheet) | (First sheet) > (Second or subsequent sheet) | Multiple paper-conveying of first sheet and stop of feeding operation | ← |
| 2 | (First sheet) > (Second or subsequent sheet) | (First sheet) = (Second or subsequent sheet) | Multiple paper-conveying of first sheet and stop of feeding operation | ← |
| 3 | (First sheet) > (Second or subsequent sheet) | (First sheet) < (Second or subsequent sheet) | Multiple paper-conveying of first sheet and stop of feeding operation | |
| 4 | (First sheet) = (Second or subsequent sheet) | (First sheet) > (Second or subsequent sheet) | | Size of second or subsequent sheet is different from reference size |
| 5 | (First sheet) = (Second or subsequent sheet) | (First sheet) = (Second or subsequent sheet) | No abnormality | First and second sheets are base sheets without patching or both sheets are patched sheets |
| 6 | (First sheet) = (Second or subsequent sheet) | (First sheet) < (Second or subsequent sheet) | | Size of first sheet is different from reference size |
| 7 | (First sheet) < (Second or subsequent sheet) | (First sheet) > (Second or subsequent sheet) | Stop of feeding operation | Second or subsequent sheet is bent in Z shape 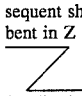 Leading/trailing edge of sheet is folded 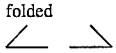 |
| 8 | (First sheet) < (Second or subsequent sheet) | (First sheet) = (Second or subsequent sheet) | Second or subsequent sheet is patched sheet | ← |

TABLE 6-continued

| | Thickness | Length | Determination by Detector | Actual Conveyed State |
|---|---|---|---|---|
| 9 | (First sheet) < (Second or subsequent sheet) | (First sheet) < (Second or subsequent sheet) | Multiple paper-conveying of second or subsequent sheet and stop of feeding operation | ← |

Figure 34:
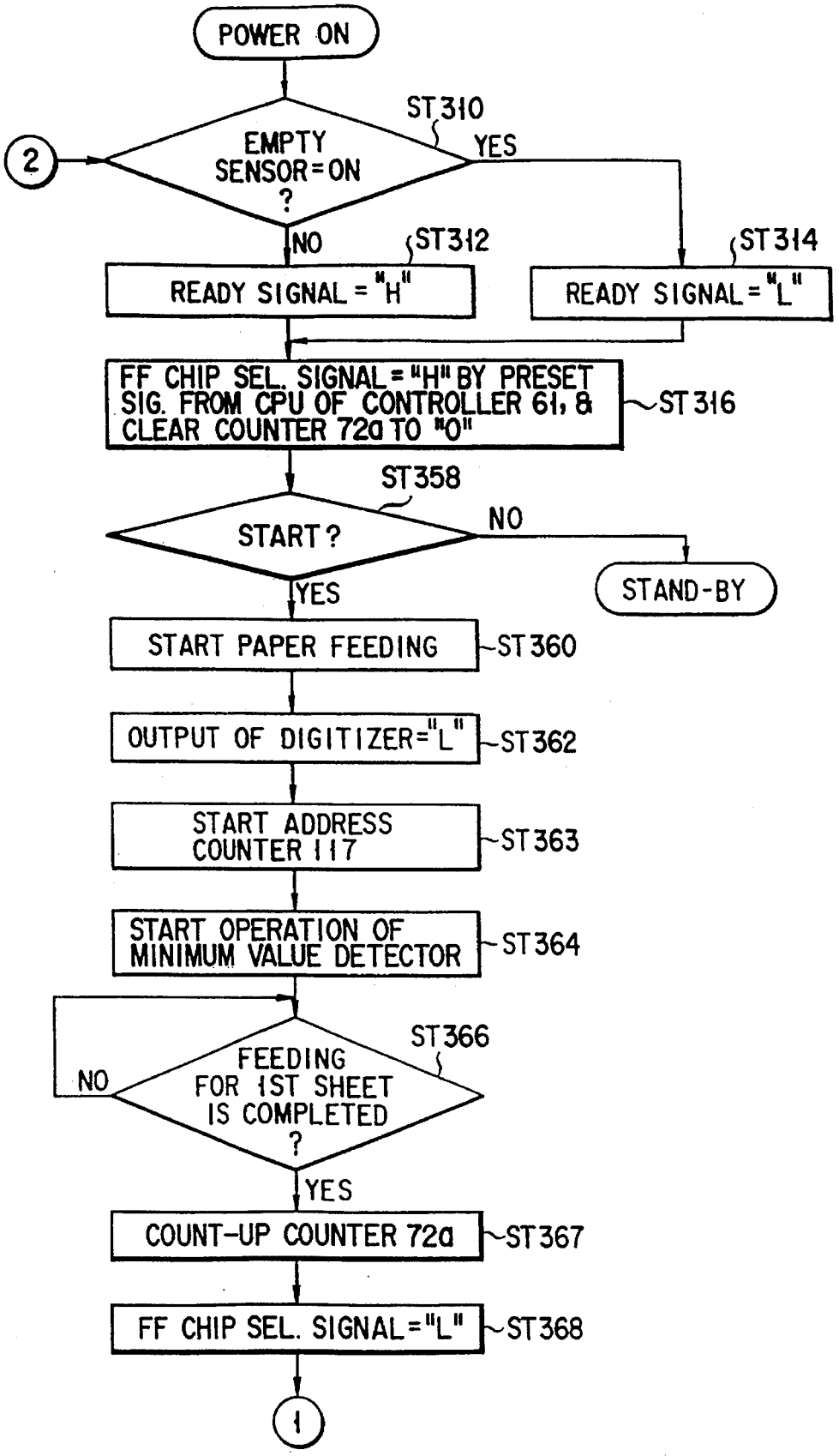
FIG. 34 is a flow chart for explaining multiple paper-conveying detection during feeding for an original.
Figure 35:
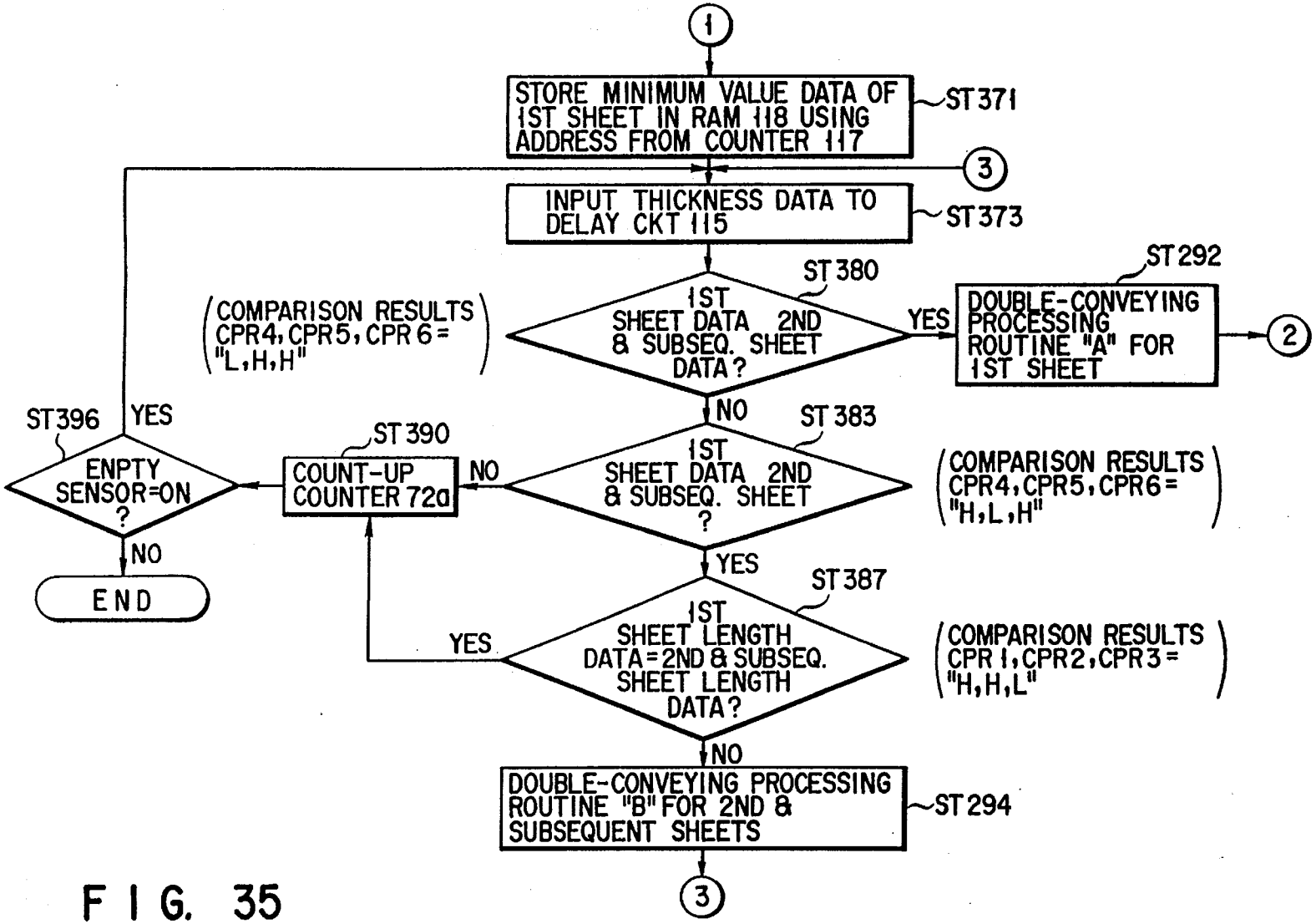
FIG. 35 is a flow chart for explaining the multiple paper-conveying detection during feeding for the original.

This operation will be described with reference to flow charts in FIGS. 34 and 35.

During the OFF period of empty sensor 29 upon power-ON operation of the apparatus (NO in ST310), the ready signal is set at "H" level (ST312). When the turn-ON operation of empty sensor 29 is detected (YES in ST310), the ready signal goes to "L" level (ST314). FF 113 is then preset in response to the preset signal from controller 61 and outputs chip select signal E113 of "H" level (ST316). This "H" signal E113 is inverted to "L" signal E116 by inverter 116 to enable delay circuit 114 and disable delay circuit 115.

At the same time, counter 72*a* arranged in memory 72 in FIG. 26 is cleared to zero in response to the preset signal from controller 61.

For example, when the copy start button of the copying machine is depressed (YES in ST358), automatic paper feeding is started (ST360). When the leading edge of first original O reaches the portion between feeding roller 35 and aligning roller 34, output signal E111 from digitizer 111 goes to "L" level (ST362). This "L" signal E111 is inverted to "H" signal E120 by inverter 120, and signal E120 is input to address counter 117. Address counter 117 starts counting master clock pulses (ST363).

The minimum value detection operation for the thickness data is started (ST364).

A digital value (thickness data at any one of paper feeding positions (1) to (10) (FIG. 30) of first original O) from ADC 74 is input to delay circuit 114 set in the enabled state. This input is determined to be NO in step ST366 until paper feeding for first original O is completed. This input continues for all points at positions (1) to (10) in the paper feeding direction in FIG. 30.

Delay circuit 114 sequentially supplies input thickness data D114 to minimum value detector 121. When paper feeding for first original O is completed (YES in ST366), 10 thickness data of first original O at positions (1) to (10) in the paper feeding direction are supplied to minimum value detector 121. Minimum value detector 121 sequentially compares the 10 input data values to select minimum value data. (This minimum value data selection operation, i.e., the minimum value detection operation of thickness data, can be performed by software under the control of the CPU in controller 61.)

When paper feeding for first original O is completed (YES in ST366), counter 72*a* is incremented by one (ST367), and digitized output signal E111 then returns to "H" level. When this "H" signal E111 is input to delay pulse generator 112, delay pulse generator 112 outputs signal E112 to FF 113 to clear FF 113. FF 113 then outputs chip select signal E113 of "L" level (ST368).

When a write signal is input from the CPU in controller 61 to RAM 118, minimum thickness data D121 of first original O which is detected by the minimum detection operation in step ST364 is stored at an address of RAM 118 which is specified by address data D117 updated by the master clock count (ST371).

Delay circuit 115 is set enabled in response to chip select signal E113 set at "L" level in step ST368. For this reason, a digital value (thickness data of each one of the 10 points obtained by dividing second and subsequent original O in the paper feeding direction) output from ADC 74 is input to delay circuit 115 set in the enabled state (ST373).

Comparison reference data D118 (data 1) corresponding to minimum thickness data D121 of first original O is read out from RAM 118 in accordance with a read signal from the CPU in controller 61. Thickness data D115 (data 2) of 10 points of second or subsequent original O in the paper feeding direction are sequentially output from delay circuit 115.

Comparator 119 sequentially compares data 1 and 2 (ST380). If thickness data D115 (data 2) of second or subsequent original O is smaller than comparison reference data D118 (data 1) corresponding to the minimum value of first original O (YES in ST380), double-conveying (multiple-conveying) has occurred in the first sheet (CPR4, CPR5, CPR6="L", "H", "H"). In this case, processing routine ST292 shown in FIG. 33A is executed, and the flow returns to first step ST310.

If thickness data D115 (data 2) of second or subsequent original O is equal to or larger than comparison reference data D118 (data 1) (NO in ST380), comparison of these data continues. If these data are not equal to each other, i.e., if D115 (data 2) is larger than D118 (data 1) (YES in ST383), double-conveying may have occurred in second or subsequent original O (CPR4, CPR5, CPR6="H", "L", "H").

In this case, the length check corresponding to step ST287 in FIG. 32 is performed using the arrangement in FIG. 14 (ST387). When the length of first original O is not equal to that of second or subsequent original O (NO in ST387), second original O is double-conveyed (CPR1, CPR2, CPR3="H", "H", "L"). In this case, the processing routine ST294 shown in FIG. 33B is executed, and the flow then returns to step ST373.

When thickness data D115 (data 2) is equal to comparison reference data D118 (data 1) (NO in ST383) or when the length of first original O becomes equal to that of second original O (YES in ST387), no double-conveying is detected. In this case, counter 72*a* is incremented by one (ST390). If sheets to be fed are still left, and empty sensor 29 is kept on (YES in ST396), the operations in steps ST373 to ST390 are repeated.

Minimum value detection may be performed in detection of both the data of the first original sheet and the second or subsequent original sheet. An embodiment for this will be described below.

Only if originals O are subjected to multiple paper-conveying such that their leading edges are perfectly aligned with each other, the thickness of the first original sheet is different from that of the second or subsequent original sheet.

The following determination can be performed:

(1) if (thickness of first sheet)>(thickness of second or subsequent sheet), then the first original sheet is determined to have been subjected to multiple-paper feeding, and the feeding operation is stopped;

(2) if (thickness of first sheet)<(thickness of second or subsequent sheet), then the second original sheet is determined to have been subjected to multiple-paper feeding, and the feeding operation is stopped; and (3) if (thickness of first sheet)=(thickness of second or subsequent sheet), and (a) if (length of first sheet)>(length of second or subsequent sheet), then the first original sheet is determined to have been subjected to multiple paper-conveying, and the feeding operation is stopped, (b) if (length of first sheet)=(length of second or subsequent sheet), then both the first original sheet and the second or subsequent original sheet are base or patched originals O, and (c) if (length of first sheet)<(length of second or subsequent sheet), then the second original sheet is determined to have been subjected to multiple paper-conveying.

According to the above-mentioned determination method, even if the first or second or subsequent original sheet is detected such that the leading edges are perfectly aligned with each other, multiple paper-conveying can be determined.

In this case, the length data need not be referred to.

Figure 36:
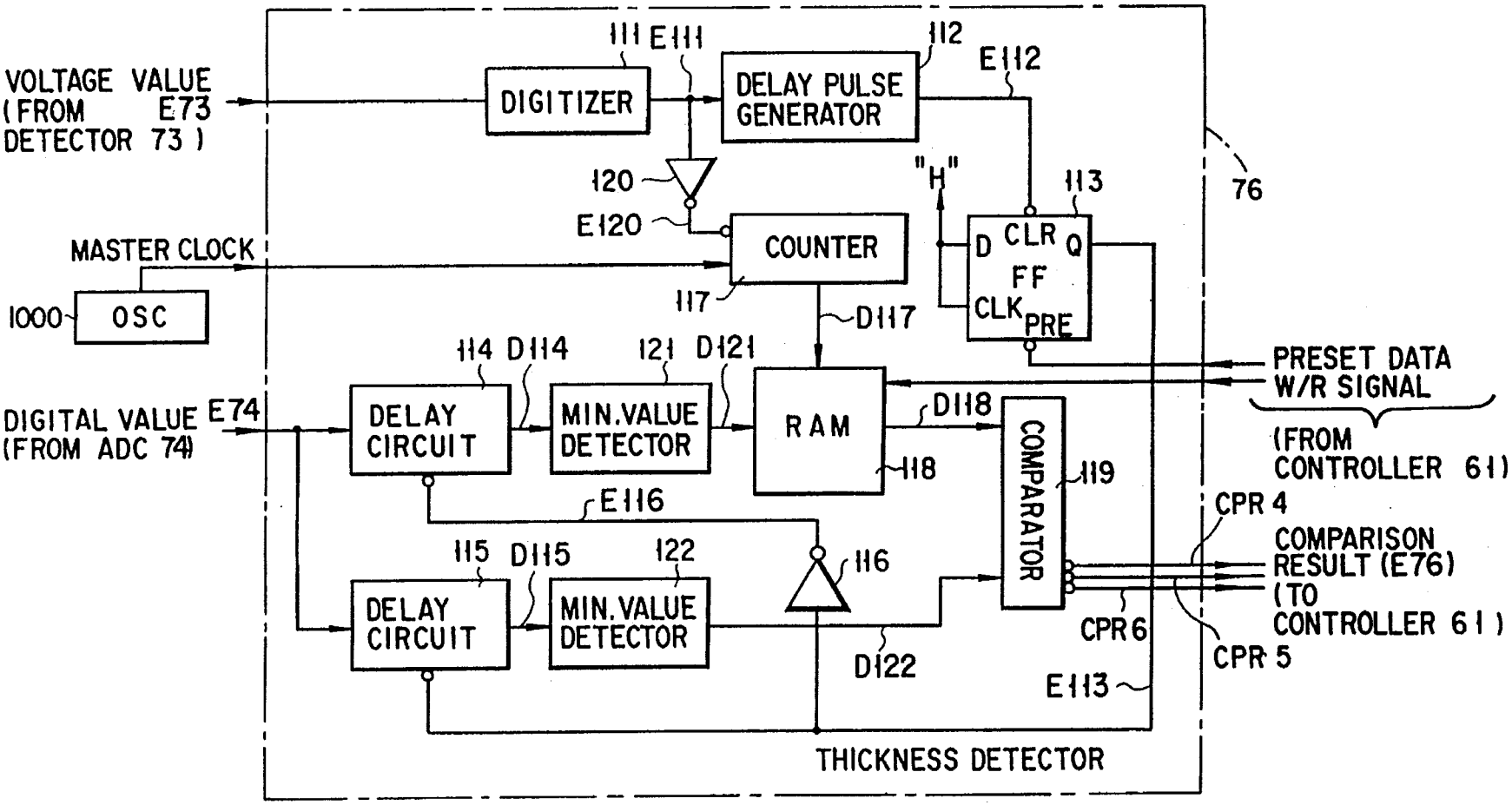
FIG. 36 is a schematic block diagram showing another arrangement of the thickness detector.

The schematic block diagram for detecting the minimum value in detection of both the data of the first original sheet and the second or subsequent original sheet is shown in FIG. 36. In this case, minimum value detector 121 is arranged between delay circuit 114 and RAM 118 in FIG. 20, and minimum value detector 122 is arranged between delay circuit 115 and comparator 119.

Figure 37:
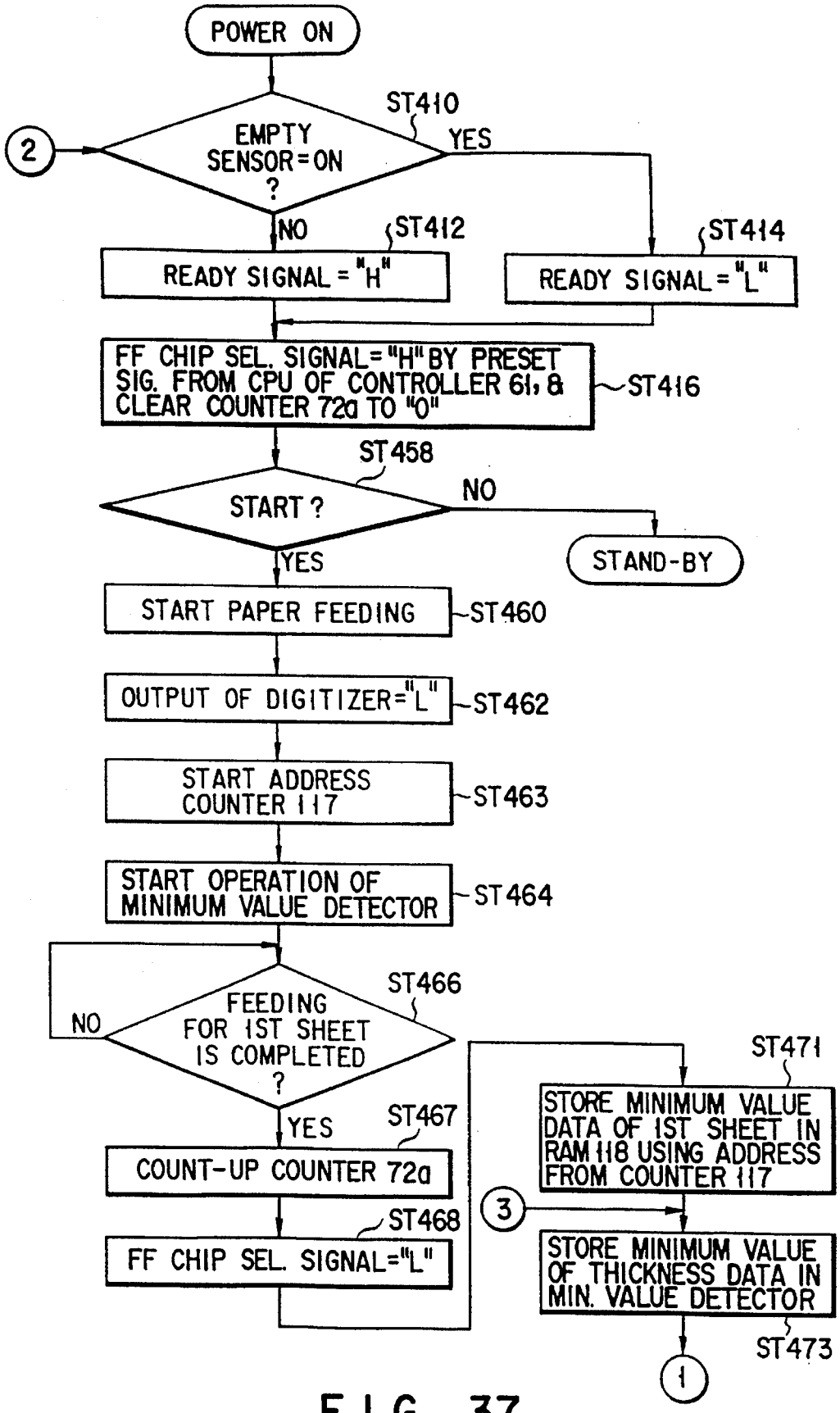
FIG. 37 is a flow chart for explaining multiple paper-conveying detection during feeding for an original.
Figure 38:
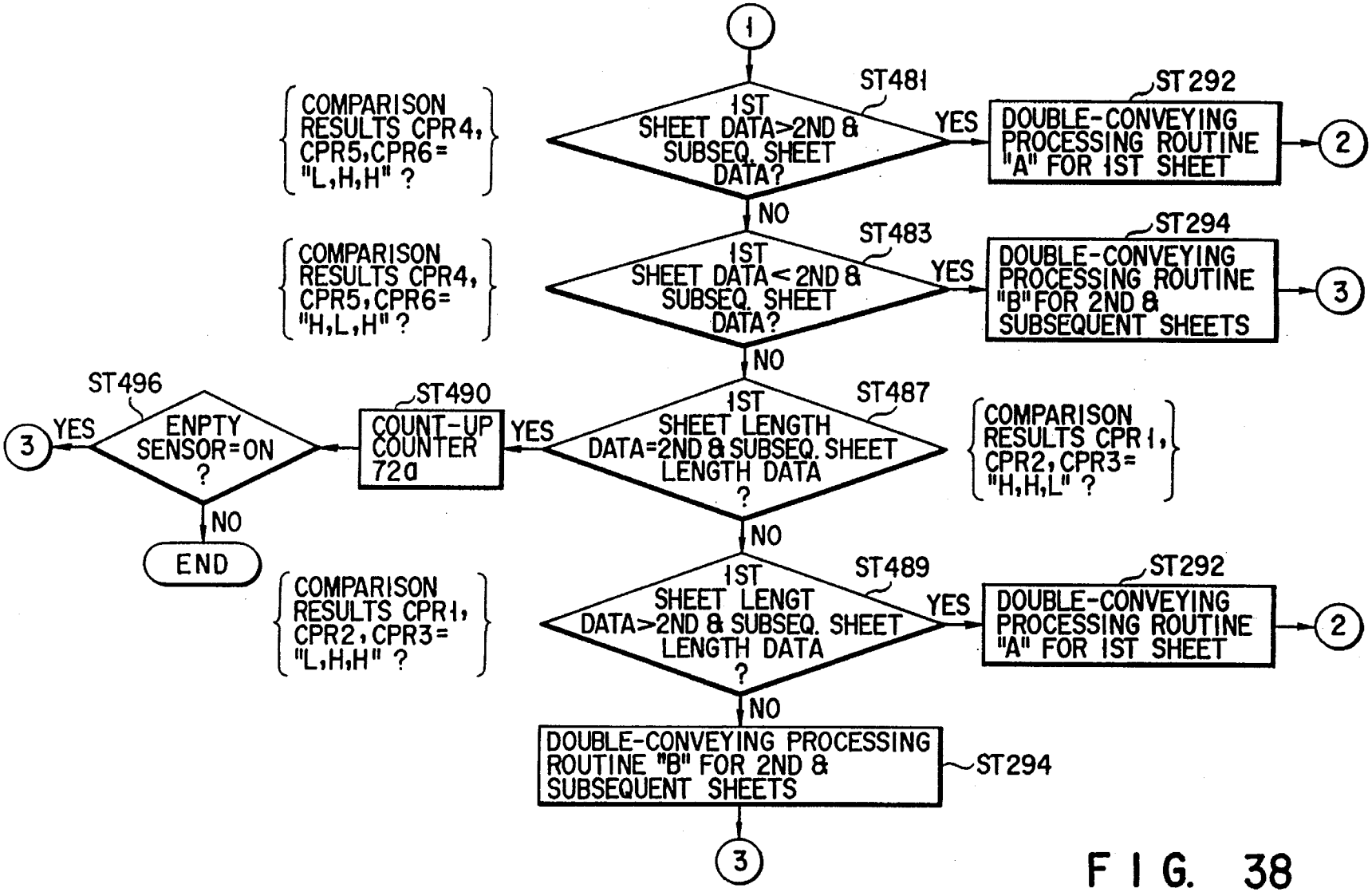
FIG. 38 is a flow chart for explaining the multiple paper-conveying detection during feeding for the original.

The flow charts of this determination method are shown in FIGS. 37 and 38.

During the OFF period of empty sensor 29 upon power-ON operation of the apparatus (NO in ST410), the ready signal is set at "H" level (ST412). When the turn-ON operation of empty sensor 29 is detected (YES in ST410), the ready signal goes to "L" level (ST414). FF 113 in FIG. 36 is preset in response to the preset signal from controller 61 and outputs chip select signal E113 of "H" level (ST416). This "H" signal E113 is inverted to "L" signal E116 by inverter 116 to enable delay circuit 114 and disable delay circuit 115.

At this time, counter 72*a* arranged in memory 72 in FIG. 26 is cleared to zero in response to the preset signal from controller 61.

For example, when the copy start button of the copying machine is depressed (YES in ST458), automatic paper feeding is started (ST460). When the leading edge of first original O reaches the portion between feeding roller 35 and aligning roller 34, output signal E111 from digitizer 111 goes to "L" level (ST462). This "L" signal E111 is inverted to "H" signal E120 by inverter 120, and signal E120 is input to address counter 117. Address counter 117 starts to count the master clock pulses (ST463).

The thickness data minimum value detection operation of minimum value detector 121 in FIG. 36 is started (ST464).

A digital value (thickness data at any one of paper feeding positions (1) to (10) (FIG. 30) of first original O) from ADC 74 is input to delay circuit 114 set in the enabled state. This input is determined to be NO in step ST466 until paper feeding for first original O is completed. This input continues for all points at positions (1) to (10) in the paper feeding direction in FIG. 30.

Delay circuit 114 sequentially supplies input thickness data D114 to minimum value detector 121. When paper feeding for first original O is completed (YES in ST466), 10 thickness data of first original O at positions (1) to (10) in the paper feeding direction are supplied to minimum value detector 121. Minimum value detector 121 sequentially compares the 10 input data values to select minimum value data. (This minimum value data selection operation, i.e., the minimum value detection operation of thickness data, can be performed by software under the control of the CPU in controller 61.)

When paper feeding for first original O is completed (YES in ST466), counter 72*a* is incremented by one (ST467), and digitized output signal E111 then returns to "H" level. When this "H" signal E111 is input to delay pulse generator 112, delay pulse generator 112 outputs signal E112 to FF 113 to clear FF 113. FF 113 then outputs chip select signal E113 of "L" level (ST468).

When a write signal is input from the CPU in controller 61 to RAM 118, minimum thickness data D121 of first original O which is detected by the minimum detection operation in step ST464 is stored at an address of RAM 118 which is specified by address data D117 updated by the master clock count (ST471).

Delay circuit 115 is set enabled in response to chip select signal E113 set to "L" level in step ST468. For this reason, a digital value (thickness data of each one of the 10 points obtained by dividing second and subsequent original O in the paper feeding direction) output from ADC 74 is input to delay circuit 115 set in the enabled state.

A digital value (thickness data at any one of paper feeding positions (1) to (10) (FIG. 30) of second original O) from ADC 74 is input to delay circuit 115 set in the enabled state. This input continues for all points at positions (1) to (10) in the paper feeding direction in FIG. 30 until paper feeding for second original O is completed.

Delay circuit 115 sequentially supplies input thickness data D115 to minimum value detector 122. When paper feeding for second original O is completed, 10 thickness data of second original O at positions (1) to (10) in the paper feeding direction are supplied to minimum value detector 122. Minimum value detector 122 sequentially compares the 10 input data values to select minimum value data. (This minimum value data selection operation, i.e., the minimum value detection operation of thickness data, can be performed by software under the control of the CPU in controller 61.)

Minimum thickness data D122 of second and subsequent originals O are stored in minimum value detector 122 (ST473).

Comparison reference data D118 (data 1) corresponding to minimum thickness data D121 is read out from RAM 118 in accordance with a read signal from the CPU in controller 61, and minimum thickness data D122 (data 2) of second and subsequent originals O are output from minimum value detector 122. Data 1 and 2 are compared by comparator 119 (ST481). If minimum value data D122 (data 2) of second or subsequent original O is smaller than minimum value data D118 (data 1) of first original O (YES in ST481), double-conveying (multiple-conveying) of the first original sheet is detected (CPR4, CPR5, CPR6="L", "H", "H"). In this case, processing routine ST292 shown in FIG. 33A is executed, and the flow returns to step ST410.

When minimum value data D122 (data 2) of the thickness of second or subsequent original O is equal to or larger than minimum value data D118 (data 1) of the thickness of first original O (NO in ST481), comparison of these data continues.

If minimum value data D122 (data 2) of second or subsequent original O is larger than minimum value data D118 of first original O (YES in ST483), double-conveying of second or subsequent original O is detected (CPR4, CPR5, CPR6="H", "L", "H"). In this case, processing routine ST294 shown in FIG. 33B is executed, and the flow then returns to first step ST473.

If minimum data D118 (data 1) of first original O is equal to minimum value data D122 (data 2) of second or subsequent original O (NO in ST483), the length check corresponding to step ST287 in FIG. 32 is performed (ST487).

If the length of first original O is larger than that of second or subsequent original O (NO in ST487; YES in ST489), double-conveying of the first sheet is detected (CPR1, CPR2, CPR3="L", "H", "H"). In this case, processing routine ST292 in FIG. 33A is performed, and the flow then returns to first step ST410.

When the length of first original O is equal to or smaller than that of second or subsequent original O (NO in ST489), double-conveying of second or subsequent original O is detected. In this case, processing routine ST294 in FIG. 33B is executed, and the flow then returns to first step ST373.

When the length of first original O is equal to that of second or subsequent original O (YES in ST487), no double-conveying is detected (CPR1, CPR2, CPR3="H", "H", "L"). In this case, counter 72*a* is incremented by one (ST490). If original sheets to be fed are still left, and empty sensor 29 is kept on (YES in ST496), operations in steps ST473 to ST490 are repeated.

When the shape of original O to be inserted into automatic paper feeding apparatus 20 is known in advance, the first sheet data need not be stored or compared.

More specifically, originals O to be fed may be slips or securities.

In this case, reference data is held in a storage means (e.g., a ROM) for holding data even after the power switch of the apparatus is turned off, and the reference data stored in this ROM is compared with the data of fed original O, thereby detecting the conveyed state of the fed sheet.

Thickness detector 76 arranged when the size of original O to be fed is predetermined will be described below.

Figure 39:
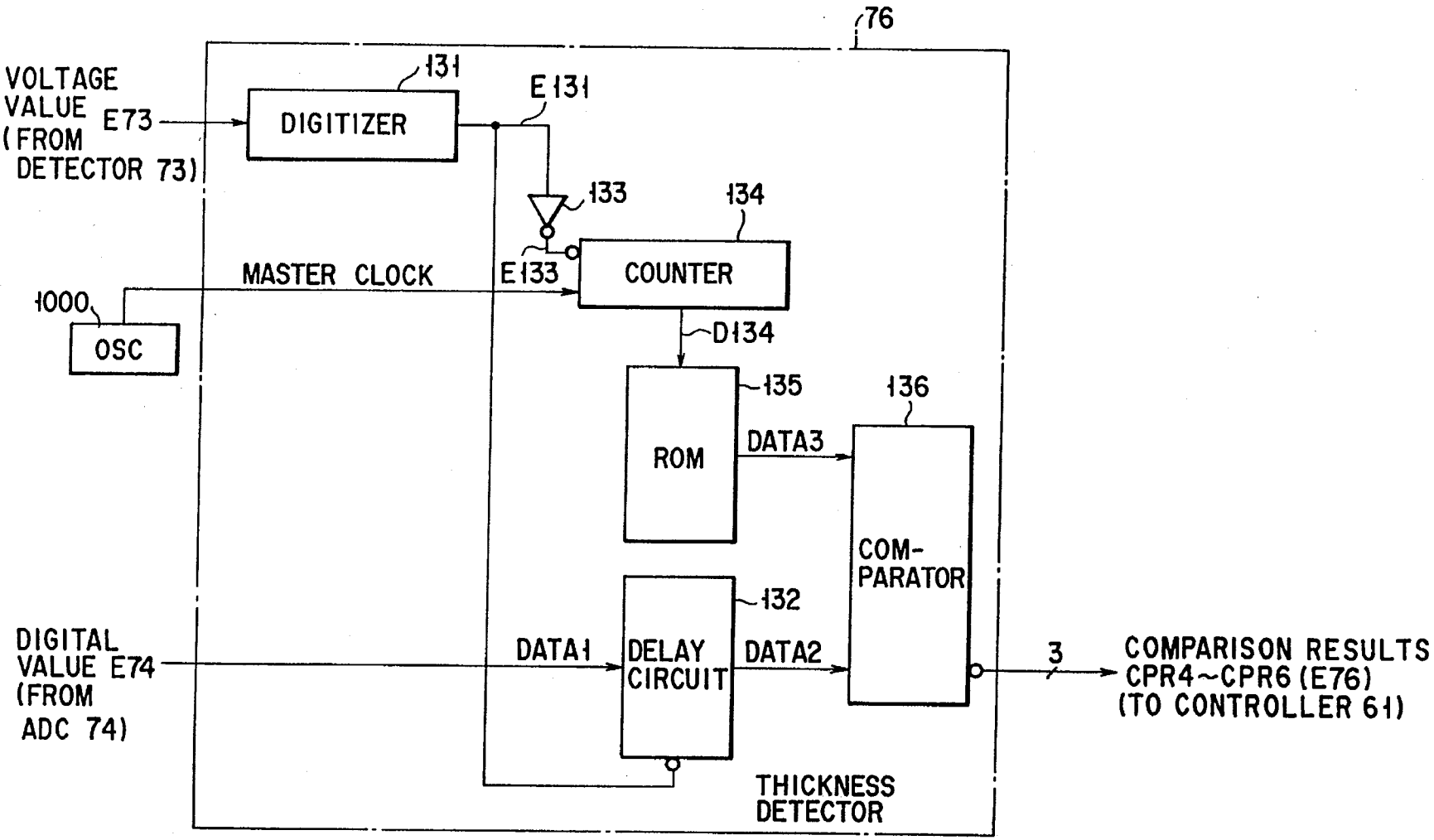
FIG. 39 is a schematic block diagram showing another arrangement of the thickness detector.

As shown in FIG. 39, this thickness detector 76 comprises digitizer 131, delay circuit 132, inverter 133, address counter 134, ROM 135, and comparator 136.

With this arrangement, when the leading edge of original O reaches a portion between feeding roller 35 and aligning roller 34, digitizer 131 outputs signal E131 of "L" level in accordance with voltage value E73 detected by detector 73. By signal E131 of "L" level, counter 134 starts to count the clock pulses from oscillator 1000. Delay circuit 132 stores a digital value (Data1) from ADC 74 which corresponds to voltage value E73 of detector 73.

When an address (D134) from counter 134 is supplied to ROM 135, ROM 135 reads out the data, i.e., reference thickness data (Data3), from this address. The readout data is then supplied to comparator 136.

Comparator 136 compares data in a predetermined range based on the reference thickness data (Data3) from ROM 135 with the thickness data (Data2) of original O from delay circuit 131. If the thickness of original O is smaller than the reference thickness, comparator 136 sets comparison result CPR4 to "L" level. If the thickness of original O is larger than the reference thickness data, comparator 136 sets comparison result CPR5 to "L" level. If the thickness of original O is equal to the reference thickness data, comparator 136 sets comparison result CPR6 to "L" level.

TABLE 7

| | | CPR4 | CPR5 | CPR6 |
|---|---|---|---|---|
| 1 | (Reference thickness data) > (sheet thickness) | L | H | H |
| 2 | (Reference thickness data) < (sheet thickness) | H | L | H |
| 3 | (Reference thickness data) = (sheet thickness) | H | H | L |

When a detection signal (CPR4 to CPR6) representing that the thickness of original O is smaller than the reference thickness is supplied from thickness detector 6 to controller 61, it is determined that original O being different from the reference sheet is conveyed. When the detection signal (CPR4 to CPR6) representing that the thickness of original O is larger than the reference thickness is supplied from thickness detector 76 to controller 61, controller 61 determines multiple paper-conveying of first original O.

When multiple paper-conveying or conveyance of original O which is different from the reference sheet is determined, controller 61 stops the feeding operation and informs main control unit 51 of occurrence of multiple paper-conveying. Main control unit 51 indicates occurrence of multiple paper-conveying or conveyance of original O different from the reference sheet on display unit 52*a* of operation panel 52.

When a detection signal (CPR4 to CPR6) representing that the thickness of original O is equal to the reference thickness is supplied from thickness detector 76 to controller 61, controller 61 performs original scanning of original O and paper discharge processing of original O. At the same time, next original O is fed from original feeding table 22 to original table 2 in the same manner as described above.

If a signal (CPR4 to CPR6) representing that the thickness of original O is not equal to the reference thickness is supplied from thickness detector 76 to controller 61, controller 61 may stop the feeding operation as an abnormal conveying.

Length detector 75 arranged when the size of original O to be fed is determined will be described below.

Figure 40:
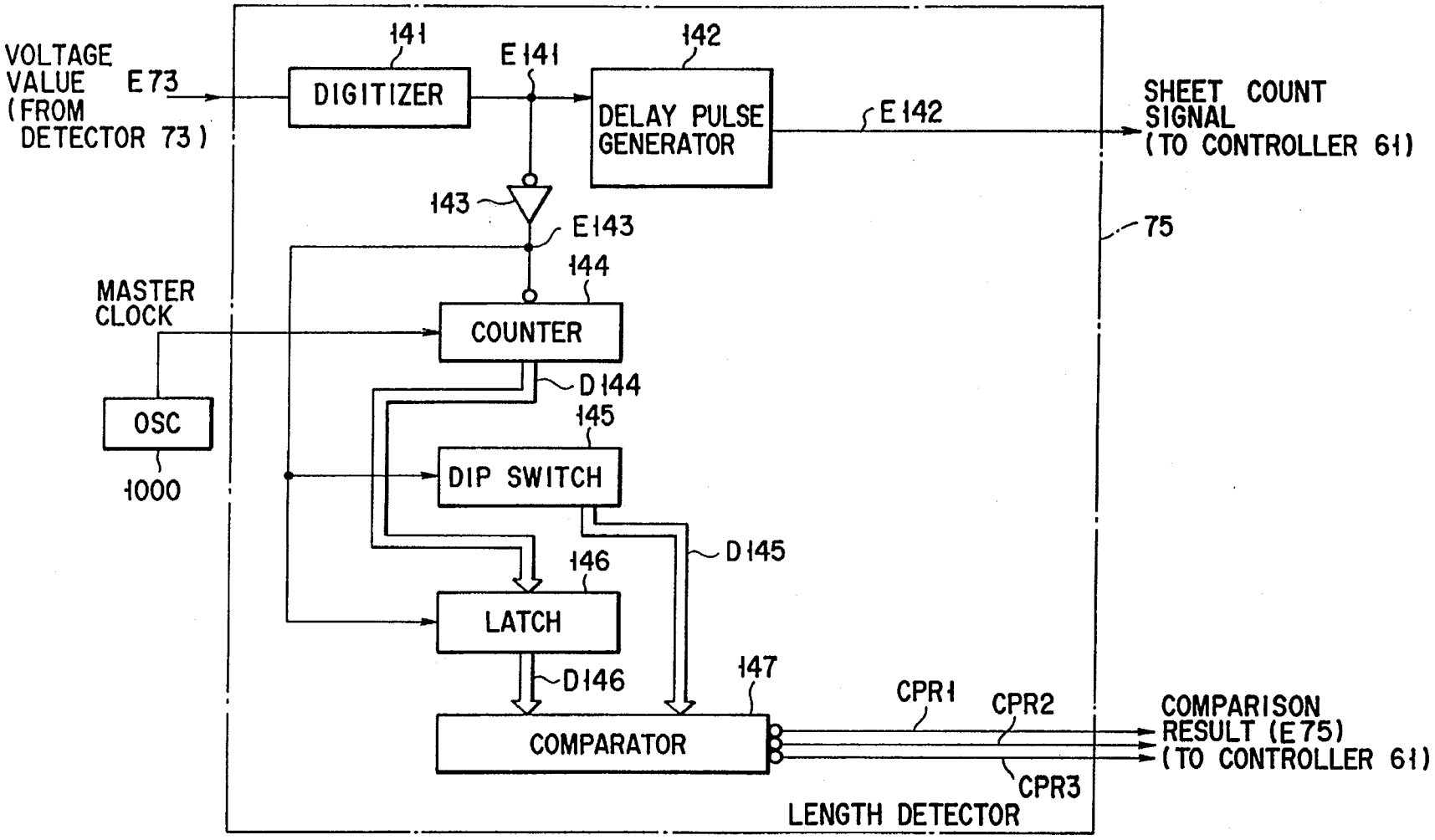
FIG. 40 is a schematic block diagram showing another arrangement of the length detector.

As shown in FIG. 40, this length detector 75 comprises digitizer 141, delay pulse generator 142, inverter 143, counter 144, dip switch (or rotary switch) 145, latch 146, and comparator 147. Length data having a predetermined size is stored in dip switch 145.

When the leading edge of original O reaches a portion between feeding roller 35 and aligning roller 34, digitizer 141 outputs signal E141 of "L" level in accordance with voltage value E73 detected by detector 73. With "H" level signal E143 obtained by inverting "L" level signal E141 via inverter 143, counter 144 starts to count the clock pulses from oscillator 1000. In this case, count value D144 of counter 144 is input to latch 146.

When the trailing edge of original O passes through feeding roller 35 and aligning roller 34, digitizer 141 outputs signal E141 of "H" level in accordance with voltage value E73 detected by detector 73 with "L" level signal E143 obtained by inverting "H" level signal E141 via inverter 143, counter 144 is cleared. As a result, the clock count (D144) corresponding to the length of original O is stored in latch 146.

Comparator 147 compares value D145 from dip switch 145, which represents the reference length, with count value D146 corresponding to the length of original O. As shown in Table 8, for example, when the length of original O is larger than the reference length (D145>D146), comparator 147 sets comparison result CPR1 to "L" level. When the length of original O is smaller than the reference length (D145<D146), comparator 147 sets comparison result CPR2 to "L" level. When the length of original O is equal to the reference length (D145=D146), comparator 147 sets comparison result CPR3 to "L" level.

TABLE 8

| | | CPR1 | CPR2 | CPR3 |
|---|---|---|---|---|
| 1 | (Reference length data) > (sheet length) | L | H | H |
| 2 | (Reference length data) < (sheet length) | H | L | H |
| 3 | (Reference length data) = (sheet length) | H | H | L |

As a result, when a detection signal (CPR1="L") representing that the length of original O is smaller than the reference length is supplied from length detector 75 to controller 61 (D145>D146), controller 61 determines that the length of original O having been conveyed is different from the length of the reference sheet. However, when a detection signal (CPR2="L") representing that the length of original O is larger than the reference length is supplied from length detector 75 to controller 61 (D145<D146), controller 61 determines multiple paper-conveying of first original O.

When multiple paper-conveying or conveyance of original O different from the reference sheet is determined, controller 61 stops the feeding operation and informs main control unit 51 of occurrence of multiple paper-conveying. Main control unit 51 indicates occurrence of multiple paper-conveying, or conveyance of original O being different from the reference sheet, on display unit 52*a* of operation panel 52.

When a detection signal (CPR3="L") representing that the length of original O is equal to the reference length is supplied from length detector 75 to controller 61 (D145=D146), controller 61 performs original scanning of original O and paper discharge processing of original O. At the same time, next original O is fed from original feeding table 22 to original table 2 in the same manner as described above.

When a signal representing that the length of original O is not equal to the reference length is supplied from length detector 75 to controller 61, controller 61 may stop the feeding operation as an abnormal conveying.

Figure 41:
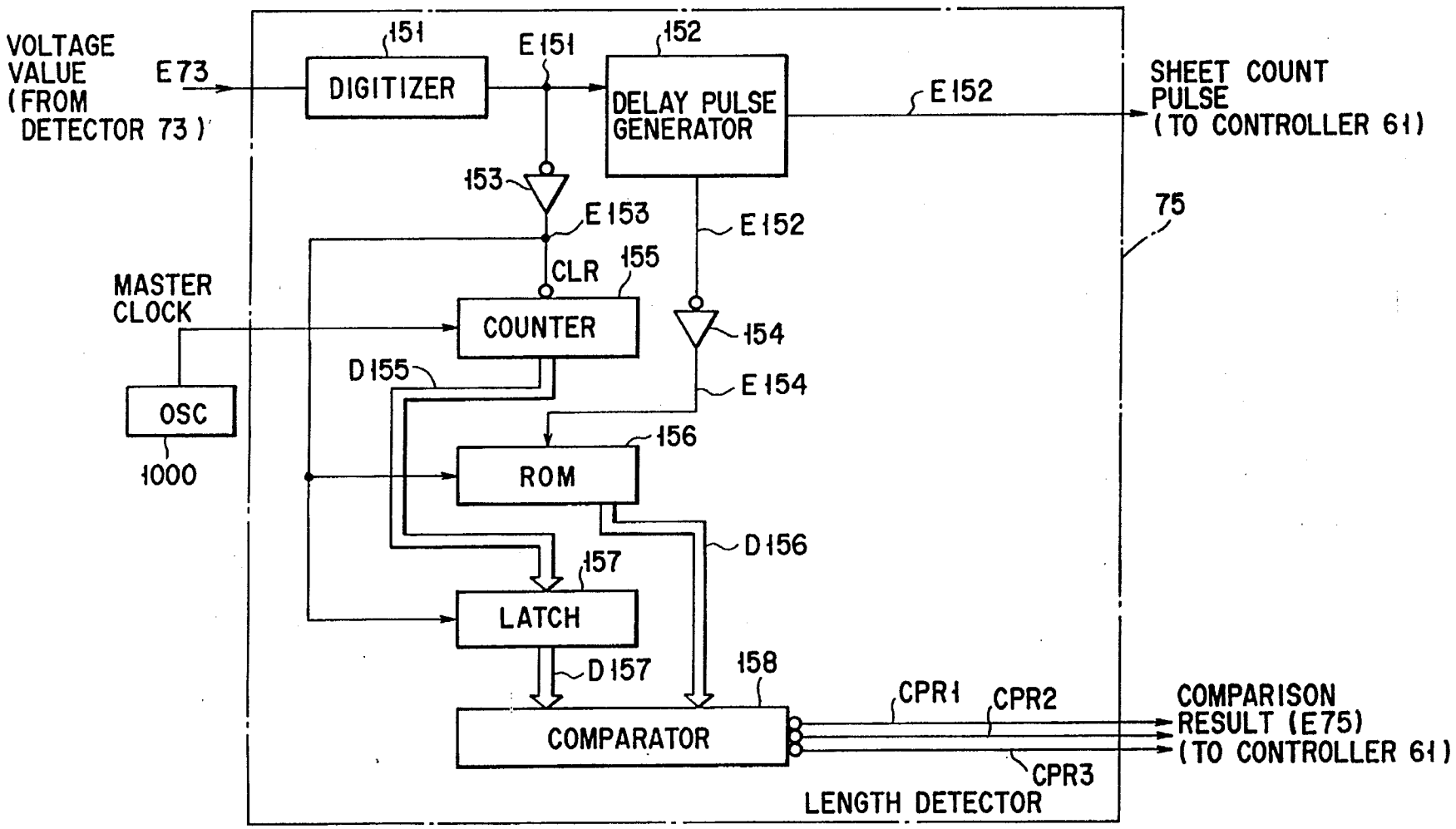
FIG. 41 is a schematic block diagram showing still another arrangement of the length detector.

In the above arrangement, the dip or rotary switch is used to store the reference length data. However, the reference length data may be set in a ROM. When a ROM is used, reference length data corresponding to a plurality of original sizes may be stored in the ROM and selectively used. The schematic block diagram of this arrangement is shown in FIG. 41. As shown in FIG. 41, length detector 75 comprises digitizer 151, delay pulse generator 152, inverters 153 and 154, counter 155, ROM 156, latch 157, and comparator 158.

When one reference length data is stored in ROM 156, signal E154 obtained by inverting delay pulse E152 from delay pulse generator 152 by inverter 154 is supplied to ROM 156. Then, the reference length data D156 of a predetermined length stored in ROM 156 is output to comparator 158. Other operations are the same as those in FIG. 40.

If a plurality of reference length data are stored in ROM 156, and when signal E154 obtained by inverting delay pulse E152 from delay pulse generator 152 by inverter 154 is supplied to ROM 156, reference length data D156 corresponding to the size designated from operation panel 52 is selectively output from ROM 156 to comparator 158. Other operations are the same as those in FIG. 40.

Figures 42A, 42B, 42C:
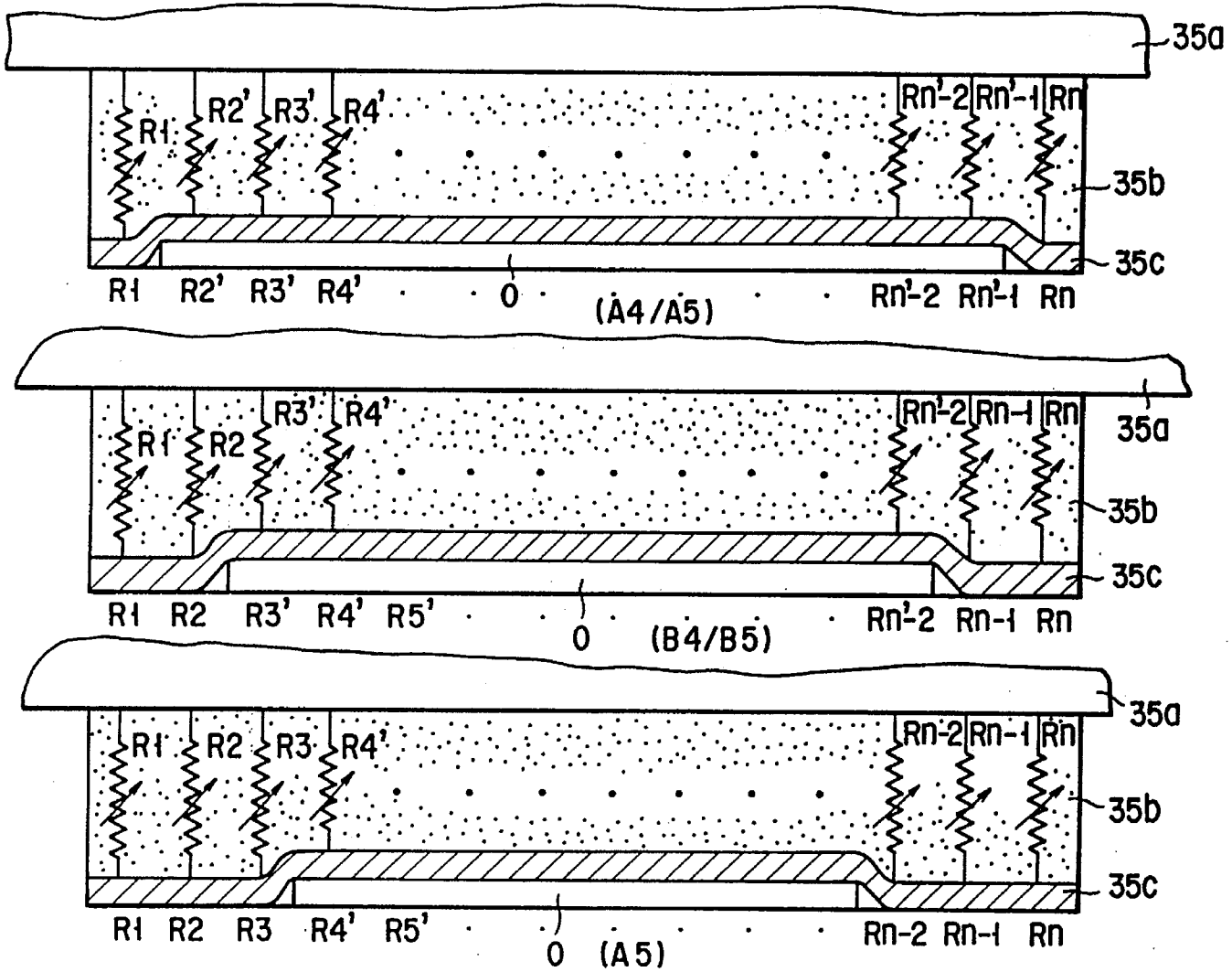
FIGS. 42A to 42C are equivalent circuit diagrams of the feeding roller.

An embodiment for detecting the size of original O to be fed, using different voltage values output from detector 73 on the basis of changes in resistance values of pressure sensitive conductive rubber 35*b* in feeding roller 35, will be described below. As can be apparent from an equivalent circuit shown in FIGS. 42A–42C, total resistance value R of pressure sensitive conductive rubber 35*b* is defined as follows in accordance with the size of original O to be fed. (1) When A5 crosswise/A4 lengthwise original O is clamped between feeding roller 35 and aligning roller 34, the following equation is established:

$$1/R=1/R1+1/R2+1/R3+1/Rn-2+1/Rn-1+1/Rn+(1/R'4+\ldots\ldots+1/R'n-3)$$

(2) When B5 crosswise/B4 lengthwise original O is clamped between feeding roller 35 and aligning roller 34, the following equation is established:

$$1/R=1/R1+1/R2+1/Rn-1+1/Rn+(1/R'3+\ldots\ldots+1/R'n-2)$$

(3) When A4 crosswise/A3 lengthwise original O is clamped between feeding roller 35 and aligning roller 34, the following equation is established:

$$1/R=1/R1+1/Rn+(1/R'2+1/R'3+\ldots\ldots+1/R'n-1)$$

Figure 43:
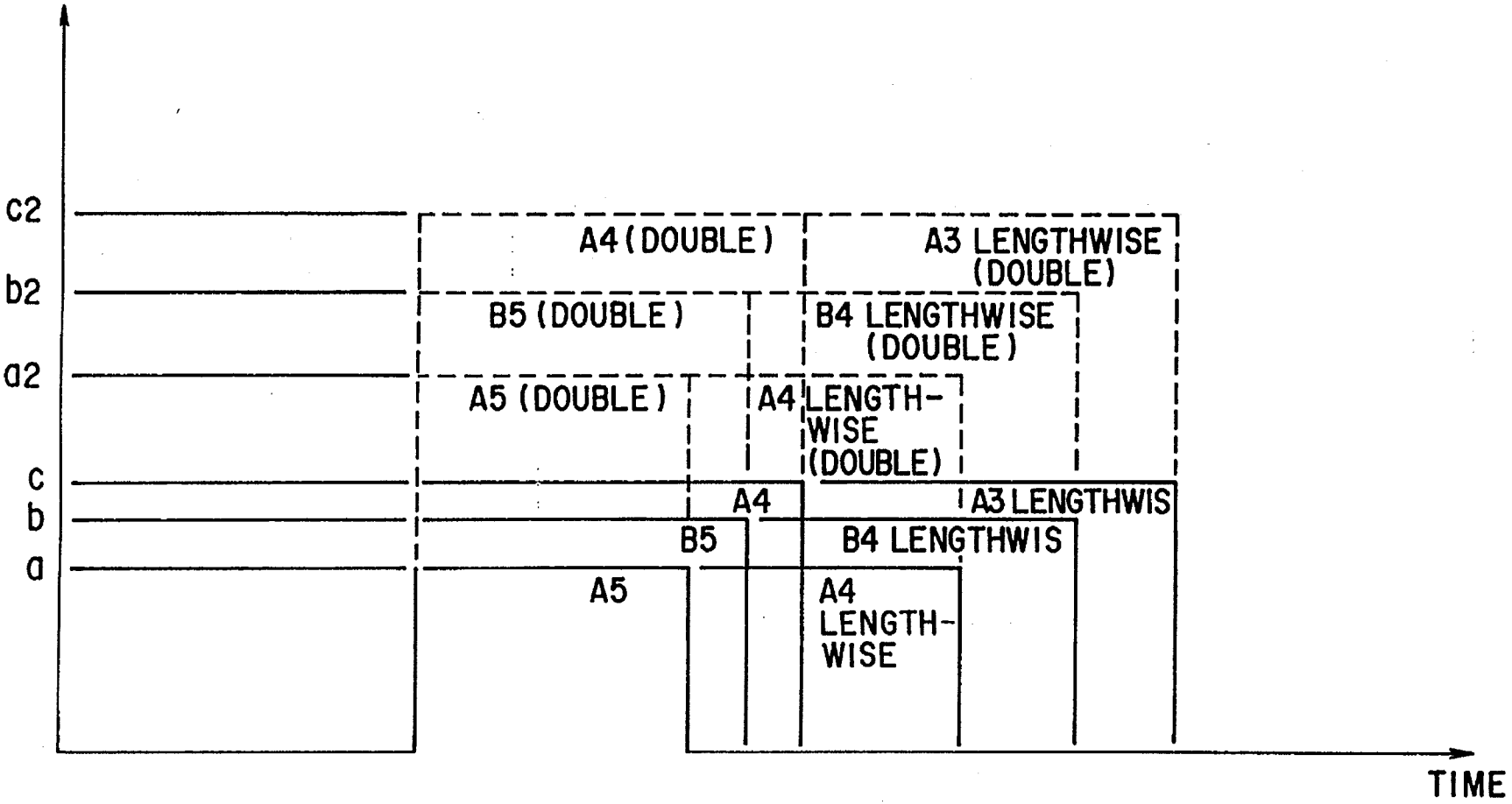
FIG. 43 is a chart showing outputs from a comparator in correspondence with original paper/sheet sizes.

When the type of original O is known in advance, the comparator-outputs (CPR1 to CPR3) corresponding to the size of original O are stored as table data in a nonvolatile storage means such as ROM 156. The outputs (CPR1 to CPR3) from ROM 156 are compared with the comparator-output upon feeding original O, so that the size of original O can be determined. An example of this table data is shown in FIG. 43.

The comparator outputs for all sizes of originals O upon feeding originals O free from multiple paper-conveying are defined as follows.

(1) When A5 crosswise/A4 lengthwise original O is clamped between feeding roller 35 and aligning roller 34, the comparator output is defined as a.

(2) When B5 crosswise or B4 lengthwise original O is clamped between feeding roller 35 and aligning roller 34, the comparator output is defined as b.

(3) When A4 crosswise or A3 lengthwise original O is clamped between feeding roller 35 and aligning roller 34, the comparator output is defined as c.

Since the thickness of original O is doubled upon occurrence of multiple paper-conveying, comparator outputs are defined as follows.

(1) when A4 crosswise or A3 lengthwise original O is clamped between feeding roller 35 and aligning roller 34, the comparator output is defined as a2.

(2) When B5 crosswise or B4 lengthwise original O is clamped between feeding roller 35 and aligning roller 34, the comparator output is defined as b2.

(3) when A5 crosswise or A4 lengthwise original O is clamped between feeding roller 35 and aligning roller 34, the comparator output is defined as c2.

For this reason, multiple paper-conveying detection and size detection can be performed by the same detection mechanism.

Discrimination between B4 crosswise and A3 lengthwise sizes, between B5 crosswise and B4 lengthwise sizes, and between A5 crosswise and A4 lengthwise sizes can be performed using length detection result.

An operation using thickness detector 76 in FIG. 39 will be described below.

In this case, reference thickness data corresponding to all the sizes described above are stored in correspondence with various counter values. Reference size data is output in correspondence with a count output from counter 134.

For example, reference data corresponding to A5 crosswise or A4 lengthwise original O, reference data corresponding to B5 crosswise or B4 lengthwise original O, reference data corresponding to A4 crosswise or A3 lengthwise original O, and reference data for multiple paper-conveying are stored in ROM 135.

With the above arrangement, when the leading edge of original O reaches a portion between feeding roller 35 and aligning roller 34, digitizer 131 outputs signal E131 of "L" level in accordance with voltage value E73 detected by detector 73. With signal E133 obtained by inverting the level of signal E131, counter 134 starts to count the clock pulses from oscillator 1000. In response to signal E131, a digital value (Data 1) from ADC 74 which corresponds to the voltage value from detector 73 is stored in delay circuit 132.

When various addresses are supplied from counter 134 to ROM 135, storage contents, i.e., reference size data written at the corresponding addresses are read out from ROM 135 and output to comparator 136.

Comparator 136 compares data in a predetermined range based on reference size data from ROM 135 with data of original O from delay circuit 132. For example, as shown in Table 10, when the original sheet is determined as A5 crosswise or A4 lengthwise original O, comparator 136 sets comparison result CPR4 to "L" level. When the original sheet is determined as B5 crosswise or B4 lengthwise original O, comparator 136 sets comparison result CPR5 to "L" level. When the original sheet is determined as A4 crosswise or A3 lengthwise original O, comparator 136 sets comparison result CPR6 to "L" level. When the original sheet is determined to have been subjected to multiple paper-conveying, comparator 136 sets all comparison results CPR4, CPR5, and CPR6 to "H" level.

TABLE 9

| | CPR4 | CPR5 | CPR6 |
|---|---|---|---|
| 1 If sheet is A4 crosswise/A3 lengthwise sheet | L | H | H |
| 2 If sheet is B5 crosswise/A3 lengthwise sheet | H | L | H |
| 3 If sheet is A5 crosswise/A3 lengthwise sheet | H | H | L |
| 4 If multiple paper-conveying occurs | H | H | H |

When comparison result CPR4 of "L" level is supplied from thickness detector 76 to controller 61, controller 61 determines feeding of A5 crosswise or A4 lengthwise original O. When comparison result CPR5 of "L" level is supplied from thickness detector 76 to controller 61, controller 61 determines feeding of B5 crosswise or B4 lengthwise original O. When comparison result CPR6 of "L" level is supplied from thickness detector 76 to controller 61, controller 61 determines feeding of A4 crosswise or A3 lengthwise original O. When all comparison results CPR4, CPR5, and CPR6 of "H" level are supplied from thickness detector 76 to controller 61, controller 62 determines multiple paper-conveying of original O and stops the feeding operation.

Figure 44:
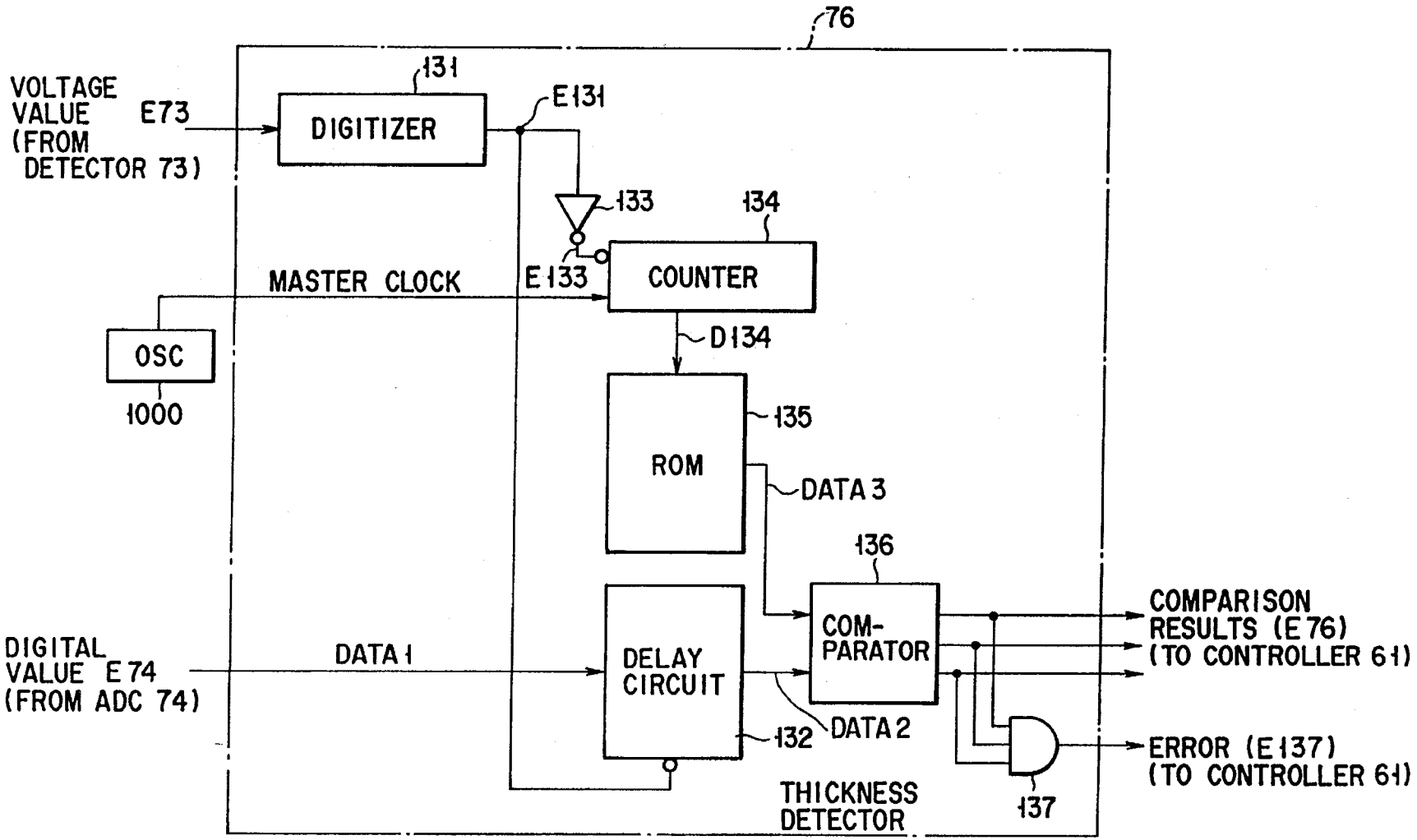
FIG. 44 is a schematic block diagram showing still another arrangement of the thickness detector.

As shown in FIG. 44, AND gate 137 for logically ANDing comparison results CPR4, CPR5, and CPR6 from comparator 136 to output error detection signal E137 may be arranged in thickness detector 76 shown in FIG. 39. In this case, controller 61 determines multiple paper-conveying of original O to stop the feeding operation in accordance with the error detection signal from AND gate 137 in thickness detector 76.

Figure 45:
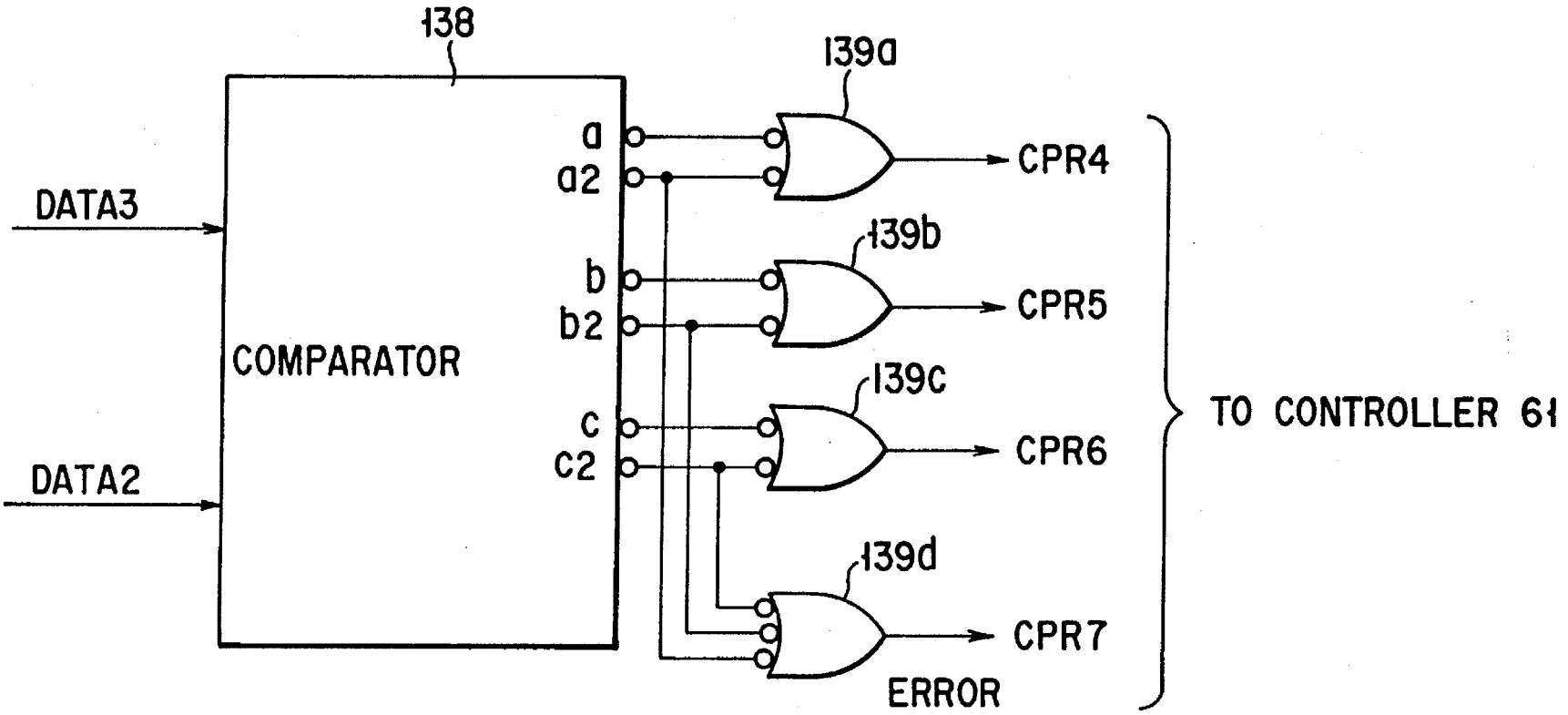
FIG. 45 is a schematic block diagram showing still another arrangement of the thickness detector.

To detect multiple paper-conveying for each size, as shown in FIG. 45, comparator 138, and NAND gates 139*a*, 139*b*, 139*c*, and 139*d* may be used in place of comparator 136 and AND gate 137 shown in FIG. 44. Comparator 138 can be constituted by a programmable logic device. When A4 crosswise or A3 lengthwise original O is normally fed, comparator 138 outputs a signal of "L" level at the $\underline{c}$ terminal. When A4 crosswise or A3 lengthwise original O is determined to have been subjected to multiple paper-conveying, comparator 138 outputs a signal of "L" of the c2 terminal. When B5 crosswise or B4 lengthwise original O is normally fed, comparator 138 outputs a signal of "L" level of the $\underline{b}$ terminal. When B5 crosswise or B4 lengthwise original O is determined to have been subjected to multiple paper-conveying, comparator 136 outputs a signal of "L" level of the b2 terminal. When A5 crosswise or A4 lengthwise original O is normally fed, comparator 136 outputs a signal of "L" level of the $\underline{a}$ terminal. When A5 crosswise or A4 lengthwise original O is determined to have been subjected to multiple paper-conveying, comparator 136 outputs a signal of "L" level of the a2 terminal.

NAND gate 139*a* outputs a NAND signal of the signals at the comparison result $\underline{a}$ and a2 terminals. NAND gate 139*b* outputs a NAND signal of signals at the comparison result $\underline{b}$ and b2 terminals. NAND gate 139*c* outputs a NAND signal of the signals at the comparison result $\underline{c}$ and c2 terminals. NAND gate 139*d* outputs a NAND signal of signals at the a2, b2, and c2 terminals. The outputs from NAND gates 139*a*, 139*b*, 139*c*, and 139*d* are output to controller 61 as comparison results CPR4 to CPR7, respectively.

The relationship between comparison results CPR4 to CPR7 and the fed states of originals O is shown in Table 10.

TABLE 10

| | CPR4 | CPR5 | CPR6 | CPR7 |
|---|---|---|---|---|
| 1 Normal feeding of A4 crosswise/A3 lengthwise sheet | L | H | H | H |
| 2 Multiple paper-conveying of A4 crosswise/ A3 lengthwise sheet | L | H | H | L |
| 3 Normal feeding of B5 crosswise/B4 lengthwise sheet | H | L | H | H |
| 4 Multiple paper-conveying of B5 crosswise/ B4 lengthwise sheet | H | L | H | L |
| 5 Normal feeding of A5 crosswise/A4 lengthwise sheet | H | H | L | H |
| 6 Multiple paper-conveying of A5 crosswise/ A4 lengthwise sheet | H | H | L | L |

The sizes of originals O can be determined into three types in accordance with the widths of originals O as described above.

The length of original O is detected to discriminate the A4 crosswise size from the A3 lengthwise size, the B5 crosswise size from the B4 lengthwise size, or the A5 crosswise size from the A4 lengthwise size.

For example, when controller 61 determines a size 10 group of original O in accordance with a comparison result from thickness detector 76 (width detector) shown in FIGS. 44 and 45, a data table in ROM 156 in length detector 75 shown in FIG. 41 is selected (i.e., selection of an address in ROM 156 for each size group) by controller 61. One of the size groups is determined in accordance with comparison result CPR1 from comparator 158.

Since the widthwise size is already detected, comparator 158 sets comparison result CPR1 as follows.

1. If the A4 crosswise or A3 lengthwise sheet is determined to be the A4 crosswise sheet, comparison result CPR1 is set at "H" level; if it is determined to be the A3 lengthwise sheet, comparison result CPR1 is set at "L" level.

2. If the B5 crosswise or B4 lengthwise sheet is determined to be the B5 crosswise sheet, comparison result CPR1 is set at "H" level; if it is determined to be the B4 lengthwise sheet, comparison result CPR1 is set at "L" level.

3. If the A5 crosswise or A4 lengthwise sheet is determined to be the A5 crosswise sheet, comparison result CPR1 is set at "H" level; if it is determined to be the A4 lengthwise sheet, comparison result CPR1 is set at "L" level.

Controller 61 reads this determination result to determine the size.

In addition, controller 61 can detect multiple paper-conveying in accordance with length direction data.

Assume that original O detected by thickness detector 76 serving as the width detector shown in FIGS. 44 and 45 belongs to size group 1.

When an output stored in latch 146 is data representing a size smaller than the A3 size after it is determined to represent a length of A4 size or more, comparison result CPR2 of comparator 158 is set at "L" level. Controller 61 determines multiple paper-conveying in accordance with this comparison result CPR2 to stop the feeding operation.

Figure 46:
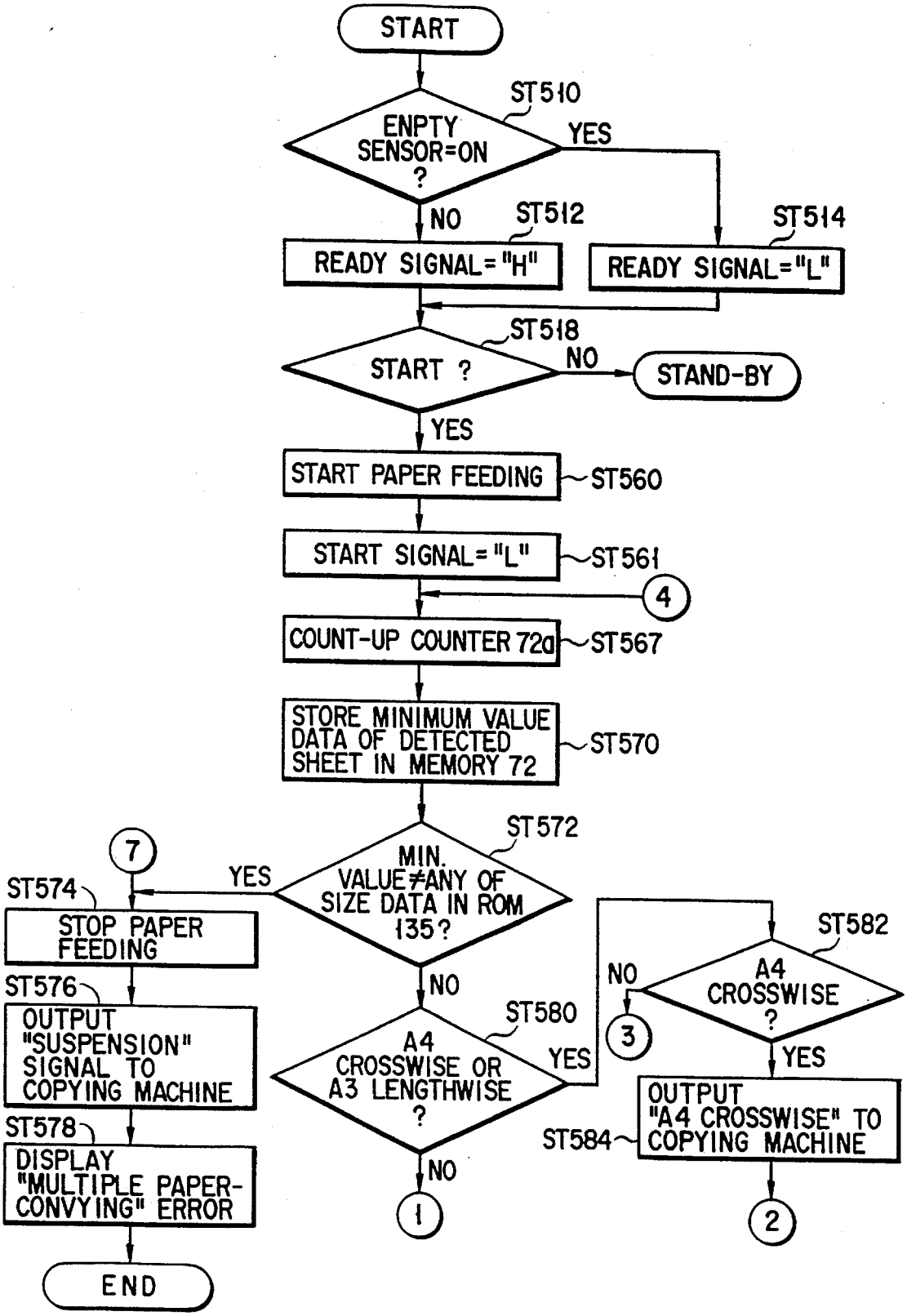
FIG. 46 is a flow chart for explaining a paper/sheet size detection operation and a multiple paper-conveying detection operation during feeding for an original.
Figure 47:
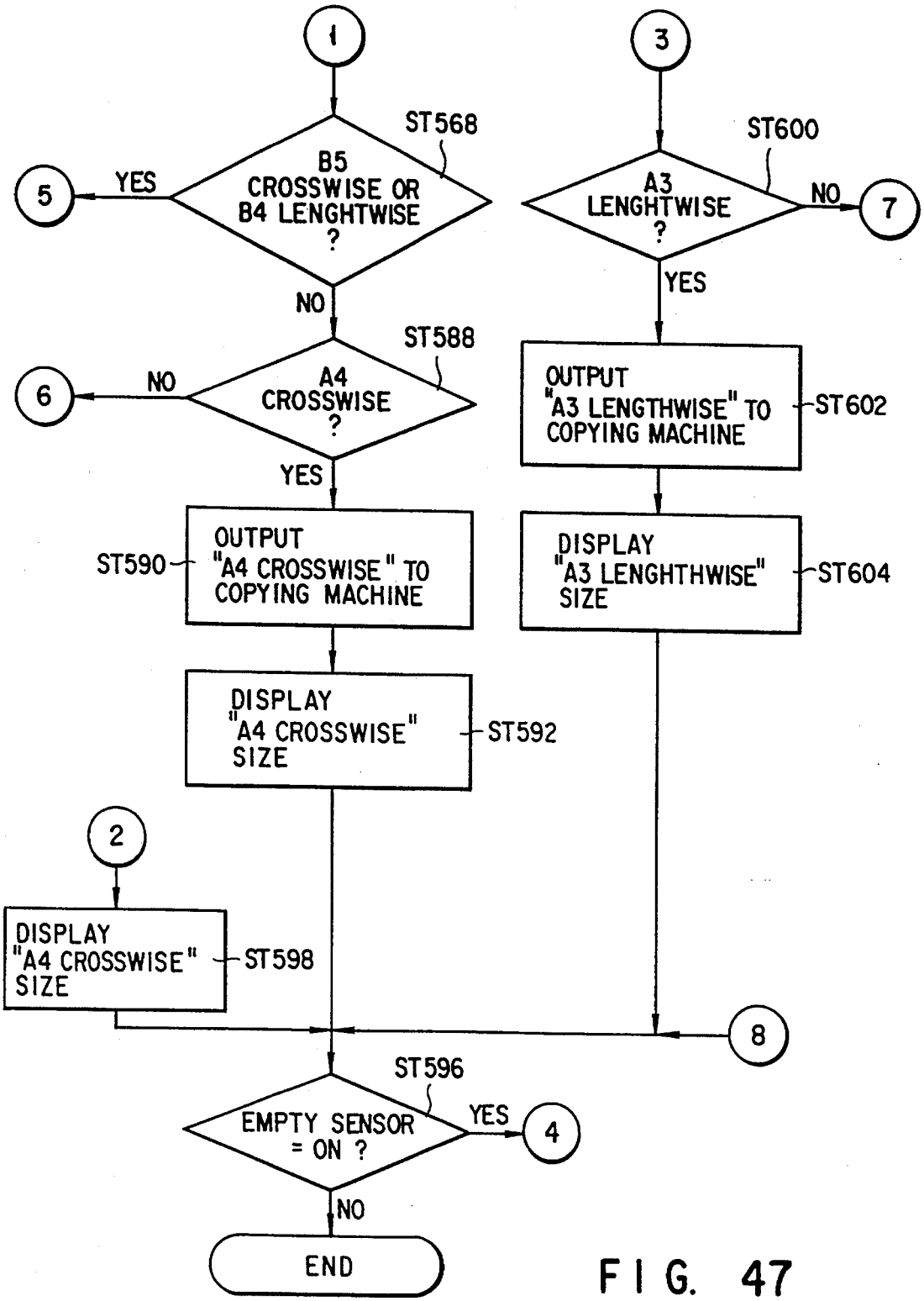
FIG. 47 is a flow chart for explaining the paper/sheet size detection operation during feeding for the original.
Figure 48:
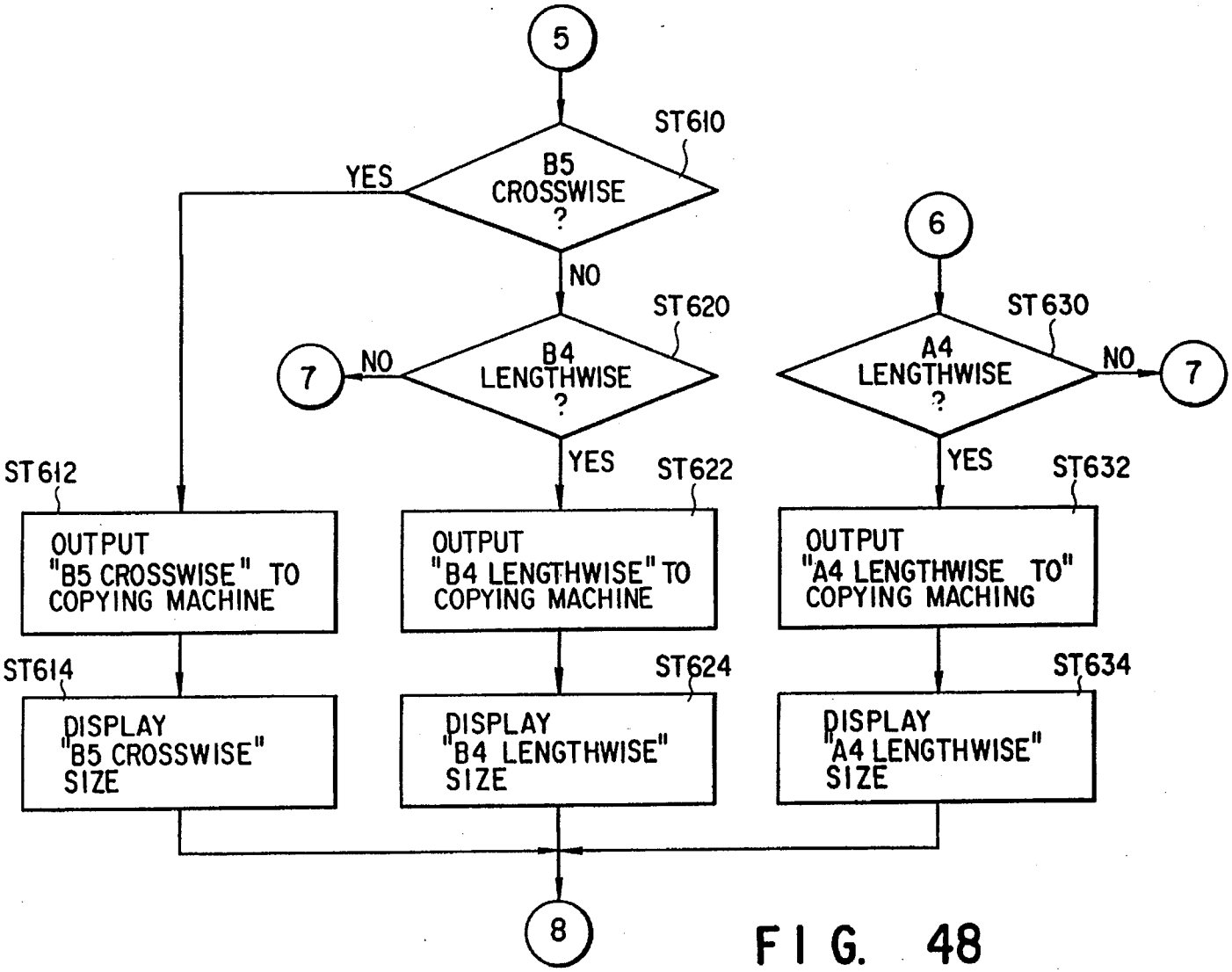
FIG. 48 is a flow chart for explaining the paper/sheet size detection operation during feeding for the original.

Flow charts of the multiple paper-conveying detection together with size detection are shown in FIGS. 46 to 48.

During the OFF period of empty sensor 29 upon power-ON operation of the apparatus (NO in ST510), the ready signal is set at "H" level (ST512). When the turn-ON operation of empty sensor 29 is detected (YES in ST510), the ready signal goes to "L" level (ST514).

For example, when the copy start button of the copying machine is depressed (YES in ST518), automatic paper feeding is started (ST560). When the leading edge of first original O reaches the portion between feeding roller 35 and aligning roller 34, output signal E131 from digitizer 131 in FIG. 44 goes to "L" level (ST562), and counter 72*a* arranged in memory 72 in FIG. 26 is incremented by one (ST567).

Minimum value detection of a digital value (Data1 in FIG. 44) from ADC 74, which is associated with currently fed first original original O, is performed. The algorithm of this minimum value detection may be identical to that used in minimum value detection step ST364 in FIG. 34. The minimum data detected here is stored at a predetermined address of memory 72 (ST570).

Data (Data2 in FIG. 45) corresponding to the minimum value of the size of first original O, which is stored in memory 72, is compared with each size data (size data Data3 corresponding to an A4 crosswise or B4 lengthwise size) read out from the address of ROM 135 which is specified by address data D134 from address counter 134 (ST572).

Minimum value data (Data2) of the size does not correspond to any ROM data (Data3) (YES in ST572), double-conveying of the first original sheet is detected. In this case, the CPU in controller 61 in FIG. 26 generates an interrupt signal to stop paper feeding in the automatic paper feeding apparatus in FIG. 2 (ST574). At the same time, the CPU in controller 61 outputs a "suspension" signal corresponding to the stop of paper feeding to copying machine main body 1 (ST576). A "multiple paper-conveying" error is displayed on a display unit (not shown) of main body 1 (ST578), thereby completing the processing in FIG. 46.

If the minimum value data (Data2) of the size corresponds to any ROM data (Data3) (NO in ST572), it is checked if the minimum value data (Data2) of the size corresponds to the A4 crosswise or A3 lengthwise size (ST580).

If the minimum value data (Data2) of the size corresponds to the A4 crosswise size (YES in ST580; YES in ST582), the CPU in controller 61 determines that first original O is an A4 crosswise sheet. The CPU then outputs information representing the "A4 crosswise size" to copying machine main body 1 (ST584). In step ST598 of FIG. 47, an "A4 crosswise" size is displayed (ST598).

If sheets to be fed are still left, and empty sensor 29 is kept on (YES in ST596), the flow returns to step ST567 in FIG. 46, and the operations in steps ST567 to ST596 are repeated.

If the minimum value data (Data2) of the size corresponds to neither the A4 crosswise size nor the A3 lengthwise size (NO in ST580), it is checked if the minimum value data (Data2) of the size corresponds to B5 crosswise or B4 lengthwise size (ST586).

When the minimum value data (Data2) of the size corresponds to neither the B5 crosswise size nor the B4 lengthwise size (NO in ST586), it is checked if the length data detected by length detector 75 in FIG. 26 corresponds to the A4 crosswise size (ST588).

When the detected sheet size corresponds to the A4 crosswise size (YES in ST588), the CPU in controller 61 outputs information representing the "A4 crosswise size" to copying machine main body 1 (ST590). The size of fed original O is displayed as an "A4 crosswise" size in main body 1 (ST592).

If sheets to be fed are still left, and empty sensor 29 is kept on (YES in ST596), the flow returns to step ST567, and the operations in steps ST567 to ST596 are repeated.

If the minimum value data (Data2) of the size does not correspond to the A4 crosswise size (NO in ST582), the CPU in controller 61 checks if first original O is a sheet of A3 lengthwise size (ST600).

If the size of set original O is not an A3 lengthwise size (NO in ST600), original O is detected to be double-conveyed. In this case, the CPU in controller 61 in FIG. 26 generates an interrupt signal to stop paper feeding in the automatic paper feeding apparatus in FIG. 2 (ST574). At the same time, the CPU in controller 61 outputs a "suspension" signal corresponding to the stop of paper feeding to copying machine main body 1 (ST576). A "multiple paper-conveying" error is then displayed on a display unit (not shown) in main body 1 (ST578), thereby completing the processing in FIG. 46.

If the size of set original O is the A3 lengthwise size (YES in ST600), the CPU in controller 61 outputs information representing the "A3 lengthwise size" to copying machine main body 1 (ST602). The size of fed original O is displayed as the "A3 lengthwise" size in main body 1 (ST604).

If original sheets to be fed are still left, and empty sensor 29 is kept on (YES in ST596), the flow returns to step ST567 in FIG. 46, and the operations in steps ST567 to ST596 are repeated.

If the minimum value data (Data2) of the size corresponds to a B5 crosswise size (YES in ST586; YES in ST610), the CPU in controller 61 outputs information representing the "B5 crosswise size" to copying machine main body 1 (ST612). The size of fed original O is displayed as the "B5 crosswise" size in main body 1 (ST614).

If the minimum value data (Data2) of the size corresponds to the B5 crosswise or B4 lengthwise size (YES in ST586), but does not correspond to the B5 crosswise size (NO in ST610), it is checked if the length data detected by length detector 75 in FIG. 26 corresponds to the B4 lengthwise size (ST620).

If the detected sheet length corresponds to the B4 lengthwise size (YES in ST620), the CPU in controller 61 outputs information representing the "B4 lengthwise size" to copying machine main body 1 (ST622). The size of fed original O is displayed as the "B4 lengthwise" size in main body 1 (ST624).

When the detected sheet length does not correspond to the A4 crosswise size (NO in ST584), it is checked if the size of the set sheet corresponds to the A4 lengthwise size (ST630).

If the size of the set original sheet corresponds to the A4 lengthwise size (YES in ST630), the CPU in controller 61 outputs information representing the "A4 lengthwise size" to copying machine main body 1 (ST632). The size of fed original O is displayed as the "A4 lengthwise" size in main body 1 (ST634).

After display processing in step ST614, ST624, or ST634, if original sheets to be fed are still left, and empty sensor 29 is kept on (YES in ST596), the flow returns to step ST567 in FIG. 46, and the operations in steps ST567 to ST634 are repeated.

If the sheet size does not correspond to the B4 lengthwise size (NO in ST620), or the sheet size does not correspond to the A4 lengthwise size (NO in ST630), original O is detected to be double-conveyed. In this case, the CPU in controller 61 generates an interrupt signal to stop paper feeding in the automatic paper feeding apparatus in FIG. 2 (ST574). At the same time, the CPU in controller 61 outputs a "suspension" signal corresponding to the stop of paper feeding to copying machine main body 1 (ST576). A "multiple paper-conveying" error is displayed on a display unit (not shown) in main body 1 (ST578), thereby completing the processing in FIG. 46.

The size of original O can be detected using only the data from length detector 75.

Figure 49:
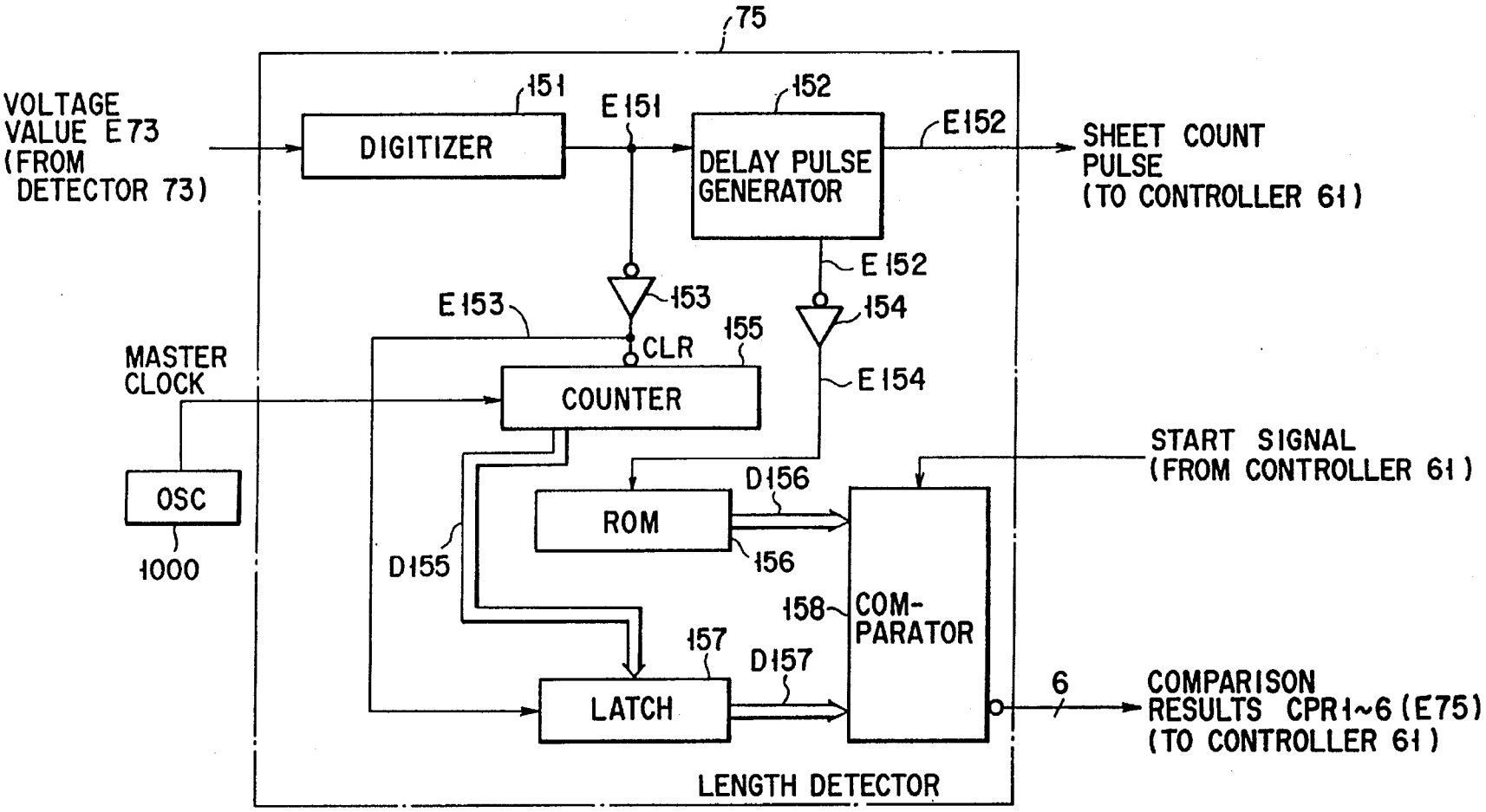
FIG. 49 is a schematic block diagram showing another arrangement of the length detector.

The schematic arrangement of length detector 75 is shown in FIG. 49.

When six types of sheets, i.e., the A4 crosswise, A3, B5 crosswise, B4, A5 crosswise, and A4 sheets are to be discriminated from each other, the lengths of originals O are as follows.

A4 crosswise: 210 mm

A3: 420 mm

B5 crosswise: 176 mm

B4: 350 mm

A5 crosswise: 148 mm

A4: 297 mm

Data D156 corresponding to these lengths are stored as table data in ROM 156, and detected length data D157 can be compared with table data D156 by comparator 158.

As shown in Table 11, when the length of original O is the A5 crosswise size, comparator 158 sets comparison result CPR1 to "L". When the length of original O is the B5 crosswise size, comparator 158 sets comparison result CPR2 to "L" level. When the length of original O is the A4 crosswise size, comparator 158 sets comparison result CPR3 to "L" level. When the length of original O is the B4 lengthwise size, comparator 158 sets comparison result CPR4 to "L". When the length of original O is the B4 lengthwise size, comparator 158 sets comparison result CPR5 to "L". When the length of original O is the A3 lengthwise size, comparator 158 sets comparison result CPR6 to "L" level.

TABLE 11

| | Sheet Size | CPR1 | CPR2 | CPR3 | CPR4 | CPR5 | CPR6 |
|---|---|---|---|---|---|---|---|
| 1 | A5 crosswise | L | H | H | H | H | H |
| 2 | B5 crosswise | H | L | H | H | H | H |
| 3 | A4 crosswise | H | H | L | H | H | H |
| 4 | A4 length-wise | H | H | H | L | H | H |
| 5 | B4 length-wise | H | H | H | H | L | H |
| 6 | A3 length-wise | H | H | H | H | H | L |

Controller 61 checks comparison results CPR1 to CPR6 from comparator 158 to determine the size of original O.

As described in the embodiment of width detection data, when all comparison results CPR1 to CPR6 from comparator 158 are set at "H" upon detection of data except for the predetermined size, multiple paper-conveying can also be detected.

The user may insert actually used original O onto automatic paper feeding apparatus 20 and may store the original sheet data as reference data in a storage means which is backed up by a battery.

Since thicknesses of originals O are different depending on different types of originals O, outputs from pressure sensitive conductive rubber 35*b* in feeding roller 35 may be different from each other depending on different sizes. Further, original O inserted into automatic paper feeding apparatus 20 is not necessarily a fixed size. In this case, in order to update the ROM data, a special tool is required. Such a requirement makes it difficult to allow the operator to perform this data updating. However, if data of actually used originals O can be stored in a nonvolatile storage means by the operator, the above problem can be solved.

Figure 50:
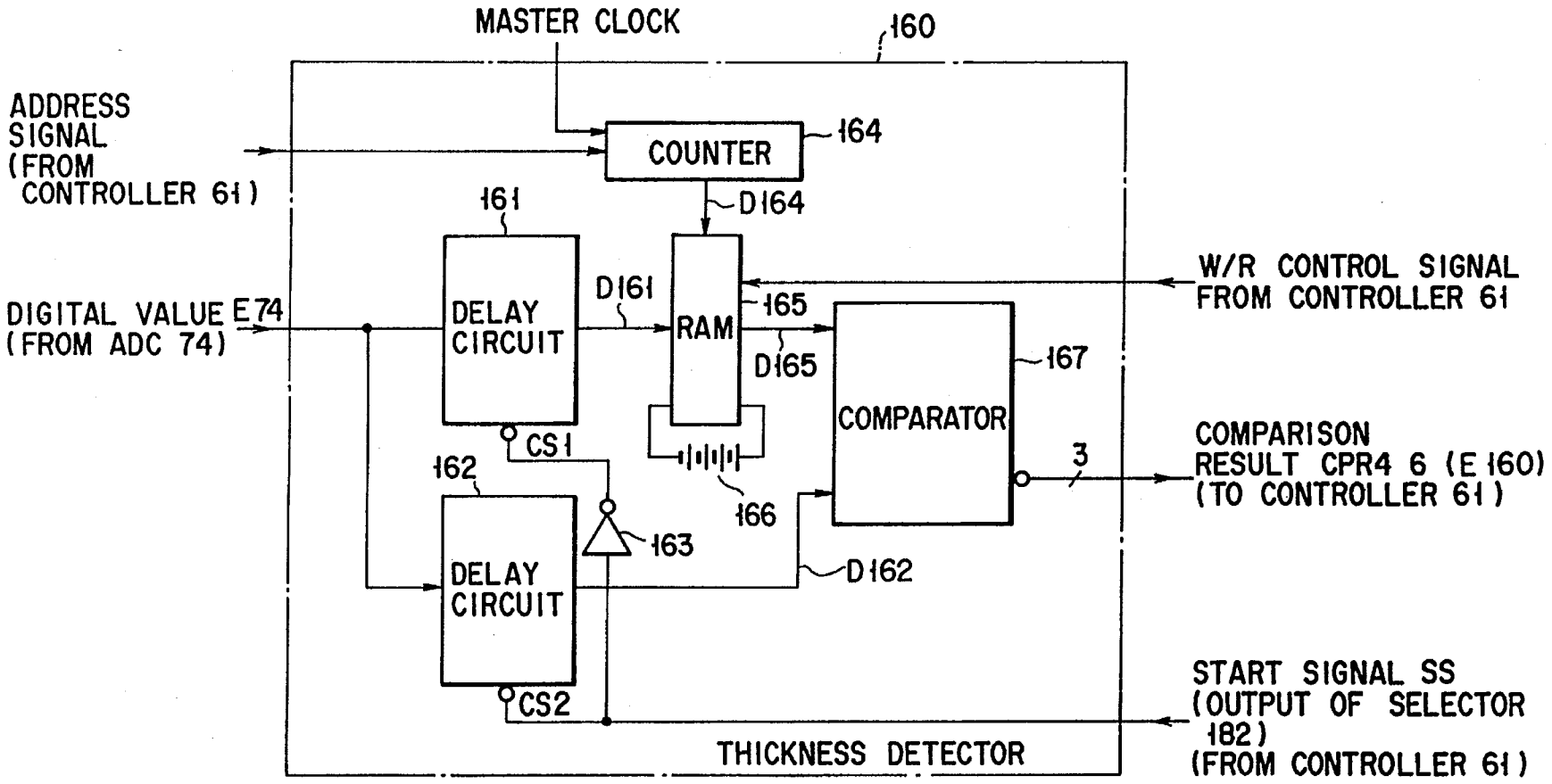
FIG. 50 is a schematic block diagram showing another arrangement of the thickness detector.

The schematic diagram of thickness detector 160 for performing the above operation is shown in FIG. 50. This thickness detector 160 comprises delay circuits 161, and 162, inverter 163, counter 164, RAM 165, battery 166, and comparator 167.

When the operator is to input data of original O, he or she selects the size of original O on operation panel 52.

Controller 61 in automatic paper feeding apparatus 20 is switched to a data input mode upon operation of an input mode select key (not shown).

When data of original O having a fixed size is entered as reference data, each fixed size is selected. A special free size is selected from free sizes 1 to 4.

By this selection, controller 61 causes counter 164 to generate an address corresponding to the designated size information.

Prior to detection of original O serving as a reference by a feeding operation, controller 61 sets start signal SS to "H" level. At this time, chip select signal CS1 from delay circuit 161 goes to "L" level by inverter 163. On the other hand, chip select signal CS2 from delay circuit 162 is set at "H" level. Therefore, delay circuit 161 is set in an operative state while delay circuit 162 is set in an inoperative state.

When automatic paper feeding apparatus 20 is set in a ready state, and if original O is detected by empty sensor 29, controller 61 starts the feeding operation. Reference original O is fed to the lower-surface side of original conveyor belt 37 currently driven in the feeding direction through a resist roller pair constituted by aligning roller 34 and feeding roller 35.

Reference original O passes through aligning roller 34 and feeding roller 35, and data (D161) corresponding to the thickness of reference original O is stored as a reference value in RAM 165 in thickness detector 160 at the address designated by controller 61. This operation is similar to that of thickness detector 76 shown in FIG. 20.

The above operations are repeated for data entry of another original O.

As a result, each size data is stored in RAM 165 being backed up by battery 166.

A normal mode is restored at the end of data entry of original O. At this time, controller 61 sets start signal SS to "L" level. Chip select signal CS1 of delay circuit 161 from inverter 163 is set at "H" level.

On the other hand, chip select signal CS2 (=SS) from delay circuit 162 is set at "L" level. In this case, delay circuit 161 is set in an inoperative state, while delay circuit 162 is set in an operative state.

Detection data (D162) input to automatic paper feeding apparatus 20 in the normal mode is temporarily stored in delay circuit 162 and compared by comparator 167 with the reference data (D165) stored in RAM 165.

Data D165 stored in RAM 165 is held as the entry data itself without any change in the normal mode, as a matter of course, because delay circuit 161 is set in an inoperative state.

As described above, multiple paper-conveying detection or size detection can be performed.

A method of discriminating output results from comparator 167 is the same as the comparison/discrimination method (FIG. 39) using Data3 of ROM 135 as reference data.

When only fixed sizes are used in automatic paper feeding apparatus 20, length data do not adversely affect the types of original O, and length detector 75 shown in FIG. 41 may be used.

Multiple paper-conveying or size detection can be performed by a combination of detection results in the widthwise and longitudinal directions.

An embodiment for inputting a free size will be described below.

Figure 51:
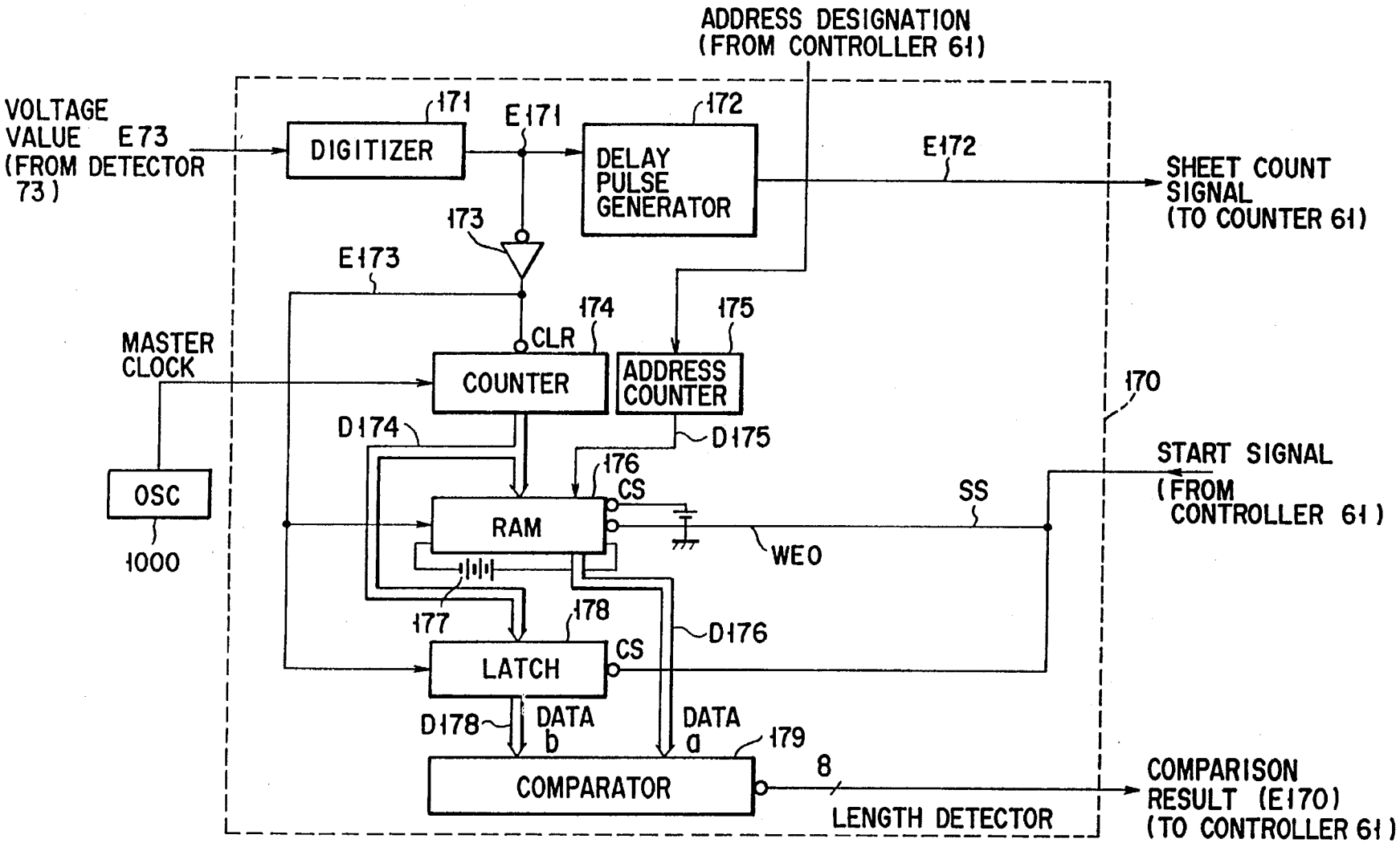
FIG. 51 is a schematic block diagram showing still another arrangement of the length detector.

The schematic block diagram of length detector 170 for this purpose is shown in FIG. 51. This length detector 170 comprises digitizer 171, delay pulse generator 172, inverter 173, counter 174, address counter 175, RAM 176, battery 177, latch 178, and comparator 179.

Upon operation of an input mode select key (not shown), controller 61 in automatic paper feeding apparatus 20 is switched to a data input mode.

If data of original O having a fixed size is entered as reference data, each fixed size is selected. However, if a special free size is to be entered as reference data, free sizes (1 to 4) are selectively used.

By this selection, controller 61 causes counter 175 to generate an address (D175) corresponding to the designated size information.

Prior to detection of reference original O by a feeding operation, controller 61 sets start signal SS at "H" level. At this time, a write enable signal (WE0) is set at "H" level. Thus, RAM 176 is set at a write enable state.

On the other hand, since chip select signal CS of latch 178 is set at "H" level, latch 178 is set in an inoperative state.

When automatic paper feeding apparatus 20 is set in a ready state, and if original O is detected by empty sensor 29, controller 61 starts the feeding operation. Reference original O is fed to the lower-surface side of original conveyor belt 37 currently driven in the feeding direction through a resist roller pair constituted by aligning roller 34 and feeding roller 35.

Reference original O passes through aligning roller 34 and feeding roller 35, and data (D174) corresponding to the length of reference original O is stored as a reference value in RAM 176 in length detector 180 at the address (D175) designated by controller 61. This operation is similar to that of length detector 75 shown in FIG. 14.

The above operations are repeated for data entry of another original O. As a result, each size data is stored in RAM 176 which is backed up by a battery.

A normal mode is restored at the end of data entry of original O. At this time, controller 61 sets start signal SS to "L" level, and the write enable signal (WE0) to RAM 176 is set at "L" level. In this case, RAM 176 is set in a write disable state.

On the other hand, since chip select signal CS from latch 178 is set at "L" level, latch 178 is set in an operative state.

The length data (D174) input to automatic paper feeding apparatus 20 in the normal mode is stored in latch 178. The stored length data (D178) is compared by comparator 179 with reference data D176 stored in RAM 176.

The data (D176) stored in RAM 176 is held as the entry data itself without any change in the normal mode, as a matter of course.

As described above, multiple paper-conveying detection or size detection can be performed. A method of discriminating output results from this comparator 167 is the same as the comparison/discrimination method (FIG. 41) using data D156 of ROM 156 as reference data.

Multiple paper-conveying detection is generally performed based on reference data stored in the nonvolatile storage means. Only when original O having a free size, or original O not used in a normal operation, is to be inserted to the automatic paper feeding apparatus, multiple paper-conveying may be detected with reference to the data of first original O.

With the above arrangement, the reference sheet data described above need not be used as entry data.

The embodiment of the above case will be described with reference to length detector 180 in FIG. 55, thickness detector 160 shown in FIG. 50, data storage contents shown in FIGS. 53 and 54, and flow charts shown in FIGS. 55 to 59.

Figure 52:
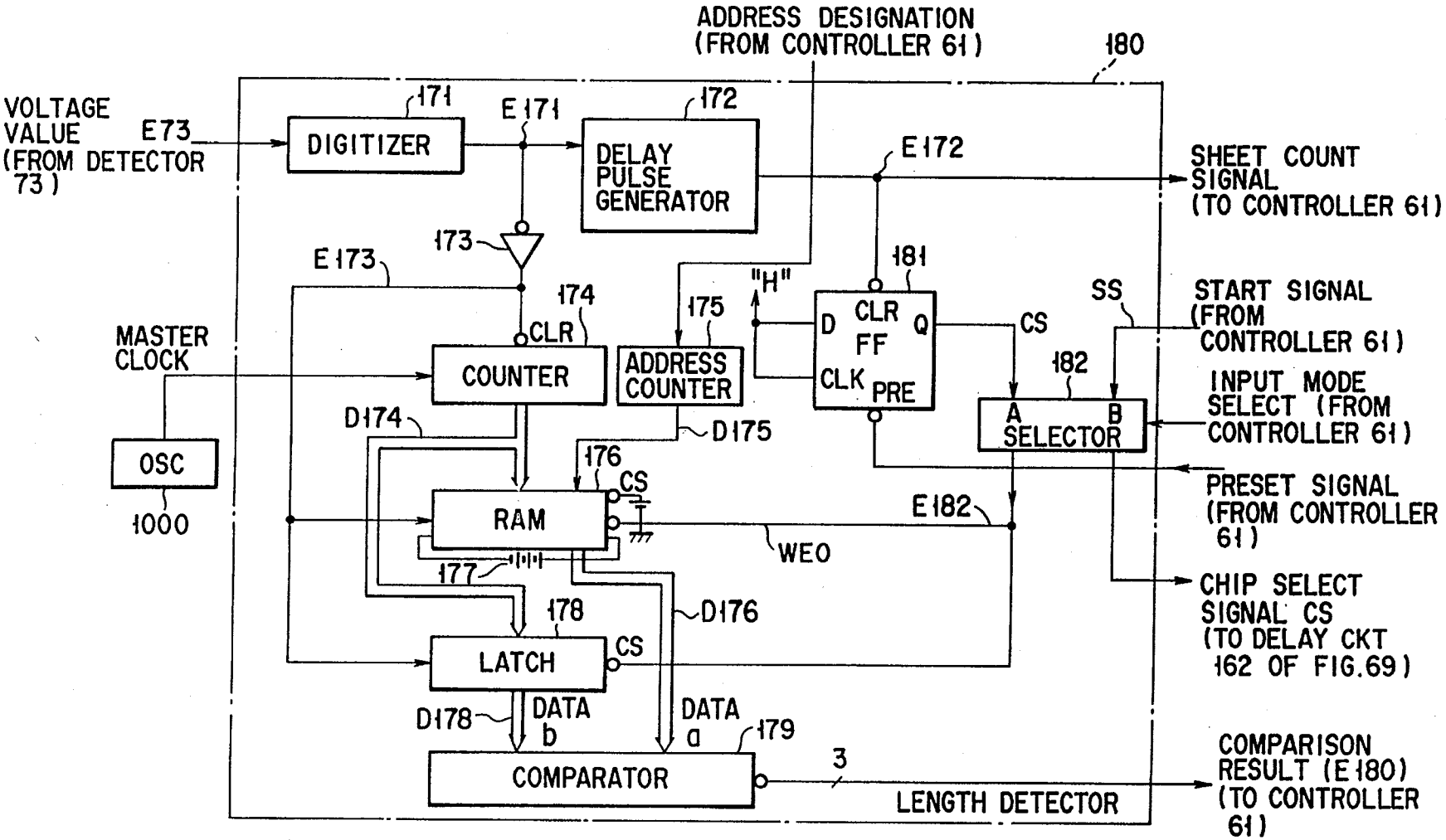
FIG. 52 is a schematic block diagram showing still another arrangement of the length detector.

The schematic block diagram of length detector 180 of this embodiment is shown in FIG. 52. This length detector 180 is obtained by adding FF 181 and selector 182 to length detector 170 shown in FIG. 51.

In a mode using first sheet 0 as a reference sheet, FF 181 and delay pulse generator 172 may be identical to FF 105 and delay pulse generator 105 shown in FIG. 14. Chip chip select signal CS from FF 181 is set at "H" level for first original O and "L" for second or subsequent original O. Then, RAM 176 is set at a write enable state for first original O, and latch 178 is set in an operative state for second or subsequent original O.

Selector 182 selects an output signal in response to an input mode select signal supplied from controller 61 upon designation on operation panel 52. Selector 182 selects chip select signal E181 from FF 181 or start signal SS from controller 61 and outputs the selected signal.

Output E182 from selector 182 serves as a write enable signal (WE0) and a chip select signal (CS) for latch 178. That is, when multiple paper-conveying is to be detected for original O based on size data D176 stored in RAM 176, selector 182 outputs the start signal (E182=SS) from controller 61. When multiple paper-conveying is to be detected for original O of a type which is not normally used, selector 182 selects the chip select signal (E182=E181) from FF 181.

Figure 53:
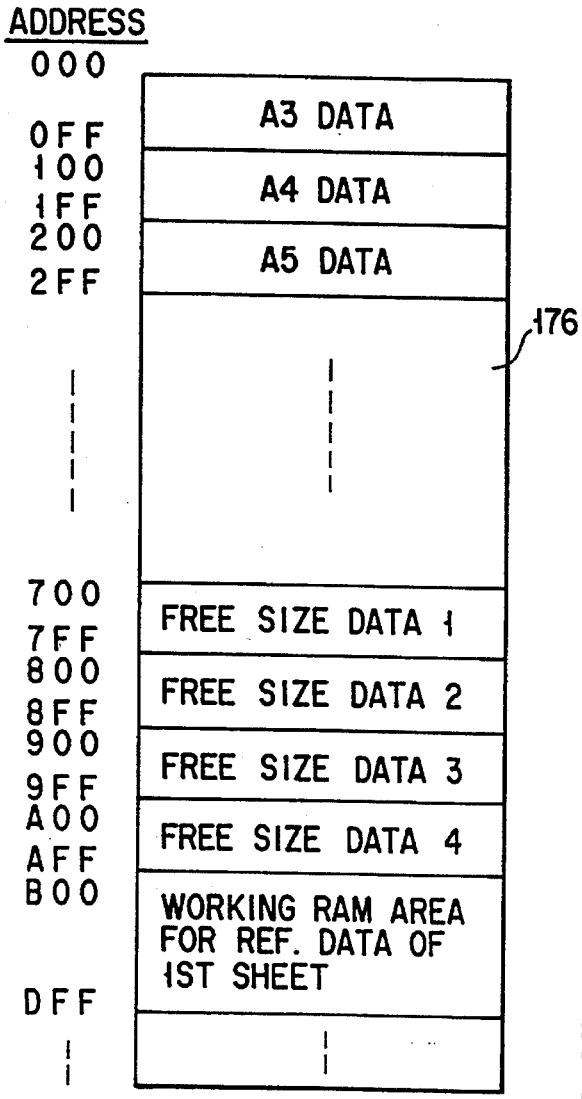
FIG. 53 is a view showing storage contents of data for all sizes in a RAM.
Figure 54:
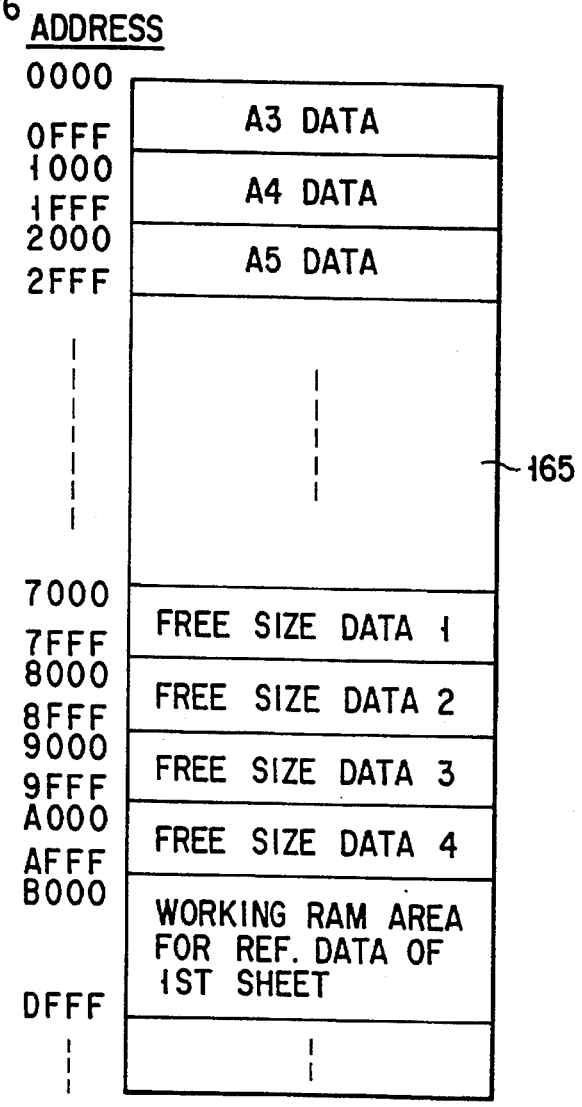
FIG. 54 is a view showing storage contents of data for all sizes in a RAM.

Fixed size data and free size data are stored in RAM 176, as shown in FIG. 53. At the same time, an area serving as a working RAM for storing first sheet data (using the first original sheet as a reference sheet) is also prepared in RAM 176.

When a thickness detection has to be performed in the above embodiment, thickness detector 160 of FIG. 50 is additionally used. In this case, it should be noted that the chip select signals (CS1, CS2) input to delay circuit 162 and inverter 163 of FIG. 50 are output E182 (=CS2) from selector 182 and its inverted level (=CS1) in FIG. 52. Fixed size data and free size data are stored in RAM 165, as shown in FIG. 54. At the same time, an area serving as a working RAM for storing first sheet data (using the first original sheet as a reference sheet) is also prepared in RAM 165.

When an operator is intended to input original data, he or she operates an input mode select key. Main control unit 51 is then set in the data input mode.

When data of original O having a fixed size is to be entered as reference data, each fixed size is selected by the operator. However, when a particular free size is to be selected, free sizes (1 to 4) are selectively used.

By this selection, controller 61 causes counter 175 to generate an address (D175) corresponding to the size designated information (free size).

Prior to detection of original O serving as a reference sheet by a feeding operation, controller 61 outputs a selection signal to selector 182 so that output E182 from selector 182 becomes the output (SS) of controller 61. Start signal SS of "H" level is output from selector 182 (E182=SS). At this time, the write enable signal (WE0) to RAM 176 is set at "H" level. Then, the RAM 176 is set at a write enable state.

On the other hand, since chip select signal CS (=E182=SS) from latch 178 is set at "H" level, latch 178 is set in an inoperative state.

Controller 61 causes counter 175 to generate an address (D175) corresponding to designated size information.

Output E182 (=SS) from selector 182 is supplied to delay circuit 162 and inverter 163 of FIG. 50. When controller 61 sets the start signal SS to "H" level, chip select signal CS1 from delay circuit 161 is inverted to "L" level by inverter 163. On the other hand, since chip select signal CS2 from delay circuit 162 is set at "H" level, delay circuit 161 is set in an operative state while delay circuit 162 is set in an inoperative state.

When original O is detected by empty sensor 29, controller 61 starts the feeding operation. Reference original O is fed to the lower-surface side of original conveyor belt 37 currently driven in the feeding direction, via a resist roller pair constituted by aligning roller 34 and feeding roller 35.

Reference original O passes through aligning roller 34 and feeding roller 35, and data (D174) corresponding to the length of reference original O is stored as a reference value in RAM 176 in length detector 180 of FIG. 51, at the address (D175) designated by controller 61. This operation is similar to that of length detector 75 shown in FIG. 51.

Data (D161) corresponding to the thickness of reference original O is stored as a reference value in RAM 165 in thickness detector 160 of FIG. 50, at the address (D164) designated by controller 61. This operation is the same as that of thickness detector 76 shown in FIG. 20.

The above operations are repeated for data entry of another original O.

Each size data as shown in FIG. 53 is stored in RAM 176 backed up by battery 177 in FIG. 52. Each size data as shown in FIG. 54 is stored in RAM 165 backed up by battery 166 in FIG. 50.

At this time, controller 61 sets the start signal SS to "L" level. Output E182 from selector 182 is identical to signal SS from controller 61 (E182=SS). This start signal SS is output to RAM 176 and latch 178 through selector 182. Then, the write enable signal (WE0) to RAM 176 goes to "L" level, and the chip select signal (CS) from latch 178 goes to "L" level. As a result, RAM 176 is set in a write disable state, while latch 178 is set in an operative state.

The length data (D174) of first or subsequent original O, which is input to automatic paper feeding apparatus 20 in the normal mode, is stored in latch 178, and the stored length data is compared by comparator 179 with reference data (D176) stored in RAM 176.

A method of discriminating the results output from comparator 179 is the same as the comparison/discrimination method using data D156 of ROM 156 as reference data shown in FIG. 41.

When the normal mode is restored, controller 61 sets the start signal SS to "L" level. Since the output (E182) from selector 182 is identical to the signal (start signal SS) from controller 61, chip select signal CS1 from delay circuit 161 is inverted to "H" level by inverter 163 in thickness detector 160 of FIG. 50.

On the other hand, chip select signal CS2 from delay circuit 162 is set at "L" level. Therefore, delay circuit 161 is set in an inoperative state, while delay circuit 162 is set in an operative state.

The thickness detection data (D162) input to automatic paper feeding apparatus 20 in the normal mode is temporarily stored in delay circuit 162, and the stored data (D162) is compared by comparator 167 with the data (D165) stored in RAM 165 as reference data.

A method of discriminating the results (CPR4 to CPR6) output from comparator 167 may be the same as the comparison/discrimination method using the data (Data3) of ROM 135 as reference data, as shown in FIG. 39.

Multiple paper-conveying detection or size detection can be performed by a combination of detection results in the widthwise (thickness) and longitudinal directions.

When a sheet except for the entered original sheets is selected, controller 61 is set in a mode for detecting multiple paper-conveying using the first sheet data as reference data.

Controller 61 switches selector 182 of FIG. 52 on the FF 181 side (A side). As a result, chip select signal CS of latch 178 becomes equal to output E181 of FF 181. Since FF181 is cleared each time the feeding for original O is performed, signal CS keeps the "L" level. As has been described with reference to length detector 75 of FIG. 14, multiple paper-conveying is detected by length detector 180, using the first sheet data as the reference data. In this case, a working area of RAM 176 is selected by address D175 from counter 175, and the reference data (D174) of the first original sheet is stored in this area.

In the multiple paper-conveying detection mode, assume that an output from comparator 179 in length detector 180 is formed of 16-bit data. When the size of a fed original sheet present in fixed size data D176 stored in RAM 176, comparator 179 outputs the comparison result (CPR1 to CPRS) of the corresponding size having "L" level. Comparison results of the sizes of the first original sheet and the second and subsequent original sheets may be output as comparison results CPR9 to CPR16. In this case, size detection can be performed even if a sheet different from that in normal mode is inserted.

As described with reference to thickness detector 76 in FIG. 20, thickness detector 160 detects multiple paper-conveying using the first sheet data (D165) as the reference data. In this case, a working area of RAM 165 is selected by the address (D164) from counter 164, and the reference data (D161) of the first original sheet is stored in this area.

To prevent erroneous detection as multiple paper-conveying upon insertion of a patched sheet in thickness detector 160 of FIG. 50, minimum value detectors (121, 122) may be connected to the outputs of delay circuits 161 and 162 as in FIG. 36. Thus, the size and multiple paper-conveying discrimination methods have been described above.

Figure 55:
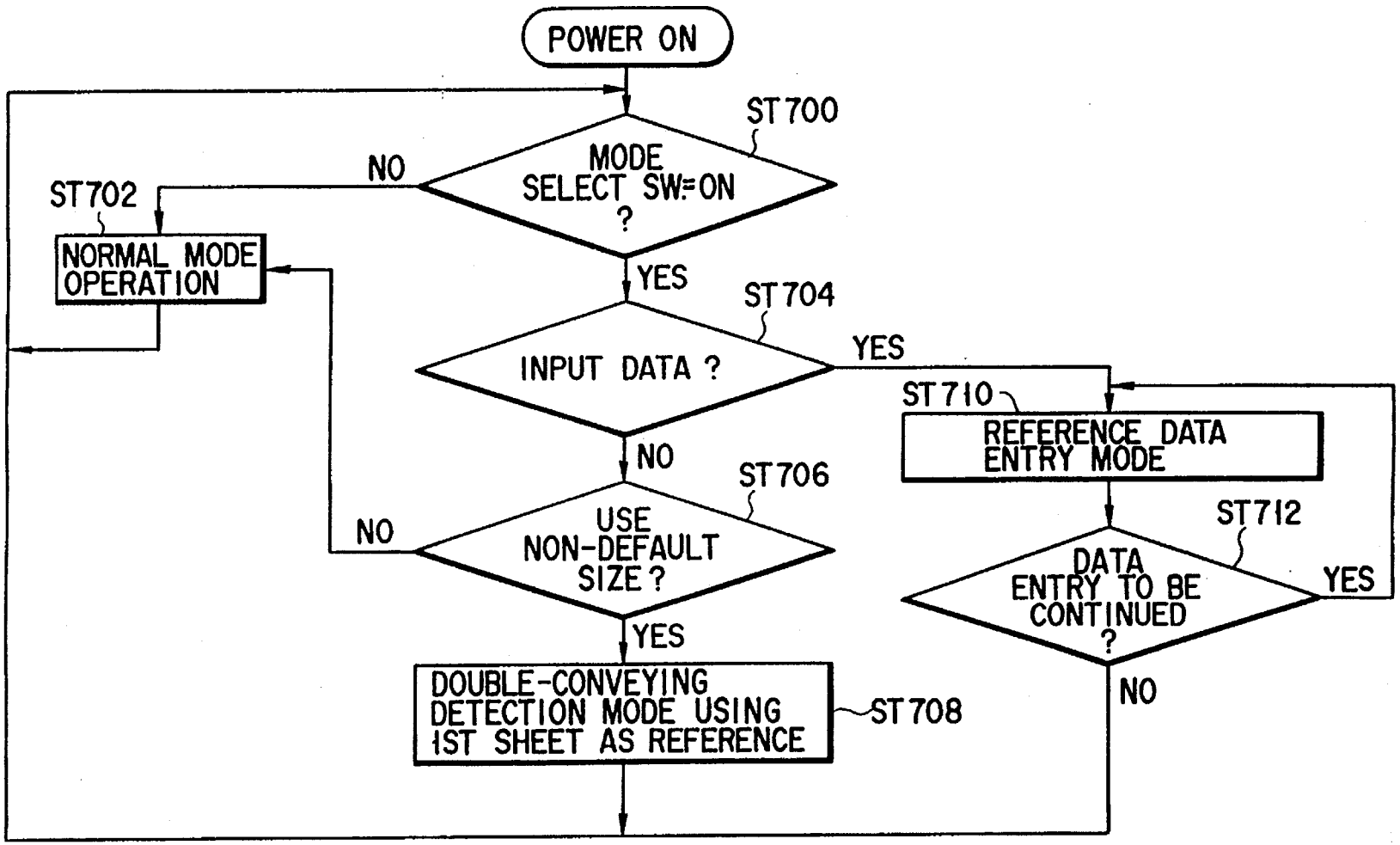
FIG. 55 is a flow chart for explaining a mode selection operation.

FIG. 55 is a flow chart for explaining processing in selection of an operation mode of the feeding apparatus.

When an input mode select key is not depressed (NO in ST700) upon power-ON operation of the apparatus, a normal mode is set to perform normal feeding (ST702). However, when the input mode select key is depressed upon power-ON operation (YES in ST700), the presence/absence of data inputs in the selected mode is checked (ST704).

If no data is input (NO in ST704), it is checked if an original sheet whose size is specified as an A4 size, a B5 size, or the like is used (ST706). If the specified sheet is used or the non-default size is not used (NO in ST706), the mode is directly set in the normal mode (ST702).

If the non-default size is used (YES in ST706), a multiple-conveying (double-conveying) detection mode using the first original sheet as a reference is set (ST708).

If data is to be input in the selected mode (YES in ST704), a reference data entry mode is set (ST710). In this entry mode, desired sheet size data (e.g., US legal size) is input from operation panel 52 or the like and stored in RAM 176 in FIG. 52. When this data entry is completed (NO in ST712), and if the input mode select key is turned off (NO in ST700), the normal mode is set (ST702).

Figure 56:
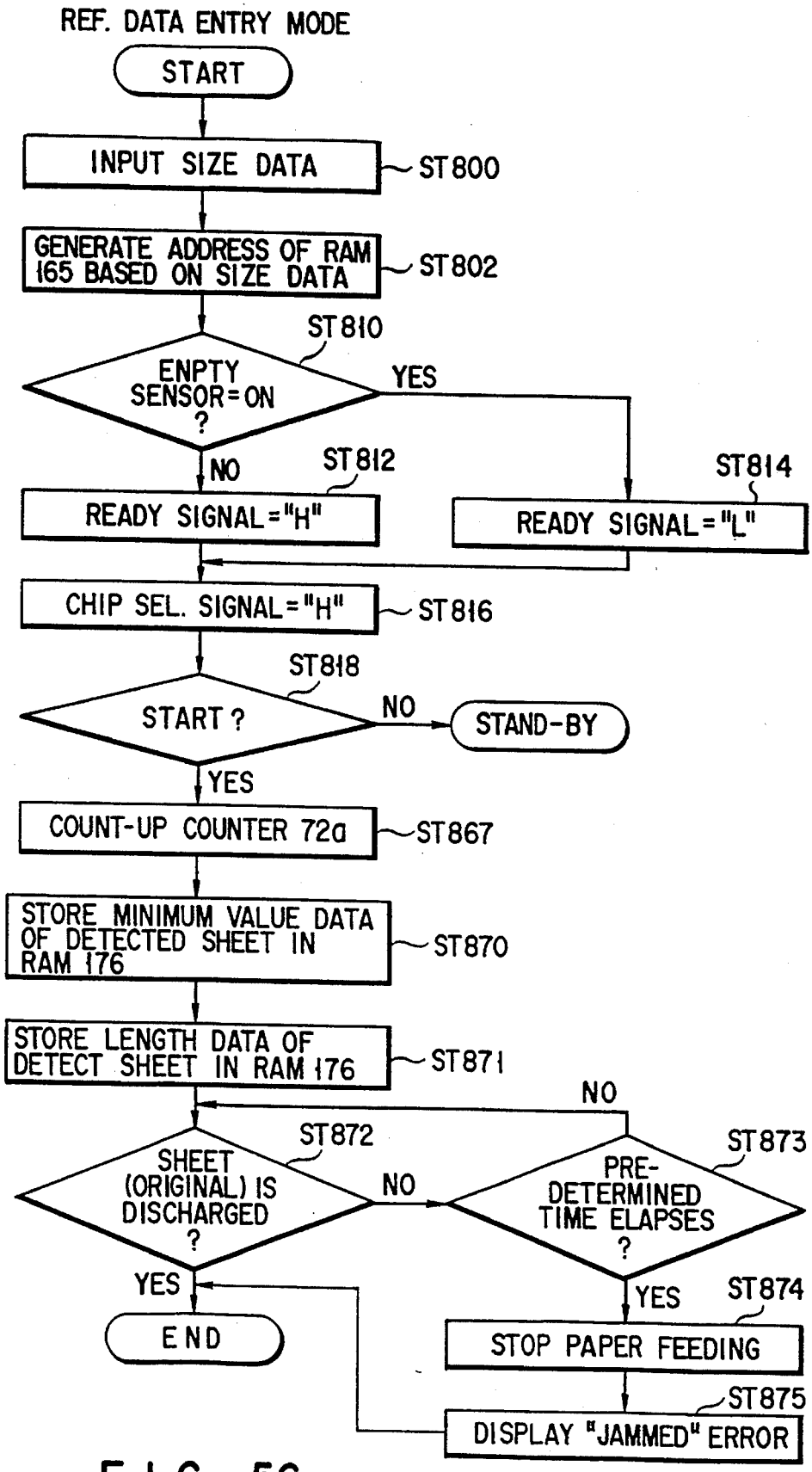
FIG. 56 is a flow chart for explaining a data entry operation.

FIG. 56 is a flow chart for explaining the content of original sheet feeding processing using reference data entry mode ST710 in FIG. 55.

Prior to paper feeding, desired sheet size data is input (ST800). An address corresponding to the input size data is generated by counter 164 in FIG. 50 (ST802), and desired sheet thickness data (D165) is read out from RAM 165.

During the OFF period of empty sensor 29 (NO in ST810), the ready signal is set at "H" level (ST812). When the turn-ON operation of empty sensor 29 is detected (YES in ST810), the ready signal goes to "L" level (ST814). Chip select signal CS is set to "H" level in response to start signal S5 from controller 61 (ST816).

This "H" signal E105 is inverted to "L" level through inverter 108. The "L" signal E108 sets latch 107 in a latch enabled state. In this case, latch 107 is set in a latch disabled state.

When the copy start button of the copying machine is depressed (YES in ST818), automatic paper feeding is started. When paper feeding for first original O is completed, counter 72*a* arranged in memory 72 in FIG. 26 is incremented by one (ST867). The minimum value of the size of original O to be detected is stored in RAM 176 in FIG. 51 (ST870). The length (count value D174 of counter 174) of first original O which is detected during original sheet feeding is also stored in RAM 176 (ST871).

When original O serving as a reference is not fed out from the feeding apparatus a predetermined time after each size data of original O is stored in RAM 176 (NO in ST872; YES in ST873), paper feeding for original O is stopped (ST874). A "jammed" error is displayed on a display unit (not shown) of main body 1 (ST875), thereby completing the processing in FIG. 56.

Figure 57:
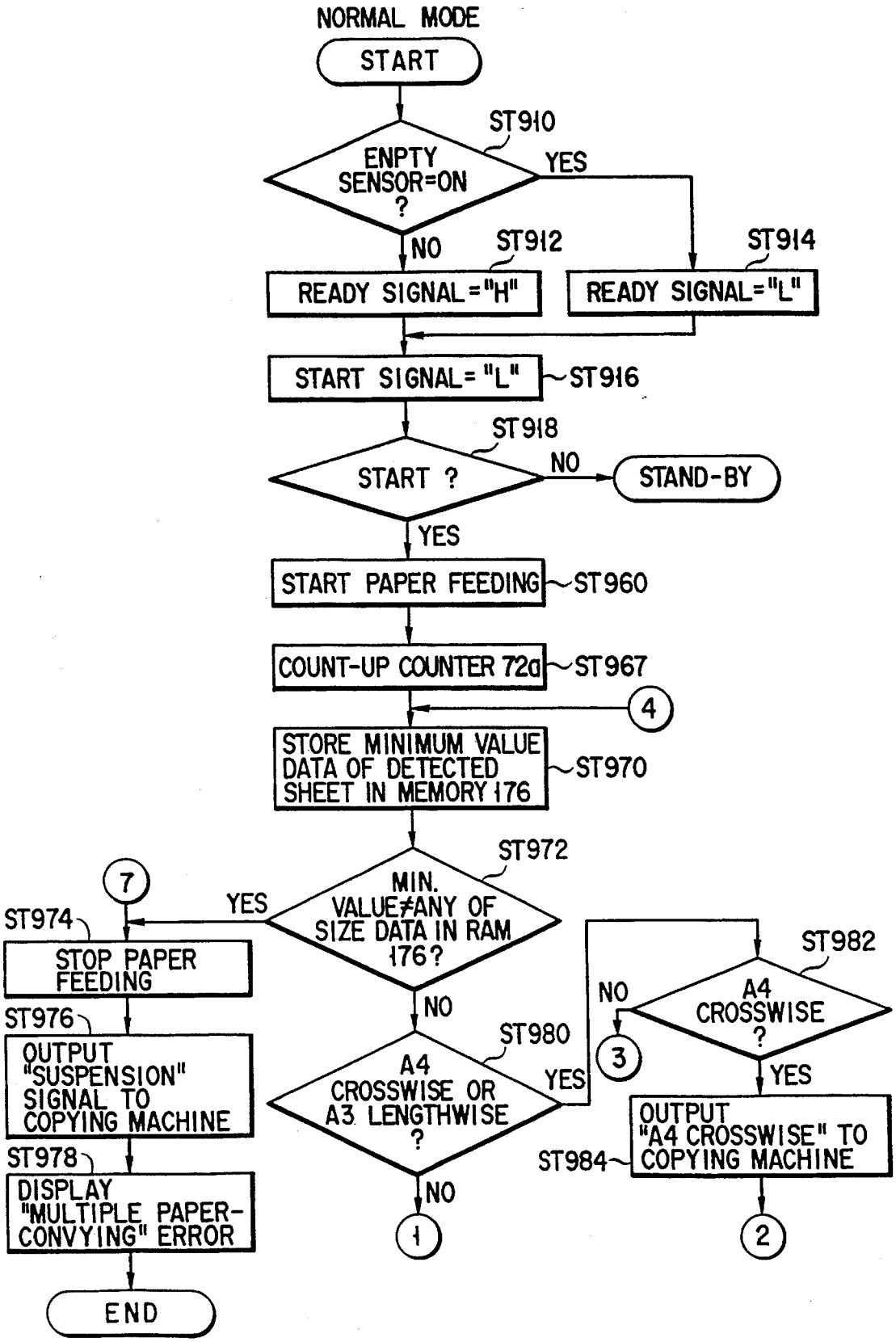
FIG. 57 is a flow chart for explaining the operation of a normal mode.
Figure 58:
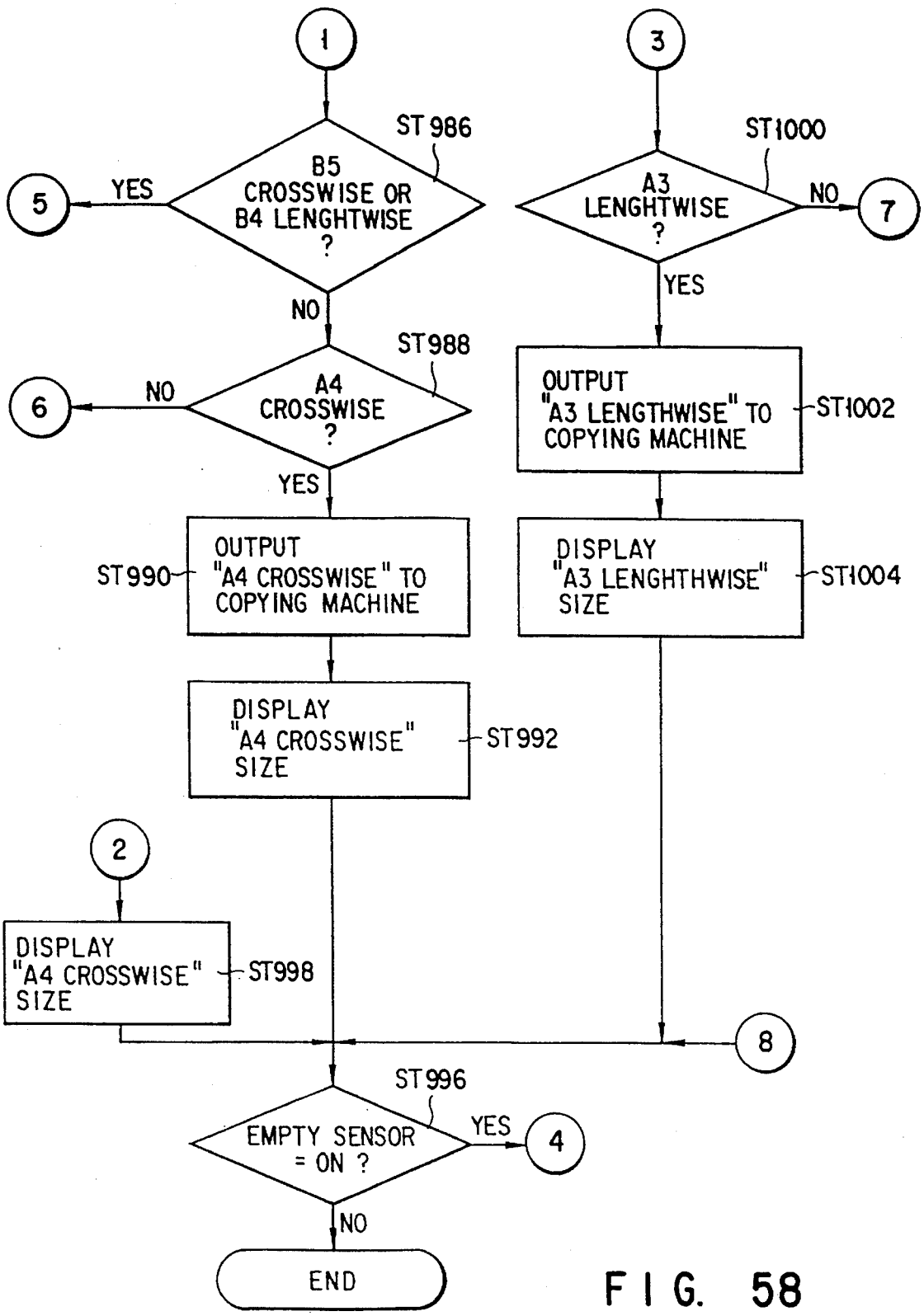
FIG. 58 is a flow chart for explaining the operation of the normal mode.
Figure 59:
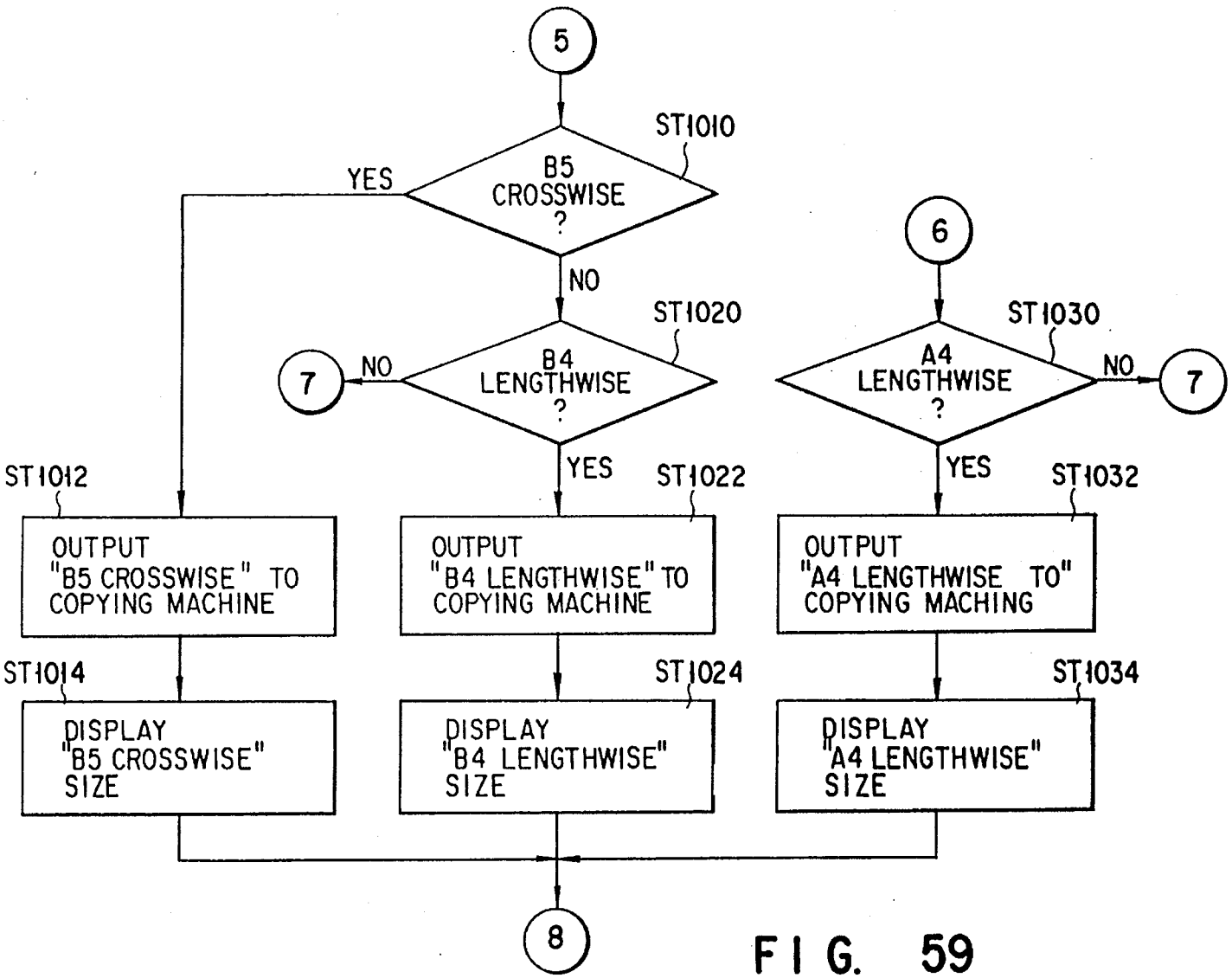
FIG. 59 is a flow chart for explaining the operation of the normal mode.

FIGS. 57 to 59 are flow charts for explaining the contents of original sheet feeding processing in normal mode operation ST702 in FIG. 55.

When an original sheet to be fed is set, the state of empty sensor 29 is checked (ST910). During the OFF period of empty sensor 29 (NO in ST910), the ready signal is set at "H" level (ST912). When the turn-0N operation of empty sensor 29 is detected (YES in ST910), the ready signal goes to "L" level (ST914). Start signal S5 from controller 61 then goes to "L" level (ST916).

For example, when the copy start button of the copying machine is depressed (YES in ST918), automatic paper feeding is started (ST960). When paper feeding for first original O is completed, counter 72*a* arranged in memory 72 of FIG. 26 is incremented by one (ST967). The minimum value of the size of first original O which is detected during paper feeding is stored in RAM 176 in FIG. 51 (ST970).

Each size data already stored in RAM 176 is compared with the detected size data of first original O (ST972).

When the detected size does not correspond to any stored comparison size data (YES in ST972), the CPU in controller 61 generates an interrupt signal to stop paper feeding in the automatic paper feeding apparatus in FIG. 2 (ST974). At the same time, the CPU in controller 61 outputs a "suspension" signal corresponding to the stop of paper feeding to copying machine main body 1 (ST976). A "multiple paper-conveying" error is displayed on a display unit (not shown) of main body 1 (ST978), thereby completing the normal mode operation.

If the detected size corresponds to any stored comparison size data (NO in ST972), it is then checked if the detected sheet size is the A4 crosswise or A3 lengthwise size (ST980).

If the detected size corresponds to the A4 crosswise or A4 lengthwise size (YES in ST980), it is checked if the detected sheet length corresponds to the A4 crosswise size (ST982). If the detected sheet length corresponds to the length of the A4 crosswise size (YES in ST982), the information representing that the size of fed original O is the A4 crosswise size is output to main body 1 (ST984). The size of fed original O is then displayed to be the "A4 crosswise" size (ST998 in FIG. 58).

If original sheets to be fed are still left, and empty sensor 29 is kept on (YES in ST996), the flow returns to step ST970 in FIG. 57, and the operations in steps ST970 to ST996 are repeated.

When the detected sheet size does not correspond to the A4 crosswise or A3 lengthwise size (NO in ST980), it is checked if the detected sheet size is the B5 crosswise or B4 lengthwise size (ST986). When the detected sheet size corresponds to the A4 crosswise size (NO in ST986; YES in ST988), information representing the "A4 crosswise size" is output to copying machine main body 1 (ST990). The size of fed original O is then displayed as the "A4 crosswise" size (ST992).

If original sheets to be fed are still left, and empty sensor 29 is kept on (YES in ST996), the flow returns to step ST970 in FIG. 57, and the operations in steps ST970 to ST996 are repeated.

If the length of the detected sheet size does not correspond to the A4 crosswise size (NO in ST982), the CPU of controller 61 checks if the first original O is a sheet of A3 lengthwise size (ST1000).

If the set original O is not a sheet of A3 lengthwise size (NO in ST1000), original O is detected to be double-conveyed. In this case, paper feeding is stopped (ST974 in FIG. 57), and the CPU in controller 61 outputs a "suspension" signal corresponding to the stop of paper feeding to copying machine main body 1 (ST976). A "multiple paper-conveying" error is displayed on a display unit (not shown) of main body 1 (ST978).

If the size of fed original O is the A3 lengthwise size (YES in ST1000), the CPU in controller 61 outputs information representing the "A3 lengthwise size" to copying machine main body 1 (ST1002). The size of fed original O is displayed as the "A3 lengthwise" size in main body 1 (ST1004).

If sheets to be fed are still left, and empty sensor 29 is kept on (YES in ST996), the flow returns to step ST970 in FIG. 57, and the operations in steps ST970 to ST996 are repeated.

If the detected sheet size corresponds to B5 crosswise or B4 lengthwise size (YES in ST986) and the B5 crosswise size (YES in ST1010 in FIG. 59), the CPU in controller 61 outputs information representing the "B5 crosswise size" to copying machine main body 1 (ST1012). The size of fed original O is displayed as the "B5 crosswise" size in main body 1 (ST1014).

If the detected sheet size corresponds to the B5 crosswise or B4 lengthwise size (YES in ST986), and the B4 lengthwise size (NO in ST1010; YES in ST1020), the CPU in controller 61 outputs information representing the "B4 lengthwise size" to copying machine main body 1 (ST1022). The size of fed original O is displayed as the "B4 lengthwise" size in main body 1 (ST1024).

If the detected sheet size does not correspond to the B4 lengthwise size (NO in ST1020), paper feeding is stopped (ST974), a "suspension" signal is output (ST976), and a "multiple paper-conveying" error is displayed (ST978).

When the length of the detected sheet size does not correspond to the A4 crosswise size (YES in ST988), but corresponds to the A4 lengthwise size (YES in ST1030), the CPU in controller 61 outputs information representing the "A4 lengthwise size" to copying machine main body 1 (ST1032). The size of fed original O is displayed as the "A4 lengthwise" size in main body 1 (ST1034).

When the detected sheet size does not correspond to the A4 lengthwise size (NO in ST1030), paper feeding is stopped (ST974), a "suspension" signal is output (ST976), and a "multiple paper-conveying" error is displayed (ST978).

An embodiment for detecting the skew of fed original O, using different voltage values with changes in resistance values of pressure sensitive conductive rubber 35*b* in feeding roller 35, will be described below.

Figures 60A, 60B, 60C:
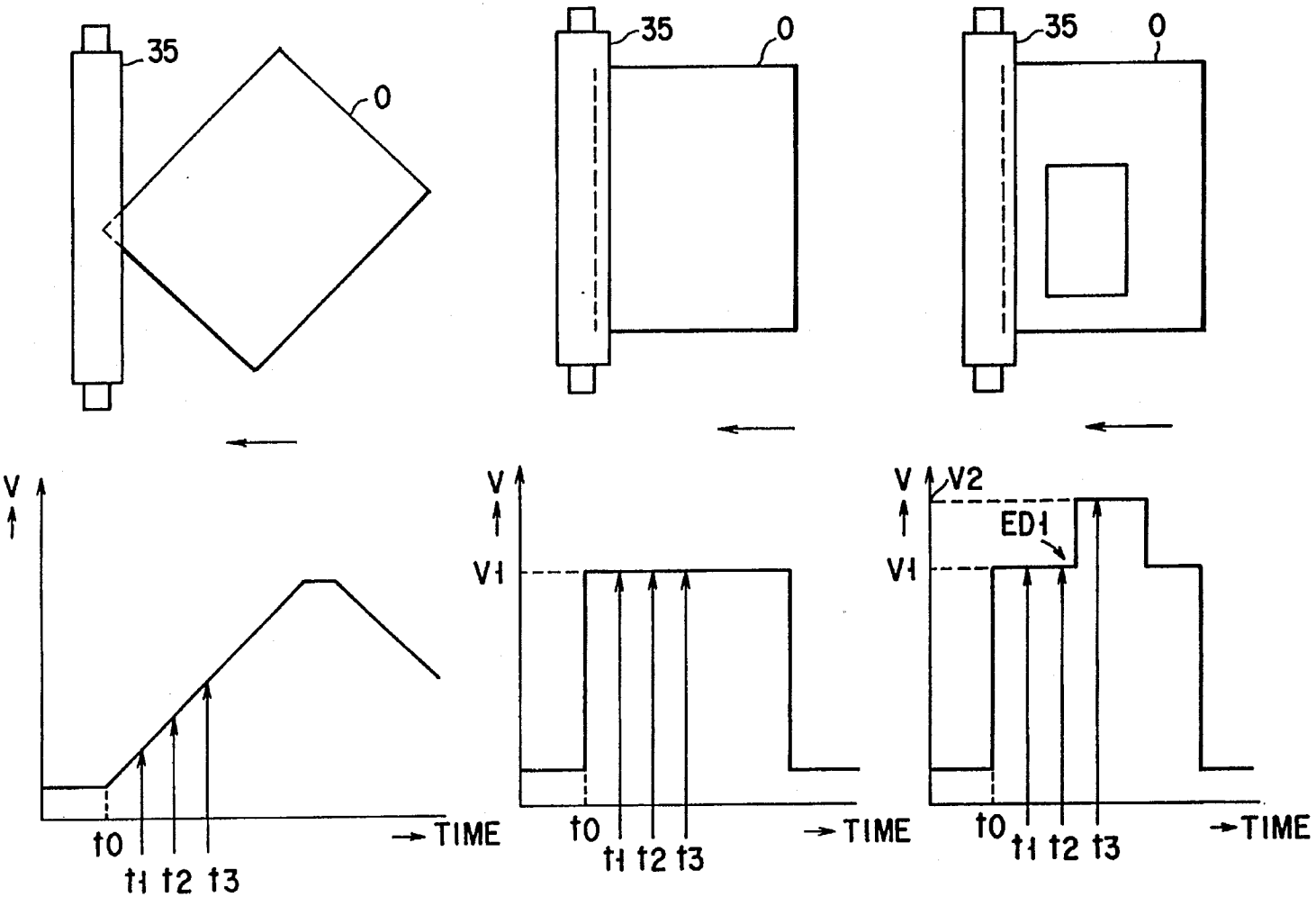
FIGS. 60A to 60C are views for explaining relationships between the conveyed states of originals and output signals corresponding to the thicknesses of the originals.

FIGS. 60A to 60C show time changes in outputs from 10 detector 73 when various originals O are clamped in feeding roller 35 using pressure sensitive conductive rubber 35*b*.

When the thickness of original O increases, the value along the ordinate or the figures is set to increase.

FIG. 60A shows an output obtained when skewed original O is inserted.

More specifically, when original O is skewed, the width of original O clamped by feeding roller 35 is elongated with a lapse of time (t1, t2, t3 . . . ) Therefore, output V from detector 73 increases with a lapse of time accordingly.

On the other hand, FIG. 60B shows output V from detector 73 when original O is normally fed. In this case, an output from detector 73 becomes constant (V1) after the leading edge of original O is clamped at time t0.

FIG. 60C shows the result of an output (V) from detector 73 when patched original O is inserted. In this case, after the leading edge of original O is clamped at time t0, constant value V1 is obtained at a portion as reference original O, the output from detector 73 changes at edge ED1 of a patched portion, and then constant value V2 is obtained again at the patched portion.

As described above, skew detection can be performed by detecting changes in time of the outputs upon clamping original O by feeding roller 35.

Figure 61:
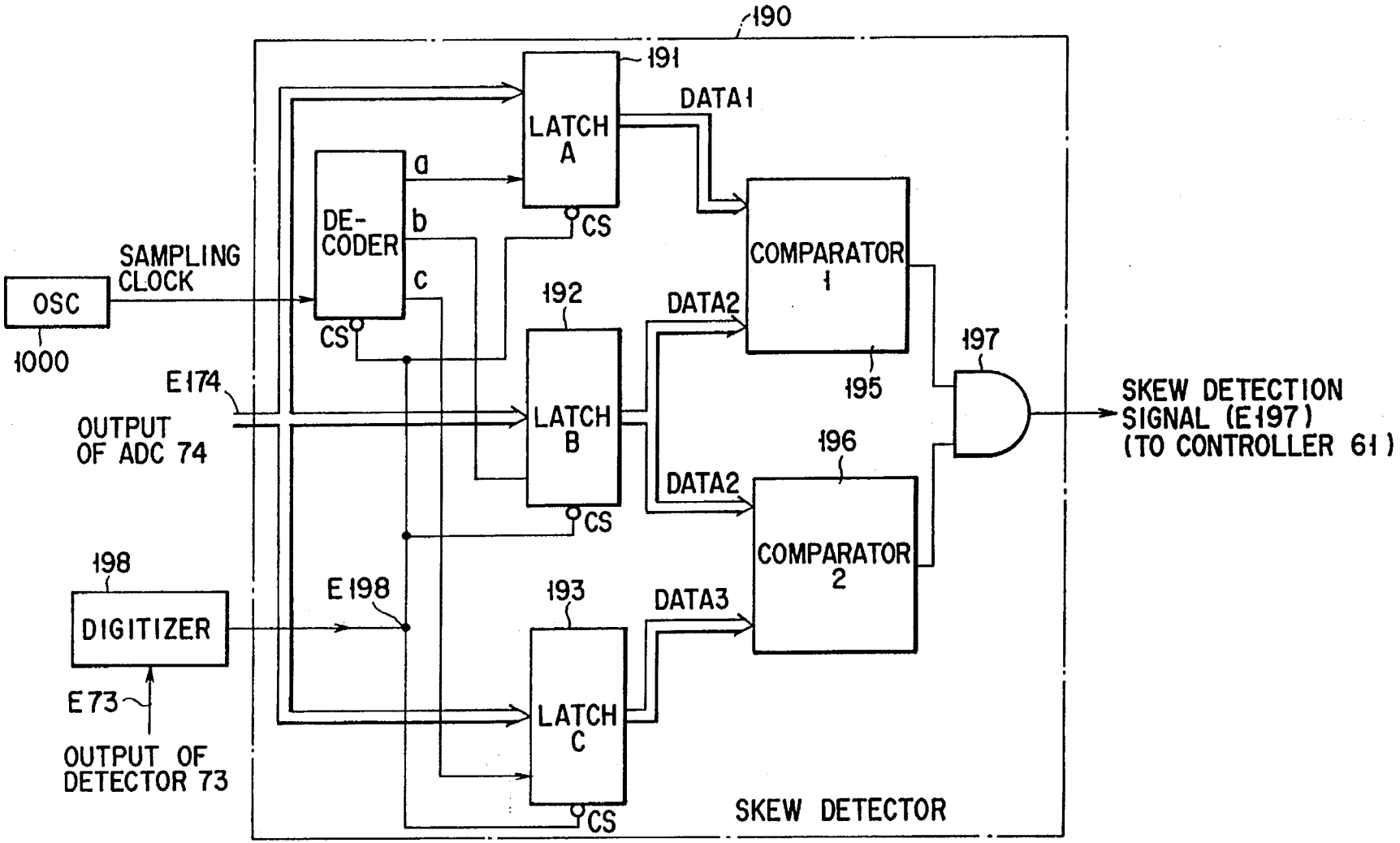
FIG. 61 is a schematic block diagram showing the arrangement of a skew detector.

FIG. 61 is the schematic block diagram of skew detector 190. Skew detector 190 comprises latches 191, 192, and 193, decoder 194, and comparators 195 and 196. Skew detector 190 is arranged between ADC 74 and controller 61 in FIG. 1. Skew detector 190 receives digitized signal E198 from digitizer 198 for digitizing an output from detector 73. This digitizer 198 is identical to that used in length or thickness detector 75 or 76. If the apparatus has length detector 75 or thickness detector 76, the digitized signal (E101 or E111) from digitizer 101 or 111 may be used for signal E198.

When original O is clamped between feeding roller 35 and aligning roller 34, a change in resistance value of pressure sensitive conductive rubber 35*b* upon a change in pressure acting on feeding roller 35 is converted into an electrical signal by detector 73. The electrical signal is then digitized by digitizer 198.

Figures 62A, 62B, 62C, 62D:
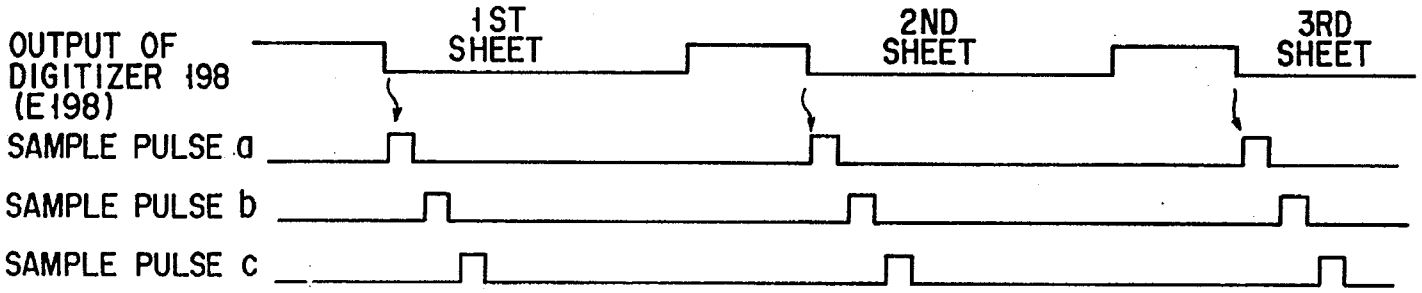
FIGS. 62A to 62D are timing charts showing sampling pulse outputs in response to a digitized output; states (conditions) for the feeding roller.

As shown in FIG. 62A, output E198 from digitizer 198 is set at "L" level while original O is present between feeding roller 35 and aligning roller 34. Otherwise, output E198 from digitizer 198 is set at "H" level.

Output E198 from digitizer 198 is supplied to the chip select terminals (CS) of latches 191,192, and 193. Latches 191,192, and 193 operate only when original O is present between feeding roller 35 and aligning roller 34.

On the other hand, decoder 194 receives as a sampling pulse a master clock from oscillator 1000 or a clock obtained by frequency-dividing the master clock. Chip select terminal CS of decoder 194 receives output E198 from digitizer 198.

At each falling edge of signal E198, decoder 194 supplies latches 191,192, and 193 with three pulses a, b, and c, having different output timings as shown in FIGS. 62B, 62C, and 62D, respectively.

Latches 191,192, and 193 store A/D-converted output data (DATA1 to DATA3) from detector 73 upon reception of pulses a, b, and c, respectively.

The data (Data1 to Data3) output from latches 191, 192, and 193 are compared by comparators 195 and 196.

Comparator 195 compares DATA1 with DATA2. If DATA1≠DATA2, then comparator 195 outputs signal E195 of "H" level to AND gate 197.

Comparator 196 compares DATA2 with DATA3. If DATA2≠DATA3, then comparator 196 outputs signal E196 of "H" level to AND gate 197.

AND gate 197 outputs skew detection signal E197 of "H" level to controller 61 when both the signals (E195 and E196) from comparators 195 and 196 are set at "H" level.

That is, if DATA1≠DATA2 and DATA2≠DATA3, then skew detection signal E197 output from AND gate 197 is set at "H" level.

When output E197 of AND gate 197 is set at "H" level, controller 61 determines that the fed original sheet has been skewed and stops the feeding operation.

If no skewing occurs, as shown in FIG. 60B, DATA1=DATA2 and DATA2=DATA3 are established, and output E197 from AND gate 197 is set at "L" level.

In the state of FIG. 60C, since DATA1=DATA2, output E195 from comparator 195 is set at "L" level. At the same time, since DATA≠DATA3, output E196 from comparator 196 is set at "H" level. In this case, output E197 from AND gate 197 is set at "L" level.

In this manner, skew detection can be effectively performed.

In skew detector 190 of FIG. 61, the sampling count of the length of original O can be adjusted by setting the period of the sampling clock input to decoder 194.

If a patched portion of fed original O is not perpendicular to the feeding direction, patched original O may be erroneously detected.

However, in the embodiment of FIG. 61, the output from detector 73 is digitized and the leading edge of original O is detected. Thereafter, the digitized value (E198) is sampled to detect the skew of reference original O, thereby preventing erroneous detection.

Skew detection can thus be performed earlier upon skewing of original O.

Feeding of skewed original O, folding of skewed original O, and catching of skewed original O in the side frame of automatic paper feeding apparatus 20 to damage original O can be prevented.

Automatic paper feeding apparatus 20 is arranged to be opened or closed with respect to original table 2 in copying machine main body 1. When automatic paper feeding apparatus 20 is to be opened, a pressure acting on feeding roller 35 in normal use is released. Therefore, an output from detector 73 which is obtained with a change in resistance value of pressure sensitive conductive rubber 35*b* in feeding roller 35*b* is set lower than that obtained when original O is clamped by feeding roller O in normal use.

By detecting a difference between these outputs, the open state of automatic paper feeding apparatus 20 can be detected, and the feeding operation is stopped. Therefore, an erroneous operation can be prevented.

Although a switch for detecting the open state is required in a conventional arrangement, this switch can be omitted in the above arrangement, thereby reducing the manufacturing cost of the automatic paper feeding apparatus 20.

This embodiment of the above case will be described below.

Figure 63A:
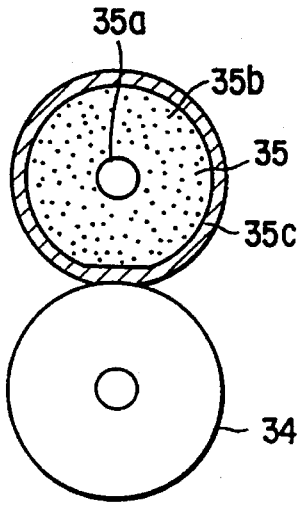
Figure 63B:
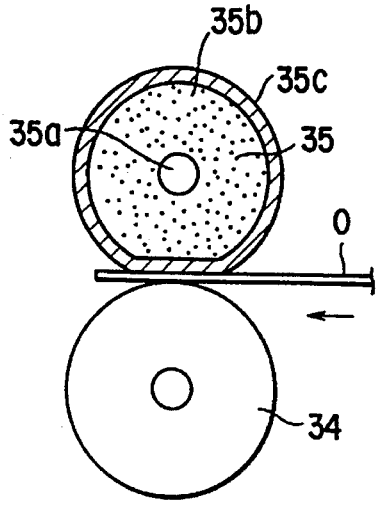
Figure 63C:
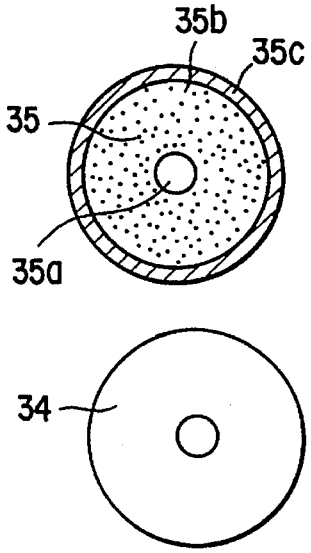
Figure 64:
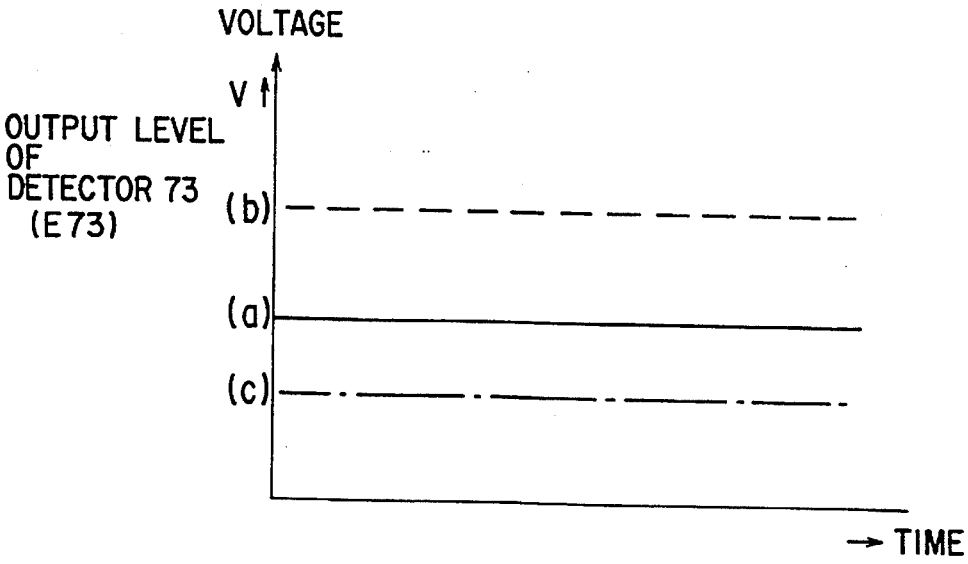
FIG. 64 is a chart for explaining output signals from a detector in the three states (conditions) to the feeding roller.

Detector 73 (ADC 74) outputs signals of FIG. 64 with respect to three states (conditions) of feeding roller 35 shown in FIGS. 63A to 63C.

FIG. 63A shows a state in which original O is not clamped in normal use. Detector 73 outputs a signal of level (a) in FIG. 64.

FIG. 63A shows a state in which original O is clamped. Detector 73 outputs a signal of level (b) shown in FIG. 64.

FIG. 63C shows a state in which automatic paper feeding apparatus 20 is set in an open state. Detector 73 outputs a signal of level (c) shown in FIG. 64.

FIG. 64 shows the outputs from detector 73 when outputs are generated in the upward direction at a higher pressure.

One of the embodiments with respect to the above case will be described below.

In setting upon unpacking of automatic paper feeding apparatus 20 or at the shipment from a factory prior to use of automatic paper feeding apparatus 20, automatic paper feeding apparatus 20 is set in a service mode from the copying machine main body or at operation panel 52 of automatic paper feeding apparatus 20.

When main control unit 51 and controller 61 are set in the service mode, the following operation will be performed.

Referring to FIG. 50, controller 61 causes address counter 164 to operate to generate addresses D164 (F000 to FFFF) of RAM 165 which represent a state in which an original sheet is not clamped in normal use.

Figure 65:
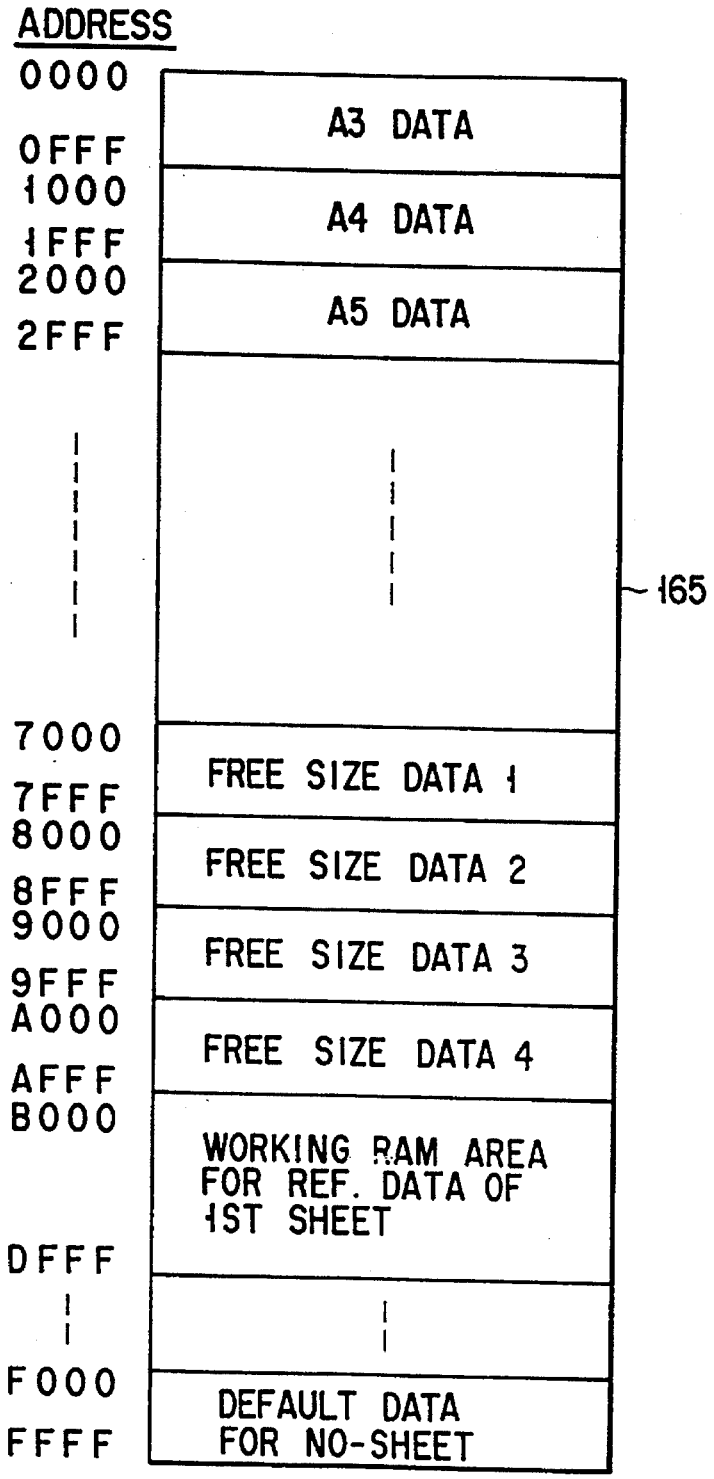
FIG. 65 is a view for explaining storage contents of data for all sizes in a RAM.

The addresses of RAM 165 at this time are shown in FIG. 65.

Controller 61 inhibits write access to the area of the above addresses in a mode except for the service mode.

Controller 61 sets start signal SS to "H" level. At this time, chip select signal CS1 from delay circuit 161 is inverted to "L" level by inverter 163, and chip select signal CS2 from delay circuit 162 is set at "H". Then, delay circuit 161 is set in an operative state, while delay circuit 162 is set in an inoperative state.

Digital value E73 of the output from detector 73 is temporarily stored in delay circuit 161 and then stored at the address (D164) of RAM 165.

When the normal mode is restored, controller 61 sets the start signal to "L" level. At this time, delay circuit 161 is set in an inoperative state, while delay circuit 162 is set in an operative state.

The output from detector 73 in an open state of automatic paper feeding apparatus 20 is temporarily stored in delay circuit 162 and compared by comparator 162 with data stored in RAM 165 and obtained when original O is not clamped in normal use. At this time, when the data stored in RAM 165 and representing a state in which original O is not clamped in normal use is larger than the detection data from delay circuit 162, comparator 162 sets comparison result CPR1 to "L" level.

Controller 61 reads this comparison result and informs main control unit 51 of the open state of automatic paper feeding apparatus 20. While comparison result CPR1 from comparator 167 is kept at "L" level, the start of a feeding operation is inhibited. Main control unit 51 causes display unit 52*a* to display the open state of automatic paper feeding apparatus 20.

Various reference size data are stored in RAM 165, and the same comparison result CPR1 is used in size detection.

However, no problem is posed to detect the open/closed state of automatic paper feeding apparatus 20 if initialization is performed upon a power-ON operation, or if a feeding operation is stopped upon detection of jamming, multiple paper-conveying, and skewing.

An output from comparator 165 may be 8- or 16-bit data and is assigned with an opening/closing detection result of the feeding mechanism except for the comparison results (i.e., size discrimination result and multiple paper-conveying result) with other reference data stored in RAM 165 shown in FIG. 65.

In this case, controller 61 reads a determination result in a given cycle with reference to a feedable state in which original O is absent.

An example is shown in Table 12 below.

TABLE 12

| | Sheet size | CPR1 | CPR2 | CPR3 | CPR4 | . . . | CPRF |
|---|---|---|---|---|---|---|---|
| 1 | A3/A4 crosswise | L | H | H | H | H | H |
| 2 | B4/B5 crosswise | H | L | H | H | H | H |
| 3 | A4/A5 crosswise | H | H | L | H | H | H |
| 4 | Free size 1 | H | H | H | L | H | H |

TABLE 12-continued

| Sheet size | CPR1 | CPR2 | CPR3 | CPR4 | ... | CPRF |
|---|---|---|---|---|---|---|
| . | . | . | . | . | . | . |
| . | . | . | . | . | . | . |
| . | . | . | . | . | . | . |
| F Normal feeding (no sheet) | H | H | H | H | H | L |

Figure 66:
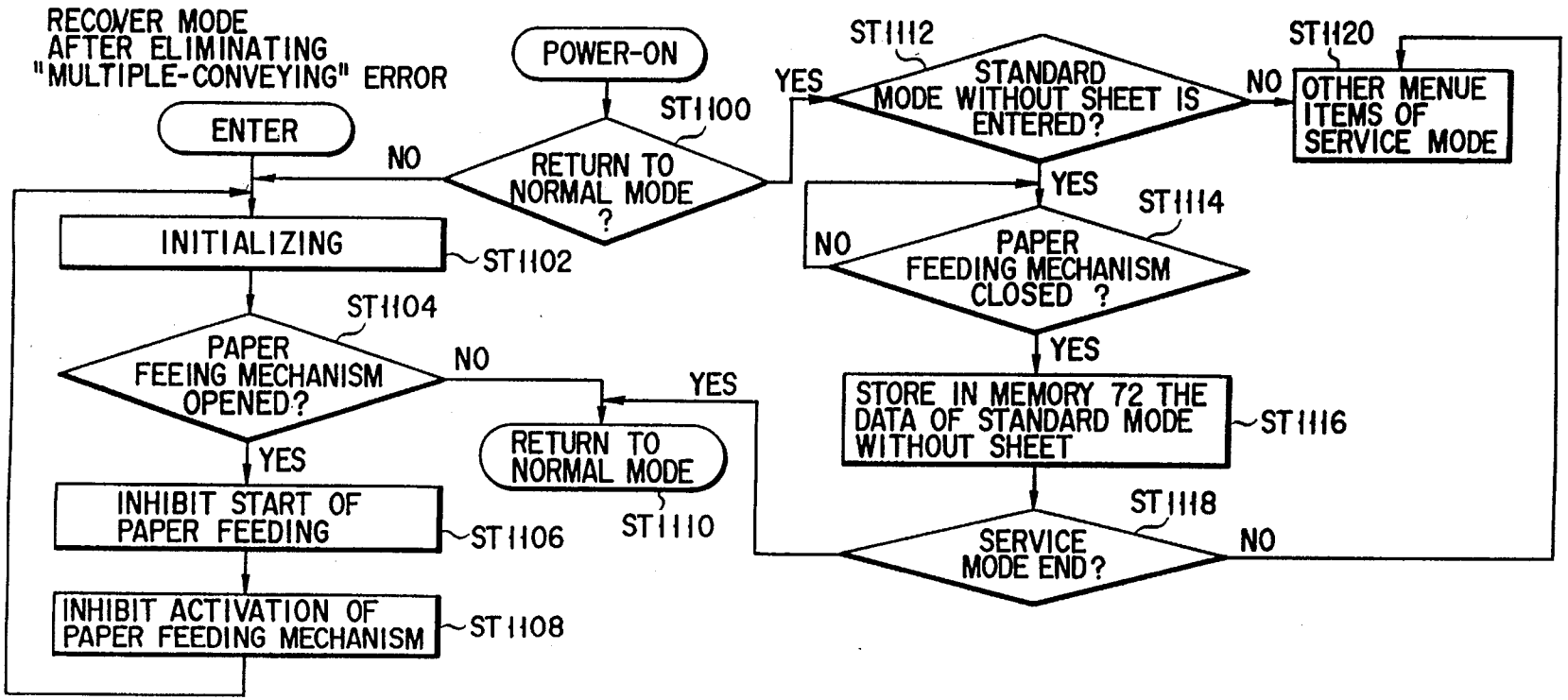
FIG. 66 is a flow chart for explaining an opening/closing detection operation for an automatic document (original) feeding apparatus.

A flow chart for explaining the above processing is shown in FIG. 66.

More specifically, upon power-ON operation of the apparatus, the CPU in controller 61 checks if a service mode is currently set (ST1100).

If the service mode is not set (NO in ST1100), or a normal state is to be restored upon interruption of paper feeding caused by multiple paper-conveying, initializing processing is performed (ST1002) to preset counters, latches, and memories in apparatus 20 to initial states.

When the feeding mechanism in FIG. 2 is open (YES in ST1104), the start of paper feeding is inhibited (ST1106), and inhibition of the operation which is caused by the "open state of the paper feeding mechanism" is displayed (ST1108). When the paper feeding mechanism is closed to set a state in which paper feeding can be started, the flow returns to step ST1102, and initializing is performed again. When the paper feeding mechanism is closed upon initializing (NO in ST1104), the normal mode is set (ST1110).

When buttons on operation panel 52 are simultaneously depressed upon power-ON operation, for example, the service mode is set (YES in ST1100). When standard state data for a multiple paper-conveying detection of an original sheet having a predetermined size is entered without using a sheet (original O) for detecting the multiple paper-conveying (YES in ST1112), and if the paper feeding mechanism in FIG. 2 is kept closed (YES in ST1114), the default data without the multiple paper-conveying detection sheet is stored in memory 72 (ST1116).

When the service mode is completed (YES in ST1118) upon memory storage processing, the normal mode is set (ST1110).

When multiple paper-conveying detection data is to be entered using a predetermined original sheet (NO in ST1112), or when processing continues in the service mode even upon completion of the memory storage processing (NO in ST1118), another data entry using another service mode menu is performed (ST1120).

The open/closed state of automatic paper feeding apparatus 20 may be detected by an opening/closing detector.

Figure 67:
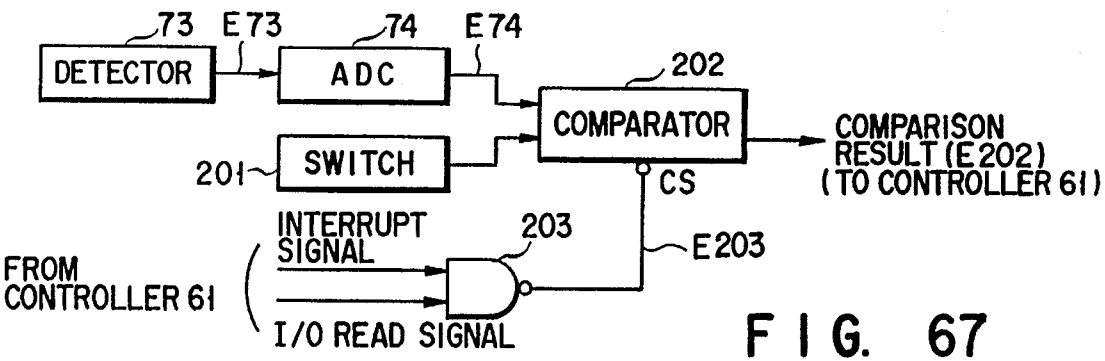
FIG. 67 is a block diagram showing a detector for detecting the open/closed state of the automatic document (original) feeding apparatus.

An embodiment of this arrangement is shown in FIG. 67.

In this case, data corresponding to outputs E73 from detector 73 is set with switch 201 at setting upon unpacking or at the time of shipment from a factory in a state wherein an original sheet is not clamped in normal use. Output E73 from detector 73 is converted into digital data E74 by ADC 74 and is always input to comparator 202. The CS terminal of this comparator 202 receives output E203 of AND gate 203. AND gate 203 receives an interrupt signal and an I/O read signal from controller 61.

That is, only when the interrupt signal and the I/O signal are simultaneously generated by controller 61, output E202 from comparator 202 is supplied to controller 61.

With the above arrangement, in a state wherein another processing is not performed, controller 61 can detect the open/closed state of automatic paper feeding apparatus 20 as needed.

Another embodiment will be described below, wherein different voltage values (E73) output in correspondence with changes in resistance values of pressure sensitive conductive rubber 35*a* in feeding roller 35 are used for calculating an average value of the stored data. In detection of multiple paper-conveying of original O, the average data is compared with a detection value of original O.

The first embodiment exemplifies an operation when the number of types of originals O is one.

First of all, the arrangement of a multiple paper-conveying detector will be described wherein the operator inserts a plurality of original sheets normally used in automatic paper feeding apparatus 20 to calculate an average value of the data of these original sheets, and multiple paper-conveying is detected with reference to the calculated average value.

Figure 68:
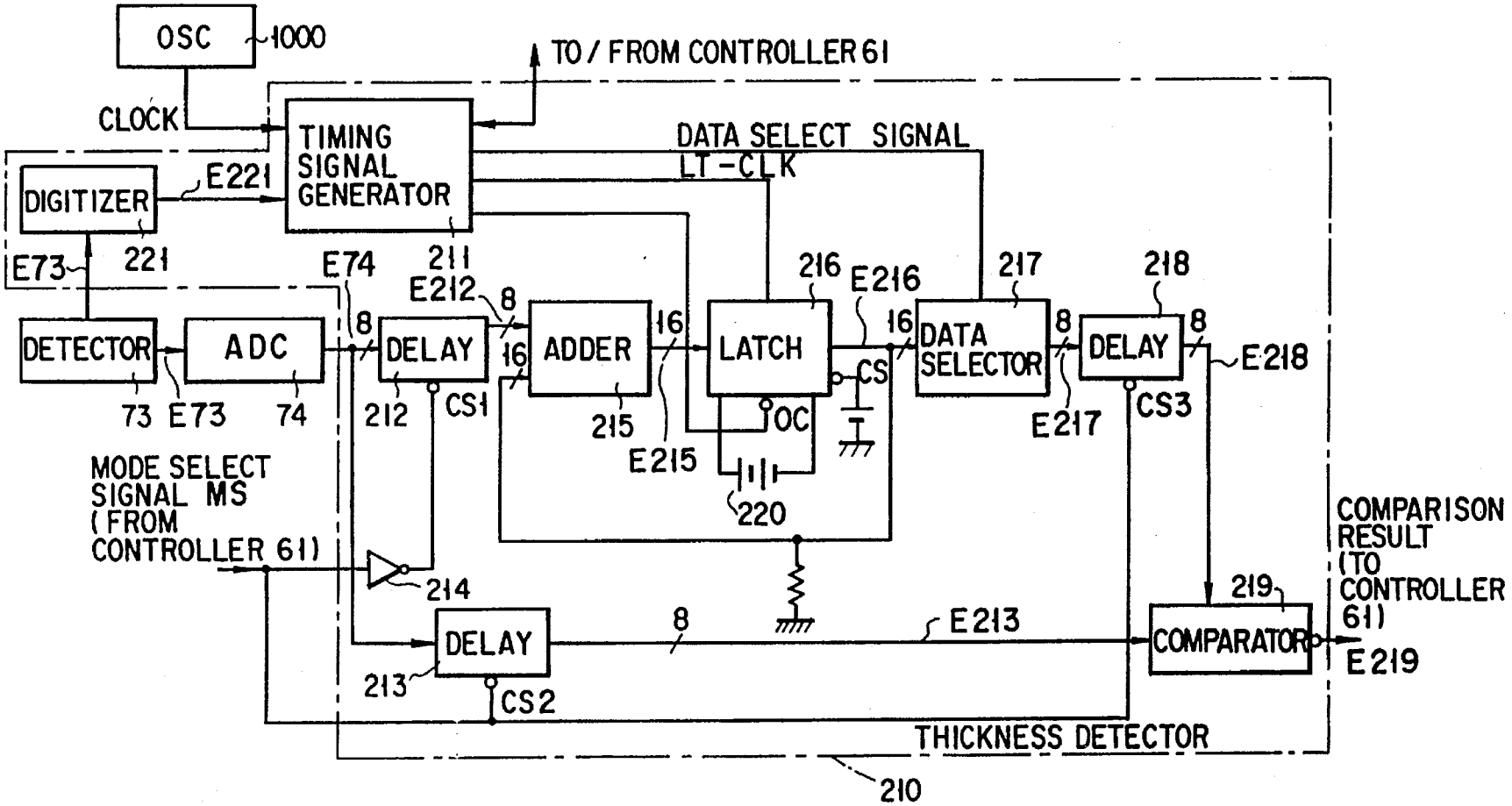
FIG. 68 is a schematic block diagram showing the arrangement of a thickness detector serving as a multiple paper-conveying detector.

FIG. 68 is the schematic block diagram of thickness detector 210 serving as a multiple paper-conveying detector.

Thickness detector 210 comprises digitizer 221, timing generator 211 for generating various timing signals, delay circuits 212, 213, and 218, inverter 214, adder 215, latch 216, data selector 217, comparator 219, and battery 220.

Figures 69A, 69B, 69C, 69D:
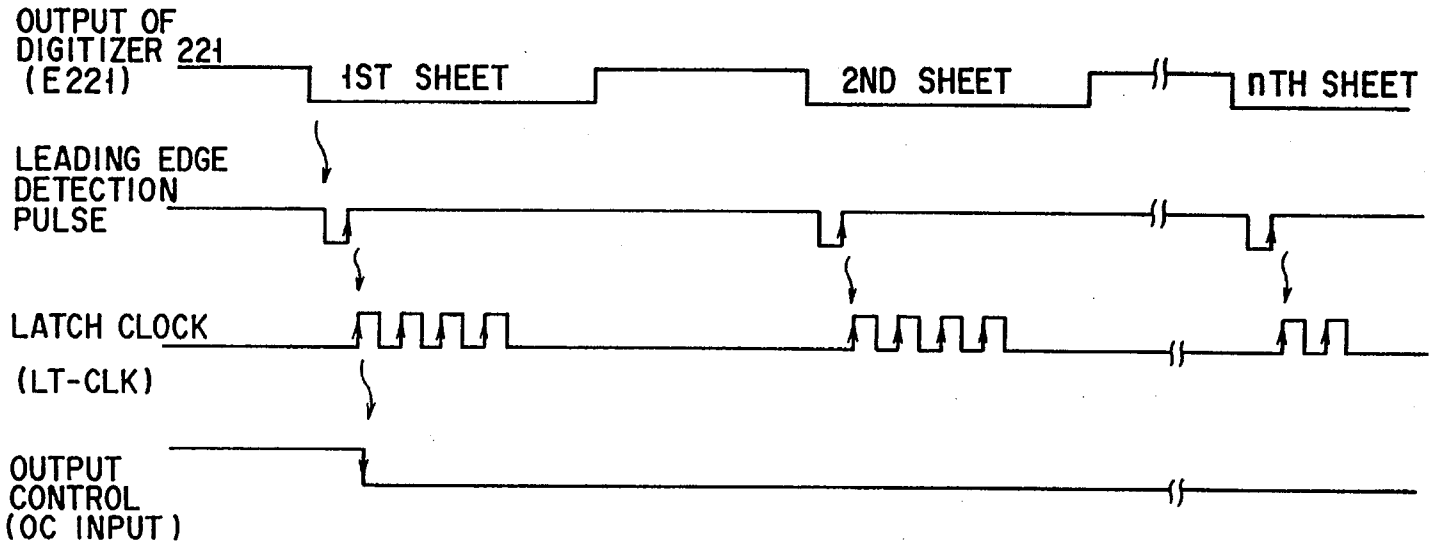
FIGS. 69A to 69D are timing charts showing signal waveforms of the main part in a thickness detector shown in FIG. 66.
Figures 70A, 70B, 70C, 70D:
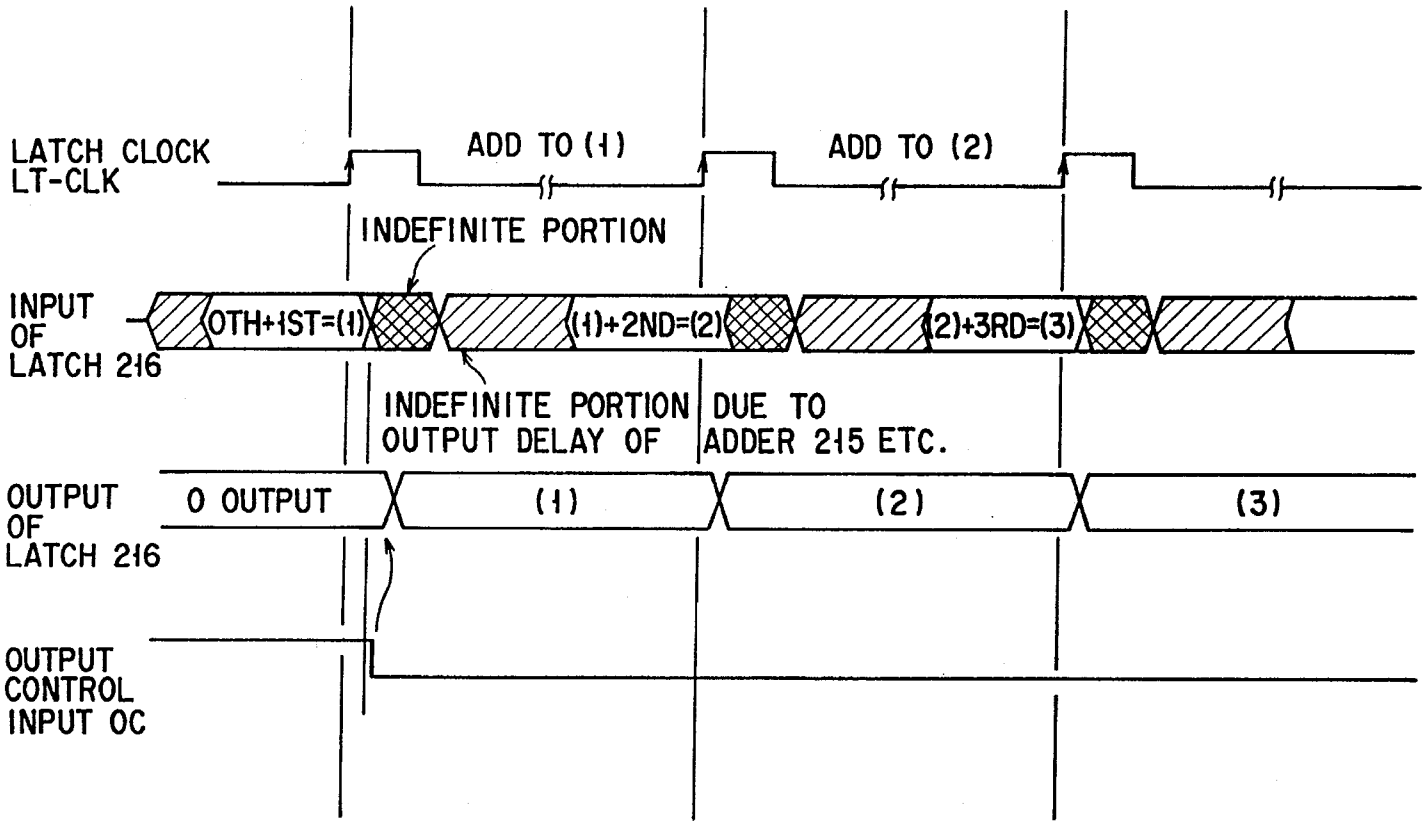
FIGS. 70A to 70D are timing charts for explaining the operation of a latch.
Figures 71A, 71B, 71C, 71D, 71E, 71F:
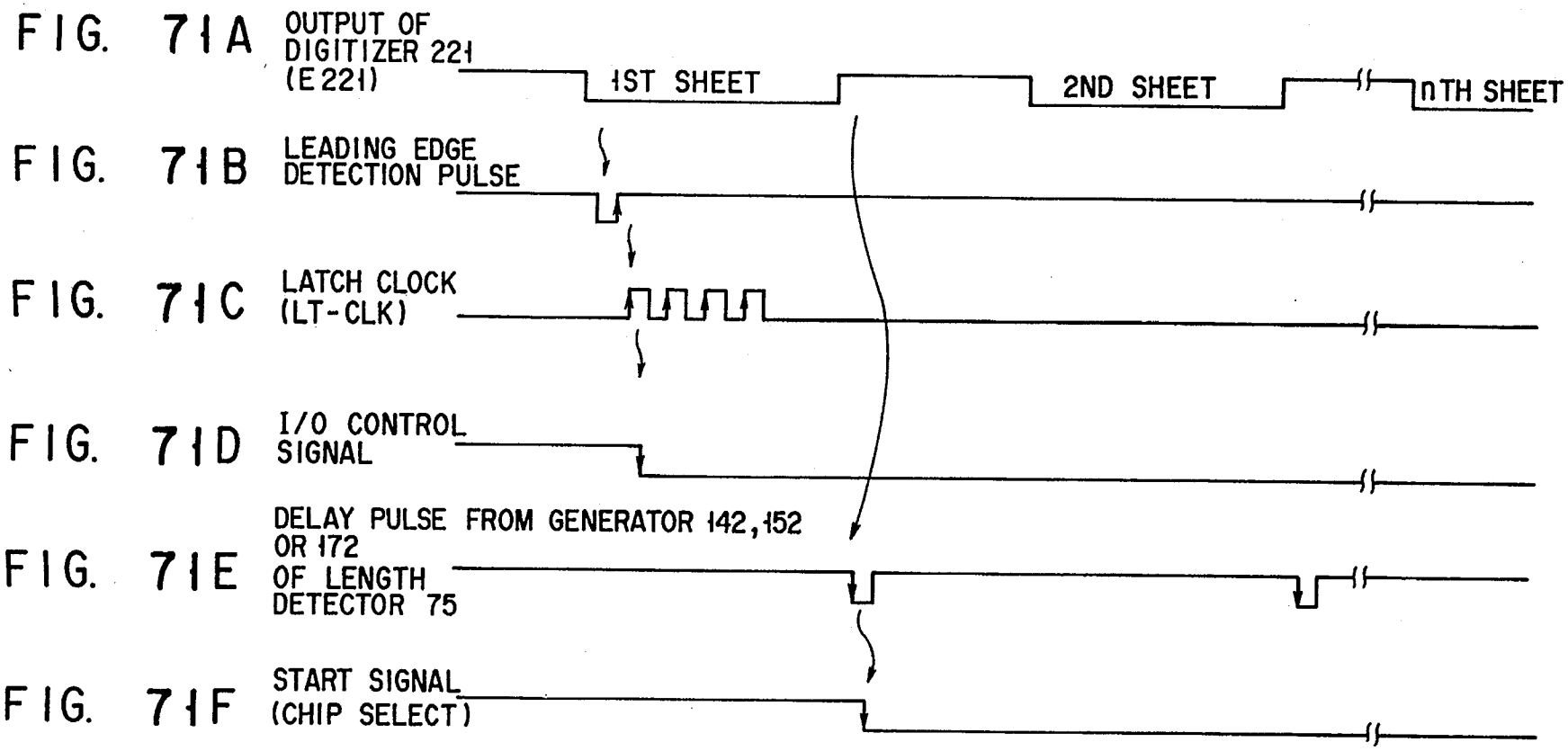
FIGS. 71A to FIG. 71F are timing charts showing signal waveforms of the main part in the thickness detector in FIG. 66.

Digitizer 221 is identical to that used in length or thickness detector 75 or 76. As shown in FIG. 69A, digitizer 221 outputs a digitized signal of "L" level when original O is clamped between feeding roller 35 and aligning roller 34.

Timing generator 211 generates a leading edge detection pulse shown in FIG. 69B when digitized signal E221 from digitizer 221 is set at "L" level shown in FIG. 69A. After the leading edge signal of the leading edge detection pulse is detected, as shown in FIG. 69C, timing generator 211 generates latch clock CT-CLK obtained by frequency-dividing the master clock from oscillator 1000. After the first leading edge output of this latch clock is detected, timing generator 211 sets input/output control signal OC held at "H" level to "L" level, as shown in FIG. 69D.

Latch clock LT-CLK is generated by a predetermined number of pulses after the leading edge of original O is detected. When original O is not clamped between feeding roller 35 and aligning roller 34, latch clock LT-CLK is not generated. The above input/output control signal OC is formed by inputting the latch clock to a flip-flop circuit.

A sampling count or a total sampling count of one original O can be set by an operator or serviceman through controller 61.

Latch clock LT-CLK from timing generator 211 and input/output control signal OC are output to latch 216.

Timing generator 211 also outputs, to data selector 217, data select signal DS representing a specific bit count of data selector 217 which is to be output to delay circuit 218 in calculation of an average value.

Prior to detection of reference original O by a feeding operation, controller 61 sets mode select signal MS to "H" level. At this time, chip select signal CS1 of delay circuit 212 is inverted to "L" level by inverter 214, and chip select signal CS2 of delay circuit 213 is set at "H" level. Therefore, delay circuit 212 is set in an operative state, while delay circuit 213 is set in an inoperative state.

When original O is detected by empty sensor 29, controller 61 starts a feeding operation and feeds reference original O to the lower-surface side of original conveyor belt 37 currently driven in the feeding direction through a resist roller pair constituted by aligning roller 34 and feeding roller 35.

When reference original O passes between aligning roller 34 and feeding roller 35, the thickness of reference original O is detected by detector 73 based on a change in resistance value of feeding roller 35. The detected voltage value E73 is converted into 8-bit data by ADC 74. The converted 8-bit data is supplied to delay circuit 212. After the converted data is delayed by delay circuit 212, the delayed data (E212) is output to adder 215. Adder 215 adds delayed data E212 from delay circuit 212 to the latch content (E216) of latch 216. The content (E216) of latch 216 is updated by the result (E215) of the sum obtained by adder 215.

When data E73 detected by detector 73 upon a change in resistance value of feeding roller 35 is supplied to digitizer 221, digitized signal E221 of "L" level is output from digitizer 221. In response to the "L" level signal E221, timing generator 211 generates the leading edge detection signal (LT-CLK) which is then supplied to latch 216.

After the first leading edge of latch clock LT-CLK is detected, timing generator 211 changes the logic level of input/output control signal OC input to the output control terminal of latch 216 from "H" level to "L" level.

The data temporarily stored in delay circuit 212 is supplied to adder 215.

FIGS. 70A to 70D are timing charts showing the timings of the inputs/outputs with respect to latch 216.

The average value calculation of latch 216 will be performed as follows.

A delay time is present until latch clock LT-CLK rises after original O is clamped between aligning roller 34 and feeding roller 35. Since the output control terminal (OC) is set at "H" level until the first latch clock (LT-CLK) is input to latch 216, latch 216 is set in a high-impedance state, and its output is set in a ground state, i.e., "0" level through a resistor. The data of "0" level (E216) and the data (E212) from delay circuit 212 are added by adder 215.

Data E74 from ADC 74 is 8-bit data, and output E216 from latch 216 is 16-bit data. The sum as 16-bit data E215 is output to latch 216 as data obtained by adding the lower eight bits of output E216 from latch 216 and delayed data E212 (E74) from ADC 74.

Here, sum data E215 is defined as (1). This data (1) is latched in latch 216 in response to the first latch clock (LT-CLK). In addition, the data (1) input to adder 215 as output E216 from latch 216 and added by adder 215 with second detected data E212 stored in delay circuit 212. The resultant data is defined as data (2). Data (2) is latched when the next latch clock (LT-CLK) is input. Data (2) is then added to third data E212 as output E216 from latch circuit 216.

This operation is repeated, and the sampled sum is stored in latch 216.

When sampling is completed by a predetermined number of times, timing generator 211 stops generating the latch clock LT-CLK.

In response to this sampling count, timing generator 211 outputs, to data selector 217, data select signal DS which represents a specific number of upper bits of 16-bit output E216 to be supplied to delay circuit 218.

In response to data select signal DS, the data representing the specific number of upper bits stored in latch 216 is output, as average data E217, from data selector 217 to delay circuit 218.

As described above, upon completion of sampling by the predetermined number of times, timing generator 211 outputs a sampling end signal to controller 61 and main control unit 51. Then, the current mode is changed to a normal detection mode. At this time, controller 61 changes mode select signal MS from "H" level to "L" level.

At this time, delay circuit 212 is set in an inoperative state, while delay circuit 213 is set in an operative state. Therefore, output E74 from ADC 74 is temporarily stored in delay circuit 213.

This mode select signal MS is also supplied to the chip select terminal (CS3) of delay circuit 218. For this reason, the average value E217 of sum data E216 accumulated in latch 216 is temporarily stored in delay circuit 218. Data E213 in delay circuit 213 is compared with data E218 in delay circuit 218 by comparator 219, so that multiple paper-conveying can be detected on the basis of the average reference data (E218).

Latch 216 is backed up by battery 220. Even if the power switch of automatic paper feeding apparatus 20 is turned off, the reference data (E216) is kept held.

The data from length detector 75 may be combined in multiple paper-conveying detection.

The length data may be averaged for a plurality of fed original sheets in the same manner as described above, and the average data may be used as reference data for detecting multiple paper-conveying.

The thickness or length of first original O may be sampled a plurality of times to obtain an average value, so that multiple paper-conveying of second or subsequent original O is detected based on the obtained average value.

In this case, mode select signal MS may not be constituted by a signal from controller 61, but may be constituted by chip select signal E105 from FF 105 in length detector 75 of FIG. 14.

Alternatively, the chip select signal from FF 113 may be used for the mode select signal (MS) by arranging delay pulse generator 112 for generating a delay pulse in accordance with digitized output E221 from digitizer 221, and FF 113 is set by this delay pulse, as in the case of FIG. 20.

In this case, chip select signal E105 (or E113) from FF 105 (or FF 113) is set at "H" level until first original O has passed and delay pulse E102 (or E112) is generated. Thereafter, the same operation as in the averaging mode of the reference data may be performed. Thus, the same operation as in the normal mode is performed for the second or subsequent original sheet since the chip select signal (E105) from FF 105 has changed from "H" level to "L" level.

Timing generator 211 may be arranged to generate latch clock LT-CLK for only the first original sheet. Chip select signal E105 from FF 105 is input to timing generator 211 to output latch clock LT-CLK for only the first original sheet.

The timing charts of the respective signals of the above case are shown in FIGS. 71A to 71F.

The embodiment in which only one type of data (E215) is stored in latch 216 to calculate an average value has been described.

Several types of data may be stored in place of storage of one type of data in latch 216. For this purpose, an arrangement using memory 237 is shown in FIG. 72.

Figure 72:
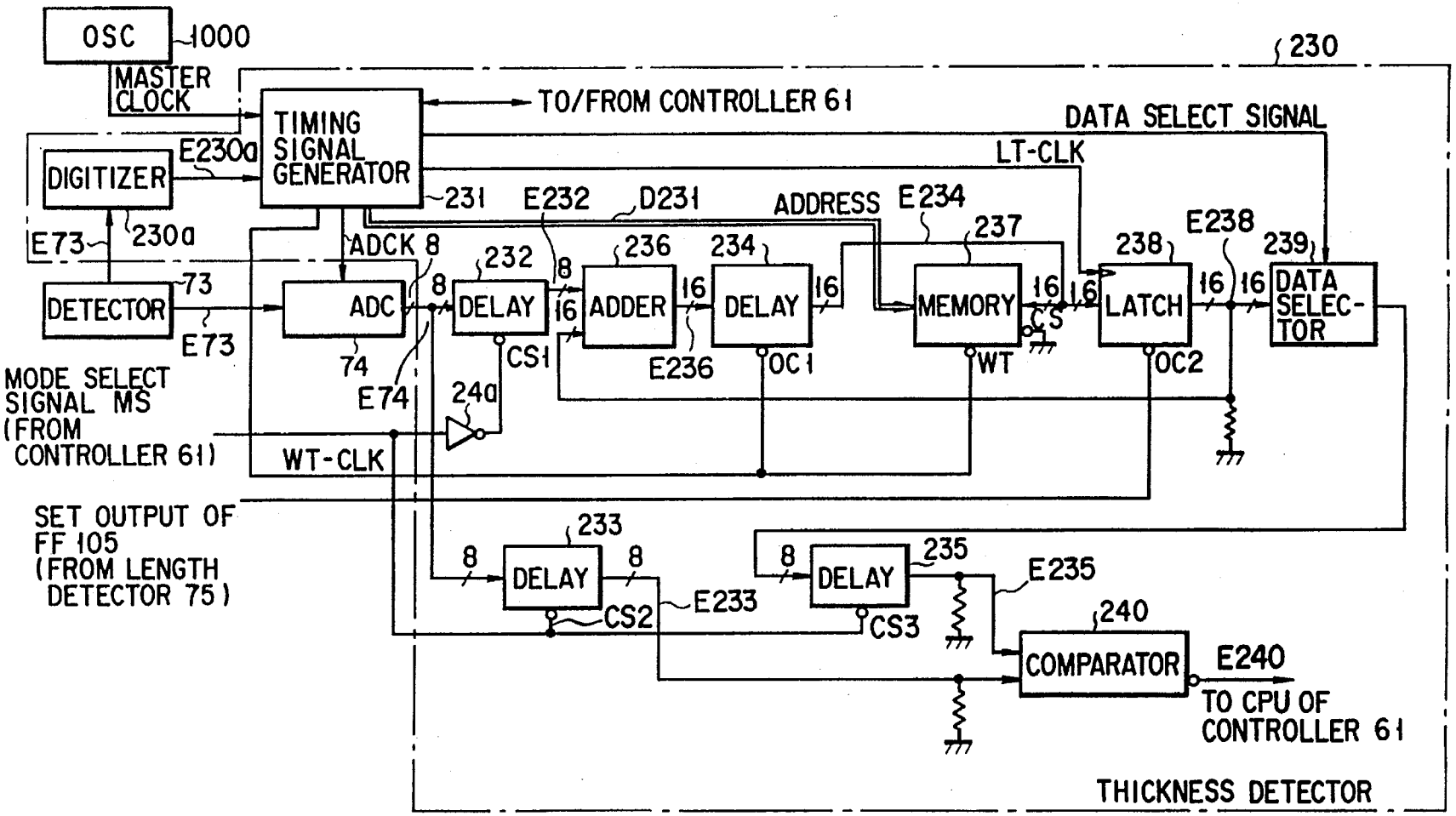
FIG. 72 is a schematic block diagram showing the arrangement of a thickness detector serving as a multiple paper-conveying detector.

FIG. 72 is the schematic block diagram showing thickness detector 230 serving as a multiple paper-conveying detector of this embodiment. Thickness detector 230 comprises digitizer 230*a*, timing generator 231, delay circuits 232, 233, 234, and 235, adder 236, memory (e.g., a RAM) 237, latch 238, data selector 239, comparator 240, and inverter 240*a*.

When original O is clamped between aligning roller 34 and feeding roller 35, output voltage E73 from detector 73 changes to cause digitizer 230*a* to output "L" signal E230*a*. Timing generator 231 for generating various timing signals supplies AD conversion clock ADCK to ADC 74.

ADC 74 outputs 8-bit digital value E74 corresponding to output voltage E73 from detector 73, on the basis of AD conversion clock ADCK. Digital value E74 is supplied to delay circuits 232 and 233.

If mode select signal MS is set at "H" level in the reference data entry mode, chip select signal CS1 from delay circuit 232 which is level-inverted by inverter 24*a* is set at "L" level. In this case, chip select signal CS2 from delay circuit 233 is set at "H" level. Delay circuit 232 is enabled, and delay circuit 233 is disabled.

When delay circuit 232 is kept disabled, 8-bit digital value E74 from ADC 74 is temporarily stored in delay circuit 232. Stored 8-bit data E232 is supplied to adder 236.

Adder 236 also receives 16-bit data E238 (to be described later) stored in latch 238. Adder 232 adds 8-bit data E232 to the lower eight bits of 16-bit data E238 and outputs sum result E236 to delay circuit 234.

Figures 74A, 74B, 74C, 74D, 74E, 74F, 74G:
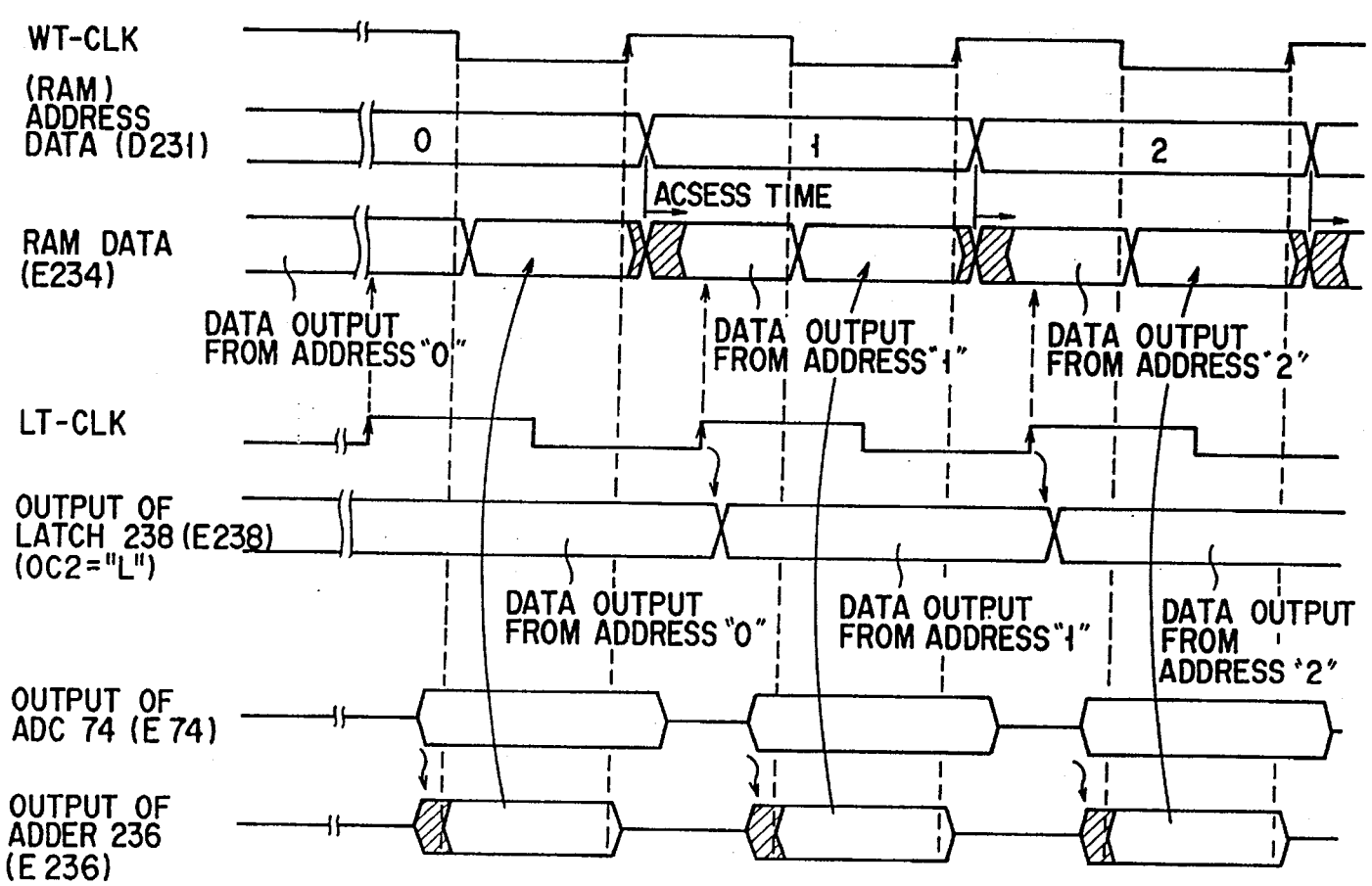
FIGS. 74A to 74G are timing charts showing signal waveforms of the main part in a thickness detector.

In response to "L" signal E230*a*, timing generator 231 generates write clock WT-CLK of "L" level when 8-bit digital value E74 is output from ADC 74 (FIGS. 74A and 74F).

When this "L" write clock WT-CLK is supplied as output control signal OC1 to delay circuit 234, the current sum result E236 (16-bit data) is stored in delay circuit 234. This stored 16-bit data E234 is then stored in memory (RAM) 237 and latch 238.

In response to "L" signal E230*a*, timing generator 231 generates address data D231 (FIGS. 74A and 74B) during generation of "L" write clock WT-CLK.

When this address data D231 is supplied to memory 237, the 16-bit data E234 currently output from delay circuit 234 is stored at an address, e.g., address 0 specified by data D231. The data stored at address 0 is sum result E236 corresponding to ADC output E74 obtained during generation of "L" write clock WT-CLK (FIGS. 74A, 74F, and 74G).

While set output E105 from FF 105 is kept at "L" level, output control signal OC2 from latch 238 is set at "L" level, and latch 238 is set in an operative state (FIG. 74E).

When latch clock LT-CLK (FIG. 74D) is output from timing generator 231, 16-bit data E234 (FIG. 74C) stored at address 0 of memory 237 is latched in latch 238. This latched data E238 is fed back to adder 236 and supplied to data selector 239.

The above operations are repeated similarly for data at address 1 and subsequent addresses of memory 237.

When data select signal DS is then output from timing generator 231, signal E239 (corresponding to data E234 stored at address 0 of memory 237) representing the upper eight bits of data E238 stored in latch 238 is output from data selector 239.

When the mode selected by mode select signal MS returns to the normal mode ("L" level), this "L" mode select signal MS is inverted by inverter 24*a* to set chip select signal CS1 from delay circuit 232 to "H" level. At the same time, chip select signal CS2 from delay circuit 233 and chip select signal CS3 from delay circuit 235 are also set at "L" level. Delay circuits 233 and 235 are enabled, while delay circuit 232 is disabled.

When delay circuit 233 is enabled, 8-bit digital value E74 from ADC 74 is temporarily stored in delay circuit 233, and then stored 8-bit data E233 is supplied to comparator 240.

When delay circuit 235 is enabled, 8-bit digital value E239 from data selector 239 is temporarily stored in delay circuit 239, and then stored 8-bit data E235 is supplied to comparator 240.

Comparator 240 compares detection data E233 (thickness data of original O currently fed) corresponding to 8-bit digital value E74 from ADC 74 with reference data E235 from delay circuit 235. As a result, it is detected that detection data E233 is larger than reference data E239, comparison result E240 representing a multiple paper-conveying error is supplied to the CPU in controller 61.

In this case, mode select signal MS is a signal from controller 61.

A mode selecting method of this case is the same as the method of storing only one type of data in latch 216 in FIG. 68.

Figure 73:
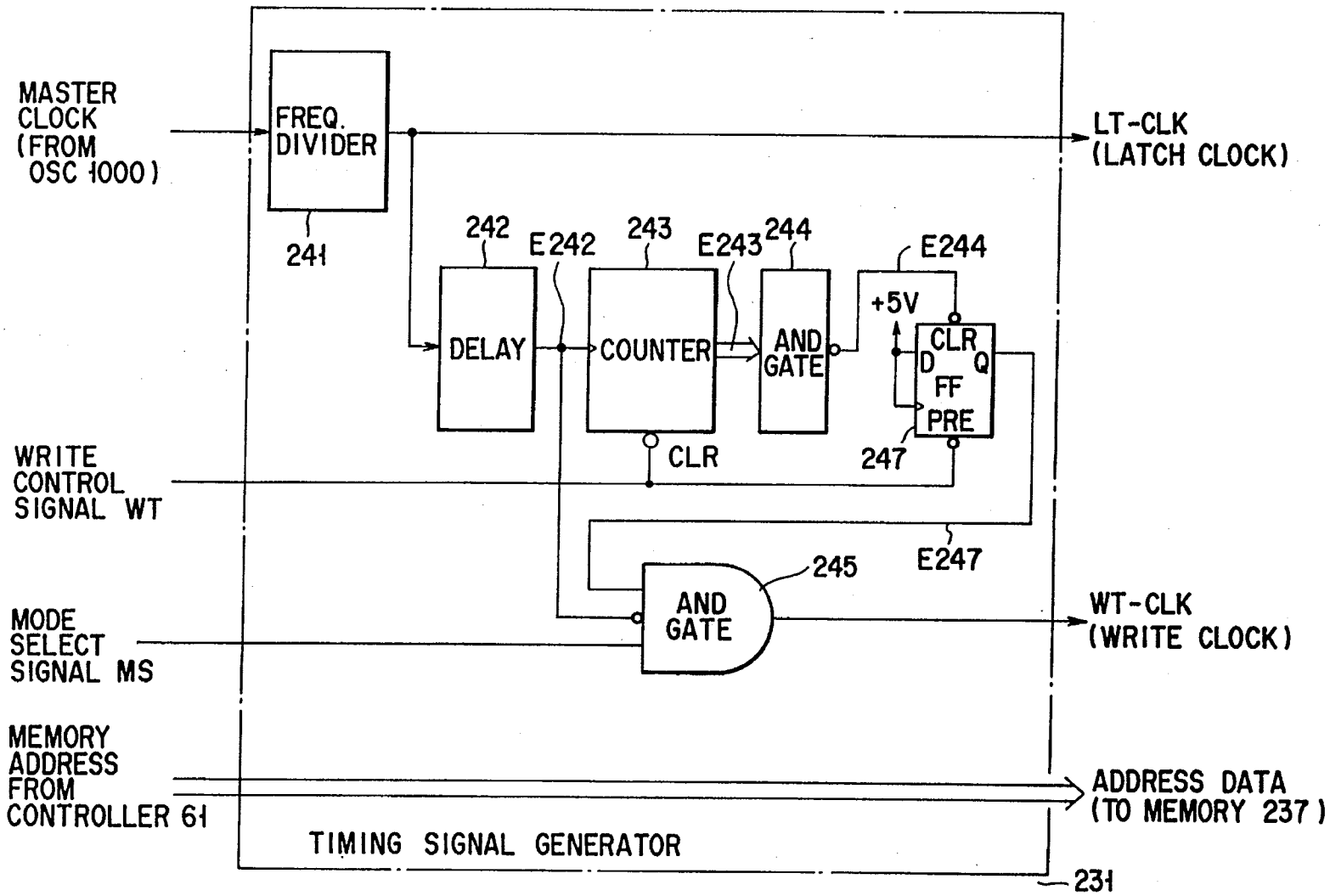
FIG. 73 is a schematic block diagram of a timing generator for generating various timing signals.

As shown in FIG. 73, timing generator 231 comprises frequency divider 241, delay circuit 242, counter 243, AND gates 244 and 245, and FF 247. A master clock (M-CLK) is frequency-divided to generate a write clock (WT-CLK) or a latch clock (LT-CLK) for latch 238 connected to the output of memory 237.

The WT control signal is connected to the clear terminal of counter 243 and the preset terminal of FF 247. The WT control signal generates a pulse of active low at the trailing edge of original O and can be used as a leading edge detection pulse.

When the WT control signal is set at "L" level, outputs E243 from counter 243 are set at all "0"s, and clear signal E244 to FF 247 becomes "H" level. Counter 243 counts up delay signal E242 of write clock LT-CLK obtained by frequency-dividing the master clock M-CLK. When count value E243 of counter 241 reaches a predetermined value, AND gate 244 outputs signal E247 of "L" level. This output E244 is input to the clear terminal of FF 247 so as to set the set output E247 to "L" level.

The set output E247 from FF 247 is used to control predetermined sampling in the reference data input mode.

Operations for storing average values for the respective originals O at given addresses of memory 237 will be described below in detail.

(1) Storage of Only One Type of Data

This data is stored at address 0000.

(2) Storage of Plurality of Original Data

Addresses are determined in accordance with the sizes of originals as follows. When the addresses are counted up one by one by a sampling count from the start address corresponding to each size, size detection can be performed simultaneously.

| | |
|---|---|
| 0000 | ← A3 data storage address |
| 1000 | ← A4 data storage address |
| 2000 | ← A5 data storage address |
| . | . |
| . | . |
| . | . |
| 7000 | ← free size data 1 storage address |
| 8000 | ← free size data 2 storage address |

After the size of the original is detected by the size detector described above, controller 61 may determine an address area corresponding to the detected size.

In the reference data input mode, the data from ADC 74 is stored in delay circuit 232.

In this case, the timings of the respective signals are shown in FIGS. 74A to 74G.

When the first original sheet serving as a reference sheet is clamped by the detection mechanism, a leading edge detection pulse is generated in accordance with the trailing edge of output E230*a* from digitizer 230*a*.

After this trailing edge signal of the leading edge detection pulse is detected, signal generator 231 generates write clock WT-CLK serving as a write signal for memory 237.

When sampling reaches a predetermined sampling count, a sampling stop signal is output to stop generating write clock WT-CLK.

Then, address D231 corresponding to the same position as the leading edge of original O is generated from the leading edge of original O, and this address is sent to memory 237.

Write clock WT-CLK is stopped prior to detection of the trailing edge of original O.

Chip select signal E105 from FF 105 in length detector 75 is input to the output control terminal (OC2) of latch 238.

Chip select signal E105 is held at "H" level until a delay pulse is generated by length detector 75 after first original O has passed.

For this reason, the output control terminal (0C2) of latch 238 is set in a high-impedance state. Since the output from latch 238 is connected to ground through a resistor, this output is set at "0" level.

Adder 238 adds the lower eight bits of 16-bit output E238 from latch 238 and eight bits output E232 of delay circuit 232.

During the input of first sheet data, output E238 from latch 238 is kept at "0" level. In practice, the detected data (E232) is directly output to adder 238.

Output E236 from adder 236 is stored in delay circuit 234. The output control terminal (OC1) of delay circuit 234 receives write clock WT-CLK.

FIGS. 74A to 74G show inputs/outputs with respect to memory 237.

When write clock WT-CLK is set at "L" level, output E234 from delay circuit 234 is output to memory 237.

When write clock WT-CLK is set at "H" level, delay circuit 234 does not generate any output, and the output data from memory 237 becomes valid.

On the other hand, write clock WT-CLK is also input to write terminal WT of memory 237.

Address D231 is output from timing generator 231 to memory 237 at a timing delayed by one count from write clock WT-CLK.

Output E234 from delay circuit 234 is stored at the address designated for memory 237 at the leading edge of write clock WT-CLK.

The above operation is repeated by a predetermined number of sampling cycles.

Set output E105 from the FF goes to "L" level for the second and subsequent original sheets.

The detection data of the second original sheet and the detection data of the first original sheet are added at the same timing from the leading edges of originals O. The result (E236) of this addition is stored in memory 237 through delay circuit 234 at the address corresponding to the same timing as that of the first original sheet.

The same operation as in the second original sheet is performed for the third and subsequent original sheets until the end of sampling.

The normal mode is restored at the end of addition of data of originals O. At this time, controller 61 sets mode select signal MS to "L" level. Chip select signal CS1 from delay circuit 232 is inverted to "H" level by inverter 241, and chip select signal CS2 from delay circuit 232 is set at "L" level. Therefore, at this time, delay circuit 232 is set in an inoperative state, while delay circuit 233 is set in an operative state. Latch clock LT-CLK and the address signal D231 are generated at the same timing as that of the reference data input mode in the normal mode.

The result (E236) of addition of the reference data output from the address of memory 237 is stabilized by latch 238, and this result is output as arbitrary 8-bit data corresponding to a total sampling count from data selector 239, thereby performing averaging processing.

The data (E233) of original O as a detection target can be compared with the average value (E235) of the reference data (E232) sampled as the same timing as that of the reference data.

The data stored in memory 237 is held as entry data itself without any change because delay circuit 232 is set in an inoperative state and write signal WT-CLK is kept disabled in the normal mode.

Multiple paper-conveying can thus be detected.

Figure 75:
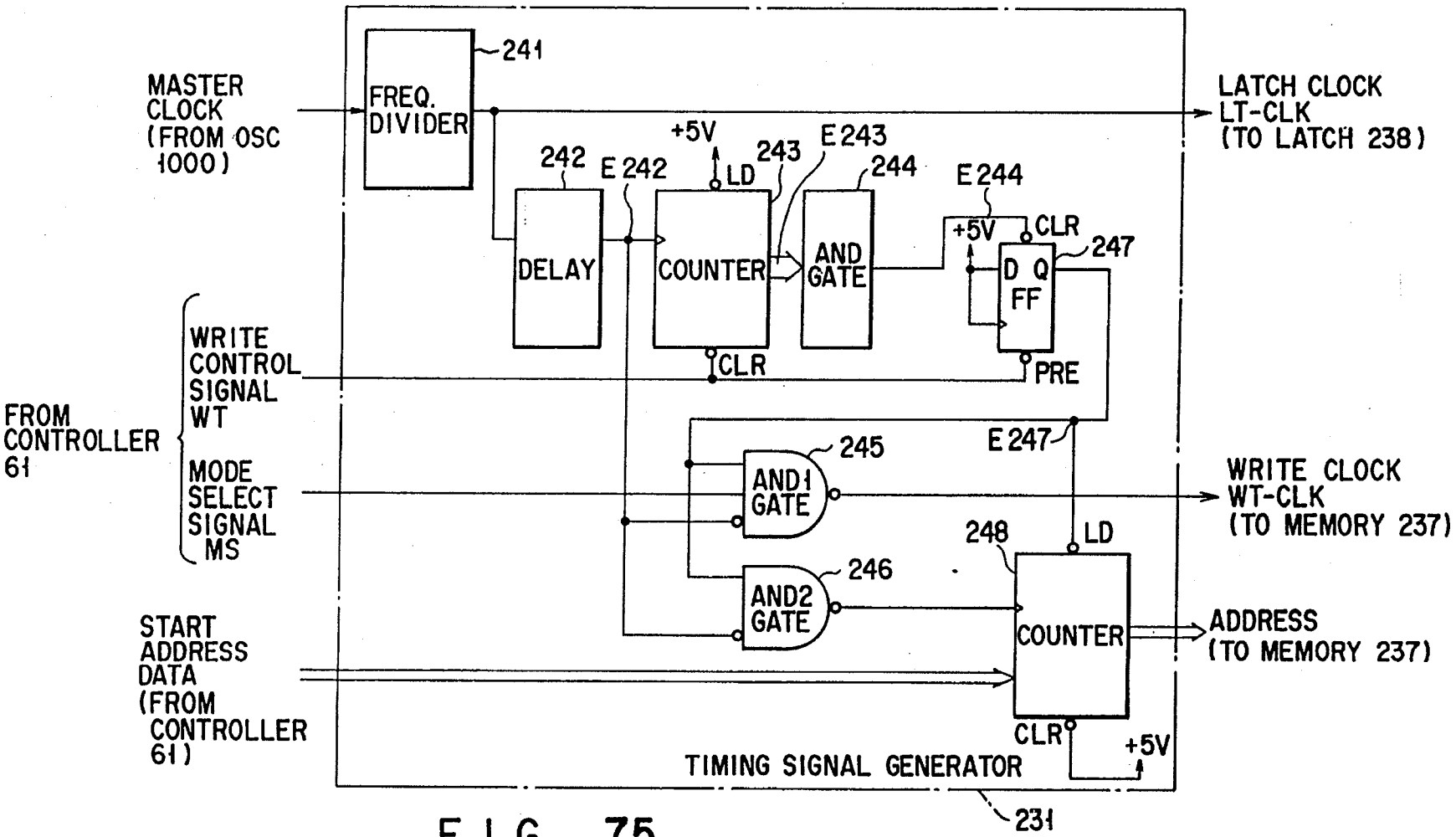
FIG. 75 is a schematic block diagram showing the arrangement of a timing generator for generating various timing signals.

The arrangement of another thickness detector having the same arrangement as in FIG. 73 will be described below. The internal arrangement of timing generator 231 is shown in FIG. 75. This arrangement is different from that shown in FIG. 73 in that AND gate 246 is added, and counter 248 for managing the addresses of memory 248 is arranged accordingly. In FIG. 73, the address signal from controller 61 is directly input to memory 247. However, an address signal from controller 61 is input to counter 248. Therefore, memory 246 can be counted up in accordance with the write clock (WT-CLK).

According to this method, using a plurality of originals O as reference sheets, multiple paper-conveying can be detected on the basis of the weighted average of thickness data for each original O. The timing charts of this case are shown in FIGS. 76A to 76G, and a view for explaining its operation is shown in FIG. 77.

Figures 76A, 76B, 76C, 76D, 76E, 76F, 76G:
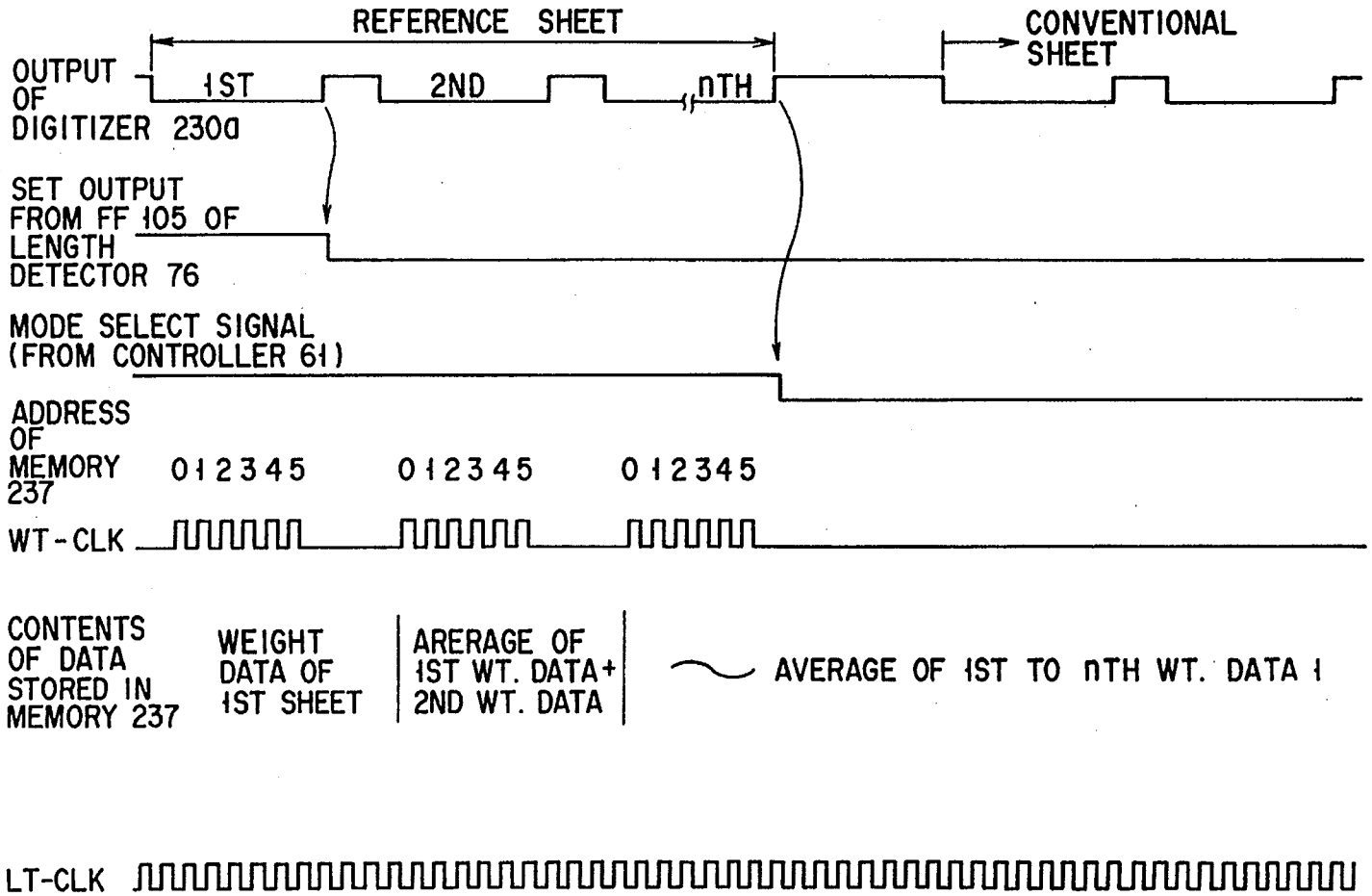
FIGS. 76A to 76G are timing charts showing signal waveforms of the main part in the thickness detector.

A detailed operation will be described below. As shown in FIG. 76B, until first original O is completely conveyed, set output (chip select signal) E105 from FF 105 in length detector 75 is kept at "H" level. Since this signal is kept at "H" level, output E238 from latch 238 shown in FIG. 72 is set in a high-impedance state. Thus, the output from latch 238 is set at "00" via a resistor connected to ground and latch 238. The thickness data of first original O is therefore stored in memory 237 as it is. This operation is the same as the method of sampling one original O a plurality of times to detect the thickness.

In feeding second reference original O, set output (chip select signal) E105 from FF 105 in length detector 75 is set at "L" level, and thickness data E238 of first reference original O which is stored in memory 237 is output from latch 238. Thickness data E238 of first reference original O and thickness data E232 of second reference original O are added by adder 236, and result E236 of the addition is stored in memory 237 through delay circuit 234.

Figure 77:
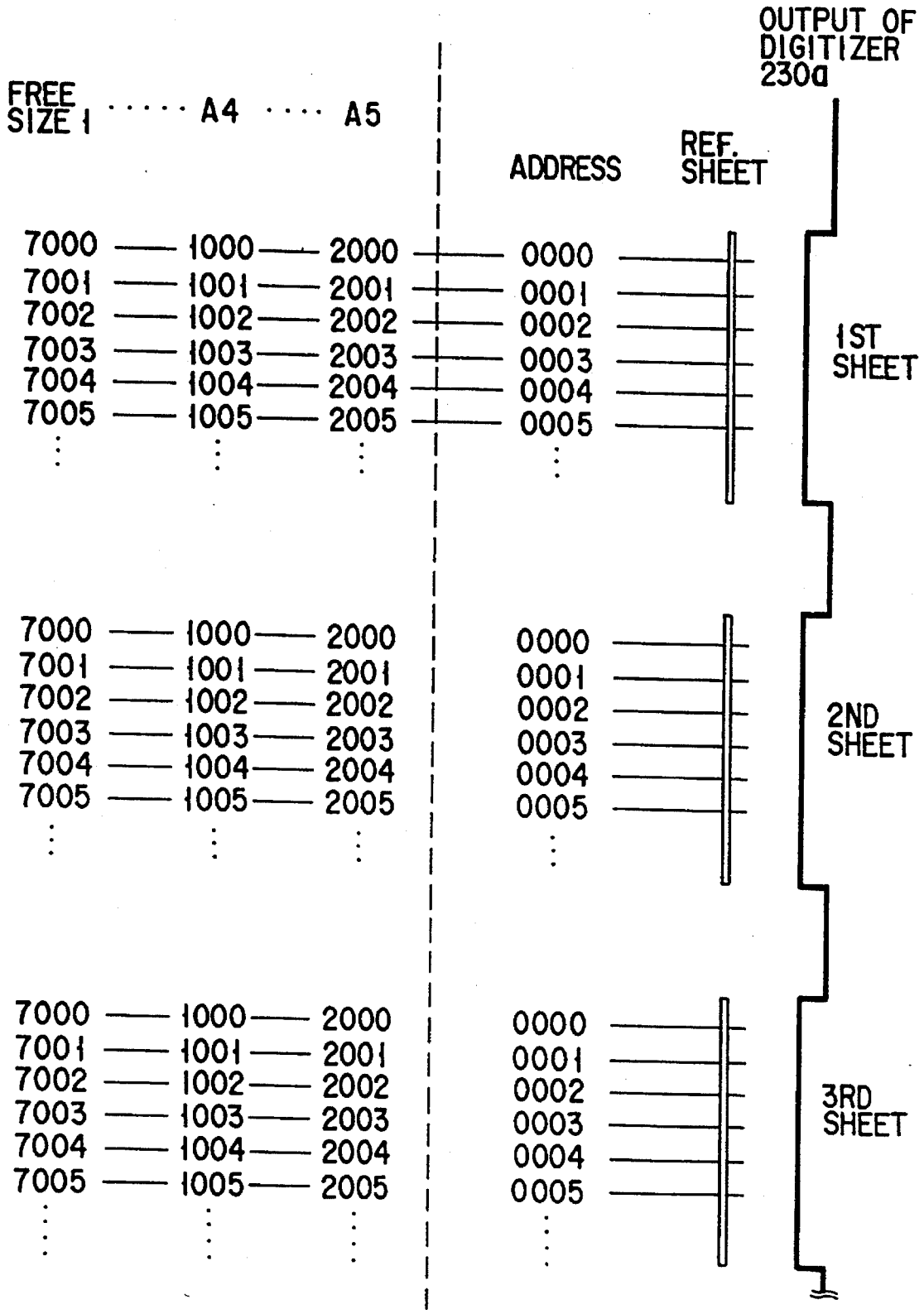
FIG. 77 is a view for explaining processing for determining addresses of sampled data.

As shown in FIG. 77, sampling results at the same position from the leading edge of originals O are added as thickness data. This operation is repeated until nth reference original O has been fed. As a result, the sums (result of additions) of the respective positions of originals O having been subjected to n additions are stored in memory 237. The 1/n of these sums is compared with the thickness of fed original O to detect multiple paper-conveying.

The write clock (WT-CLK), the latch clock (LT-CLK), and addition timings of memory 237 are shown in FIGS. 74A to 74G.

The above description has been made for one type of original O. Addresses of memory 237 are set for a plurality of types of originals O.

(1) Storage of Only One Type of Original Sheet Data 0000 or more (2) Storage of Plurality of Types of Original Sheet Data

| | |
|---|---|
| 0000–0FFF: | A3 data storage area |
| 1000–1FFF: | A4 data storage area |
| 2000–2FFF: | A5 data storage area |
| . | . |
| . | . |
| . | . |
| 7000–7FFF: | free size data 1 storage area |

-continued

| | |
|---|---|
| 8000–8FFF: | free size data 2 storage area |

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A paper sheet feeding apparatus comprising:

a table for placing a plurality of paper sheets;

means for feeding the paper sheets placed on said table;

a pressure-sensitive and electrically-conductive member being allowed to be pressed with a given pressure to the paper sheet fed by said feeding means;

means for generating an electrical signal representing a pressure condition of said pressure-sensitive and electrically-conductive member pressed to the paper sheet; and means for detecting that two or more of the paper sheets are simultaneously fed by said feeding means, in accordance with the electrical signal from said generating means;

wherein said pressure-sensitive and electrically-conductive member includes:

a roller being formed of a pressure-sensitive and electrically-conductive rubber having an electrical resistance value which varies depending on a pressure applied to the rubber, and an electrical conductive material provided outside of said roller, and wherein said generating means includes:

first detecting means, coupled to said electrical conductive material, for detecting a change in the resistance value of said pressure-sensitive and electrically-conductive rubber to provide resistance change information, and second detecting means for detecting that two or more of the paper sheets are simultaneously fed by said feeding means, in accordance with the resistance change information provided by said first detecting means.

2. The apparatus of claim 1, wherein said roller is pressed to the paper sheet so that a rotation of said roller feeds the paper sheet.

3. The apparatus of claim 1, wherein said detecting means includes:

length detector means for detecting a length of the paper sheet with respect to a fed direction of the paper sheet being fed by said feeding means in accordance with a content of the electrical signal from said generating means; and means for determining whether or not the length of the paper sheet detected by said length detector means is longer than a predetermined length, so as to detect multiple paper sheet-conveying.

4. The apparatus of claim 1, wherein said detecting means includes:

thickness detector means for detecting a thickness of the paper sheet being fed by said feeding means in accordance with a content of the electrical signal from said generating means; and means for determining whether or not the thickness of the paper sheet detected by said thickness detector means is larger than a predetermined thickness, so as to detect multiple paper sheet-conveying.

5. The apparatus of claim 1, wherein said detecting means includes:

length detector means for detecting a length of the paper sheet with respect to a fed direction of the paper sheet being fed by said feeding means in accordance with a content of the electrical signal from said generating means;

thickness detector means for detecting a thickness of the paper sheet being fed by said feeding means in accordance with the content of the electrical signal from said generating means; and means for determining whether or not the multiple paper sheet-conveying occurs, in accordance with the length detected by said length detector means and the thickness detected by said thickness detector means.

6. The apparatus of claim 1, wherein said detecting means includes:

length detector means for detecting a length of each of the paper sheets with respect to a fed direction of each paper sheet being fed by said feeding means, in accordance with a content of the electrical signal from said generating means;

means for storing as reference length data the length of a first one of the paper sheets detected by said length detector means; and means for comparing the reference length data stored in said storing means with the length of a second or subsequent one of the paper sheets detected by said length detector means, so as to detect multiple paper sheet-conveying of the second or subsequent one of the paper sheets.

7. The apparatus of claim 6, further comprising:

means for updating a content of the reference length data stored in said storing means when the multiple paper sheet-conveying is detected for the first one of the paper sheets by said detecting means; and means for keeping a content of the reference length data stored in said storing means when the multiple paper sheet-conveying is detected for the second or subsequent one of the paper sheets by said detecting means.

8. The apparatus of claim 1, wherein said detecting means includes:

thickness detector means for detecting a thickness of each of the paper sheets being fed by said feeding means, in accordance with a content of the electrical signal from said generating means;

means for storing as reference thickness data the thickness of a first one of the paper sheets detected by said thickness detector means; and means for comparing the reference thickness data stored in said storing means with the thickness of a second or subsequent one of the paper sheets detected by said thickness detector means, so as to detect multiple paper sheet-conveying of the second or subsequent one of the paper sheets.

9. The apparatus of claim 1, wherein said detecting means includes:

length detector means for detecting a length of each of the paper sheets with respect to a fed direction of each paper sheet being fed by said feeding means, in accordance with a content of the electrical signal from said generating means;

thickness detector means for detecting a thickness of each of the paper sheets being fed by said feeding means, in accordance with a content of the electrical signal from said generating means;

first storing means for storing as reference length data the length of a first one of the paper sheets detected by said length detector means;

second storing means for storing as reference thickness data the thickness of the first one of the paper sheets detected by said thickness detector means; and means for comparing the reference length data stored in said first storing means with the length of a second or subsequent one of the paper sheets detected by said length detector means to provide a first comparison result, and comparing the reference thickness data stored in said second storing means with the thickness of the second or subsequent one of the paper sheets detected by said thickness detector means to provide a second comparison result, so as to detect multiple paper sheet-conveying of the paper sheets in accordance with the first and second comparison results.

10. The apparatus of claim 9, further comprising:

means for updating a content of the reference length data stored in said first storing means and a content of the reference thickness data stored in said second storing means when the multiple paper sheet-conveying is detected for the first one of the paper sheets by said detecting means; and means for keeping a content of the reference length data stored in said first storing means and a content of the reference thickness data stored in said second storing means when the multiple paper sheet-conveying is detected for the second or subsequent one of the paper sheets by said detecting means.

11. The apparatus of claim 1, wherein said detecting means includes:

length detector means for detecting a length of the paper sheet with respect to a fed direction of the paper sheet being fed by said feeding means in accordance with a content of the electrical signal from said generating means, so as to provide length data;

peak detector means for detecting a peak value of the electrical signal from said generating means;

thickness detector means for detecting a thickness of the paper sheet in accordance with the peak value detected by said peak detector means, so as to provide thickness data; and means for detecting multiple paper sheet-conveying in accordance with the length data provided by said length detector means and the thickness data provided by said thickness detector means.

12. The apparatus of claim 1, wherein said detecting means includes:

length detector means for detecting a length of the paper sheet with respect to a fed direction of the paper sheet being fed by said feeding means in accordance with a content of the electrical signal from said generating means, so as to provide length data;

minimum detector means for detecting a minimum value of the electrical signal from said generating means;

thickness detector means for detecting a thickness of the paper sheet in accordance with the minimum value detected by said minimum detector means, so as to provide thickness data; and means for detecting multiple paper sheet-conveying in accordance with the length data provided by said length detector means and the thickness data provided by said thickness detector means.

13. The apparatus of claim 1, wherein said detecting means includes:

length detector means for detecting a length of each of the paper sheets with respect to a fed direction of each paper sheet being fed by said feeding means, in accordance with a content of the electrical signal from said generating means;

means for storing a predetermined reference length data with respect to the length of the paper sheets; and means for comparing the predetermined reference length data stored in said storing means with the length of the paper sheet detected by said length detector means, so as to detect multiple paper sheet-conveying.

14. The apparatus of claim 1, wherein said detecting means includes:

thickness detector means for detecting a thickness of each of the paper sheets fed by said feeding means, in accordance with a content of the electrical signal from said generating means;

means for storing a predetermined reference thickness data with respect to the thickness of the paper sheets; and means for comparing the predetermined reference thickness data stored in said storing means with the thickness of the paper sheet detected by said thickness detector means, so as to detect multiple paper sheet-conveying.

15. The apparatus of claim 1, wherein said detecting means includes:

length detector means for detecting a length of each of the paper sheets with respect to a fed direction of each paper sheet being fed by said feeding means, in accordance with a content of the electrical signal from said generating means;

thickness detector means for detecting a thickness of each of the paper sheets fed by said feeding means, in accordance with a content of the electrical signal from said generating means;

first storing means for storing a predetermined reference length data with respect to the length of the paper sheets;

second storing means for storing a predetermined reference thickness data with respect to the thickness of the paper sheets; and means for comparing the predetermined reference length data stored in said first storing means with the length of the paper sheet detected by said length detector means to provide a first comparison result, and comparing the predetermined reference thickness data stored in said second storing means with the thickness of the paper sheet detected by said thickness detector means to provide a second comparison result, so as to detect multiple paper sheet-conveying in accordance with the first and second comparison results.

16. A paper sheet feeding apparatus comprising:

a table for placing a plurality of paper sheets;

means for feeding the paper sheets placed on said table;

a pressure-sensitive and electrically-conductive member being allowed to be pressed with a given pressure to the paper sheet fed by said feeding means;

means for generating an electrical signal representing a pressure condition of said pressure-sensitive and electrically-conductive member pressed to the paper sheet; and means for detecting that two or more of the paper sheets are simultaneously fed by said feeding means, in accordance with the electrical signal from said generating means;

wherein said pressure-sensitive and electrically-conductive member includes a roller having a pressure-sensitive and electrically-conductive rubber, said roller being pressed to the paper sheet so that a rotation of said roller feeds the paper sheet.

17. The apparatus of claim 16, wherein said pressure-sensitive and electrically-conductive member includes:

a roller being formed of a pressure-sensitive and electrically-conductive rubber having an electrical resistance value which varies depending on a pressure applied to the rubber, and an electrical conductive material provided outside of said roller, and wherein said generating means includes:

first detecting means, coupled to said electrical conductive material, for detecting a change in the resistance value of said pressure-sensitive and electrically-conductive rubber to provide resistance change information, and second detecting means for detecting that two or more of the paper sheets are simultaneously fed by said feeding means, in accordance with the resistance change information provided by said first detecting means.

18. The apparatus of claim 16, wherein said detecting means includes:

length detector means for detecting a length of the paper sheet with respect to a fed direction of the paper sheet being fed by said feeding means in accordance with a content of the electrical signal from said generating means; and means for determining whether or not the length of the paper sheet detected by said length detector means is longer than a predetermined length, so as to detect multiple paper sheet-conveying.

19. The apparatus of claim 16, wherein said detecting means includes:

thickness detector means for detecting a thickness of the paper sheet being fed by said feeding means in accordance with a content of the electrical signal from said generating means; and means for determining whether or not the thickness of the paper sheet detected by said thickness detector means is larger than a predetermined thickness, so as to detect multiple paper sheet-conveying.

20. The apparatus of claim 16, wherein said detecting means includes:

length detector means for detecting a length of the paper sheet with respect to a fed direction of the paper sheet being fed by said feeding means in accordance with a content of the electrical signal from said generating means;

thickness detector means for detecting a thickness of the paper sheet being fed by said feeding means in accordance with the content of the electrical signal from said generating means; and means for determining whether or not the multiple paper sheet-conveying occurs, in accordance with the length detected by said length detector means and the thickness detected by said thickness detector means.

21. The apparatus of claim 16, wherein said detecting means includes:

length detector means for detecting a length of each of the paper sheets with respect to a fed direction of each paper sheet being fed by said feeding means, in accordance with a content of the electrical signal from said generating means;

means for storing as reference length data the length of a first one of the paper sheets detected by said length detector means; and means for comparing the reference length data stored in said storing means with the length of a second or subsequent one of the paper sheets detected by said length detector means, so as to detect multiple paper sheet-conveying of the second or subsequent one of the paper sheets.

22. The apparatus of claim 21, further comprising:

means for updating a content of the reference length data stored in said storing means when the multiple paper sheet-conveying is detected for the first one of the paper sheets by said detecting means; and means for keeping a content of the reference length data stored in said storing means when the multiple paper sheet-conveying is detected for the second or subsequent one of the paper sheets by said detecting means.

23. The apparatus of claim 16, wherein said detecting means includes:

thickness detector means for detecting a thickness of each of the paper sheets being fed by said feeding means, in accordance with a content of the electrical signal from said generating means;

means for storing as reference thickness data the thickness of a first one of the paper sheets detected by said thickness detector means; and means for comparing the reference thickness data stored in said storing means with the thickness of a second or subsequent one of the paper sheets detected by said thickness detector means, so as to detect multiple paper sheet-conveying of the second or subsequent one of the paper sheets.

24. The apparatus of claim 16, wherein said detecting means includes:

length detector means for detecting a length of each of the paper sheets with respect to a fed direction of each paper sheet being fed by said feeding means, in accordance with a content of the electrical signal from said generating means;

thickness detector means for detecting a thickness of each of the paper sheets being fed by said feeding means, in accordance with a content of the electrical signal from said generating means;

first storing means for storing as reference length data the length of a first one of the paper sheets detected by said length detector means;

second storing means for storing as reference thickness data the thickness of the first one of the paper sheets detected by said thickness detector means; and means for comparing the reference length data stored in said first storing means with the length of a second or subsequent one of the paper sheets detected by said length detector means to provide a first comparison result, and comprising the reference thickness data stored in said second storing means with the thickness of the second or subsequent one of the paper sheets detected by said thickness detector means to provide a second comparison result, so as to detect multiple paper sheet-conveying of the paper sheets in accordance with the first and second comparison results.

25. The apparatus of claim 24, further comprising:

means for updating a content of the reference length data stored in said first storing means and a content of the reference thickness data stored in said second storing means when the multiple paper sheet-conveying is detected for the first one of the paper sheets by said detecting means; and means for keeping a content of the reference length data stored in said first storing means and a content of the reference thickness data stored in said second storing means when the multiple paper sheet-conveying is detected for the second or subsequent one of the paper sheets by said detecting means.

26. The apparatus of claim 16, wherein said detecting means includes:

length detector means for detecting a length of the paper sheet with respect to a fed direction of the paper sheet being fed by said feeding means in accordance with a content of the electrical signal from said generating means, so as to provide length data;

peak detector means for detecting a peak value of the electrical signal from said generating means;

thickness detector means for detecting a thickness of the paper sheet in accordance with the peak value detected by said peak detector means, so as to provide thickness data; and means for detecting multiple paper sheet-conveying in accordance with the length data provided by said length detector means and the thickness data provided by said thickness detector means.

27. The apparatus of claim 16, wherein said detecting means includes:

length detector means for detecting a length of the paper sheet with respect to a fed direction of the paper sheet being fed by said feeding means in accordance with a content of the electrical signal from said generating means, so as to provide length data;

minimum detector means for detecting a minimum value of the electrical signal from said generating means;

thickness detector means for detecting a thickness of the paper sheet in accordance with the minimum value detected by said minimum detector means, so as to provide thickness data; and means for detecting multiple paper sheet-conveying in accordance with the length data provided by said length detector means and the thickness data provided by said thickness detector means.

28. The apparatus of claim 16, wherein said detecting means includes:

length detector means for detecting a length of each of the paper sheets with respect to a fed direction of each paper sheet being fed by said feeding means, in accordance with a content of the electrical signal from said generating means;

means for storing a predetermined reference length data with respect to the length of the paper sheets; and means for comparing the predetermined reference length data stored in said storing means with the length of the paper sheet detected by said length detector means, so as to detect multiple paper sheet-conveying.

29. The apparatus of claim 16, wherein said detecting means includes:

thickness detector means for detecting a thickness of each of the paper sheets fed by said feeding means, in accordance with a content of the electrical signal from said generating means;

means for storing a predetermined reference thickness data with respect to the thickness of the paper sheets; and means for comparing the predetermined reference thickness data stored in said storing means with the thickness of the paper sheet detected by said thickness detector means, so as to detect multiple paper sheet-conveying.

30. The apparatus of claim 16, wherein said detecting means includes:

length detector means for detecting a length of each of the paper sheets with respect to a fed direction of each paper sheet being fed by said feeding means, in accordance with a content of the electrical signal from said generating means;

thickness detector means for detecting a thickness of each of the paper sheets fed by said feeding means, in accordance with a content of the electrical signal from said generating means;

first storing means for storing a predetermined reference length data with respect to the length of the paper sheets;

second storing means for storing a predetermined reference thickness data with respect to the thickness of the paper sheets; and means for comparing the predetermined reference length data stored in said first storing means with the length of the paper sheet detected by said length detector means to provide a first comparison result, and comparing the predetermined reference thickness data stored in said second storing means with the thickness of the paper sheet detected by said thickness detector means to provide a second comparison result, so as to detect multiple paper sheet-conveying in accordance with the first and second comparison results.

31. A paper sheet feeding apparatus comprising:

a table for placing a plurality of paper sheets;

means for feeding the paper sheets placed on said table;

a roller having pressure-sensitive and electrically-conductive rubber being allowed to be pressed with a given pressure to the paper sheet which is fed by said feeding means;

means for separately generating, with a given time interval, electrical signals each representing a pressure condition of said roller pressed to the paper sheet; and means for detecting an inclination of the paper sheet with respect to a direction of feeding the paper sheet fed by said feeding means, in accordance with a change in contents of the electrical signals generated by said generating means with respect to passage of time.

* * * * *